US005691125A

United States Patent [19]

Hara et al.

[11] Patent Number: 5,691,125

[45] Date of Patent: Nov. 25, 1997

[54] SILVER HALIDE COLOR PHOTOGRAPHIC MATERIAL

[75] Inventors: Takefumi Hara; Kazuyoshi Yamakawa; Sadanobu Shuto; Mitsuru Yamamoto; Makoto Suzuki; Yasuhiro Shimada; Katsuro Nagaoka; Satoshi Nagaoka; Yoshihiko Shibahara; Hideo Ikeda, all of Minami-ashigara, Japan

[73] Assignee: Fuji Photo Film Co., Ltd., Kanagawa, Japan

[21] Appl. No.: 665,897

[22] Filed: Jun. 19, 1996

Related U.S. Application Data

[62] Division of Ser. No. 453,398, May 30, 1995, Pat. No. 5,578,436, which is a division of Ser. No. 43,027, Apr. 5, 1993, abandoned.

[30] Foreign Application Priority Data

Apr. 3, 1992 [JP] Japan ..... 4-109131

[51] Int. Cl.[6] ..... G03C 1/46

[52] U.S. Cl. ..... 430/505; 430/558; 430/564; 430/384; 430/385

[58] Field of Search ..... 430/558, 384, 430/385, 505, 564

[56] References Cited

U.S. PATENT DOCUMENTS 5,326,681 7/1994 Sato et al. ..... 430/558
5,401,624 3/1995 Sato et al. ..... 430/558

*Primary Examiner*—Geraldine Letscher
*Attorney, Agent, or Firm*—Sughrue, Mion, Zinn, Macpeak & Seas, PLLC

[57] ABSTRACT

There is disclosed a silver halide color photographic material having a red-sensitive silver halide emulsion layer, a green-sensitive silver halide emulsion layer, a blue-sensitive silver halide emulsion layer, which comprises a cyan dye-forming coupler represented by formula (I) and (a) a monodisperse silver halide emulsion, (b) non-photosensitive silver halide emulsion wherein the inside or the surface of grains is fogged, (c) a colloidal silver, (d) negative-type interval latent image-type silver halide grains chemically sensitized to a defined depth from the surface, (e) a sensitizing dye containing a sulfonamide group, (f) three separated layers of high, medium, and low sensitivities, (g) two separated layers each having different content of iodine, (h) grains each having a defined spectral sensitivity distribution and a DIR-hydroquinone, or (i) a DIR-hydroquinone: formula (I)

wherein $R^1$ represents a hydrogen atom or a substituent, $R^2$ represents a substituent, X represents a hydrogen atom or a group capable of being released upon a coupling reaction of the coupler represented by formula (I) with the oxidized product of a color-developing agent, and $Z^1$ represents a group of nonmetallic atoms required for forming a nitrogen-containing 6-membered heterocyclic ring, which contains at least one group capable of being dissociated.

25 Claims, No Drawings

SILVER HALIDE COLOR PHOTOGRAPHIC MATERIAL

This is a divisional of application Ser. No. 08/453,398 filed May 30, 1995 U.S. Pat. No. 5,578,436 which is a divisional of application Ser. No. 08/043,027 filed Apr. 5, 1993 now abandoned.

FIELD OF THE INVENTION

The present invention relates to a silver halide color photographic material that contains a novel cyan dye-forming coupler and that is excellent in (a) sensitivity/graininess ratio and color reproduction.

Further, the present invention relates to a silver halide color photographic material that is excellent in, equally to color reproduction, any of such points as (b) maximum color density, sharpness and processing ability for sensitizing; (c) color formation, image-dye stability, and sensitivity; (d) image-dye stability and improved residual color after development processing; (e) improved graininess; (f) saturation and color reproduction of primary colors and intermediate colors; and (g) stability at development processing.

BACKGROUND OF THE INVENTION

For silver halide color photographic materials, the system of forming a color image by using reactions between dye-forming couplers capable of respectively forming yellow, magenta, and cyan (hereinafter referred to as yellow coupler, magenta coupler, and cyan coupler, respectively) and the oxidized product of a color-developing agent is now practiced most widely.

(1) With respect to above point (a)

In recent years, for silver halide color photographic materials, studies for improving dye-forming couplers have been made vigorously with a view toward improving color reproduction and image fastness, but as yet it is difficult to say that satisfactory improvement has been made. In particular, with respect to cyan couplers, although phenol couplers or naphthol couplers are used conventionally all the time, the dyes formed from these couplers have undesirable absorption in the blue and green regions, which is a great obstacle to improvement of color reproduction. Further, since conventional cyan couplers interact with silver halide emulsions, when a photographic material containing those couplers is stored at high temperatures, the problem arises that the sensitivity lowers.

(2) With respect to above point (b)

Further, recently, cyan couplers with a new skeleton having a nitrogen-containing heterocyclic ring have been vigorously studied and various heterocyclic compounds have been suggested. For example, diphenylimidazole couplers are described in JP-A ("JP-A" means unexamined published Japanese Patent Application) No. 226653/1988 and pyrazoloazole couplers are disclosed, for example, in JP-A No. 199352/1988, 250649/1988, 250650/1988, 554/1989, 555/1989, 105250/1990, and 105251/1990. All of these couplers are asserted to be improved in color reproduction and are characterized by excellent absorption characteristics of the dyes produced therefrom.

However, the cyan dyes obtained from the above couplers have the defects that the absorption is in the short wavelength region and that the fastness to light and heat are poor, and further they have practically the serious problem that the coupling activity of the couplers themselves is low.

Incidentally, in order to improve color reproduction, use of a grain-surface-fogged emulsion of a silver halide is disclosed, for example, in JP-B ("JP-B" means examined Japanese Patent Publication) No. 35011/1984, but the emulsion is accompanied by the problems that fogging due to contact with a photosensitive emulsion takes place and that the maximum color density is lowered due to the influence of the developability of a photosensitive emulsion.

On the other hand, in the field of color photographic materials, particularly of color reversal photographic materials, in order to make up under-exposure of a color photographic material, adjustment of the sensitivity by processing, i.e., a process called "sensitizing process," is carried out. JP-B No. 38296/1990 describes that a grain-inside-fogged emulsion is contained in a color reversal photographic material for the sensitizing process. By this, however, the sensitizing processing ability can be improved, but the use conditions of the grain-inside-fogged emulsion are difficult to be optimized and, depending on the usage, the problem that the maximum color density is lowered arises.

(3) With respect to above point (c)

Further, in a silver halide color photographic material among this, an internal latent image-type emulsion whose storage stability is made high and whose sensitivity is increased has been developed. To increase further the sensitivity of the photographic material that uses this internal latent image-type emulsion, various attempts have been made. For example, U.S. Pat. Nos. 2,696,436, 3,206,313, 3,917,485, 3,979,213, and 4,623,612, and JP-B Nos. 29405/1968 and 13259/1970 describe that, by immersing a silver halide emulsion-coated sample in an $AgNO_3$ solution or a silver halide solvent, or by carrying out chemical sensitization during the production of a silver halide emulsion and then carrying out Ostwald ripening or adding an aqueous $AgNO_3$ solution and an aqueous soluble halide solution, a silver halide photographic material or a silver halide photographic emulsion whose internal sensitivity is high is prepared and its photographic properties are good.

Incidentally, in silver halide color photographic materials, in recent years, new cyan couplers have been suggested for improving, for example, the color reproduction (the coupling activity and the molecular extinction coefficient of the obtained dyes) of conventional phenol- and naphthol-type cyan couplers, the fastness of the color image obtained therefrom, and the absorption characteristics of the color image obtained therefrom. For example, European Publication Patent No. 333,185 discloses 3-hydroxypyridine compounds, European Publication Patent No. 362,808 discloses 3H-2-dicyanomethylidenethiazoles, JP-A No. 32260/1989 discloses 3-dicyanomethylidene-2,3-dihydrobenzothiophene-1,1-dioxides, JP-A No. 264753/1988 and U.S. Pat. No. 4,873,183 disclose pyrazoloazoles, U.S. Pat. Nos. 4,818,672 and 4,921,783, JP-A No. 48243/1991, etc. disclose imidazoles, European Publication Patent Nos. 304,001, 329,036, and 374,781, and JP-A No. 85851/1990 disclose pyrazolopyrimidones and pyrazoloquinazolones, and European Publication Patent No. 342,637 discloses condensed ring triazoles.

However, in silver halide color photographic materials that use an internal latent image-type emulsion, the performance of these suggested new cyan couplers is not satisfactory to simultaneously satisfy, for example, the above color-forming property, color image fastness, and reproduction, and further improvement is demanded in order to put them to practical use.

That is, the dyes formed from these couplers have undesirable absorption in the blue and green regions, which is a great hindrance to improving in color reproduction. Further, since the conventional cyan couplers interact with a silver halide emulsion, there arises a problem that the sensitivity of a photographic material that uses an internal-latent-image-type emulsion containing this cyan coupler is lowered.

(4) With respect to above point (d)

In recent years, for color photographic materials, work has been done to make the color photographic material highly sensitive and to make the image quality high, in order to meet user's need. Improvement in color reproduction, as well as sharpness and graininess, is placed as a major subject in making the image quality high in color photographic materials, and research is continuing. On the other hand, improvement in development processing stability, handleability, color dye fastness, etc., of photographic materials is looked forward to, and the desire for such improvement is increasing.

With a view to improving color reproduction and image fastness, although improvement in dye-forming couplers is studied actively, it is hard to say that satisfactory improvement has been made. In particular, with respect to cyan couplers, although phenol couplers or naphthol couplers are used conventionally all the time, the dyes formed from these couplers have undesirable absorption in the blue and green regions, which is a great obstacle to improving color reproduction. Further, the fact that the molecular extinction coefficient of the cyan dye formed is small is disadvantageous to improving sharpness of images.

Further, the cyan dyes obtained from the above cyan couplers having a novel skeleton with a nitrogen-containing heterocyclic ring have the defects that the absorption lies in the range of short wavelengths and that the fastness to light and heat is poor, and practically they suffer from the serious problem that the coupling activity of the couplers themselves is small.

On the other hand, condensed ring pyrrole cyan couplers, as described in Japanese Patent Application Nos. 336807/1991 and 226325/1992, are excellent in spectral absorption properties, color image fastness, and color forming property; and it can be said that they are well expected to develop further in the future.

However, when these condensed ring pyrrole cyan couplers are used in a photographic material, they have the defect that the dissolving out of a sensitizing dye contained in the photographic material is not completed in the processing and causes color to remain in the photographic material; namely, the so-called residual color is great.

(5) With respect to above point (e)

Further, in recent years, requirements for the quality of silver halide color photographic materials are becoming more and more strict and it is required to simultaneously achieve excellent graininess, sharpness, tone reproduction, and color reproduction simultaneously.

As means of improving graininess, use is made of three silver halide emulsion layers different in sensitivity to improve graininess, which is disclosed in, for example, JP-B No. 15495/1974. However, although this method improves graininess, since the applied amount of silver halide emulsions increases to inevitably increase the thickness of the film of the emulsion layers, problems arise; that is, the development-inhibiting effect between different color-sensitive layers decreases, and the saturation of colors is degraded.

As means of enhancing the color saturation, a method is known wherein the amount of iodine in a silver halide emulsion is adjusted or a development-inhibitor-releasing compound which is the so-called DIR compound is used to inhibit the development between different color-sensitive layers.

For example, in JP-A No. 29238/1993, a method is disclosed wherein the content of iodine of the silver halide emulsion of a more sensitive layer is made smaller than the content of iodine of the silver halide emulsion of a less sensitive layer, whereby the development inhibiting between different color-sensitive layers is increased more in a high-light. However, color saturation cannot be enhanced satisfactorily by such a technique only. Further, if development inhibiting between different color-sensitive layers is made too high, though indeed the color saturation is enhanced, there is the risk that the color reproduction of subtle natural tints other than primary colors lacks fidelity, which is a problem.

(6) With respect to above point (f)

Owing to the recent technical advancement of silver halide color multilayer photographic materials, if the conditions of exposure at the time of photographing are suitable, and if, after the exposure, the conditions of processing, the conditions of printing, the conditions of screening, and the like are suitable, good color reproduction is now available. However, if these are not suitable, satisfactory color reproduction is not necessarily obtained in some cases, and all those skilled in the art are interested in that point being improved by improving color photographic materials.

The conditions of exposure at the time of photographing include, for example, excess or deficiency of the exposure amount, the exposure time, the distribution of the quantity of light of the object (the conditions of illumination), and the color temperature of the light source. Therefore, for example, for the purpose of providing a photographing photographic material that is faithful to color reproduction and whose color reproduction does not change greatly under conditions of photographing with various light sources, U.S. Pat. No. 3,672,898 discloses a method wherein the spectral sensitivity distributions of blue-, green-, and red-sensitive silver halide emulsion layers are restricted within certain ranges by combining spectral sensitizing dyes with filter dyes.

The present inventors studied various combinations of the above measures and could not find a photographic material wherein both the saturation and the fidelity of hues are satisfactory. This is because a measure is taken of making the overlap of the spectral sensitivity distributions of a red-sensitive layer and a green-sensitive layer large, and therefore mixing of colors (color contamination) due to color separation failure takes place, thereby causing the saturation to lower.

Although color separation failure can be prevented by choosing spectral sensitizing dyes wherein the ends of the spectral absorption spectrum are sharp, the sharpness is limited in actually existing spectral sensitizing dyes, and in particular it is extremely difficult to make the short wavelength ends sharp. Although, as described in U.S. Pat. No. 3,672,898, use of a filter dye can cut short wavelength ends sharply to a certain extent, it acts unfavorably at the same time because the spectral sensitivity distribution of other layers having light absorption in the part corresponding to the wavelength of that filter is affected undesirably and the sensitivity is lowered.

In color photographic materials, it is expected that various colors are reproduced to have the same brightness and colors as seen by the human eye. Colors perceived by the human vision are influenced by the spectral distribution of the absorption or emission of the object and the color temperature of the light source illuminating the object, and the difference in color temperature of a light source is perceived only as a relatively small difference by the human eye, while such a difference is detected to a greater degree than that by color photographic materials. This is because, first, the relative sensitivities of three spectrally sensitive organs of human vision change depending on the color temperature and brightness of a light source, and second the spectral sensitivity distributions of the three sensitive organs are different from the spectral sensitivity of color photographic materials. The difference between the spectral sensitivity distributions of the sensitive organs and those of color photographic materials causes such a phenomenon that, on one hand, for one color, the color reproduced by a color photographic material and the color directly observed with the naked eye are recognized as visually identical, and on the other hand, for another color, the color reproduced by a color photographic material is perceived as being completely different color by the naked eye.

To improve color reproduction, it is known to use the interlayer-inhibiting effect in the first development of a color reversal processing. For example, by giving the development-inhibiting effect from a green-sensitive layer to a red-sensitive layer, the color formation of a red-sensitive layer in white exposure can be suppressed greater than in the case of red exposure. Similarly, the development-inhibiting effect from a red-sensitive layer to a green-sensitive layer gives reproduction of green that is high in the degree of saturation.

As means of enhancing the interlayer effect, it is known to increase the iodine content of an emulsion or to use a DIR compound. However, conventionally known DIR compounds are not necessarily satisfactory in the effect for improving color reproduction and the effect for decreasing the deterioration of color reproduction is unsatisfactory when there is a great overlap of spectral sensitivity distributions.

For the purpose of providing color photographic materials wherein the change in color reproduction due to a change in the color temperature of a light source at the time of photographing is low and which have color reproduction high in saturation, JP-A No. 131937/1984 discloses a method wherein the widths of the maximum sensitivities of the spectral distributions of a blue-sensitive silver halide emulsion layer, a green-sensitive silver halide emulsion layer, and a red-sensitive silver halide emulsion layer are specified and nondiffusible DIR compounds are contained.

Although the present inventors attempted a variety of combinations of the above means, they could not obtain a photographic material that is satisfactory both in that the change in color reproduction due to a change of the color temperature of a light source at the time of photographing is small and in that even when the color temperature of a light source changes, the color reproduced is high in saturation and primary colors and neutral tints are reproduced faithfully.

(7) With respect to above point (g)

Further, when the above cyan dye-forming couplers having a novel skeleton with a nitrogen-containing heterocyclic ring are used, there is a problem with processing stability in that the photographic property is liable to variation remarkably owing to the change of the amount of sodium sulfite in a color developer, and thus it has been desired to solve this problem. In photographic processing laboratories located throughout in the world, there is a case where the state of storage of processing solutions is not good. Therefore, no problems of processing stability are recently noted as a required property for a photographic material.

SUMMARY OF THE INVENTION

It is an object of the present invention to provide a silver halide color photographic material excellent in color reproduction and sensitivity/graininess ratio.

Another object of the present invention is to provide a silver halide color photographic material whose sensitivity is less lowered by storing and whose storage stability is excellent.

A further object of the present invention is to provide a silver halide color photographic material that is improved in color reproduction without lowering the maximum color density of a cyan dye.

A further object of the present invention is to provide a silver halide color photographic material that is improved in sharpness and processing ability for sensitizing, as well as color reproduction, without lowering the maximum color density of a cyan dye.

A further object of the present invention is to provide a silver halide color photographic material wherein the color-forming property of the cyan color image and the color image fastness are excellent, the color reproduction is improved, and good sensitivity is exhibited.

A further object of the present invention is to provide a silver halide color photographic material that uses an internal latent image-type emulsion and does not allow the sensitivity to lower after storage.

A further object of the present invention is to provide a silver halide color photographic material improved in image-dye fastness, color reproduction, and residual color after development processing.

A further object of the present invention is to provide a silver halide color photographic material that can realize color reproduction faithfully and high in saturation by improving the graininess.

A further object of the present invention is to provide a novel silver halide multilayer color reversal photographic material, and more particularly to provide a silver halide color photographic material wherein the change of color reproduction due to a change in the color temperature of a light source at the time of photographing will be small, and at the same time the color reproduced will be high in saturation and faithful color reproduction of primary colors and neutral tints will be excellent when the color temperature of a light source changes.

A further object of the present invention is to provide a silver halide color photographic material excellent in color reproduction, that has less variation of photographic property owing to the change of color developer composition.

Other and further objects, features, and advantages of the invention will appear more fully from the following description.

DETAILED DESCRIPTION OF THE INVENTION

The present inventors have studied keenly in various ways to overcome the above defects of conventional silver halide photographic materials, and have found that the above objects can be attained by embodiments, shown below, utilizing a cyan coupler represented by the following formula (I).

That is, the present invention provides:

(1) A silver halide color photographic material having at least one red-sensitive silver halide emulsion layer, at least one green-sensitive silver halide emulsion layer, and at least one blue-sensitive silver halide emulsion layer on a support, which comprises, in at least one layer constituting said photographic material, at least one cyan dye-forming coupler represented by the following formula (I) and the silver halide emulsion contained in said at least one layer that comprises a monodisperse silver halide emulsion: formula (I)

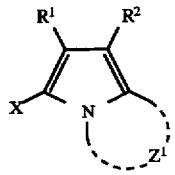

wherein $R^1$ represents a hydrogen atom or a substituent, $R^2$ represents a substituent, X represents a hydrogen atom or a group capable of being released upon a coupling reaction of the coupler represented by formula (I) with the oxidized product of a color-developing agent, and $Z^1$ represents a group of non-metallic atoms required for forming a nitrogen-containing 6-membered heterocyclic ring, which contains at least one group capable of being dissociated (hereinafter referred to as the first embodiment).

(2) A silver halide color photographic material having at least one red-sensitive silver halide emulsion layer, at least one green-sensitive silver halide emulsion layer, and at least one blue-sensitive silver halide emulsion layer on a support, which comprises at least one cyan coupler represented by formula (I) as stated in above item (1) and, at least one layer of said silver halide emulsion layer and/or intermediate layer adjacent to said silver halide emulsion layer, a non-photosensitive silver halide emulsion wherein the inside or the surface of the grains is fogged (hereinafter referred to as the second embodiment).

(3) A silver halide color photographic material having at least one red-sensitive silver halide emulsion layer, at least one green-sensitive silver halide emulsion layer, and at least one blue-sensitive silver halide emulsion layer on a support, which comprises at least one cyan coupler represented by formula (I) as stated in above item (1) and, in at least one layer of said silver halide emulsion layer and/or intermediate layer adjacent to said silver halide emulsion layer, colloidal silver (hereinafter referred to as the third embodiment).

(4) A silver halide color photographic material stated under (2), which comprises, in the emulsion layer containing said cyan dye-forming coupler and/or an intermediate layer adjacent to said emulsion layer, a non-photosensitive silver halide emulsion wherein the inside or the surface of the grains is fogged.

(5) A silver halide color photographic material stated under (3), wherein the emulsion layer containing said cyan dye-forming coupler and/or an intermediate layer adjacent to said emulsion layer contains colloidal silver.

(6) A silver halide color photographic material having one or more silver halide emulsion layers on a support, which comprises at least one cyan dye-forming coupler represented by formula (I) as stated in above item (1) and, in at least one layer of said silver halide emulsion layer, negative type internal latent image-type silver halide grains that are chemically sensitized to a depth of less than 0.02 μm from the grain surface (hereinafter referred to as the fourth embodiment).

(7) A silver halide color photographic material having, on a support, at least one blue-sensitive silver halide emulsion layer, at least one green-sensitive silver halide emulsion layer, and at least one red-sensitive silver halide emulsion layer, which comprises in at least one layer constituting said photographic material, at least one cyan dye-forming coupler represented by formula (I) as stated in above item (1), and at least one compound represented by the following formula (II):

formula (II)

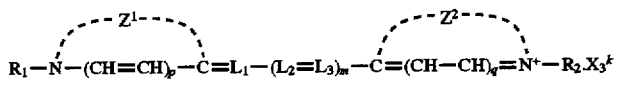

wherein $R_1$ represents $-(CH_2)_r-CONHSO_2-R_3$, $-(CH_2)_s-SO_2NHCO-R_4$, $-(CH_2)_t-CONHCO-R_5$, or $-(CH_2)_u-SO_2NHSO_2-R_6$, in which $R_3$, $R_4$, $R_5$, or $R_6$ represents an alkyl group, an alkoxy group, or an amino group; r, s, t, or u is an integer of 1 to 5, $R_2$ has the same meaning as that of $R_1$ or represents an alkyl group; $Z^1$ and $Z^2$ each represent a group of nonmetallic atoms required to form a 5- or 6-membered heterocyclic ring; p and q are each 0 or 1; $L_1$, $L_2$, or $L_3$ represents a methine group; m is 0, 1, or 2; $X_3$ represents an anion; and k represents a number required to make the charge in the molecule zero (hereinafter referred to as the fifth embodiment).

(8) A silver halide color photographic material having a red-sensitive silver halide emulsion layer, a green-sensitive silver halide emulsion layer, and a blue-sensitive silver halide emulsion layer on a support, which comprises at least one of said color-sensitive layer comprising at least three separate silver halide emulsion layers, comprising a low-sensitive silver halide emulsion layer, a medium-sensitive silver halide emulsion layer, and a high-sensitive silver halide emulsion layer, that are coated in the stated order, with said low-sensitive silver halide emulsion layer positioned nearer to the support and comprising, in said red photosensitive silver halide emulsion layer, a cyan coupler represented by formula (I) as stated in above item (1) (hereinafter referred to as the sixth embodiment).

(9) A silver halide color photographic material having a red-sensitive silver halide emulsion layer, a green-sensitive silver halide emulsion layer, and a blue-sensitive silver halide emulsion layer-on a support, which comprises at least one of said color sensitive layer comprising at least two silver halide emulsion separate layers that contain silver iodobromide emulsions and are different in sensitivity, the average content of iodine of the emulsions of the highest sensitive layers out of the separated layers is smaller than the average content of iodine of the emulsions of the lower sensitive emulsion layers, and, in said red-sensitive silver halide emulsion layer, a cyan dye-forming coupler represented by formula (I) as stated in above item (1) (hereinafter referred to as the seventh embodiment).

(10) A color reversal photographic material having, on a support, at least one blue-sensitive silver halide emulsion layer containing a color coupler that will form yellow, at least one green-sensitive silver halide emulsion layer containing a color coupler that will form magenta, and at least one red-sensitive silver halide emulsion containing a color coupler that will form cyan, which comprises, with respect to the spectral sensitivity distribution SB (λ) of said blue-sensitive silver halide emulsion layer:

(a) the wavelength λBmax where the SB (λ) becomes maximum is such that $$406\ \text{nm} \leqq \lambda Bmax \leqq 475\ \text{nm},$$

with respect to the spectral sensitivity distribution SG (λ) of said green-sensitive silver halide emulsion layer:

(b) the wavelength λ Gmax where the SG (λ) becomes maximum is such that $$527\ \text{nm} \leqq \lambda Gmax \leqq 580\ \text{nm},$$

(c) with respect to the sensitivity SG (λGmax) of the green-sensitive silver halide emulsion layer at the time when the wavelength is λGmax, and the sensitivity SG (470) of the green-sensitive silver halide emulsion layer of a wavelength of 470 nm:

$$1.50 \leqq SG(\lambda Gmax) - SG(470) \leqq 1.90,$$

with respect to the spectral sensitivity distribution SR (λ) of said red-sensitive silver halide emulsion layer:

(d) the wavelength λRmax where the SR (λ) becomes maximum is such that $$610\ \text{nm} \leqq \lambda Rmax \leqq 650\ \text{nm},$$

(e) with respect to the sensitivity SR (λRmax) of the red-sensitive silver halide emulsion layer at the time when the wavelength is λRmax and the sensitivity SR (570) of the red-sensitive silver halide emulsion layer of a wavelength of 570 nm:

$$1.05 \leqq SR(\lambda Rmax) - SR(570) \leqq 1.55,$$

and at least one layer of any constitutional layers on the support comprises a compound represented by formula (III) and at least one cyan dye-forming coupler represented by formula (I) as stated in above item (1):

$$A(L)_n-(G)_{m'}-(\text{Time})_t-X \qquad \text{formula (III)}$$

wherein A represents a redox mother nucleus or its precursor, which is an atomic group that allows $-(\text{Time})_t-X$ to be released only upon being oxidized during the photographic processing; Time represents a group that will release X after being released from the oxidized product of A; X represents a development inhibitor; L represents a bivalent linking group, G represents an acid group; and n, m', and t are each 0 or 1 (hereinafter referred to as the eighth embodiment).

(11) A silver halide color photographic material having, on a support, at least one blue-sensitive silver halide emulsion layer, at least one green-sensitive silver halide emulsion layer, and at least one red-sensitive silver halide emulsion layer, which comprises, in at least one layer constituting said photographic material, at least one cyan dye-forming coupler represented by formula (I) as stated in above item (1) and at least one compound represented by formula (III) as stated in above item (10) (hereinafter referred to as the ninth embodiment).

The cyan coupler represented by formula (I) for use in the present invention will now be described in detail.

In formula (I), $R^1$ represents a hydrogen atom or a substituent and $R^2$ represents a substituent. The substituents represented by $R^1$ and $R^2$ include, for example, an aryl group, an alkyl group, a cyano group, an acyl group, a carbamoyl group, an alkoxycarbonyl group, an aryloxycarbonyl group, a formylamino group, an acylamino group, an alkoxycarbonylamino group, an aryloxycarbonyl-amino group, a sulfonamido group, a ureido group, a sulfamoylamino group, an alkylamino group, an arylamino group, an alkoxy group, an aryloxy group, a heterocyclic-oxy group, an alkylthio group, an arylthio group, a heterocyclic-thio group, a heterocyclic group, a halogen atom, a hydroxyl group, a nitro group, a sulfamoyl group, a sulfonyl group, an acyloxy group, a carbamoyloxy group, an imido group, a sulfinyl group, a phospholyl group, a carboxyl group, a phosphono group, and an unsubstituted amino group. Among them, those which can be further substituted may be substituted by the substituents mentioned above.

The preferable substituents represented by $R^1$ and $R^2$ are an aryl group (preferably having 6 to 30 carbon atoms, e.g., phenyl, m-acetylaminophenyl, and p-methoxyphenyl), an alkyl group (preferably having 1 to 30 carbon atoms, e.g., methyl, trifluoromethyl, ethyl, isopropyl, heptafluoropropyl, t-butyl, n-octyl, and n-dodecyl), a cyano group, an acyl group (preferably having 1 to 30 carbon atoms, e.g., acetyl, pivaloyl, benzoyl, furoyl, and 2-pyridylcarbonyl), a carbamoyl group (preferably having 1 to 30 carbon atoms, e.g., methylcarbamoyl, ethylcarbamoyl, dimethylcarbamoyl, and n-octylcarbamoyl), an alkoxycarbonyl group (preferably having 1 to 30 carbon atoms, e.g., methoxycarbonyl, ethoxycarbonyl, and isopropoxycarbonyl), an aryloxycarbonyl group (preferably having 7 to 30 carbon atoms, e.g., phenoxycarbonyl, p-methoxyphenoxycarbonyl, m-chlorophenoxycarbonyl, and o-methoxyphenoxycarbonyl), a formylamino group, an acylamino group {e.g., an alkylcarbonylamino group preferably having 1 to 30 carbon atoms, (e.g., acetylamino, propionylamino, and cyanoacetylamino), an arylcarbonylamino group preferably having 7 to 30 carbon atoms (e.g., benzoylamino, p-toluylamino, pentafluorobenzoylamino, and m-methoxy-benzoylamino), and a heterocyclic-carbonylamino group preferably having 4 to 30 carbon atoms (e.g., 2-pyridylcarbonylamino, 3-pyridylcarbonylamino, and furoylamino)}, an alkoxycarbonylamino group (preferably having 2 to 30 carbon atoms, e.g., methoxycarbonylamino, ethoxycarbonylamino, and methoxyethoxycarbonylamino), an aryloxycarbonylamino (preferably having 7 to 30 carbon atoms, e.g., phenoxycarbonylamino, p-methoxyphenoxycarbonylamino, p-methylphenoxycarbonylamino, and m-chlorophenoxycarbonylamino), a sulfonamido group (preferably having 1 to 30 carbon atoms, e.g., methanesulfonamido, benzenesulfonamido, and p-toluenesulfonamido), a ureido group (preferably having 1 to 30 carbon atoms, e.g., methylureido, dimethylureido, and p-cyanophenylureido), a sulfamoylamino group (preferably having 1 to 30 carbon atoms, e.g., methylaminosulfonylamino, ethylaminosulfonylamino, and anilinosulfonylamino), an alkylamino group (preferably having 1 to 30 carbon atoms, e.g., methylamino, dimethylamino, ethylamino, diethylamino, and n-butylamino), an arylamino group (preferably having 6 to 30 carbon atoms, e.g., anilino), an alkoxy group (preferably having 1 to 30 carbon atoms, e.g., methoxy, ethoxy, isopropoxy, n-butoxy, methoxy-ethoxy, and n-dodecyloxy), an aryloxy group (preferably having 6 to 30 carbon atoms, e.g., phenoxy, m-chlorophenoxy, p-methoxyphenoxy, and o-methoxyphenoxy), a heterocyclic-oxy group (preferably having 3 to 30 carbon atoms, e.g., tetrahydropyranyloxy, 3-pyridyloxy, and 2-(1,3-benzoimidazolyl)oxy), an alkylthio group (preferably having 1 to 30 carbon atoms, e.g., methylthio, ethylthio, n-butylthio, and t-butylthio), an arylthio group (preferably having 6 to 30 carbon atoms, e.g., phenylthio), a heterocyclic-thio (preferably-having 3 to 30 carbon atoms, e.g., 2-pyridylthio, 2-(1,3-benzoxazolyl)-thio, 1-hexadecyl-1,2,3,4-tetrazolyl-5-thio, and 1-(3-N-octadecylcarbamoyl)phenyl-1,2,3,4-tetrazolyl-5-thio), a heterocyclic group (preferably having 3 to 30 carbon atoms, e.g., 2-benzoxazolyl, 2-benzothiazolyl, 1-phenyl-2-benzimidazolyl, 5-chloro-1-tetrazolyl, 1-pyrrolyl, 2-furanyl, 2-pyridyl, and 3-pyridyl), a halogen atom (e.g., fluorine, chlorine, and bromine), a hydroxyl group, a nitro group, a sulfamoyl group (preferably having 0 to 30 carbon atoms, e.g., methylsulfamoyl and dimethylsulfamoyl), a sulfonyl group (preferably having 1 to 30 carbon atoms, e.g., methanesulfonyl, benzenesulfonyl, and toluenesulfonyl), an acyloxy group (preferably having 1 to 30 carbon atoms, e.g., formyloxy, acetyloxy, and benzoyloxy), a carbamoyloxy group (preferably having 1 to 30 carbon atoms, e.g., methylcarbamoyloxy and diethylcarbamoyloxy), an imido group (preferably having 4 to 30 carbon atoms, e.g., succinimido and phthalimido), a sulfinyl group (having 1 to 30 carbon atoms, e.g., diethylaminosulfinyl), a phosphoryl group (preferably having 0 to 30 carbon atoms, e.g., dimethoxyphosphoryl), a carboxyl group, a phosphono group, and an unsubstituted amino group.

Preferably, at least one of $R^1$ and $R^2$ represents an electron-attracting group wherein the $\sigma_p$ value of the Hammett substituent constant is 0.35 or more, more preferably 0.60 or more, and particularly preferably at least one of $R^1$ and $R^2$ represents a cyano group.

The Hammett substituent constant used herein is described briefly. The Hammett rule is an empirical rule advocated by L. P. Hammett in 1935 to discuss quantitatively the influence of substituents on reactions or equilibriums of benzene derivatives and its appropriateness is now widely recognized. Substituent constants determined by the Hammett rule include $\sigma_p$ and $\sigma_m$ values and many of them are listed in many common books, and, for example, they are listed in detail by J. A. Dean in *Lange's Handbook of Chemistry*, Vol. 12, 1979 (Mc Graw-hill) and in *Kagaku no Ryoiki*, an extra issue, No. 122, pages 96 to 103, 1979 (Nanko-do). In the present invention, although substituents are defined or described by Hammett substituent constant $\sigma_p$ values, of course the substituents are not limited only to those substituents whose Hammett substituent constant $\sigma_p$ values are known and listed in these books, but include substituents whose Hammett substituent constant $\sigma_p$ values are not known in the literature but fall in the above ranges when measured on the base of the Hammett rule.

As the electron-attracting groups having $\sigma_p$ values of 0.35 or more, preferably, for example, a cyano group (the $\sigma_p$ value: 0.66), a nitro group (0.78), a carboxyl group (0.45), a perfluoroalkyl group {e.g., trifluoromethyl (0.54) and perfluorobutyl}, an acyl group {e.g., acetyl (0.50) and benzoyl (0.43)}, a formyl group (0.42), a sulfonyl group {e.g., trifluoromethanesulfonyl (0.92), methanesulfonyl (0.72), and benzenesulfonyl (0.70)}, a sulfinyl group {e.g., methanesulfinyl (0.49)}, a carbamoyl group {e.g., carbamoyl (0.36), methylcarbamoyl (0.36), phenylcarbamoyl, and 2-chloro-phenylcarbamoyl}, an alkoxycarbonyl group {e.g., methoxycarbonyl (0.45), ethoxycarbonyl, and diphenylmethylcarbonyl}, a heterocyclic residue {e.g., pyrazolyl (0.37) and 1-tetrazolyl (0.50)}, an alkylsulfonyloxy group {e.g., methanesulfonyloxy (0.36)}, a phospholyl group {e.g., dimethoxyphospholyl (0.60) and diphenylphospholyl}, a sulfamoyl group (0.57), a pentachlorophenyl group, a pentafluorophenyl group, or a sulfonyl group-substituted aromatic group (e.g., 2,4-dimethanesulfonylphenyl) can be mentioned.

As the electron-attracting group having a $\sigma_p$ value of 0.60 or more, for example, a cyano group, a nitro group, and a sulfonyl group can be mentioned.

X represents a hydrogen atom or a group capable of being released upon a coupling reaction of the coupler with the oxidized product of a color developing agent (hereinafter referred to as coupling-off group), such as an aromatic primary amine developing agent.

Specific examples of the coupling-off group include a halogen atom (e.g., fluorine, chlorine, and bromine), an alkoxy group (e.g., ethoxy, dodecyloxy, methoxyethylcarbamoylmethoxy, carboxypropyloxy, and methylsulfonylethoxy), an aryloxy group (e.g., 4-chlorophenoxy, 4-methoxyphenoxy, and 4-carboxyphenoxy), an acyloxy group (e.g., acetoxy, tetradecanoyloxy and benzoyloxy), a sulfonyloxy group (e.g., methanesulfonyloxy and toluenesulfonyloxy), an acylamino group (e.g., dichloroacetylamino and heptafluorobutylylamino), a sulfonamido group (e.g., methanesulfonamido and p-toluenesulfonamido), an alkoxycarbonyloxy group (e.g., ethoxycarbonyloxy and benzyloxycarbonyloxy), an aryloxycarbonyloxy group (e.g., phenoxycarbonyloxy), an alkylthio (e.g., carboxymethylthio), an arylthio group (e.g., 2-butoxy-5-tert-octylphenylthio), a heterocyclicthio group (e.g., tetrazolylthio), a carbamoylamino group (e.g., N-methylcarbamoylamino and N-phenylcarbamoylamino), a 5- or 6-membered nitrogen-containing heterocyclic group (e.g., imidazolyl, pyrazolyl, triazolyl, tetrazolyl, and 1,2-dihydro-2-oxo-1-pyridyl), an imido group (e.g., succinimido and hydantoinyl), an aromatic azo group (e.g., phenylazo), a sulfinyl group (e.g., 2-Sutoxy-5-tert-octylphenylsulfinyl), and a sulfonyl group (e.g., 2-butoxy-5-tert-octylphenylsulfonyl), which may be substituted by the groups which are allowable as substituents of $R^1$.

There are bis-type couplers obtained by condensing a 4-equivalent coupler with aldehydes or ketones as the coupling-off groups bonded through the carbon atom. The coupling-off group of the present invention may also contain a photographically useful group, such as a development restrainer and a development accelerator.

$Z^1$ represents a group of non-metallic atoms to form a nitrogen-containing 6-membered heterocyclic ring, which contains at least one group capable of being dissociated.

Four bivalent linking groups for constituting the above nitrogen-containing 6-membered heterocyclic ring include —NH—, —N(R)—, —N=, —CH(R)—, —CH=, —C(R)=, —CO—, —S—, —SO—, and —$SO_2$—., wherein R represents a substituent, including those mentioned for $R^1$ and $R^2$.

As the group capable of being dissociated, those having an acid proton, such as —NH— and —CH(R)— can be mentioned, and preferably those having a pKa of 3 to 12 in water.

Preferably the cyan coupler represented by formula (I) includes those represented by formulae (Ib) to (Is):

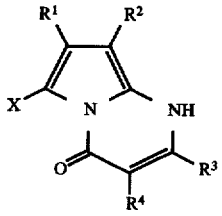
(Ib)
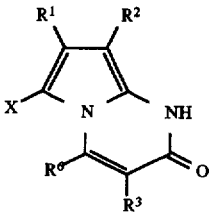
(Ic)
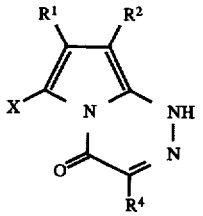
(Id)
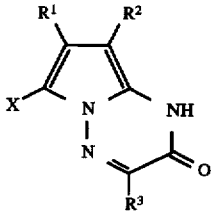
(Ie)
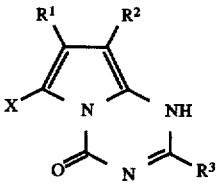
(If)
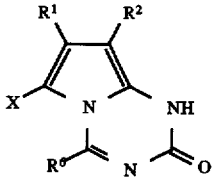
(Ig)
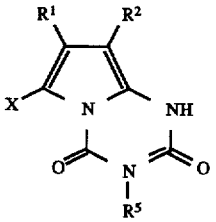
(Ih)
-continued
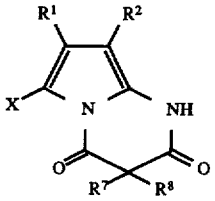
(Ii)
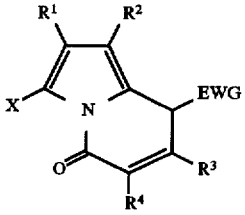
(Ij)
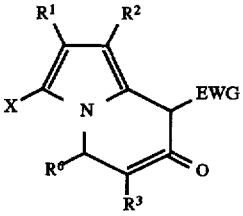
(Ik)
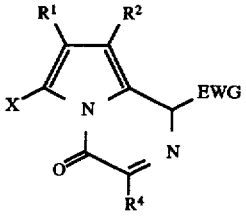
(Il)
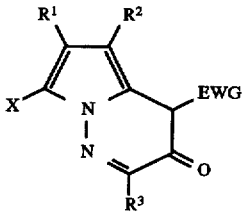
(Im)
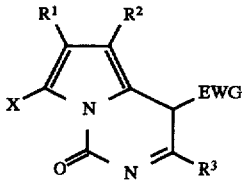
(In)
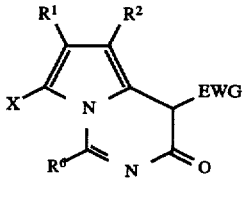
(Io)

-continued (Ip)

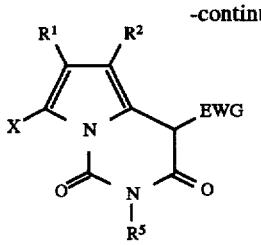

(Iq)

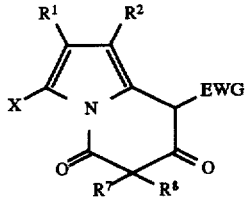

(Ir)

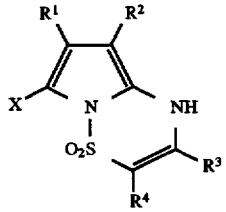

(Is)

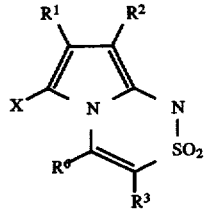

wherein $R^1$ $R^2$, and X have the same meanings as those in formula (I), $R^3$, $R^5$, $R^6$, $R^7$, and $R^8$ each represent a hydrogen atom or a substituent, $R^4$ represents a substituent, and EWG represents an electron-attracting group wherein the Hammett substituent constant 94 $_p$ value is 0.35 or more.

Examples of the groups represented by $R^3$, $R^4$, $R^5$, $R^6$, $R^7$, and $R^8$ are the same groups as described for $R^1$ and $R^2$.

The coupler represented by formula (I) may form a dimer or more higher polymer having, in the group represented by $R^1$ to $R^8$, a coupler residue represented by formula (I), or may allow the group represented by $R^1$ to $R^8$ to have a polymer chain to form a homopolymer or a copolymer. The homopolymer or copolymer bonded to a polymer chain is typically a homopolymer or copolymer of an addition-copolymerizable ethylenically unsaturated compound having a coupler residue represented by formula (I). In that case, in the polymer there may be one or more types of the color-forming repeating units having a coupler residue represented by formula (I) and the copolymer may contain one or more types of non-color-forming ethylenically unsaturated monomers as copolymer components, such as acrylates, methacrylates, and maleates.

Now, typical compound examples of the coupler to be used in the present invention are shown, but the present invention is not limited to them.

The substituents used in the compound examples are shown below in numerical order.

H (1)

F (2)

-continued

Cl (3)

Br (4)

I (5)

(6)

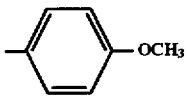

(7)

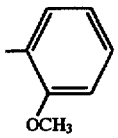

(8)

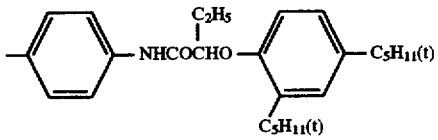

(9)

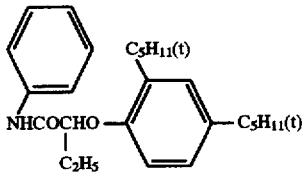

(10)

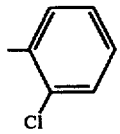

(11)

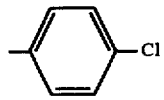

(12)

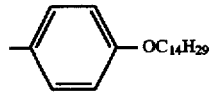

(13)

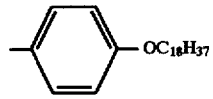

(14)

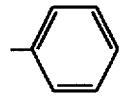

(15)

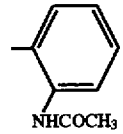

(16)

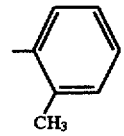

-continued
(17)
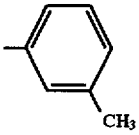
(18)
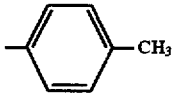
(19)
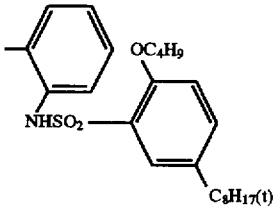
(20)
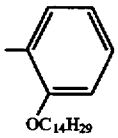
$CH_3$ (21)
$C_2H_5$ (22)
$-C_3H_7(i)$ (23)
$-C_4H_9(t)$ (24)
$-CF_3$ (25)
$-C_3F_7$ (26)
$-(CH_2)_3OC_{12}H_{25}$ (27)
(28)
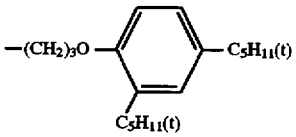
$-C_{16}H_{33}$ (29)
(30)
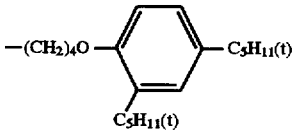
$-CN$ (31)
$-COCH_3$ (32)
$-COC_{15}H_{31}$ (33)
$-COC_4H_9(t)$ (34)
(35)
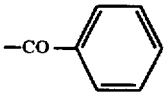
$-CONH_2$ (36)
$-CONHC_{16}H_{33}$ (37)
-continued
(38)
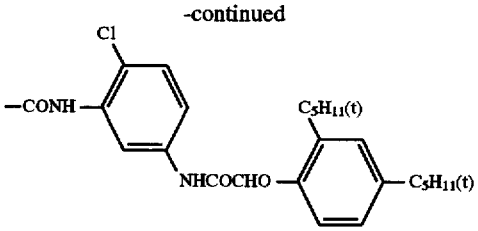
(39)
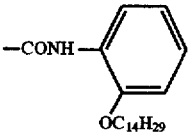
(40)
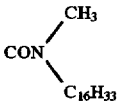
$-CO_2CH_3$ (41)
$-CO_2C_{16}H_{33}$ (42)
$-CO_2C_2H_5$ (43)
(44)
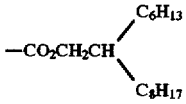
$-CO_2CH_2(CF_2)_6F$ (45)
$-NHCOCH_3$ (46)
$-NHCOCH_2CN$ (47)
$-NHCOC_4H_9(t)$ (48)
(49)
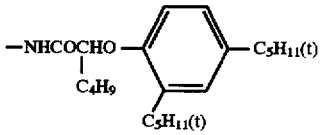
(50)
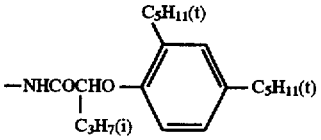
(51)
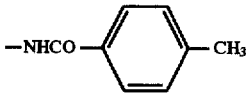
(52)
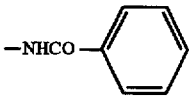
(53)
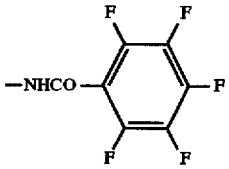
(54)
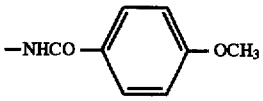

-continued
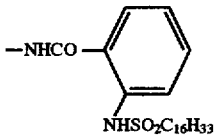
(55)
$-NHCO_2C_2H_5$ (56)
$-NHCO_2C_4H_9(i)$ (57)
$-NHCO_2CH_2CH(C_2H_5)C_4H_9$ (58)
$-NHSO_2CH_3$ (59)
$-NHSO_2C_{16}H_{33}$ (60)
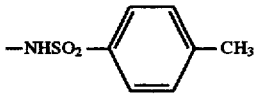
(61)
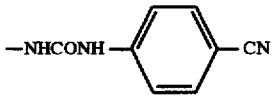
(62)
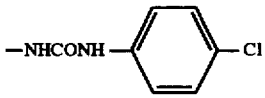
(63)
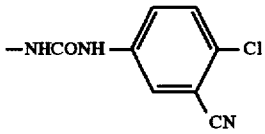
(64)
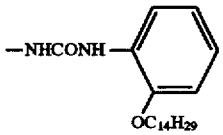
(65)
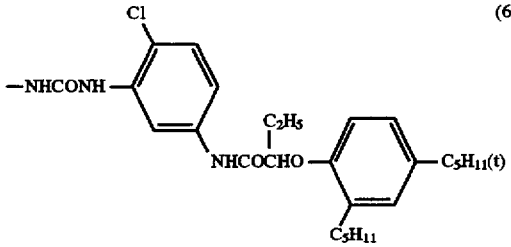
(66)
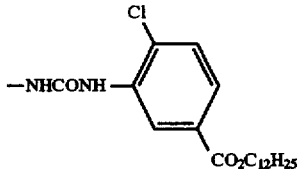
(67)
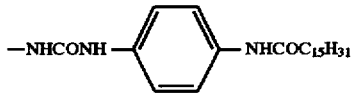
(68)
$-N(CH_3)_2$ (69)
-continued
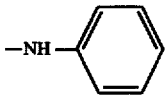
(70)
$-OCH_3$ (71)
$-OC_2H_5$ (72)
$-OCH_2CH_2OCH_3$ (73)
$-OCH_2CH_2OH$ (74)
$-OCH_2CH_2SCH_2CH_2OH$ (75)
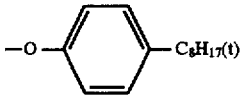
(76)
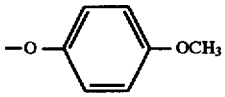
(77)
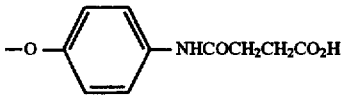
(78)
$-SCH_2CH_2OH$ (79)
$-SCH_2CO_2H$ (80)
$-SCH_2CH_2CO_2H$ (81)
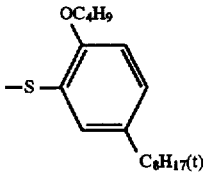
(82)
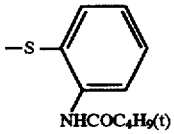
(83)
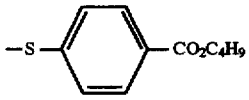
(84)
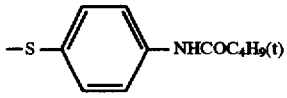
(85)
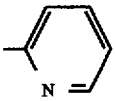
(86)
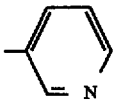
(87)
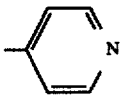
(88)

-continued

(89) 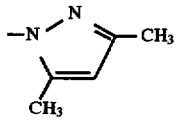

(90) 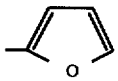

(91) 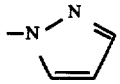

(92) $-OH$

(93) $-NO_2$

(94) 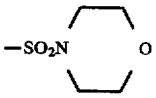

(95) $-SO_2NH(CH_2)_3OC_{12}H_{25}$

(96) 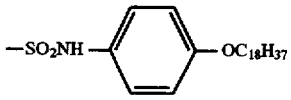

(97) 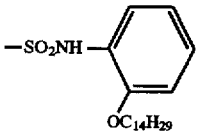

(98) 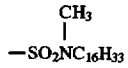

(99) 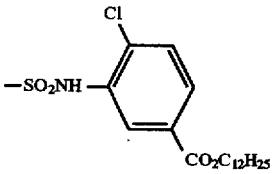

(100) $-SO_2CH_3$ (101) 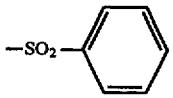

(102) 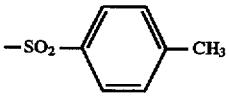

(103) $-SO_2C_4H_9$

Typical compound examples of the coupler to be used in the present invention are shown in the Table below, but the present invention is not limited to them.

TABLE 1

Compounds represented by formula (Ib)

| Coupler No. | $R^1$ | $R^2$ | $R^3$ | $R^4$ | $R^5$ | $R^6$ | $R^7$ | $R^8$ | X |
|---|---|---|---|---|---|---|---|---|---|
| (Ib)-1 | (14) | (31) | (13) | (21) | — | — | — | — | (1) |
| (Ib)-2 | (14) | (31) | (13) | (21) | — | — | — | — | (3) |
| (Ib)-3 | (88) | (31) | (28) | (21) | — | — | — | — | (3) |
| (Ib)-4 | (42) | (31) | (12) | (21) | — | — | — | — | (3) |

TABLE 1-continued

Compounds represented by formula (Ib)

| Coupler No. | $R^1$ | $R^2$ | $R^3$ | $R^4$ | $R^5$ | $R^6$ | $R^7$ | $R^8$ | X |
|---|---|---|---|---|---|---|---|---|---|
| (Ib)-5 | (12) | (31) | (15) | (21) | — | — | — | — | (3) |
| (Ib)-6 | (31) | (31) | (19) | (21) | — | — | — | — | (3) |
| (Ib)-7 | (31) | (31) | (20) | (21) | — | — | — | — | (3) |
| (Ib)-8 | (16) | (40) | (13) | (21) | — | — | — | — | (1) |
| (Ib)-9 | (9) | (31) | (14) | (21) | — | — | — | — | (3) |
| (Ib)-10 | (8) | (31) | (14) | (21) | — | — | — | — | (3) |
| (Ib)-11 | (43) | (43) | (13) | (21) | — | — | — | — | (3) |
| (Ib)-12 | (14) | (31) | (19) | (23) | — | — | — | — | (74) |
| (Ib)-13 | (25) | (31) | (19) | (23) | — | — | — | — | (77) |
| (Ib)-14 | (14) | (45) | (67) | (23) | — | — | — | — | (79) |
| (Ib)-15 | (25) | (31) | (66) | (23) | — | — | — | — | (83) |
| (Ib)-16 | (14) | (31) | (58) | (23) | — | — | — | — | (91) |

TABLE 2

Compounds represented by formula (Ic)

| Coupler No. | $R^1$ | $R^2$ | $R^3$ | $R^4$ | $R^5$ | $R^6$ | $R^7$ | $R^8$ | X |
|---|---|---|---|---|---|---|---|---|---|
| (Ic)-1 | (14) | (31) | (44) | — | — | (21) | — | — | (1) |
| (Ic)-2 | (14) | (31) | (44) | — | — | (21) | — | — | (3) |
| (Ic)-3 | (14) | (31) | (44) | — | — | (1) | — | — | (1) |
| (IC)-4 | (18) | (31) | (45) | — | — | (1) | — | — | (3) |
| (Ic)-5 | (31) | (31) | (45) | — | — | (1) | — | — | (3) |
| (Ic)-6 | (31) | (31) | (42) | — | — | (1) | — | — | (1) |
| (Ic)-7 | (14) | (31) | (37) | — | — | (1) | — | — | (3) |
| (Ic)-8 | (15) | (31) | (38) | — | — | (1) | — | — | (3) |
| (Ic)-9 | (16) | (31) | (39) | — | — | (1) | — | — | (3) |
| (Ic)-10 | (43) | (43) | (39) | — | — | (1) | — | — | (3) |
| (Ic)-11 | (31) | (43) | (44) | — | — | (1) | — | — | (3) |
| (Ic)-12 | (45) | (31) | (44) | — | — | (1) | — | — | (3) |
| (Ic)-13 | (7) | (31) | (44) | — | — | (72) | — | — | (3) |
| (Ic)-14 | (14) | (31) | (38) | — | — | (72) | — | — | (3) |
| (Ic)-15 | (10) | (44) | (1) | — | — | (69) | — | — | (3) |
| (Ic)-16 | (87) | (31) | (44) | — | — | (1) | — | — | (82) |
| (Ic)-17 | (14) | (31) | (44) | — | — | (1) | — | — | (83) |
| (Ic)-18 | (88) | (31) | (38) | — | — | (1) | — | — | (76) |
| (Ic)-19 | (14) | (31) | (37) | — | — | (1) | — | — | (80) |
| (Ic)-20 | (14) | (31) | (40) | — | — | (1) | — | — | (91) |

TABLE 3

Compounds represented by formulae (Id), (Ie), (If), (Ig), and (Ii)

| Coupler No. | $R^1$ | $R^2$ | $R^3$ | $R^4$ | $R^5$ | $R^6$ | $R^7$ | $R^8$ | X |
|---|---|---|---|---|---|---|---|---|---|
| (Id)-1 | (14) | (31) | — | (13) | — | — | — | — | (1) |
| (Id)-2 | (25) | (31) | — | (19) | — | — | — | — | (3) |
| (Id)-3 | (43) | (31) | — | (28) | — | — | — | — | (80) |
| (Id)-4 | (31) | (14) | — | (27) | — | — | — | — | (83) |
| (Ie)-1 | (14) | (31) | (13) | — | — | — | — | — | (1) |
| (Ie)-2 | (25) | (31) | (20) | — | — | — | — | — | (3) |
| (Ie)-3 | (43) | (31) | (30) | — | — | — | — | — | (79) |
| (Ie)-4 | (31) | (14) | (29) | — | — | — | — | — | (84) |
| (If)-1 | (14) | (31) | (28) | — | — | — | — | — | (1) |
| (If)-2 | (25) | (31) | (27) | — | — | — | — | — | (3) |
| (If)-3 | (43) | (31) | (19) | — | — | — | — | — | (81) |
| (If)-4 | (31) | (14) | (12) | — | — | — | — | — | (82) |
| (Ig)-1 | (14) | (31) | — | — | — | (9) | — | — | (1) |
| (Ig)-2 | (25) | (31) | — | — | — | (13) | — | — | (3) |
| (Ig)-3 | (43) | (31) | — | — | — | (27) | — | — | (80) |
| (Ig)-4 | (31) | (14) | — | — | — | (28) | — | — | (85) |
| (Ii)-1 | (14) | (31) | — | — | — | — | (27) | (27) | (1) |
| (Ii)-2 | (25) | (31) | — | — | — | — | (27) | (27) | (3) |
| (Ii)-3 | (43) | (31) | — | — | — | — | (28) | (28) | (81) |
| (Ii)-4 | (31) | (14) | — | — | — | — | (28) | (28) | (84) |

TABLE 4

Compounds represented by formula (Ih)

| Coupler No. | $R^1$ | $R^2$ | $R^3$ | $R^4$ | $R^5$ | $R^6$ | $R^7$ | $R^8$ | X |
|---|---|---|---|---|---|---|---|---|---|
| (Ih)-1 | (14) | (31) | — | — | (29) | — | — | — | (1) |
| (Ih)-2 | (8) | (31) | — | — | (14) | — | — | — | (1) |
| (Ih)-3 | (37) | (31) | — | — | (21) | — | — | — | (1) |
| (Ih)-4 | (49) | (31) | — | — | (21) | — | — | — | (3) |
| (Ih)-5 | (25) | (37) | — | — | (21) | — | — | — | (1) |
| (Ih)-6 | (31) | (31) | — | — | (8) | — | — | — | (1) |
| (Ih)-7 | (14) | (38) | — | — | (21) | — | — | — | (1) |
| (Ih)-8 | (42) | (42) | — | — | (14) | — | — | — | (1) |
| (Ih)-9 | (13) | (31) | — | — | (14) | — | — | — | (1) |
| (Ih)-10 | (14) | (31) | — | — | (13) | — | — | — | (74) |
| (Ih)-11 | (14) | (31) | — | — | (9) | — | — | — | (75) |
| (Ih)-12 | (14) | (31) | — | — | (8) | — | — | — | (76) |
| (Ih)-13 | (31) | (14) | — | — | (13) | — | — | — | (78) |
| (Ih)-14 | (31) | (31) | — | — | (12) | — | — | — | (79) |
| (Ih)-15 | (42) | (14) | — | — | (19) | — | — | — | (80) |
| (Ih)-16 | (42) | (31) | — | — | (20) | — | — | — | (81) |

TABLE 4-continued

Compounds represented by formula (Ih)

| Coupler No. | $R^1$ | $R^2$ | $R^3$ | $R^4$ | $R^5$ | $R^6$ | $R^7$ | $R^8$ | X |
|---|---|---|---|---|---|---|---|---|---|
| (Ih)-17 | (14) | (31) | — | — | (8) | — | — | — | (82) |
| (Ih)-18 | (31) | (31) | — | — | (8) | — | — | — | (83) |
| (Ih)-19 | (14) | (31) | — | — | (19) | — | — | — | (84) |
| (Ih)-20 | (31) | (14) | — | — | (9) | — | — | — | (91) |

TABLE 5

Compounds represented by formulae (Ij), (Ik), (Il), (Im), and (n)

| Coupler No. | $R^1$ | $R^2$ | $R^3$ | $R^4$ | $R^5$ | $R^6$ | $R^7$ | $R^8$ | EWG | X |
|---|---|---|---|---|---|---|---|---|---|---|
| (Ij)-1 | (14) | (31) | (13) | (21) | — | — | — | — | (31) | (1) |
| (Ij)-2 | (25) | (31) | (19) | (23) | — | — | — | — | (31) | (3) |
| (Ij)-3 | (43) | (31) | (67) | (23) | — | — | — | — | (43) | (79) |
| (Ij)-4 | (31) | (14) | (68) | (23) | — | — | — | — | (31) | (82) |
| (Ik)-1 | (14) | (31) | (44) | — | — | (21) | — | — | (31) | (1) |
| (Ik)-2 | (25) | (31) | (45) | — | — | (1) | — | — | (43) | (3) |
| (Ik)-3 | (43) | (31) | (44) | — | — | (72) | — | — | (31) | (80) |
| (Ik)-4 | (31) | (14) | (1) | — | — | (69) | — | — | (31) | (83) |
| (Il)-1 | (14) | (31) | — | (19) | — | — | — | — | (43) | (1) |
| (Il)-2 | (25) | (31) | — | (13) | — | — | — | — | (31) | (3) |
| (Il)-3 | (43) | (31) | — | (27) | — | — | — | — | (31) | (81) |
| (Il)-4 | (31) | (14) | — | (28) | — | — | — | — | (43) | (84) |
| (Im)-1 | (14) | (31) | (20) | — | — | — | — | — | (31) | (1) |
| (Im)-2 | (25) | (31) | (13) | — | — | — | — | — | (31) | (3) |
| (Im)-3 | (43) | (31) | (29) | — | — | — | — | — | (43) | (79) |
| (Im)-4 | (31) | (14) | (30) | — | — | — | — | — | (31) | (85) |
| (In)-1 | (14) | (31) | (19) | — | — | — | — | — | (31) | (1) |
| (In)-2 | (25) | (31) | (12) | — | — | — | — | — | (43) | (3) |
| (In)-3 | (43) | (31) | (27) | — | — | — | — | — | (31) | (80) |
| (In)-4 | (31) | (14) | (28) | — | — | — | — | — | (31) | (82) |

TABLE 6

Compounds represented by formulae (Io), (Ip), (Iq), (Ir), and (Is)

| Coupler No. | $R^1$ | $R^2$ | $R^3$ | $R^4$ | $R^5$ | $R^6$ | $R^7$ | $R^8$ | EWG | X |
|---|---|---|---|---|---|---|---|---|---|---|
| (Io)-1 | (14) | (31) | — | — | — | (13) | — | — | (43) | (1) |
| (Io)-2 | (25) | (31) | — | — | — | (9) | — | — | (31) | (3) |
| (Io)-3 | (43) | (31) | — | — | — | (28) | — | — | (31) | (81) |
| (Io)-4 | (31) | (14) | — | — | — | (27) | — | — | (43) | (83) |
| (Ip)-1 | (14) | (31) | — | — | (8) | — | — | — | (31) | (1) |
| (Ip)-2 | (25) | (31) | — | — | (9) | — | — | — | (31) | (3) |
| (Ip)-3 | (43) | (31) | — | — | (13) | — | — | — | (43) | (79) |
| (Ip)-4 | (31) | (14) | — | — | (19) | — | — | — | (31) | (84) |
| (Iq)-1 | (14) | (31) | — | — | — | — | (27) | (27) | (31) | (1) |
| (Iq)-2 | (25) | (31) | — | — | — | — | (27) | (27) | (43) | (3) |
| (Iq)-3 | (43) | (31) | — | — | — | — | (28) | (28) | (31) | (80) |
| (Iq)-4 | (31) | (14) | — | — | — | — | (28) | (28) | (31) | (85) |
| (Ir)-1 | (14) | (31) | (13) | (21) | — | — | — | — | — | (1) |
| (Ir)-2 | (25) | (31) | (28) | (21) | — | — | — | — | — | (3) |
| (Ir)-3 | (43) | (31) | (19) | (23) | — | — | — | — | — | (81) |
| (Ir)-4 | (31) | (14) | (67) | (23) | — | — | — | — | — | (83) |
| (Is)-1 | (14) | (31) | (44) | — | — | (21) | — | — | — | (1) |
| (Is)-2 | (25) | (31) | (45) | — | — | (1) | — | — | — | (3) |
| (Is)-3 | (43) | (31) | (38) | — | — | (72) | — | — | — | (79) |
| (Is)-4 | (31) | (14) | (40) | — | — | (1) | — | — | — | (84) |

Next, Synthesis Examples of typical couplers of the present invention are shown below.

Synthesis Example 11 Synthesis of Coupler (Ic)-1

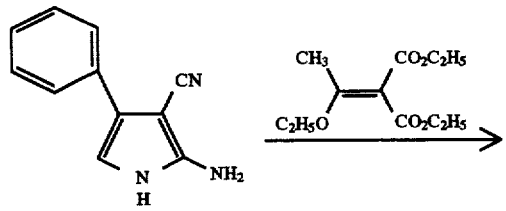

Compound a

-continued

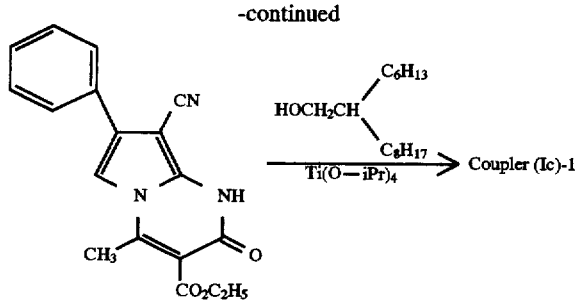

Compound b 18.3 Grams of 2-amino-3-cyano-4-phenylpyrrole (Compound a) which can be obtained easily by condensing 2-aminoacetophenone hydrochloride and malononitrile in the presence of an alkali and 25.3 g of diethyl ethoxyethylidenemalonate were dispersed in 300 ml of ethanol, then 22.0 ml of a methanol solution containing 28% of sodium methylate was added to the dispersion, and the mixture was heated for 5 hours under reflux. After cooling, ethyl acetate was added, washing with water was carried out, the organic solvents were distilled off, the separated crystals were filtered off to obtain 11.6 g of Compound b. Then, 50 ml of Fineoxocol 1600 (2-hexyl decanol, tradename, manufactured by Nissan Chem. Co.) and 2.0 g of titanium isopropoxide ($Ti(O\text{-}i\text{-}Pr)_4$) were added thereto and the resulting mixture was heated for 6 hours at an oil bath temperature of 130° to 140° C. After cooling, it was purified by silica gel chromatography (hexane/ethyl acetate=1/1) to obtain a pale yellow oil of 14.7 g of Coupler (Ic)-1.

(Synthesis Example 2) Synthesis of Coupler (Ic)-3

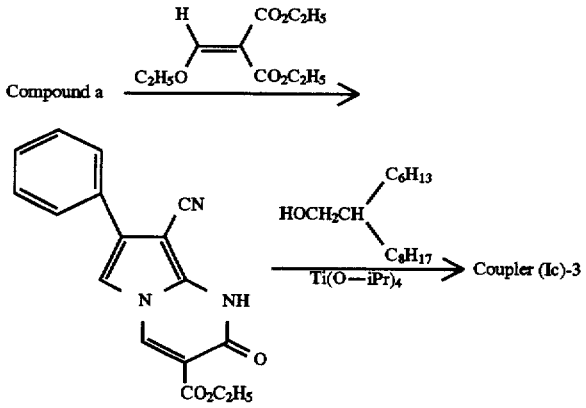

Compound c 18.3 Grams of 2-amino-3-cyano-4-phenylpyrrole (Compound a) and 24.0 g of diethyl ethoxymethylenemalonate were dispersed in 400 ml of ethanol, then 22.0 ml of a methanol solution containing 28% of sodium methylate, and the mixture was heated for 1 hour under reflux. After cooling, the separated crystals were filtered off to obtain 28.0 g of Compound c. Then, 150 ml of Fineoxocol 1600 (2-hexyl decanol, tradename manufactured by Nissan Chem. Co.) and 4.0 g of $Ti(O\text{-}i\text{-}Pr)_4$ were added thereto and the reaction mixture was heated for 2 hours at an oil bath temperature of 130° to 140° C. After cooling, it was purified by silica gel chromatography to obtain 36.2 g of Coupler (Ic)-3.

(Synthesis Example 3) Synthesis of Coupler (Ib)-1

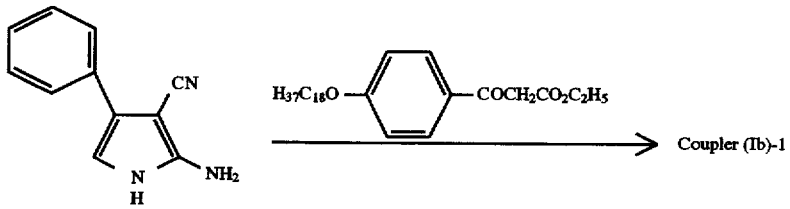

Compound a 18.3 Grams of 2-amino-3-cyano-4-phenylpyrrole (Compound a) and 46.0 g of ethyl p-octadecyloxybenzoylacetate were dispersed in 300 ml of acetic acid and the dispersion was heated for 8 hours under reflux. After cooling, 1 liter of ethyl acetate and 1 liter of water were added thereto and the separated crystals were filtered off to obtain 29.0 g of Coupler (Ib)-1.

The amount of the cyan coupler to be used in the present photographic material is generally 0.001 to 100 mol, preferably 0.01 to 10 mol, and more preferably 0.1 to 1 mol, per mol of the silver halide.

I. First embodiment

The monodisperse emulsion to be used in the first embodiment of the present invention will now be described.

The monodisperse emulsion refers to one wherein the deviation coefficient of the grain diameter distribution is 20% or below. Preferably the deviation coefficient is in the range of 15% or below.

The deviation coefficient can be determined by a known method disclosed, for example, in JP-A No. 48754/1984.

As the method for preparing the monodisperse emulsion that is used in the first embodiment of the present invention, various methods are known and representative examples thereof are JP-B Nos. 153482/1977 and 42739/1980, U.S. Pat. Nos. 4,431,729 and 4,259,438, British Patent No. 1535016, U.S. Pat. Nos. 4,259,438 and 4,431,729, and JP-A Nos. 39027/1976, 88017/1976, 158220/1979, 36829/1980, 196541/1983, 48521/1979, 99419/1979, 78831/1981, 178235/1982, 49938/1983, 37653/1983, 106532/1983, and 149037/1983.

Also, a method described in JP-A No. 142329/1980 can be used preferably.

That is, when use is made of a silver halide seed crystal emulsion having an arbitrary grain diameter distribution and the addition rate of the silver ion and the halide ion during the crystal growth stage is made in such a way that the crystal growth rate is 30 to 100% of the critical growth rate of the crystals, a monodisperse silver halide emulsion can be obtained.

The monodisperse silver halide grains of the present invention may have a regular crystal form, such as a cubic form or an octahedral form, or an irregular crystal form, such as a spherical form or a tabular form, or may have a crystal defect, such as a twin plane, or may have a complex crystal form of these. Also they may be made up of a mixture of grains of different crystal forms.

Particularly, monodisperse hexagonal tabular grains described in JP-A No. 11928/1988 can be preferably used.

The silver halide of the monodisperse emulsion used in the present invention is silver chloride, silver chlorobromide, or silver bromide; or silver iodobromide, silver iodochloride, or silver iodobromochloride containing about 30 mol % or below of silver iodide. Silver bromoiodide or silver bromochloroiodide containing about 2 to about 25 mol % of silver iodide is particularly preferable.

More preferably, in the case of the color negative photographic material, silver bromoiodide containing about 2 to 10 mol % of silver iodide is used and in the case of the color reversal photographic material, silver bromoiodide containing about 1 to 5 mol % of silver iodide is used.

The crystal may have a uniform structure, or may have a structure wherein the halogen composition of the inside is different from that of the outside, or may have a laminated structure. The structure may be such that silver halides whose compositions are different are epitaxially joined or such that a silver halide is joined to a compound other than silver halides, such as silver rhodanate and lead oxide. Also use may be made of a mixture of grains having different crystal forms.

The above emulsion may be of a surface latent image-type wherein a latent image is mainly formed on the surface or of an internal latent image-type wherein a latent image is formed mainly in the grain, or of a type wherein a latent image is formed both on the surface and in the inside. The internal latent image-type of the emulsion may be an internal latent image-type emulsion of a core/shell-type described in JP-A No. 264740/1988. A method of the preparation of this internal latent image type emulsion of a core/shell-type is described in JP-A No. 133542/1984. The thickness of the shell of this emulsion varies depending, for example, on the development processing and is preferably 3 to 40 nm, particularly preferably 5 to 20 nm.

The chemical sensitization of the monodisperse emulsion for use in the present invention can be carried out by using active gelatin as described by T. H. James in *The Theory of the Photographic Process*, 4th edition, Macmillan, 1977, pages 67 to 76, or by using sulfur, selenium, tellurium, gold, platinum, palladium, or iridium, or a combination of them at a temperature of 30 to 80° C., a pAg of 5 to 10, and a pH of 5 to 8 as described in Research Disclosure, Vol. 120, April 1974, 12008, ibid. Vol. 34, June 1975, 13452, U.S. Pat. Nos. 2,642,361, 3,297,446, 3,772,031, 3,857,711, 3,901,714, 4,266,018, and 3,904,415, and British Patent No. 1,315,755. The chemical sensitization is optimally carried out in the presence of a gold compound and a thiocyanate compound or in the presence of a sulfur-containing compound, such as sodium thiosulfate, a thiourea type compound, a rhodanine type compound, or a sulfur-containing compound described in U.S. Pat. Nos. 3,857,711, 4,266,018, and 4,054,457. The chemical sensitization can be carried out in the presence of an auxiliary chemical sensitizing agent. As the auxiliary chemical sensitizing agent for use, compounds that are known to increase sensitivity and suppress fogging during the chemical sensitization, such as azaindene, azapyridazine, and azapyrimidine, are used. Examples of the auxiliary chemical sensitizing agent are described in U.S. Pat. Nos. 2,131,038, 3,411,914, and 3,554,757, JP-A No. 126526/1983, and the above-mentioned *Photographic Emulsion Chemistry*, by Duffin, pages 138 to 143. In addition to or instead of the chemical sensitization, reduction sensitization can be carried out, for example, by using hydrogen as described in U.S. Pat. Nos. 3,891,446 and 3,984,249, or by using a reducing agent, such as stannous chloride, thiourea dioxide, and a polyamine, as described in U.S. Pat. Nos. 2,518,698, 2,743,182, and 2,743,183, or by processing at a low pAg (e.g., lower than 5) and/or a high pH (e.g., higher than 8). Chemical sensitization methods described in U.S. Pat. Nos. 3,917,485 and 3,966,476 can be used to improve color sensitization property.

Sensitization using an oxidizing agent described in JP-A Nos. 3134/1986 and 3136/1986 can be applied.

These monodisperse emulsions may be used in any of emulsion layers having the same photosensitivity and preferably are used in all the layers. One and the same layer contains one or more monodisperse emulsions and preferably contains two or three monodisperse emulsions as a mixture although one and the same layer may contain four or more monodisperse emulsions as a mixture. When two or more monodisperse emulsions are used as a mixture in emulsion layers having the same photosensitivity, the grain size distribution of the whole emulsion contained in said emulsion layers may be monodisperse or polydisperse and in the distribution there may be two or more maximum values of the size distribution. It is not required that the grain size distribution of the whole emulsion contained in said emulsion layers is monodisperse, and a preparation method is used in which emulsions wherein the grain size distribution are monodisperse, namely, emulsions which are prepared as monodisperse emulsions when they are prepared are mixed and incorporated into said emulsion layers.

In the present invention, preferably the monodisperse emulsion amounts to 20 to 100%, and more preferably 50 to 100%, in an emulsion in emulsion layers having the same photosensitivity.

II. Second embodiment

The second embodiment of the present invention will be described in detail.

The term "a silver halide emulsion wherein the inside or the surface of the grains is fogged" in the second embodiment of the present invention refers to a non-photosensitive silver halide emulsion capable of being developed uniformly (non-imagewise) irrespective of unexposed part and exposed part of the photographic material.

The silver halide emulsion for use in the present invention wherein the surface of the grains is fogged can be prepared by subjecting an emulsion that can form a surface latent image, for example, to a process wherein a reducing agent or a gold salt is added under suitable conditions of the pH and the pAg, to a process wherein the emulsion is heated under a low pAg, or to a process wherein uniform exposure is given. As the reducing agent, for example, stannous chloride, a hydrazine compound, or ethanolamine can be used.

As the silver halide wherein the surface is fogged, any of silver chloride, silver chlorobromide, silver iodobromide, silver chloroiodobromide, and the like can be used.

Although there are no particular restrictions on the grain size of the silver halide grains whose surface is fogged, an average grain size of 0.01 to 0.75 μm, particularly 0.05 to 0.6 μm, is preferable.

Also, there are no particular restrictions on the shape of the grains, regular grains and irregular grains may be used, and although a polydisperse emulsion can be used, a monodisperse emulsion (particularly a monodisperse emulsion wherein the deviation coefficient CV of the grain size distribution is 20% or less) is preferred.

The term "a silver halide emulsion wherein the inside of the grains is fogged" used in the specification and claims of the present invention refers to an emulsion comprising core/shell-type silver halide grains consisting of inner nuclei of a silver halide whose surface is fogged and outer shells of a silver halide which cover that surfaces.

This core/shell-type silver halide emulsion wherein the inner nucleus surfaces are fogged is generally produced by forming silver halide grains that will form inner nuclei, then fogging chemically or optically the surfaces of those silver halide grains, and depositing a silver halide on the surfaces of the inner nuclear silver halide grains to form outer shell.

The above fogging step can be carried out by a process wherein a reducing agent or a gold salt is added under suitable conditions of the pH and the pAg, by a process wherein heating is effected under a low pAg, or by a process wherein uniform exposure is given. As the reducing agent, for example, stannous chloride, a hydrazine compound, ethanolamine, or thiourea dioxide can be used.

Preferably the thickness of the outer shell is to be set in the range of 50 to 1,000 Å (angstroms), more preferably 100 to 500 Å.

The halogen composition of the silver halide that forms the inner nucleus of the core/shell-type silver halide grains and the halogen composition of the silver halide that forms outer shell may be the same or different.

As the silver halide wherein the inside of the grains is fogged, any of silver chloride, silver bromide, silver chlorobromide, silver iodobromide, silver chloroiodobromide, and the like can be used.

Although there are no particular restrictions on the grain size of the silver halide wherein the inside of the grains is fogged, preferably the average grain size is 0.01 to 0.75 μm, particularly 0.05 to 0.6 μm.

Also, there are no particular restrictions on the shape of the grains of the silver halide emulsion wherein the inside of the grains is fogged and regular grains and irregular grains may be used.

Although the silver halide emulsion wherein the inside of the grains is fogged may be polydisperse, preferably it is a monodisperse emulsion (particularly a monodisperse emulsion wherein the deviation coefficient CV of the grain size distribution is 20% or less).

The silver halide emulsion for use in the present invention wherein the inside of the grains is fogged can be judged whether it can be used or not by the following test method: two samples prepared by coating film supports with the emulsion to be tested in a coating amount of 0.5 g/m$^2$ in terms of silver (the samples are not exposed to light) are processed with a developer having the below-given formulation for 2 min and 10 min respectively at 38° C. and then are fixed. The formulation of the developer:

| | |
|---|---|
| Water | 700 ml |
| Sodium tetrapolyphosphate | 2 g |
| Sodium sulfite | 20 g |
| Hydroquinone monosulfonate | 30 g |
| Sodium carbonate (monohydrate) | 30 g |
| 1-phenyl-4-methyl-4-hydroxymethyl-3-pyrazolidone | 2 g |

-continued

| | |
|---|---|
| Potassium bromide | 2.5 g |
| Potassium thiocyanate | 1.2 g |
| Potassium iodide (0.1 aqueous solution) | 2 ml |
| Water to make | 1 liter |

On the basis of the results of the above test, the emulsion used in the sample which shows little increase in density in the case of 2-min processing, but in the case of 10-min processing shows an increase in density 5 times higher or more higher than the density of the 2-min processing is suitably used as the silver halide emulsion of the present invention wherein the inside of the grains is fogged.

In the present invention, the silver halide emulsion wherein the inside or the surface of the grains is fogged is contained in a usual photosensitive silver halide emulsion layer or intermediate layer.

That is, the layer to which these silver halide emulsions are applied includes one or more layers of a red-sensitive emulsion layer and/or its adjacent layers, a green-sensitive emulsion layer and/or its adjacent layers, and a blue-sensitive emulsion layer and/or its adjacent layer. In the case wherein one color-sensitive layer is divided into a higher sensitive layer and a lower sensitive layer, the above silver halide emulsion may be applied to both, but particularly preferably it is added to the lower sensitive layer.

In the present invention, although the amount of the silver halide emulsion to be used wherein the inside or the surface of the grains is fogged varies depending, for example, on the development processing conditions and the timing of the development, preferably the amount is 0.05 to 50 mol %, particularly preferably 0.1 to 40 mol %, for the photosensitive silver halide in the same or adjacent layers.

In silver halide photographic materials, a technique wherein a layer for absorbing light having a specific wavelength is provided in order to absorb and filter light, to prevent halation, or to adjust sensitivity is well known.

Particularly, a technique wherein a yellow filter layer is positioned nearer to a support than a blue sensitive layer and farther from the support than other color sensitive layers thereby cutting the inherent sensitivities of a green sensitive emulsion and a red sensitive emulsion and a technique wherein an antihalation layer for preventing undesired light scattering is positioned nearer to a support than a photosensitive emulsion layer are at present put to practical use most generally. In these light absorbing layers, generally, fine particles of colloidal silver are used in view of practical use. However, it is known that these colloidal silver particles cause the adjacent emulsion layer to have harmful contact fogging.

However, in the present invention, such contact fogging would not occur.

III. Third embodiment

As the colloidal silver to be used in the third embodiment of the present invention, any of yellow colloidal silver, brown colloidal silver, blue colloidal silver, black colloidal silver, and the like can be used, and there are no particular restrictions as to which layer the colloidal silver is contained and the colloidal silver can suitably be contained in any layer of photosensitive silver halide emulsion layers and non-photosensitive intermediate layers.

The amount of the colloidal silver to be added is preferably 0.0001 to 0.4 g/m$^2$, more preferably 0.0003 to 0.3 g/m$^2$.

The preparation of various type colloidal silvers is described in the literature, for example, in "*Colloidal Elements*" (yellow colloidal silver by the dextrin reduction method by Carey Lea) written by Weiser and published by Wiley & Sons, New York, 1933, in German Patent No. 1,096,193 (brown colloidal silver and black colloidal silver), or in U.S. Pat. No. 2,688,601 (blue colloidal silver).

IV. Fourth embodiment

The fourth embodiment of the present invention will be described below in detail.

The internal latent image-type emulsion of the present invention is required to be chemically sensitized to a depth of less than 0.02 μm from the grain surface. In the case wherein the chemical sensitization is made to a depth of 0.02 μm or more from the surface, even if the development is made with a developer practical for black and white photographic materials, color negative photographic materials, and color reversal photographic materials, the development becomes insufficient, and not only the substantial sensitivity is damaged but also the effect of the addition of the present tellurium compound becomes unremarkable.

The above practical developer is neither a developer wherein a silver halide solvent is eliminated to intentionally develop a surface latent image only nor a developer that contains a large amount of a silver halide solvent to intentionally develop an internal latent image and is a developer that contains such a silver halide solvent that while a silver halide is suitably dissolved, the reduction reaction takes place so that the optimum sensitivity can be exhibited. However, if a large amount of the solvent is contained, it is not preferable because the dissolution of the silver halide proceeds excessively during the processing and the graininess is aggravated by an infectious development. Specifically, as a silver halide solvent, potassium iodide in an amount of 100 mg/liter or less but 20 mg/liter or more, or sodium sulfite or potassium sulfite in an amount of 100 g/liter or less but 20 mg/liter or more is preferably contained in the developer. In addition, as a silver halide solvent, potassium thiocyanate or the like can be used in the developer.

A preferable position where chemical sensitization is carried out is 0.002 μm or more but less than 0.015 μm, more preferably 0.004 μm or more but less than 0.01 μm. Further, more preferably it is required to pay attention not only to the part where chemical sensitization is carried out but also to the in-grain latent image distribution including the ratio of the surface sensitivity to the inside sensitivity. In this case, most preferably the in-grain latent image distribution caused by the exposure has at least one maximum value in the grains, the existing position of this one maximum value is in less than 0.01 μm from the grain surface, and the grain surface is also chemically sensitized to the extent of one fifth or more of said maximum value but less than one times said maximum value.

Herein the latent image distribution is given by taking the depth (×μm) of the latent image from the grain surface on the horizontal axis and the number (y) of the latent images on the vertical axis, x is given by the expression:

$$x=\frac{S}{2}\times\left(1-\sqrt[3]{\frac{Ag_1}{Ag_0}}\right)$$

wherein

S: the silver halide emulsion average grain size (μm), $Ag_1$: the residual amount of silver after the unexposed emulsion-coated sample is processed as shown below, and $Ag_0$: the coated amount of silver before the processing, and y is the reciprocal of the exposure amount that gives a density of 0.2+ fogging when the following processing is carried out after an exposure to white light is given for 1/100 sec. The processing conditions for determining the above latent image distribution are such that sodium thiosulfate in an amount of 0 to 10 g/liter to a processing solution consisting of

| | |
|---|---|
| N-methyl-p-aminophenol sulfate | 2.5 g |
| sodium L-ascorbiate | 10 g |
| sodium metaborate | 35 g |
| potassium bromide | 1 g |
| water to make | 1 liter (pH: 9.6) |

and the processing is carried out at 25° C. for 5 min. Herein, by varying the amount of sodium thiosulfate from 0 to 10 g/liter, the depth from the surface of the latent image in the silver halide grains developed during the processing varies, whereby the change in the number of latent image in the depth direction can be found.

As the method of preparing an internal latent image-type emulsion, methods described, for example, in U.S. Pat. Nos. 3,979,213, 3,966,476, 3,206,313, and 3,917,485 and JP-B Nos. 294045/1968 and 13259/1970 can be employed, but, in any of them, in order to make the emulsion have the latent image distribution of the present invention, the technique of the chemical sensitization, the amount of the silver halide to be deposited after the chemical sensitization, and the conditions of the depositing must be adjusted.

That is, in U.S. Pat. No. 3,966,476, a method is carried out wherein a silver halide is deposited on emulsion grains after the chemical sensitization by the controlled double-jet method. However, after the chemical sensitization if a silver halide is deposited by this method as carried out in this patent, photosensitive nuclei cannot be buried in the grains. Therefore, to secure the latent image distribution of the present invention, it is required that the amount of a silver halide to be deposited after the chemical sensitization is made larger than the case carried out in U.S. Pat. No. 3,966,476 or the conditions of the depositing (e.g., the solubility of the silver halide during the depositing and the speed of the addition of a soluble silver salt and a soluble halide) are controlled so that the thickness may be made less than 0.02 μm.

In U.S. Pat. No. 3,979,213, an internal latent image-type emulsion is prepared by a method wherein a silver halide is deposited again on emulsion grains, whose surface has been chemically sensitized, by the controlled double-jet method. If the amount of the silver halide used in this patent is deposited on grains, the rate of the surface sensitivity to the total sensitivity is doomed to be smaller than one tenth. Consequently, to secure the most preferable latent image distribution, the amount of the silver halide to be deposited after the chemical sensitization must be smaller than that used in U.S. Pat. No. 3,979,213.

Among the internal latent image-type emulsions of the present invention, the most preferable one can be prepared as described in JP-A No. 1150728/1989 by a method of producing a photographic emulsion including a step of forming shells on silver halide core grains, wherein after said core grains are chemically sensitized, shells are formed in the presence of a tetrazaindene compound.

In this method, in the dispersion system, i.e., in the emulsion wherein seed grains and/or silver halide grains which grow using seed grains as nuclei are present in a dispersed manner, the tetrazaindene compound is preferably present in the range of $10^{-2}$ to $10^{-5}$ mol, more preferably $10^{-2}$ to $10^{-4}$ mol, per mol of the silver halide contained in said emulsion.

The amount of the tetrazaindene compound to be added gives influence greatly on the latent image distribution from the silver halide grain surface to the inside and its optimum amount is suitably adjusted in the above range of the amount to be added depending, for example, on the halogen composition of the emulsion grains, and the pAg, the pH, and the temperature at which the silver halide is deposited on the cores, that is, the cores are grown further.

For example, where the amount of Ag to be used for the formation of shells is large and the number of latent images on the shell surfaces is small, it is preferable to add a tetrazaindene compound in a larger amount within the above range of the amount to be added, while if the amount of Ag to be used for the formation of shells is small and the number of latent images on the shell surfaces is inclined to be large, a smaller amount is added preferably.

As the method of adding the tetrazaindene compound, it can be added directly into a water-soluble protective colloidal solution containing seed grains, or it may be dissolved in an aqueous water-soluble silver halide solution and the solution may be added slowly with the growth of the silver halide grains wherein seed grains serve as nuclei.

It is suitable that the tetrazaindene compound is present when the core grains are allowed to grow further and it is also possible to add the tetrazaindene compound before the chemical sensitization of the cores. Since particularly a tetrazaindene compound is adsorbed on silver halide grains and serves to specify the sites where the chemical sensitization will occur, preferably the tetrazaindene compound is allowed to present at the time of the chemical sensitization of the cores.

In this method, the amount of silver to be used in the step of forming shells on the chemically sensitized cores and the amount (M) of silver in the shell parts are preferably to satisfy the following expression:

$$\left(1-\sqrt[3]{\frac{M_0}{M_0+M}}\right)\times R<0.02$$

wherein $M_0$: the amount of silver of seed grains, and

R: the final grain size (μm)

In this method, preferably the silver electric potential (SCE) in the step of forming shells on the core grains is +80 mV or below but −30 mV or over. If the silver electric potential is made higher than +80 mV, the chemical sensitizer that have not been used in the chemical sensitization in the process of forming shells becomes readily reactive with the shell parts, frequently resulting in making the surface sensitivity higher than the internal sensitivity.

On the other hand, if the formation of shells on the core grains is effected at a silver electric potential of less than −30 mV, the chemically sensitized core grain surfaces undergo oxidation reaction with excess halogen and the sensitivity lowers. Preferably the silver electric potential in the step of growing the core grains is −10 mV or over but +60 mV or below.

In the present embodiment, the temperature in the step of forming shells on the core grains is preferably +70° C. or below but +35° C. or over. If the temperature is higher than +70° C., since the remaining chemical sensitizer becomes reactive with the shell parts as described above, the surface sensitivity cannot be made lower than the internal sensitivity. On the other hand, if the core grains are grown at a temperature of less than +35° C., new nuclei are liable to occur in the process of the growth of crystals and new silver halide does not precipitate satisfactorily on the chemically sensitized sites of the core grains. That is, it is not preferable because new nuclei are liable to appear in the step of forming shells. More preferably, the temperature in the step of forming shells is 45° C. or over but 60° C. or below.

In the present embodiment, the speed of addition of the water-soluble silver salt solution in the step of growing grains from core grains is preferably in the range of 30 to 100% of the crystal growth critical speed.

The above crystal growth critical speed is defined as the upper limit wherein new nuclei are substantially not generated in the step of growing grains. The expression "are substantially not generated" means that the weight of newly generated crystal nuclei is preferably 10% or less of the total weight of silver halides.

The chemical sensitization of the core grains can be carried out by using active gelatin as described by T. H. James in "*The Theory of the photographic Process,*" 4th ed., Macmillan, 1977, pages 67 to 76 or by using a combination of several of sulfur, selenium, tellurium, gold, platinum, and iridium as described in *Research Disclosure*, Vol. 120, April 1974, 12008, *Research Disclosure*, Vol. 34, June 1975, 13452, U.S. Pat. Nos. 2,642,361, 3,297,446, 3,772,031, 3,857,711, 3,901,714, 4,266,018, and 3,904,415, and British Patent No. 1,315,755.

The most preferable mode is preferably carried out at a silver electric potential (SCE) of ±0 mV or over but +120 mV or below, more preferably +30 mV or over but +120 mV or below, and further more preferably +60 mV or over but +120 mv or below. To make the silver electric potential high, that is, to make the pAg low causes the chemical sensitization reaction to proceed effectively, so that not only good sensitivity is obtained but also the excess chemical sensitizer that will remain in the formation of shells is reduced to make the surface sensitivity lower than the internal sensitivity, which is preferable.

Although there are no particular restrictions as to which layer the internal latent image-type emulsion is contained in the present invention, the internal latent image-type emulsion is preferably contained in a red sensitive emulsion layer and is preferably contained in that layer wherein the cyan coupler represented by formula (I) is contained. The amount of internal latent image-type emulsion is generally 10 to 100%, preferably 20 to 100%, based on the amount of the emulsion to be used.

The latent image ratio formed on the surface of this internal latent image-type emulsion is preferably from 0.1 to 0.8, more preferably from 0.2 to 0.7.

Further, preferably the silver halide color photographic material of the present invention is developed with a developer containing a silver halide solvent to form an image.

Preferably the silver halide color photographic material of the present invention is a silver halide color reversal photographic material.

V. Fifth embodiment

The fifth embodiment of the present invention will be described below in detail.

In formula (II), the alkyl group represented by $R_3$ or $R_4$ may be substituted, preferably has 4 or less carbon atoms, and particularly preferably is a methyl group or an ethyl group. The sulfoalkyl group represented by $R_2$ may be substituted, preferably has 5 or less carbon atoms, and particularly preferably is a 2-sulfoethyl group, a 3-sulfopropyl group, a 4-sulfobutyl group, or a 3-sulfobutyl group. Preferably r or s is 1, 2, or 3. The 5- or 6-membered heterocyclic nucleus represented by $Z^1$ or $Z^2$ includes a thiazole nucleus {a thiazole nucleus (e.g., thiazole, 4-methylthiazole, 4-phenylthiazole, 4,5-dimethylthiazole, and 4,5-diphenylthiazole), a benzothiazole nucleus (e.g., benzothiazole, 4-chlorobenzothiazole, 5-chlorobenzothiazole, 6-chlorobenzothiazole, 5-nitrobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-ethoxycarbonylbenzothiazole, 5-carboxybenzothiazole, 5-phenetylbenzothiazole, 5-fluorobenzothiazole, 5-chloro-6-methylbenzothiazole, 5,6-dimethylbenzothiazole, 5,6-dimethoxybenzothiazole, 5-hydroxy-6-methylbenzothiazole, tetrahydroxybenzothiazole, and 4-phenylbenzothiazole), a naphthothiazole nucleus (e.g., naphtho[2,1-d]thiazole, naphtho[1,2-d]thiazole, naphtho[2,3-d]thiazole, 5-methoxynaphtho[1,2-d]thiazole, 7-ethoxynaphtho[2,1-d]thiazole, 8-methoxynaphtho[1,2-d]thiazole, and 5-methoxynaphtho[2,3-d]thiazole)}, a thiazoline nucleus (e.g., thiazoline, 4-methylthiazoline, and 4-nitrothiazoline), an oxazole nucleus {an oxazole nucleus (e.g., oxazole,4-methyloxazole, 4-nitrooxazole, 5-methyloxazole, 4-phenyloxazole, 4,5-diphenyloxazole, and 4-ethyloxazole), a benzoxazole nucleus (e.g., benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-nitrobenzoxazole, 5-trifluoromethylbenzoxazole, 5-hydroxybenzoxazole, 5-carboxybenzoxazole, 6-methylbenzoxazole, 6-chlorobenzoxazole, 6-nitrobenzoxazole, 6-methoxybenzoxazole, 6-hydroxybenzoxazole, 5,6-dimethylbenzoxazole, 4,6-dimethylbenzoxazole, and 5-ethoxybenzoxazole), and a naphthoxazole nucleus (e.g., naphth[2,1-d]oxazole, naphth[1,2-d]oxazole, naphth[2,3-d]oxazole, and 5-nitronaphth[2,1-d]oxazole)}, an oxazoline nucleus (e.g.,4,4-dimethyloxazoline), a selenazole nucleus {a selenazole nucleus (e.g., 4-methylselenazole, 4-nitroselenazole, and 4-phenylselenazole), a benzoselenazole nucleus (e.g., benzoselenazole, 5-chlorobenzoselenazole, 5-nitrobenzoselenazole, 5-methoxybenzoselenazole, 5-hydroxybenzoselenazole, 6-nitrobenzoselenazole, 5-chloro-6-nitroselenazole, and 5,6-dimethylbenzoselenazole), and a naphthoselenazole nucleus (e.g., naphtho[2,1-d]selenazole and naphtho[1,2-d]selenazole)}, a selenazoline nucleus (e.g., selenazoline and 4-methylselenazoline), a tellurazole nucleus {a tellurazole nucleus (e.g., tellurazole, 4-methyltellurazole, and 4-phenyltellurazole), a benzotellurazole nucleus (e.g., benzotellurazole, 5-chlorobenzotellurazole, 5-methylbenzotellurazole, 5,6-dimethylbenzotellurazole, and 6-methoxybenzotellurazole), and a naphthotellurazole (e.g., naphtho[2,1-d]tellurazole and naphtho[1,2-d]tellurazole), a tellurazoline nucleus (e.g., tellurazoline and 4-methyltellurazoline), a 3,3-dialkylindolenine nucleus (e.g., 3,3-dimethylindolenine, 3,3-diethylindolenine, 3,3-dimethyl-5-cyanoindolenine,3,3-dimethyl-6-nitroindolenine, 3,3-dimethyl-5-nitroindolenine, 3,3-dimethyl-5-methoxyindolenine, 3,3,5-trimethylindolenine, and 3,3-dimethyl-5-chloroindolenine), an imidazole nucleus {an imidazole nucleus (e.g., 1-alkylimidazole, 1-alkyl-4-phenylimidazole, and 1-arylimidazole), a benzoimidazole nucleus (e.g., 1-alkylbenzoimidazole, 1-alkyl-5-chlorobenzoimidazole, 1-alkyl-5,6-dichlorobenzoimidazole, 1-alkyl-5-methoxybenzoimidazole, 1-alkyl-5-cyanobenzoimidazole, 1-alkyl-5-fluorobenzoimidazole, 1-alkyl-5-trifluoromethylbenzoimidazole, 1-alkyl-6-chloro-5-cyanobenzoimidazole, 1-alkyl-6-chloro-5-trifluorobenzoimidazole, 1-allyl-5,6-dichlorobenzoimidazole, 1-allyl-5-chlorobenzoimidazole, 1-arylbenzoimidazole, 1-aryl-5-chlorobenzoimidazole, 1-aryl-5,6-dichlorobenzoimidazole, 1-aryl-5-methoxybenzoimidazole, and 1-aryl-5-cyanobenzoimidazole), and a naphthoimidazole nucleus (e.g., alkylnaphtho[1,2-d]imidazole and 1-arylnaphtho[1,2-d]imidazole), wherein preferably the alkyl group is an unsubstituted alkyl group having 1 to 8 carbon atoms, such as methyl, ethyl, propyl, isopropyl, and butyl or a hydroxyalkyl group (e.g., 2-hydroxyethyl or 3-hydroxypropyl), with particular preference given to a methyl group and an ethyl group and the aryl group is phenyl, halogen-substituted (e.g., chlorine-substituted) phenyl, alkyl-substituted (e.g., methyl-substituted) phenyl, or an alkoxy-substituted (e.g., methoxy-substituted) phenyl}, a pyridine nucleus (e.g., 2-pyridine, 4-pyridine, 5-methyl-2-pyridine, and 3-methyl-4-pyridine), a quinoline nucleus {a quinoline nucleus (e.g., 2-quinoline, 3-methyl-2-quinoline, 5-ethyl-2-quinoline, 6-methyl-2-quinoline, 6-nitro-2-quinoline, 8-fluoro-2-quinoline, 6-methoxy-2-quinoline, 6-hydroxy-2-quinoline, 8-chloro-2-quinoline, 4-quinoline, 6-ethoxy-4-quinoline, 6-nitro-4-quinoline, 8-chloro-4-quinoline, 8-fluoro-4-quinoline, 8-methyl-4-quinoline, 8-methoxy-4-quinoline, 6-methyl-4-quinoline, 6-methoxy-4-quinoline, and 6-chloro-4-quinoline), and an isoquinoline nucleus (e.g., 6-nitro-1-isoquinoline, 3,4-dihydro-1-isoquinoline, and 6-nitro-3-isoquinoline)}, an imidazo[4,5-b]quinoxaline nucleus (e.g., 1,3-diethylimidazo[4,5-b]quinoxaline and 6-chloro-1,3-diallyimidazo[4,5-b]quinoxaline), an oxadiazole nucleus, a thiadiazole nucleus, a tetrazole nucleus, and a pyrimidine nucleus.

Among these heterocyclic nuclei, preferable ones are a thiazole nucleus, a benzothiazole nucleus, a naphthothiazole nucleus, an oxazole nucleus, a benzoxazole nucleus, a naphthoxazole nucleus, a benzoimidazole nucleus, a naphthoimidazole nucleus, and a quinoline nucleus, most preferably a benzothiazole nucleus, a benzoselenazole nucleus, or a quinoline nucleus.

The methine group represented by $L_1$, $L_2$, and $L_3$ may be substituted and the substituent includes an optionally substituted alkyl group (e.g., methyl, ethyl, and 2-carboxyethyl), an optionally substituted aryl group (e.g., phenyl and o-carboxyphenyl), a halogen atom (e.g., chlorine and bromine), an alkoxy group (e.g., methoxy and ethoxy), an alkylthio group (e.g., methylthio and ethylthio) and may also form a ring together with other methine group or together with an auxochrome. The anion represented by $X_3$ includes an inorganic or organic acid anion (e.g., chloride, bromide, iodide, p-toluenesulfonato, naphthalenedisulfonato, methanesulfonato, methylsulfato, ethylsulfato, and perchlorato).

Preferably, m is 0 or 1.

The amount of the compound represented by formula (II) to be added may be generally $4\times10^{-6}$ to $8\times10^{-3}$ mol, preferably $5\times10^{-5}$ to $2\times10^{-3}$ mol, per mol of silver halide.

Typical examples of the compound represented by formula (II) are shown below, but the scope of the present invention is not restricted only to them.

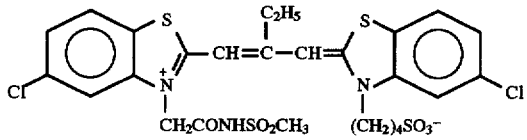
(II)-1
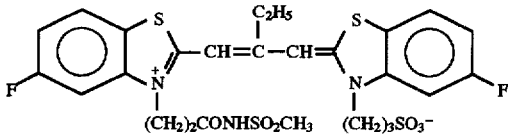
(II)-2
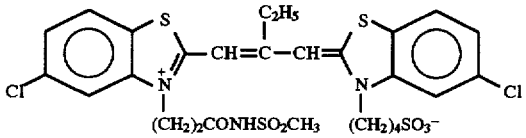
(II)-3
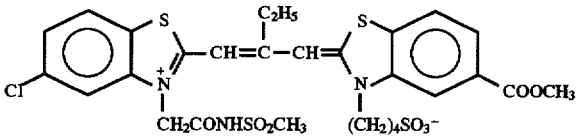
(II)-4
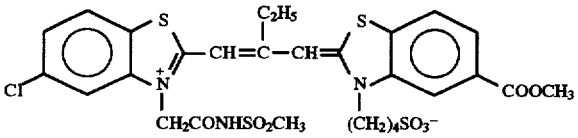
(II)-5
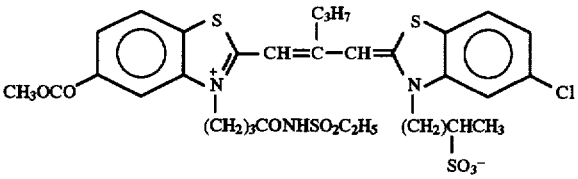
(II)-6
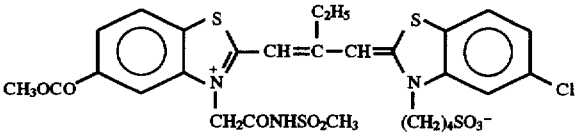
(II)-7
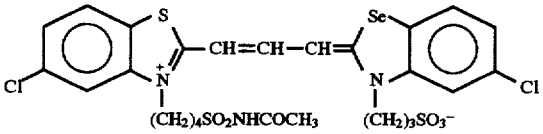
(II)-8
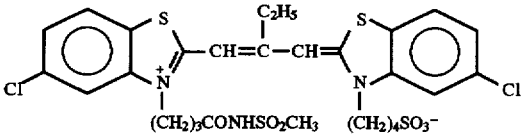
(II)-9
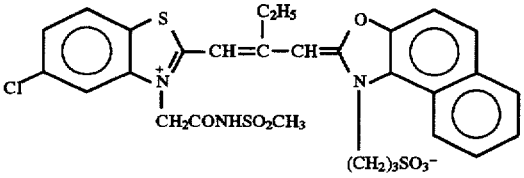
(II)-10

-continued
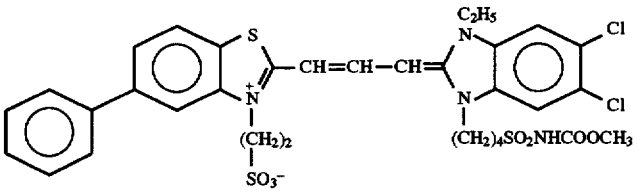
(II)-11
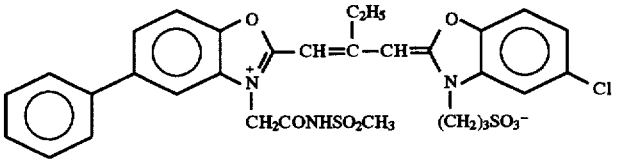
(II)-12
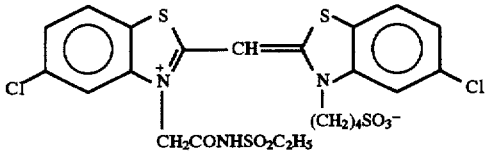
(II)-13
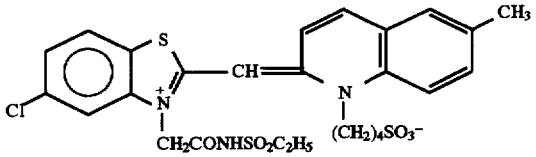
(II)-14
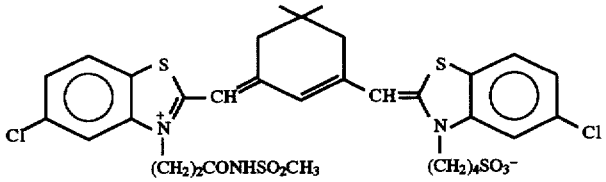
(II)-15
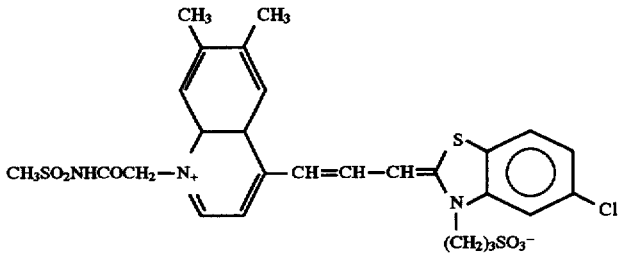
(II)-16
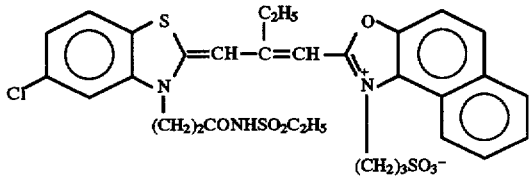
(II)-17
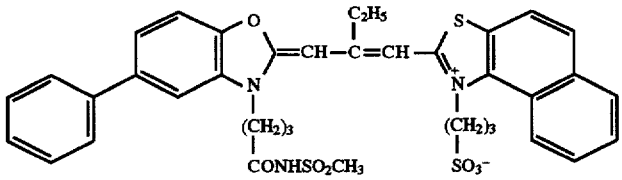
(II)-18

-continued
(II)-19
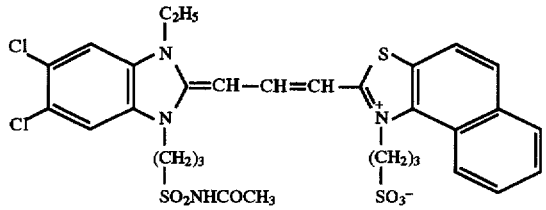
(II)-20
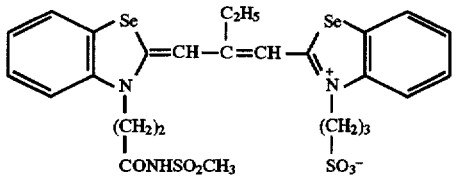
(II)-21
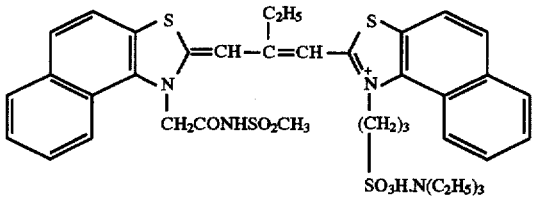
(II)-22
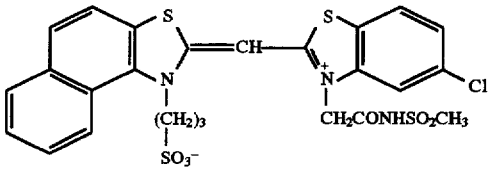
(II)-23
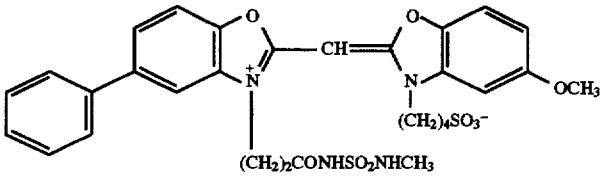
(II)-24
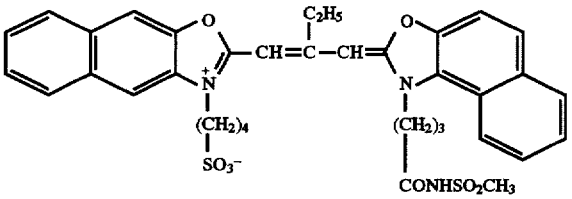
(II)-25
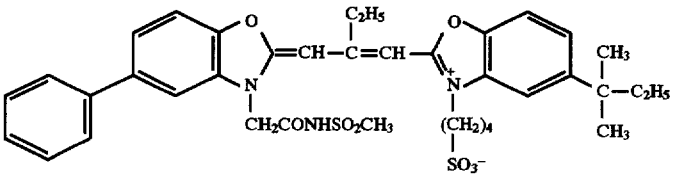
(II)-26
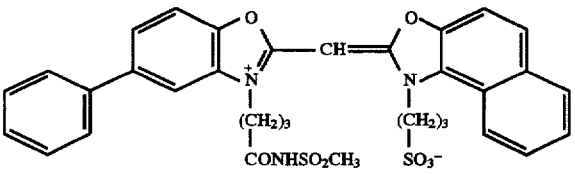

-continued

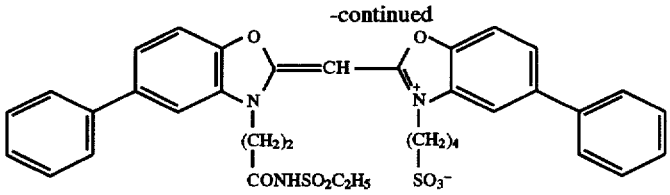

(II)-27

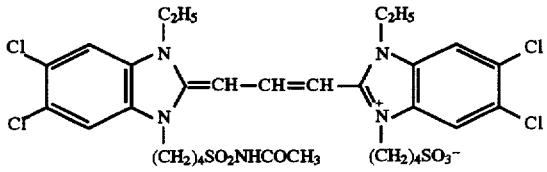

(II)-28

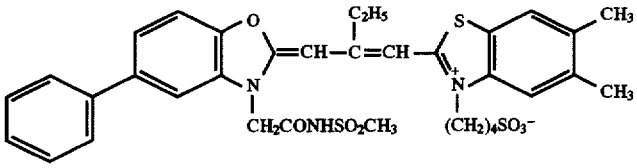

(II)-29

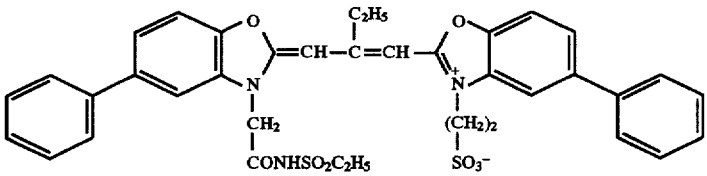

(II)-30

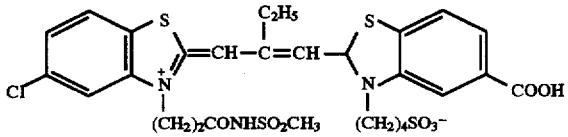

(II)-31

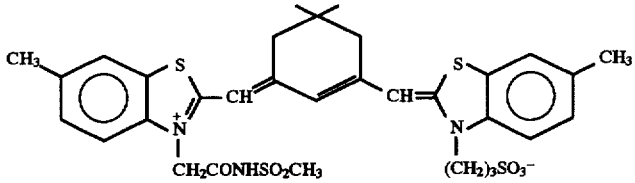

(II)-32

VX. Sixth embodiment

The sixth embodiment will be described below in detail.

In the sixth embodiment of the present invention, at least one of the color sensitive layers, preferably at least the green-sensitive layer comprises at least three separated layers made up of a low-sensitive silver halide emulsion layer, a medium-sensitive silver halide emulsion layer, and a high-sensitive silver halide emulsion layer that are coated in the stated order with said low-sensitive silver halide emulsion layer positioned nearer to the support. The separated layers are preferably consisting of three layers. Further, preferably each of the red-sensitive silver halide emulsion layer, the green-sensitive silver halide emulsion layer, and the blue-sensitive silver halide emulsion layer comprises three layers consisting of a low-sensitive silver halide emulsion layer, a medium-sensitive silver halide emulsion layer, and a high-sensitive silver halide emulsion layer.

Further, the sensitivity difference between the low sensitivity, the medium sensitivity, and the high sensitivity of the emulsions of the separated layers is 1.1 times or more, that is, one's sensitivity is 1.1 times as high as the other's. Preferably the difference of the sensitivity between the low-sensitive silver halide emulsion layer and the medium-sensitive silver halide emulsion layer and between the medium-sensitive silver halide emulsion layer and the high-sensitive silver halide emulsion layer is 1.5 times or more but 10 times or less, that is, one's sensitivity is as high as 1.5 times the other's or more but 10 times as high as the other's or less.

VII. Seventh embodiment

In the seventh embodiment of the present invention, at least one of the red-sensitive silver halide emulsion layer, the green-sensitive silver halide emulsion layer, and the blue-sensitive silver halide emulsion layer comprises at least two silver halide emulsion separate layers, preferably three silver halide emulsion separate layers, containing silver iodobromide emulsions and different in sensitivity. Preferably, the average iodine content of the emulsions of the highest sensitive layers is 1 to 4 mol % and the average iodine content of the emulsions of the other layers is 1 mol % greater than or more greater than the average iodine content of the emulsions of the highest sensitive layers.

In the seventh embodiment, preferably, each of the emulsions of all the emulsion layers comprises silver bromoiodide grains having an iodine content of 5 mol % or less. Preferably, at least one emulsion layer contains silver bromoiodide grains wherein the relative standard deviation of the iodine distribution between the grains is 20% or less and there are high iodine phases in the inside.

Further, in the present embodiment, preferably all the emulsion layers are applied simultaneously at a time.

Further, preferably, the silver halide color photographic material of the present invention is for color reversal development processing.

Further, in the present invention, a preferable silver halide to be contained in the silver halide emulsion layers is silver bromoiodide, silver chloroiodide, or silver bromochloroiodide containing 30 mol % or less of silver iodide.

In the present invention, although the cyan coupler represented by formula (I) is contained in the red photosensitive silver halide emulsion layer, preferably the cyan coupler represented by formula (I) is contained in each of the low-sensitive red photosensitive emulsion layer, the medium-sensitive red photosensitive emulsion layer, and the high-sensitive red photosensitive emulsion layer.

In the present invention, the total coating amount of the silver halide emulsions is preferably 1 $g/m^2$ or more but 8 $g/m^2$ or less, more preferably 2 $g/m^2$ or more but 6 $g/m^2$ or less, and further more preferably 2 $g/m^2$ or more but 4.5 $g/m^2$ or less, in terms of silver.

The ratio of the coating amounts of silver of the separate layers having the same color sensitivity and different in sensitivity is desirably such that, assuming the total amount of silver of said color sensitive layer to be 100%, the high-sensitive layer is 15 to 40%, the medium-sensitive layer is 20 to 50%, the low-sensitive layer is 20 to 50%. Preferably, the coating amount of silver of the high-sensitive layer is smaller than those of the medium-sensitive layer and the low-sensitive layer.

VIII. Eighth embodiment and Ninth embodiment

Now the eighth embodiment of the present invention will be described below in detail.

The spectral sensitivity distribution SB (λ) is obtained by passing white light of 4800 K through a spectroscope to carry out wedge exposure and carrying out sensitometry at respective wavelengths to find the negative logarithm of the exposure amount (lux.sec) that gives a yellow density of 1.4. The spectral sensitivity distribution SG (λ) is obtained by passing white light of 4800 K through a spectroscope to carry out wedge exposure and carrying out sensitometry at respective wavelengths to find the negative logarithm of the exposure amount (lux.sec) that gives a magenta density of 1.4. The spectral sensitivity distribution SR (λ) is obtained by passing white light of 4800 K through a spectroscope to carry out wedge exposure and carrying out sensitometry at respective wavelengths to find the negative logarithm of the exposure amount (lux.sec) that gives a cyan density of 1.4.

With respect to λBmax, λGmax, λRmax, SG (λmax)–SG (470), and SR (λRmax)–SR (570), 410 nm≦λBmax≦460 nm, 530 nm≦λGmax≦575 nm, 620 nm≦λRmax≦640 nm, 1.55≦SG (λGmax)≦SG (470)≦1.65, and 1.00≦SR (λRmax)–SR (570)≦1.10 are preferable alone or in combination.

In the present invention, the spectral sensitivity distributions of the blue-sensitive layer, the green-sensitive layer, and the red-sensitive layer can be obtained, for example, by using a suitable combination of spectral sensitizing dyes having the structural formulas given below:

Spectral sensitizing dye For the blue-sensitive silver halide emulsion layer:

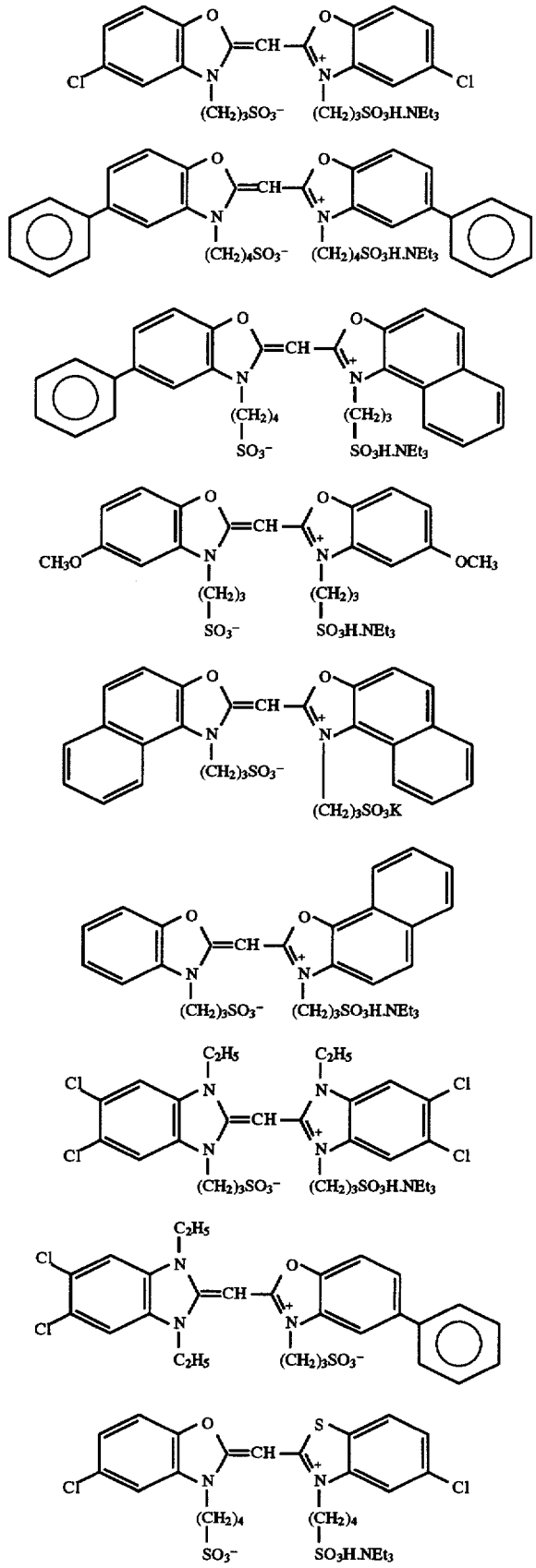

-continued
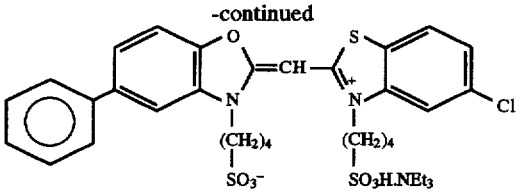
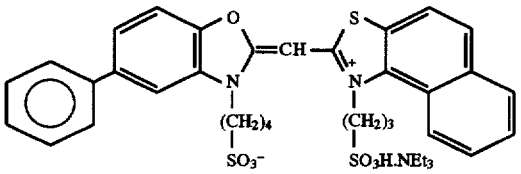
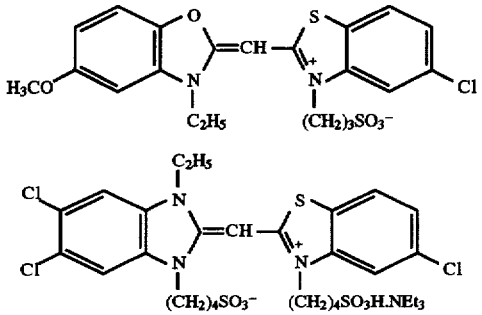
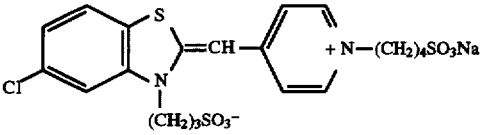
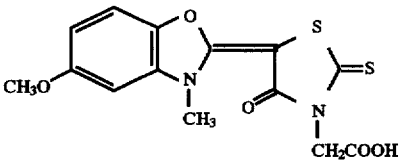
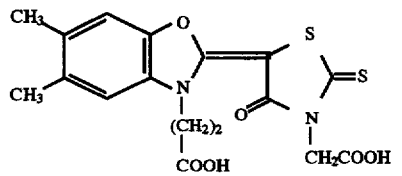
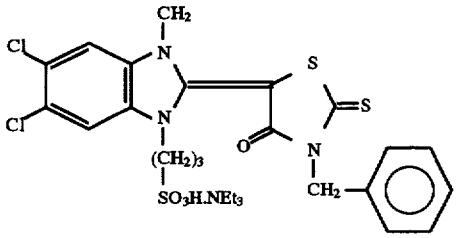
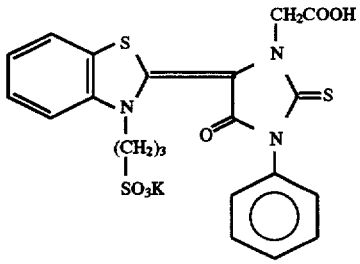
-continued
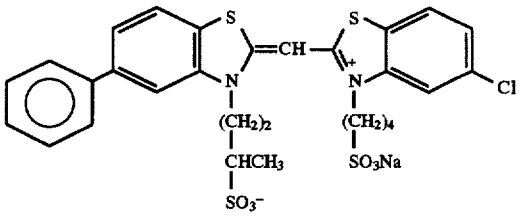
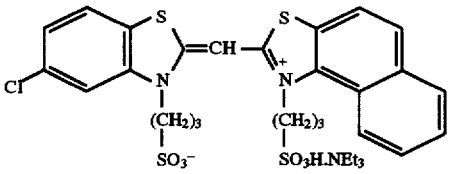
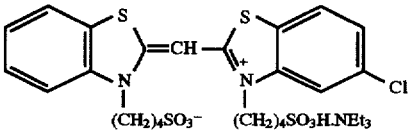
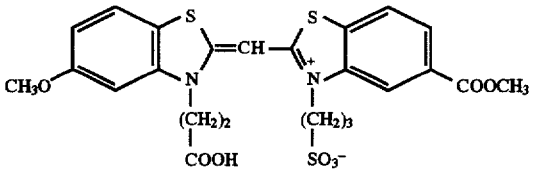
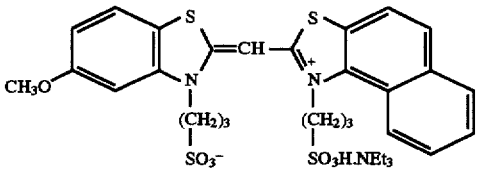
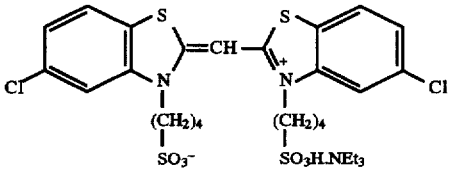
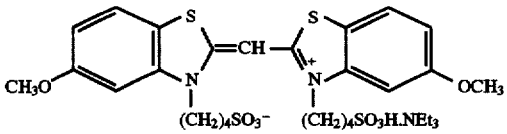
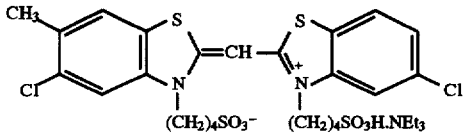
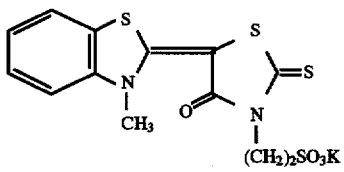
Spectral sensitizing dye For the green-sensitive silver halide emulsion layer:

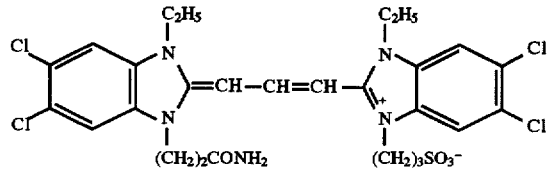
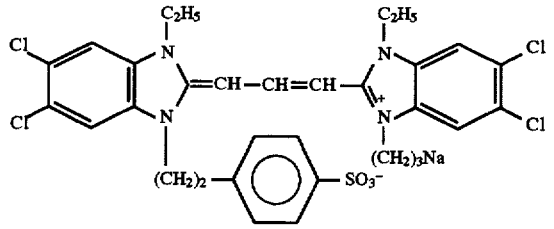
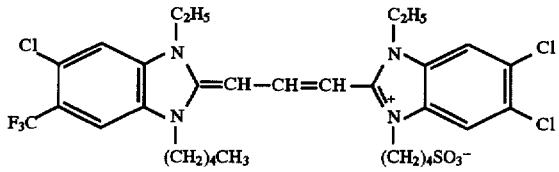
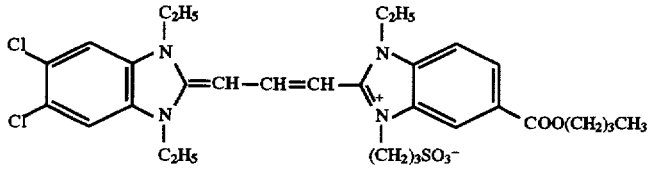
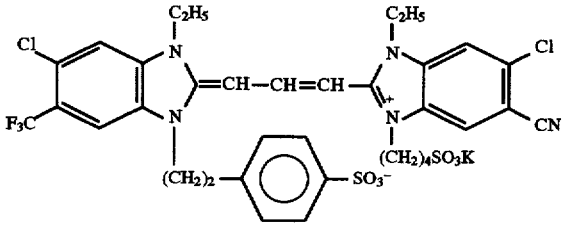
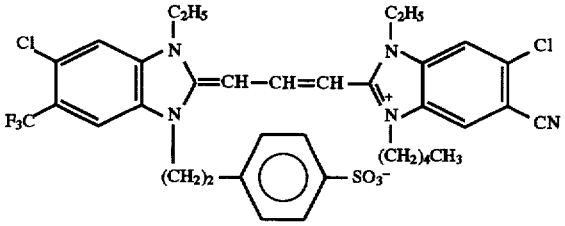
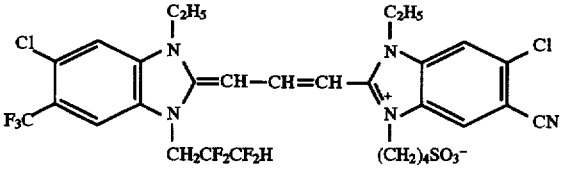
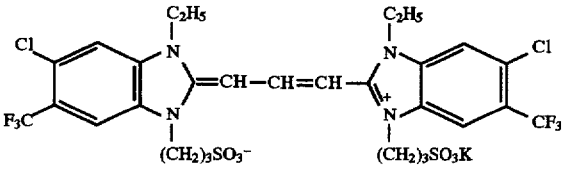

-continued
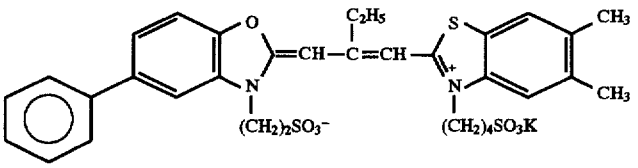
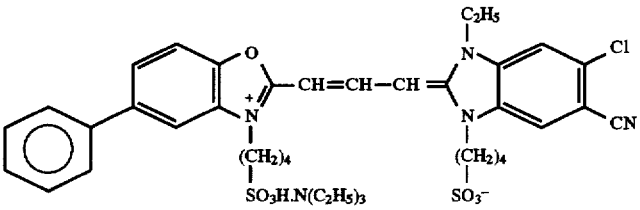
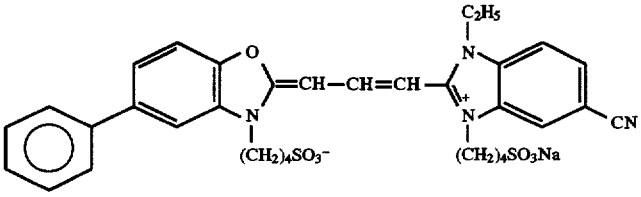
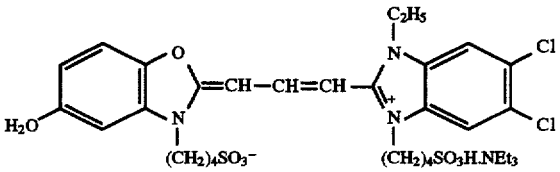
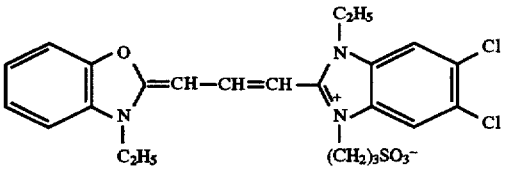
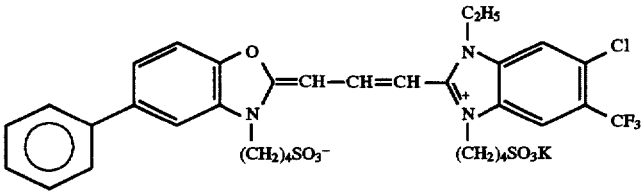
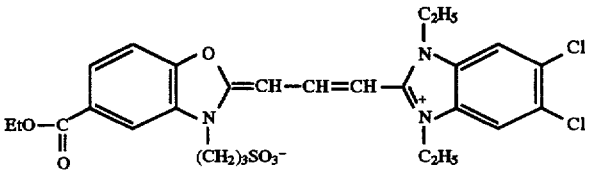
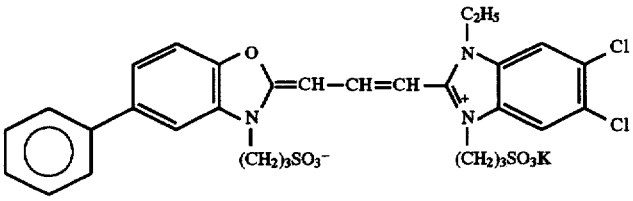

-continued
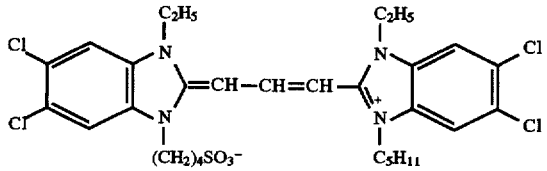
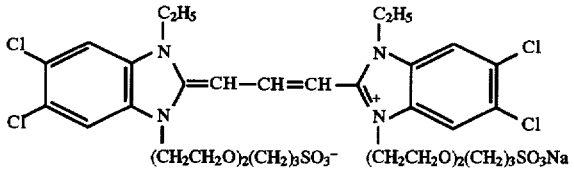
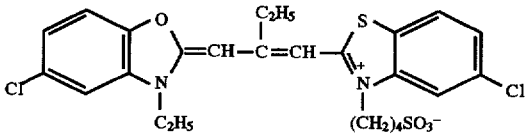
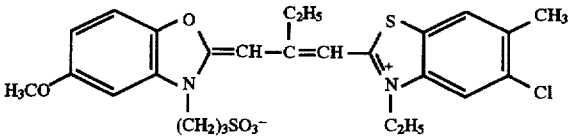
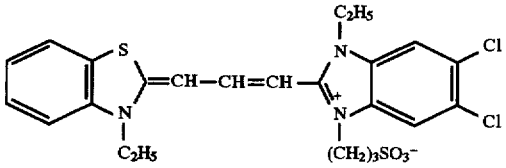
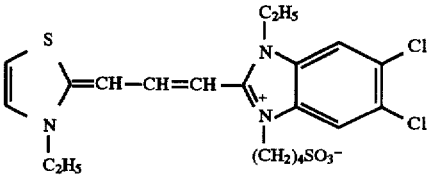
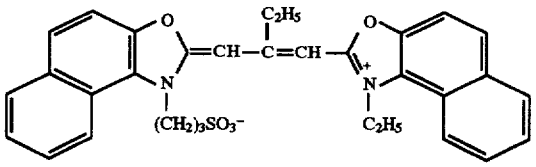
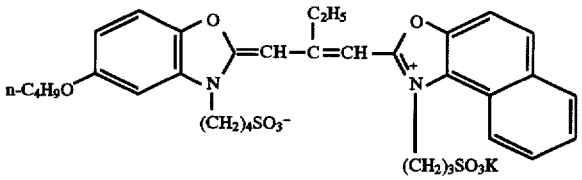
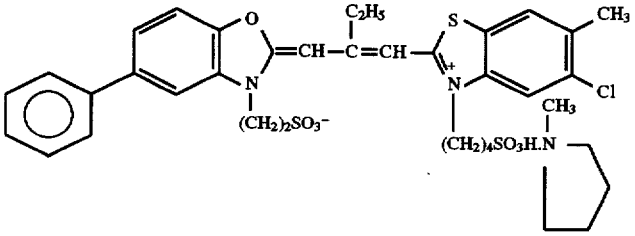

-continued
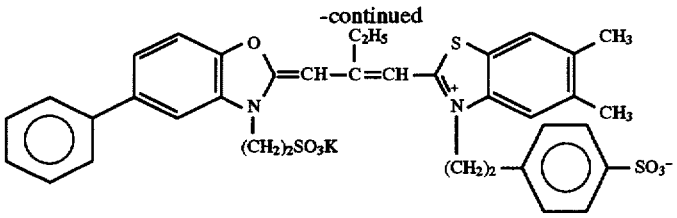
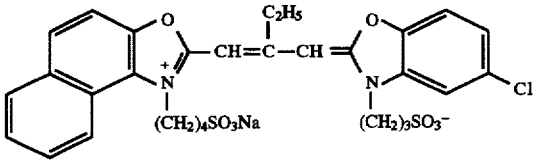
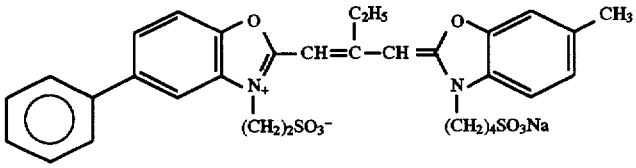
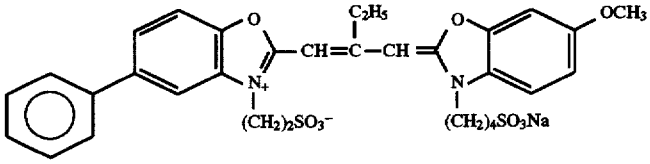
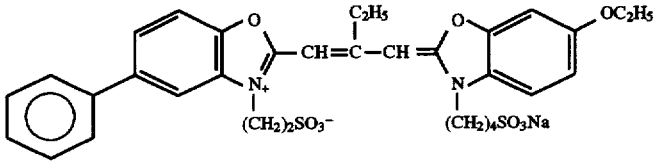
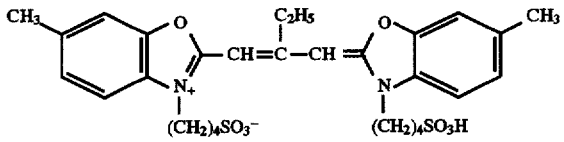
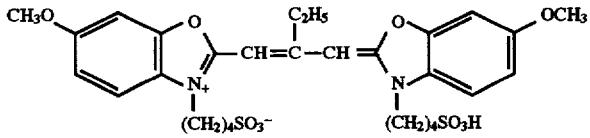
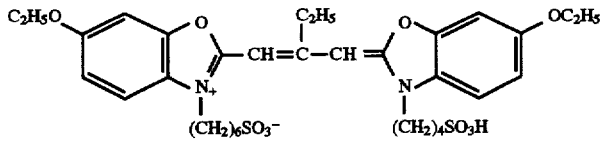
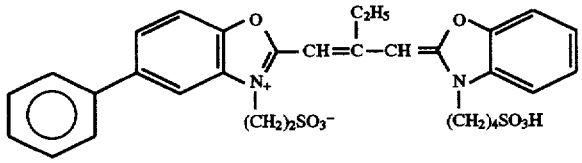
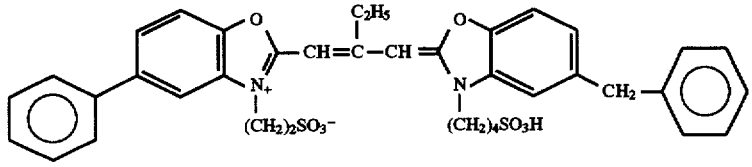

-continued
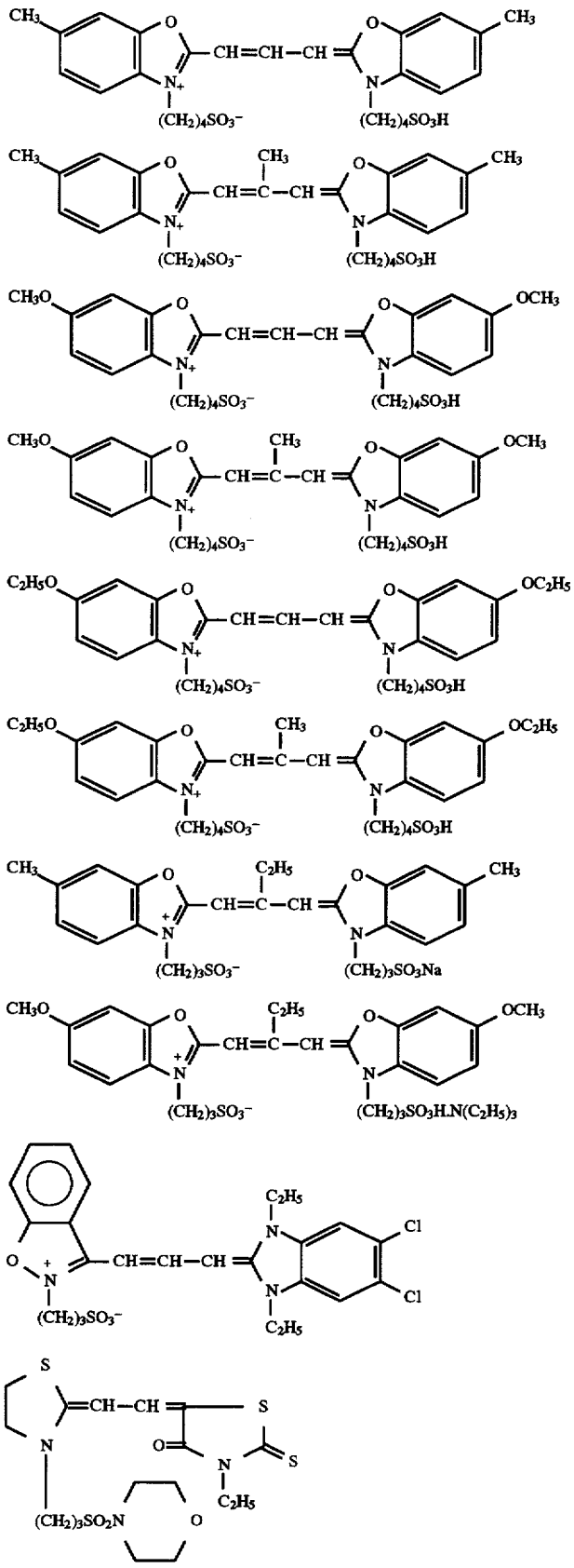

-continued
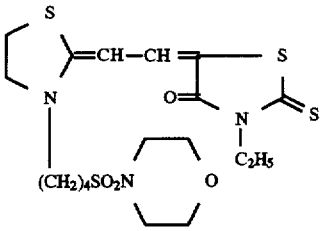
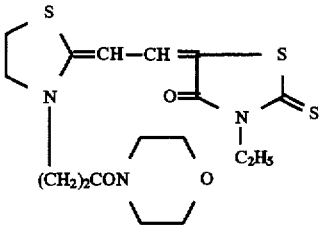
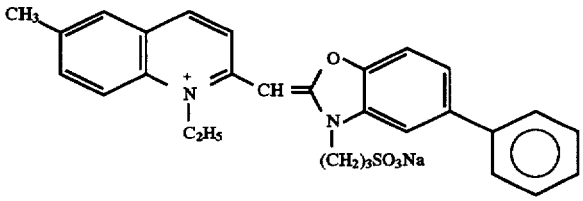
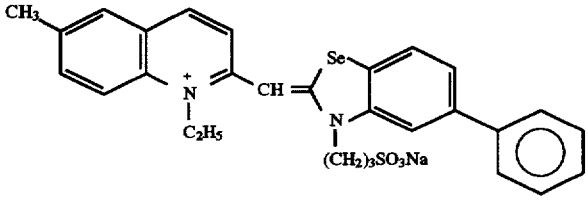
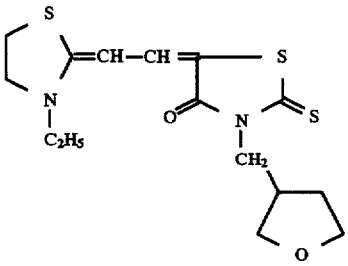
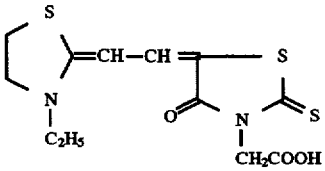
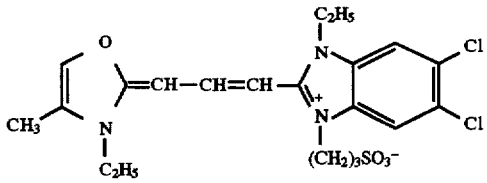

-continued
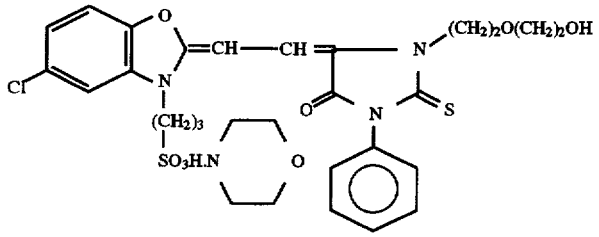
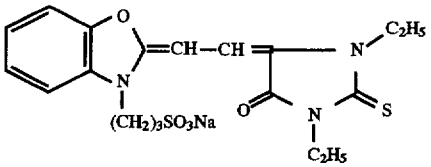
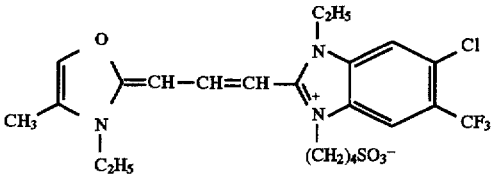
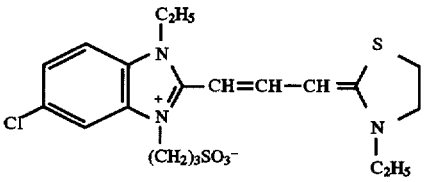
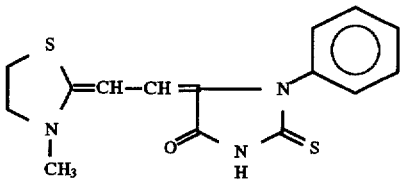
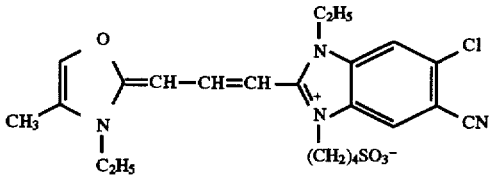
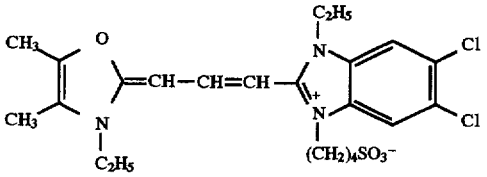
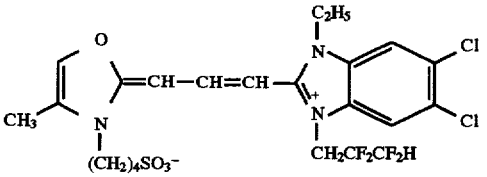

-continued
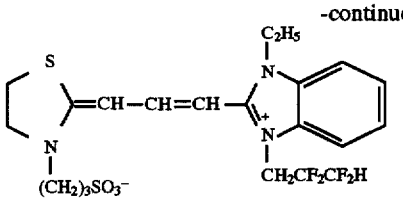
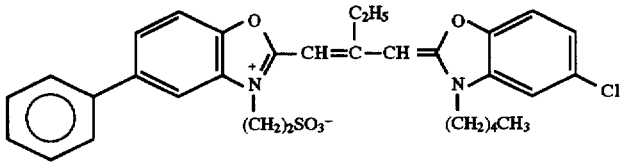
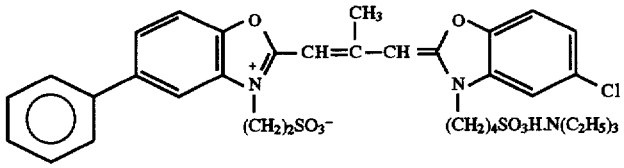
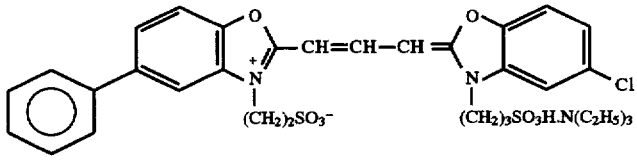
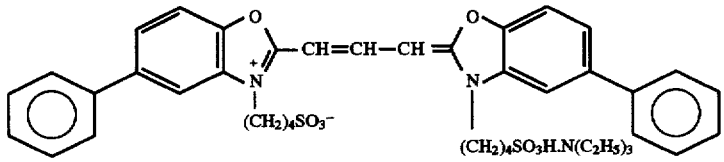
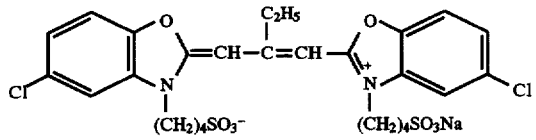
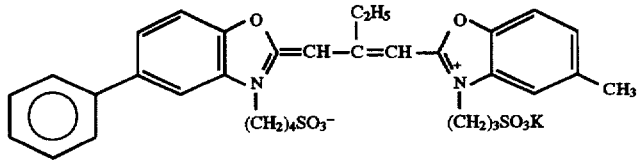
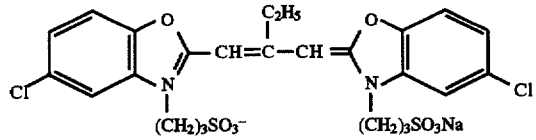
Spectral sensitizing dye for the red-sensitive silver halide emulsion layer:
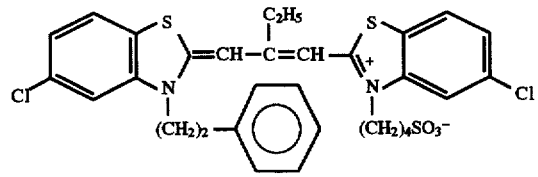

-continued
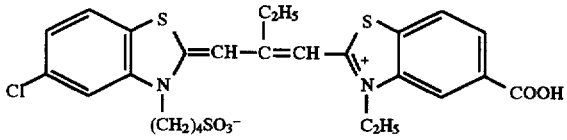
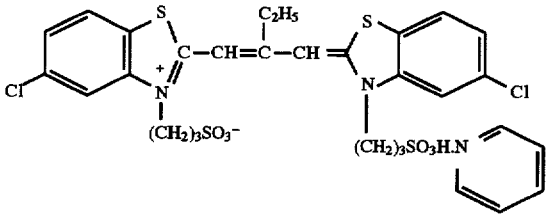
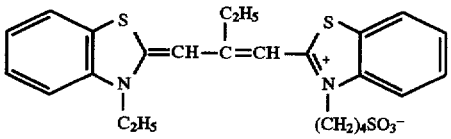
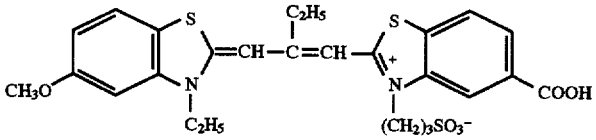
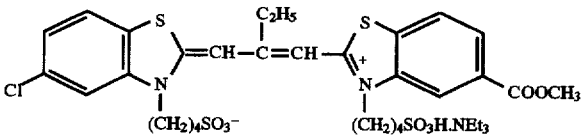
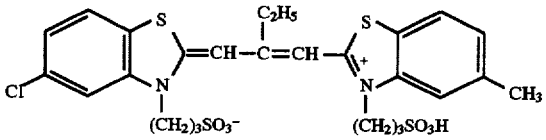
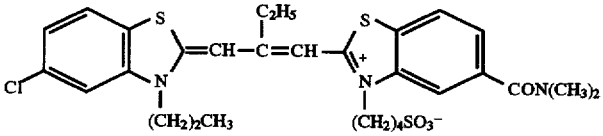
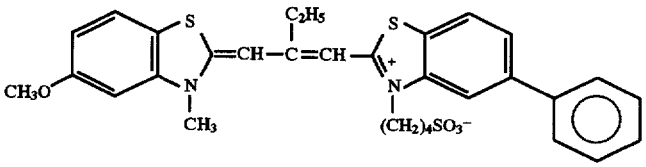
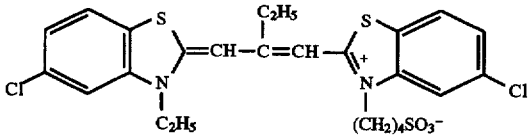
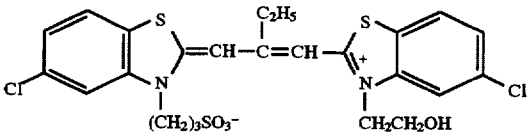

-continued
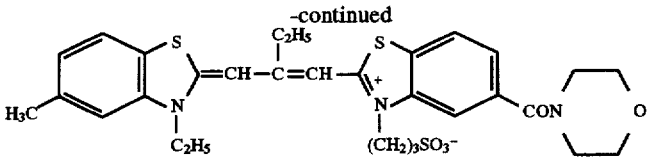
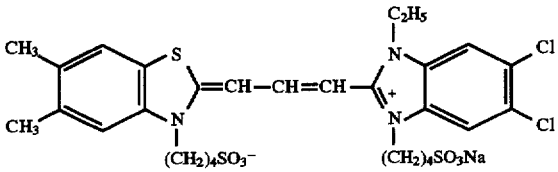
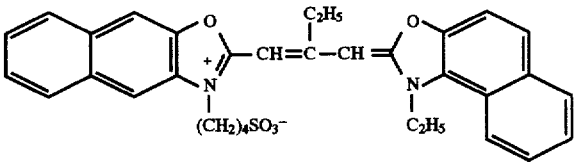
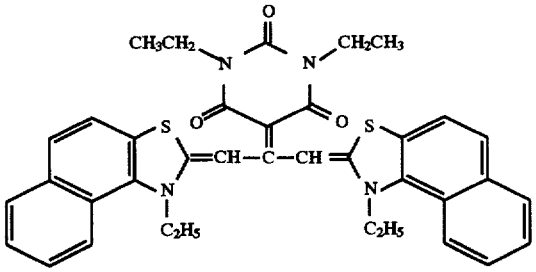
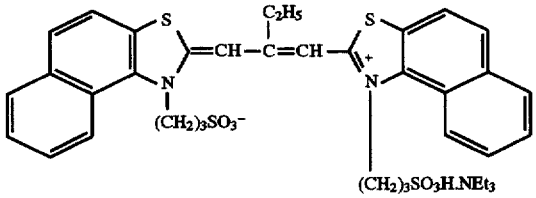
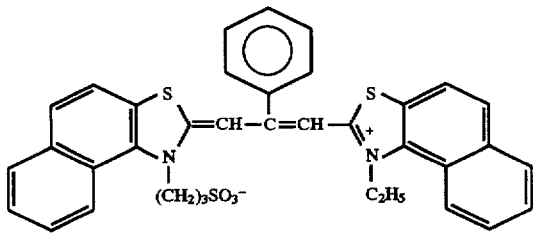
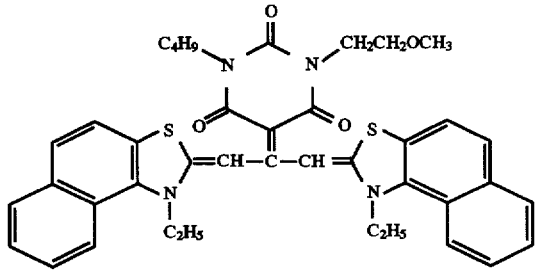
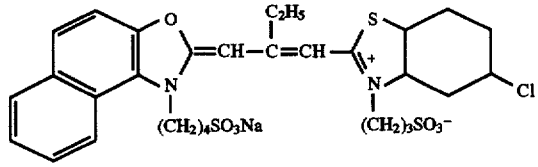

-continued
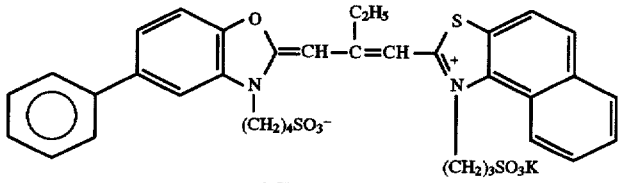
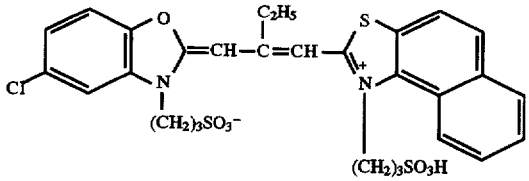
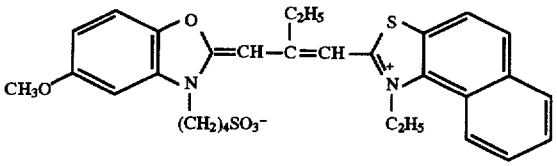
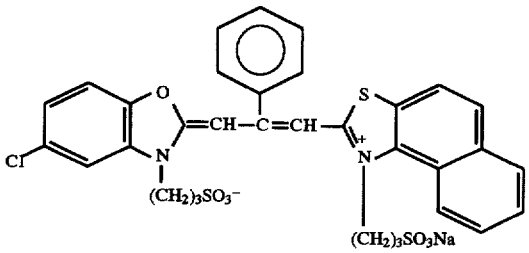
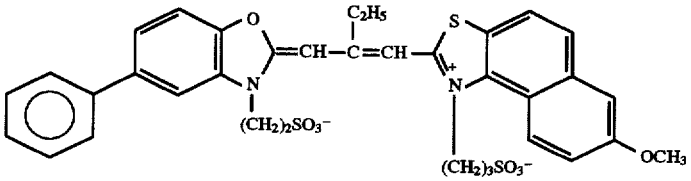
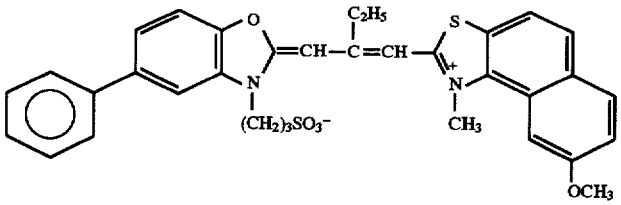
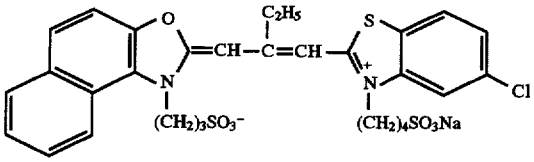
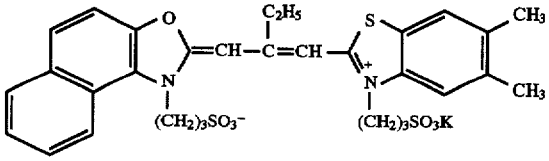

-continued
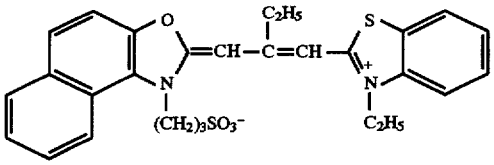
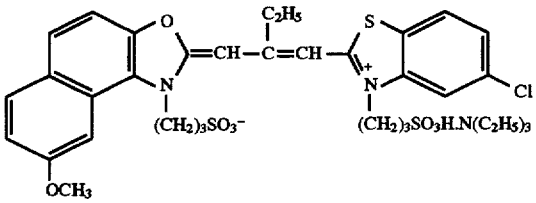
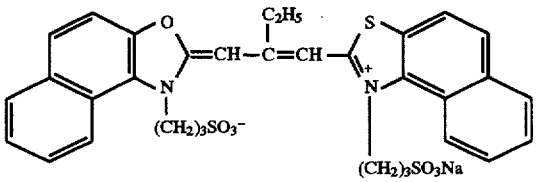
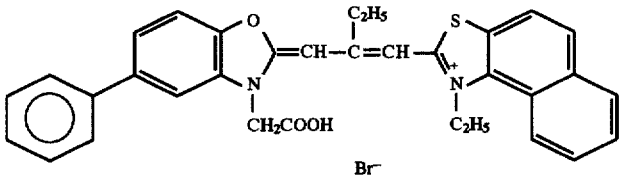
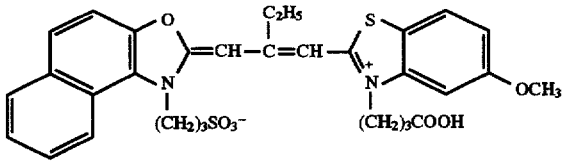
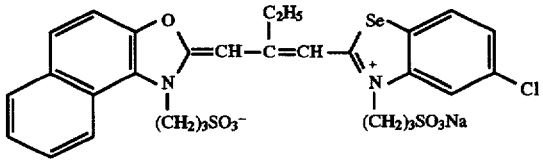
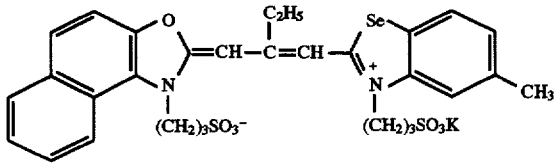
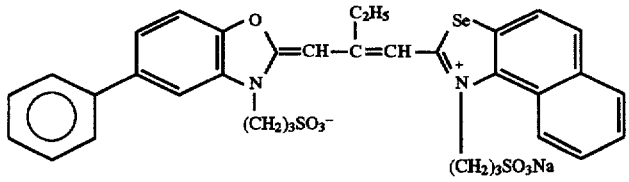

-continued

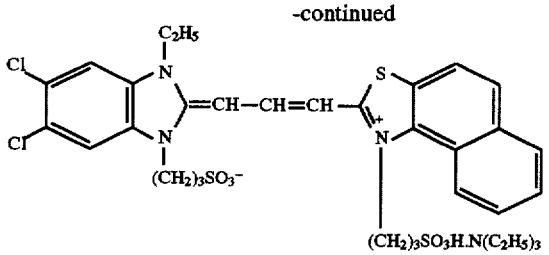

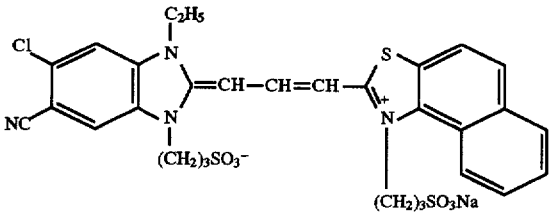

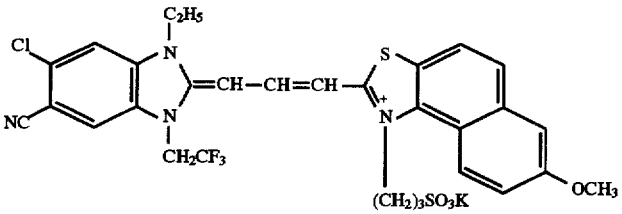

VIII. Eighth and Ninth embodiments

Now the compound represented by formula (III) used in the eighth embodiment and the ninth embodiment of the present invention will be described in detail.

$$A(L)_n—(G)_{m'}—(\text{Time})_t—X^1 \qquad \text{formula (III)}$$

wherein A represents a redox (oxidation-reduction) mother nucleus or its precursor, which is an atomic group that allows $-(\text{Time})_t—X^1$ to be released only upon being oxidized during the photographic development processing. Time represents a group that will release $X^1$ after being released from the oxidized product of A, $X^1$ represents a development inhibitor, L represents a bivalent linking group, G represents an acidic group, and n, m', and t are each 0 or 1.

Formula (III) will now be described in more detail.

As the redox mother nucleus represented by A, those which obey the Kendall-Pelz rule can be mentioned, and, for example, hydroquinone, catechol, p-aminophenol, o-aminophenol, 1,2-naphthalenediol, 1,4-naphthalenediol, 1,6-naphthalenediol, 1,2-aminonaphthol, 1,4-aminonaphthol, 1,6-aminonaphthol, gallates, gallic amide, hydrazine, hydroxylamine, pyrazolidone, and reductone can be mentioned.

The amino group possessed by these redox mother nucleuses is preferably substituted by a sulfonyl group having 1 to 25 carbon atoms or an acyl group having 1 to 25 carbon atoms. As the sulfonyl group, a substituted or unsubstituted aliphatic sulfonyl group or aromatic sulfonyl group can be mentioned. As the acyl group, a substituted or unsubstituted aliphatic acyl group or aromatic acyl group can be mentioned. The hydroxyl group or amino group that forms the redox mother nucleus of A may be protected by a protecting group whose protecting function can be removed at the time of development processing. Examples of the protecting group are an acyl group, an alkoxycarbonyl group, and a carbamoyl group which have 1 to 25 carbon atoms as well as protecting groups described in JP-A Nos. 197037/1984 and 201057/1984. Further, if possible, the protecting group may bond to the substituent of A described below to form a 5-, 6-, or 7-membered ring.

The redox mother nucleus represented by A may be substituted by a substituent at a suitable position. Examples of that substituent are those having 25 or less carbon atoms, such as an alkyl group, an aryl group, an arylthio group, an alkoxy group, an aryloxy group, an amino group, an amido group, a sulfonamido group, an alkoxycarbonylamino group, a ureido group, a carbamoyl group, an alkoxycarbonyl group, a sulfamoyl group, a sulfonyl group, a cyano group, a halogen atom, an acyl group, a carboxyl group, a sulfo group, a nitro group, a heterocyclic residue, and $—(L)_n—(G)_{m'}—(\text{Time})_t—X^1$, which may be further substituted by those substituents mentioned above. If possible, these substituents may bond together to form a saturated or unsaturated carbon ring or saturated or unsaturated heterocyclic ring.

As preferable examples of A, hydroquinone, catechol, p-aminophenol, o-aminophenol, 1,4-naphthalenediol, 1,4-aminonaphthol, gallates, gallic amide, and hydrazine can be mentioned, with more preference given to hydroquinone, catechol, p-aminophenol, o-aminophenol, and hydrazine, most preferably hydroquinone and hydrazine.

L represents a bivalent linking group and preferable examples are alkylene, alkenylene, arylene, oxyalkylene, oxyarylene, aminoalkyleneoxy, aminoalkenyleneoxy, aminoaryleneoxy, and an oxygen atom.

G represents an acidic group and preferably includes $$-\overset{O}{\overset{\|}{C}}-,\quad -\overset{O}{\overset{\|}{C}}-\overset{O}{\overset{\|}{C}}-,\quad -\overset{S}{\overset{\|}{C}}-,\quad -SO-,\quad -SO_2-,$$

-continued

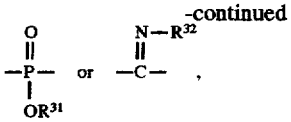

wherein $R^{31}$ represents an alkyl group, an aryl group, or a heterocyclic ring and $R^{32}$ represents a hydrogen atom or has the same meaning as that of $R^{31}$.

Preferably, G represents

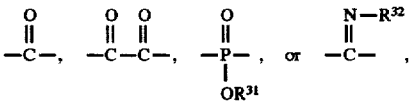

more preferably —CO— or —COCO—, and most preferably —CO—.

n and m' are each 0 or 1 and preferable one is dependent on the type of A. For example, when A is hydroquinone, catechol, aminophenol, naphthalenediol, aminonaphthol, or a gallic acid, n=0 is preferable, and more preferably n=m'=0. When A is hydrazine or hydroxylamine, n=0 and m'=1 are preferable, and when A is pyrazolidone, n=m'=1 is preferable.

$-(Time)_t-X^1$ is a group that will be released as $-(Time)_t-X^1$ only when the redox mother nucleus represented by A in formula (III) undergoes a cross oxidation reaction at the time of development processing to be converted to the oxidized product.

Preferably Time is linked to G through a sulfur atom, a nitrogen atom, an oxygen atom, or a selenium atom.

Time represents a group capable of releasing $X^1$ further thereafter, and Time may have a timing-adjusting function, and may be a coupler that will release $X^1$ upon reaction with the oxidized product of a developing agent or may be a redox group.

In the case wherein Time is a group having a timing-adjusting function, examples are those described in U.S. Pat. Nos. 4,248,962 and 4,409,323, British Patent No. 2,096,783, U.S. Pat. No. 4,146,396, and JP-A Nos. 146,828/1976 and 56,837/1982. Time may be a combination of two or more selected from those described in them.

Preferable examples of the timing-adjusting group include:

(1) Groups that use a cleavage reaction of hemi-acetals.

Examples are groups that are described in, for example U.S. Pat. No. 4,146,396 and JP-A Nos. 249148/1985 and 249149/1985, and are represented by the following formula. Herein a mark * denotes the position where it bonds to the left side in formula (III) and a mark ** denotes the position where it bonds to the right side in formula (III).

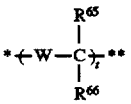

formula (T-1)

wherein W represents an oxygen atom, a sulfur atom, or a group $—NR_{67}—$, $R_{65}$ and $R_{66}$ each represent a hydrogen atom or a substituent, $R_{67}$ represents a substituent, t is 1 or 2, and when t is 2, two $—W—CR_{65}R_{66}—$ groups may be the same or different. When $R_{65}$ and $R_{66}$ each represent a substituent, and typical examples of $R_{67}$ each include a group $R_{69}$, a group $R_{69}CO—$, a group $R_{69}SO_2—$, a group $R_{69}R_{70}NCO—$ or a group $R_{69}R_{70}NSO_2—$ wherein $R_{69}$ represents an aliphatic group, an aromatic group, or a heterocyclic group, $R_{70}$ represents an aliphatic group, an aromatic group, a heterocyclic group, or a hydrogen atom, $R_{65}$, $R_{66}$, and $R_{67}$ each may represent a bivalent group to bond together to form a ring structure.

(2) Groups that cause a cleavage reaction using an intramolecular nucleophilic substitution reaction.

Examples are timing groups described in U.S. Pat. No. 4,248,962 and can be represented by the following formula

*—Nu—Link—E—** formula (T-2)

wherein a mark * denotes the position where it bond to the left side in formula (III), a mark  denotes the position where it bond to the right side in formula (III), Nu represents a nucleophilic group, such as an oxygen atom and a sulfur atom, E represents an electrophilic group that can cleave the bond to the mark  when attacked nucleophilically by Nu, and Link represents a linking group for relating sterically Nu to E so that Nu and E can undergo an intramolecular nucleophilic substitution reaction.

(3) Groups that cause a cleavage reaction using an electron transfer reaction along a conjugated system.

Examples are described in U.S. Pat. Nos. 4,409,323 and 4,421,845 and are groups represented by the following formula:

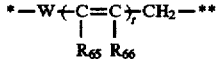

formula (T-3)

wherein a mark *, a mark **, W, $R_{65}$, $R_{66}$, and t have the same meanings as those described for (T-1).

(4) Groups that use a cleavage reaction by hydrolysis of esters.

Examples are linking groups described in West German Published Patent No. 2,626,315 and include the following groups.

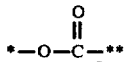

formula (T-4)

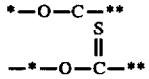

formula (T-5)

wherein a mark * and a mark ** have the same meanings as those described for formula (T-1).

(5) Groups that use a cleavage reaction of iminoketals.

Examples are linking groups described in U.S. Pat. No. 4,546,073 and are represented by the following formula:

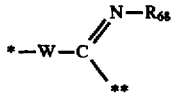

formula (T-6)

wherein a mark *, a mark **, and W have the same meanings as those described for formula (T-1) and $R_{68}$ has the same meaning as that of $R_{67}$.

Examples wherein the group represented by D is a coupler or a redox group are the following.

If the coupler is, for example, a phenol coupler, examples of the coupler are those wherein the coupler bonds to G of formula (III) at the oxygen atom of the hydroxyl group from which the hydrogen atom is excluded. If the coupler is a 5-pyrazolone coupler, examples of the coupler are those wherein the coupler bonds to G of formula (III) at the oxygen atom of the hydroxyl group, from which the hydrogen atom is excluded, of the tautomerized 5-hydroxypyrazole form.

These function as couplers appear only when there are released from G, and these react with the oxidized product of a developing agent to release X bonded to the coupling site.

Preferable examples in the case wherein Time is a coupler are those having the following formulas (C-1) to (C-4):

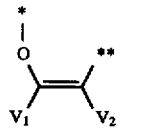

formula (C-1)

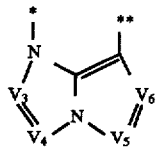

formula (C-2)

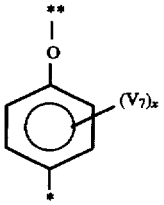

formula (C-3)

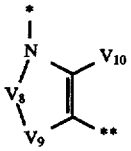

formula (C-4)

wherein $V_1$ and $V_2$ each represent a substituent, $V_3$, $V_4$, $V_5$, and $V_6$ each represent a nitrogen atom or a substituted or unsubstituted methine group, $V_7$ represents a substituent, x is an integer of 0 to 4, when x is 2, 3, or 4, the $V_7$ groups may be the same or different, two $V_7$ may bond together to form a cyclic structure, $V_8$ represents a group —CO—, a group —$SO_2$—, an oxygen atom, or a substituted imino group, $V_9$ represents a group of non-metallic atoms to form a 5- to 8-membered ring together with

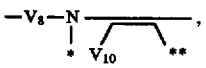

and $V_{10}$ represents a hydrogen atom or a substituent.

In formula (III), if the group represented by Time is a redox group, preferably the redox group is represented by the following formula (R-1):

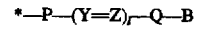

formula (R-1)

wherein P and Q each independently represent an oxygen atom or a substituted or unsubstituted imino group, at least one of Y and Z represents a methine group having X as a substituent, other Y's and Z's each represent a substituted or unsubstituted methine group or a nitrogen atom, 1 is an integer of 1 to 3, Y and Z may be the same or different, B represents a hydrogen atom or a group that can be removed by an alkali, and any two substituents of P, Y, Z, Q, and B may be bivalent groups to bond together to form a ring structure. For example, $(Y{=}Z)_l$ may form a benzene ring or a pyridine ring.

When P and Q each represent a substituted or unsubstituted imino group, the imino group is preferably a sulfonyl group-substituted or acyl group-substituted imino group.

In this case, P and Q are represented respectively as follows:

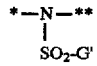

formula (N-1)

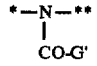

formula (N-2)

wherein a mark * denotes the position where it bonds to B and a mark ** denotes the position where it bonds to one of the free valences of —$(Y{=}Z)_1$—.

The group represented by G' in the formula represents an aliphatic group, an aromatic group, or a heterocyclic group.

Among the groups represented by formula (R-1), particularly preferable groups are those represented by the following formula (R-2) or (R-3):

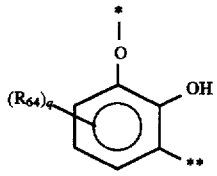

formula (R-2)

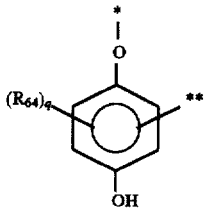

formula (R-3)

wherein a mark * denotes the position where it bonds to G of formula (III) and a mark ** denotes the position where it bonds to X.

$R_{64}$ represents a substituent, q is an integer of 0 to 3, when q is 2 or 3, the two or three $R_{64}$ may be the same or different, and when the two $R_{64}$ are substituents on adjacent carbon atoms, they become bivalent groups to bond together to form a ring structure.

$X^1$ means a development inhibitor. Preferable examples of $X^1$ include compounds having a mercapto group bonded to a heterocycle represented by formula (X-1) and heterocyclic compounds capable of producing iminosilver represented by formula (X-2):

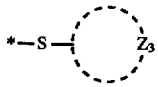

formula (X-1)

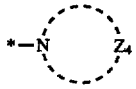

formula (X-2)

wherein $Z_3$ represents a group of nonmetallic atoms required to form a monocyclic or condensed heterocyclic ring, $Z_4$ represents a group of nonmetallic atoms required to form together with the N a monocyclic or condensed heterocyclic ring, which these heterocyclic rings each may have a substituent, and a mark * denotes the position where it bonds to Time. More preferably, the heterocyclic rings formed by $Z_3$ and $Z_4$ are 5- to 8-membered heterocyclic ring, most preferably 5- or 6-membered heterocyclic ring, having at least one of nitrogen, oxygen, sulfur, and selenium as a heteroatom.

As examples of the heterocyclic ring represented by $Z_3$, azoles (e.g., tetrazole, 1,2,4-triazole, 1,2,3-triazole, 1,3,4-thiadiazole, 1,3,4-oxadiazole, 1,3-thiazole, 1,3-oxazole, imidazole, benzothiazole, benzoxazole, benzimidazole, pyrrole, pyrazole, and indazole), azaindenes (e.g., tetrazaindene, pentazaindene, and triazaindene), and azines (e.g., pyrimidine, triazine, pyrazine, and pyridazine) can be mentioned.

As examples of the heterocyclic ring represented by $Z_4$, triazoles (e.g., 1,2,4-triazole, benzotriazole, and 1,2,3-triazole), indazole, benzimidazole, azaindenes (e.g., tetrazaindene and pentazaindene), and tetrazole can be mentioned.

Preferable substituents possessed by the development inhibitor represented by formula (X-1) or (X-2) include a group $R_{77}$, a group $R_{78}O$—, a group $R_{77}S$—, a group $R_{77}OCO$—, a group $R_{77}OSO_2$—, a halogen atom, a cyano group, a nitro group, a group $R_{77}SO_2$—, a group $R_{78}CO$—, a group $R_{77}COO$—,

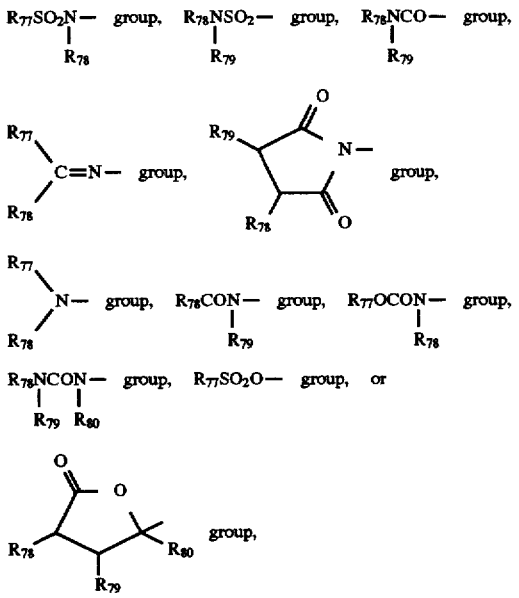

wherein $R_{77}$ represents an aliphatic group, an aromatic group, or a heterocyclic group, $R_{78}$, $R_{79}$, and $R_{80}$ each represent an aliphatic group, an aromatic group, a heterocyclic group, or a hydrogen atom. If there are two or more of $R_{77}$'s, $R_{78}$'s, and/or $R_{80}$'s in the molecule, they may bond together to form a ring (e.g., a benzene ring).

Examples of the compound represented by formula (X-1) include substituted or unsubstituted mercaptoazoles (e.g., 1-phenyl-5-mercaptotetrazole, 1-propyl-5-mercaptotetrazole, 1-butyl-5-mercaptotetrazole, 2-methylthio-5-mercapto-1,3,4-thiadiazole, 3-methyl-4-phenyl-5-mercapto-1,2,4-triazole, 1-(4-ethylcarbamoylphenyl)-2-mercaptoimidazole, 2-mercaptobenzoxazole, 2-mercaptobenzimidazole, 2-mercaptobenzothiazole, 2-mercaptobenzoxazole, 2-phenyl-5-mercapto-1,3,4-oxadiazole, 1-{3-(3-methylureido)phenyl}-5-mercaptotetrazole, 1-(4-nitrophenyl)-5-mercaptotetrazole, and 5-(2-ethylhexanoylamino)-2-mercaptobenzimidazole), substituted or unsubstituted mercaptoazaindenes (e.g., 6-methyl-4-mercapto-1,3,3a,7-tetraazaindene, and 4,6-dimethyl-2-mercapto-1,3,3a,7-tetraazaindene), and substituted or unsubstituted mercaptopyrimidines (e.g., 2-mercaptopyrimidine and 2-mercapto-4-methyl-6-hydroxypyrimidine).

As the heterocyclic compounds capable of forming imino silver, for example, substituted or unsubstituted triazoles (e.g., 1,2,4-triazole, benzotriazole, 5-methylbenzotriazole, 5-nitrobezotriazole, 5-bromobenzotriazole, 5-n-butylbenzotriazole, and 5,6-dimethylbenzotriazole), substituted or unsubstituted indazoles (e.g., indazole, 5-nitroindazole, 3-nitroindazole, and 3-chloro-5-nitroindazole), and substituted or unsubstituted benzimidazoles (e.g., 5-nitrobenzimidazole and 5,6-dichlorobenzimidazole) can be mentioned.

Further, $X^1$ may be one that will be released from Time of formula (III) to become a compound having development inhibiting properties once and to undergo a certain reaction with a developer component to change to a compound that has substantially no development inhibiting properties or has extremely reduced development inhibiting properties. As the functional group that will undergo such chemical reactions, for example, an ester group, a carbonyl group, an imino group, an immonium group, a Michael addition accepting group, or an imido group can be mentioned.

As examples of such a deactivation-type development inhibitor, development inhibitor residues described, for example, in U.S. Pat. No. 4,477,563 and JP-A Nos. 218644/1985, 221750/1985, 233650/1985, and 11743/1986 can be mentioned.

Among these, those having an ester group are preferred. Specific examples are 1-(3-phenoxycarbonylphenyl)-5-mercaptotetrazole, 1-(4-phenoxycarbonylphenyl)-5-mercaptotetrazole, 1-(3-maleimidophenyl)-5-mercaptotetrazole, 5-phenoxycarbonylbenzotriazole, 5-(4-cyanophenoxycarbonyl)benzotriazole, 2-phenoxycarbonylmethylthio-5-mercapto-1,3,4-thiadiazole, 5-nitro-3-phenoxycarbonylimidazole, 5-(2,3-dichloropropyloxycarbonyl)benzotriazole, 1-(4-benzoyloxyphenyl)-5-mercaptotetrazole, 5-(2-methanesulfonylethoxycarbonyl)-2-mercaptobenzothiazole, 5-cinnamoylaminobenzotriazole, 1-(3-vinylcarbonylphenyl)-5-mercaptotetrazole, 5-succinimidomethylbenzotriazole, 2-{4-succinimidophenyl}-5-mercapto-1,3,4-oxadiazole, 6-phenoxycarbonyl-2-mercaptobenzoxazole, 2-(1-methoxycarbonylethylthio)-5-mercapto-1,3,4-thiadiazole, 2-butoxycarbonylmethoxycarbonylmethylthio-5-mercapto-1,3,4-thiadiazole, 2-(N-hexylcarbamoylmethoxycarbonylmethylthio)-5-mercapto-1,3,4-thiadiazole, and 5-butoxycarbonylmethoxycarbonylbenzotriazole.

Among the compounds represented by formula (III), compounds represented by the following formulas (III') and (III") are preferable:

formula (III')

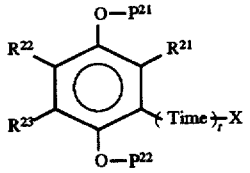

wherein $R^{21}$ to $R^{23}$ each represent a hydrogen atom or a group substitutable on the hydroquinone nucleus, $p^{21}$ and $p^{22}$ each represent a hydrogen atom or a protecting group whose protecting function can be removed at the time of development processing, and Time, X, and t have the same meanings as defined in formula (III).

formula (III")

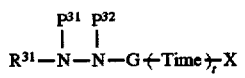

wherein $R^{31}$ represents an aryl group, a heterocyclic group, an alkyl group, an aralkyl group, an alkenyl group, of an alkynyl group, $p^{31}$ and $p^{32}$ each represent a hydrogen atom or a protecting group whose protecting function can be removed at the time of development processing, and G, Time, X, and t have the same meanings as defined in formula (III).

In formula (III'), more particularly, the substituents represented $R^{21}$ to $R^{23}$ include, for example, those mentioned as the substituents of A of formula (III) and preferably $R^{22}$ and $R^{23}$ each represent, for example, a hydrogen atom, an alkylthio group, an arylthio group, an alkoxy group, an aryloxy group, an amido group, a sulfonamido group, an alkoxycarbonylamino group, or a ureido group, more preferably a hydrogen atom, an alkylthio group, an alkoxy group, an amido group, a sulfonamido group, an alkoxycarbonylamino group, or a ureido group.

Preferably $R^{21}$ represents a hydrogen atom, a carbamoyl group, an alkoxycarbonyl group, a sulfamoyl group, a sulfonyl group, a cyano group, an acyl group, or a heterocyclic group, more preferably a hydrogen atom, a carbamoyl group, an alkoxycarbonyl group, a sulfamoyl group, or a cyano group. $R^{22}$ and $R^{23}$ may bond together to form a ring.

Examples of the protecting groups represented by $p^{21}$ and $p^{22}$ are those mentioned as the protecting group of the hydroxyl group of A of formula (III) and preferably include a hydrolyzable group, such as an acyl group, an alkoxycarbonyl group, an aryloxycarbonyl group, a carbamoyl group, an imidoyl group, an oxazolyl group, and a sulfonyl group, a precursor group of a type using a retro Michael reaction described in U.S. Pat. No. 4,009,029, a precursor group of a type using, as an intramolecular nucleophilic group, an anion produced after a ring cleavage reaction described in U.S. Pat. No. 4,310,612, a precursor group that causes a cleavage reaction by the electron transfer of an anion through a conjugated system described in U.S. Pat. No. 3,674,478, 3,932,480, or 3,993,661, a precursor group that causes a cleavage reaction by the electron transfer of the reacted anion after a ring cleavage described in U.S. Pat. No. 4,335,200, and a precursor group using an imidomethyl group described in U.S. Pat. Nos. 4,363,865 and 4,410,618.

Preferably, $p^{21}$ and $p^{22}$ each represent a hydrogen atom.

Preferably, X is mercaptoazoles and benzotriazoles. As the mecaptoazoles, mercaptotetrazoles, 5-mercapto-1,3,4-thiadizoles, and 5-mercapto-1,3,4-oxadiazoles are more preferable.

Most preferably, X is 5-mercapto-1,3,4-thiadiazoles.

Among the compounds represented by formula (III'), compounds represented by the following formulas (III'") and (III"") are more preferable:

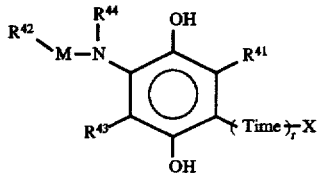

Formula (III'")

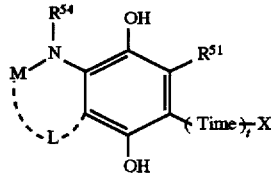

formula (III"")

wherein $R^{42}$ represents an aliphatic group, an aromatic group, or a heterocyclic group, M represents $$-\overset{O}{\overset{\|}{C}}-,\quad -SO_2-,\quad -\overset{R^{45}}{\overset{|}{N}}-\overset{O}{\overset{\|}{C}}-,\quad -O-\overset{O}{\overset{\|}{C}}-,\quad -\overset{R^{45}}{\overset{|}{N}}-SO_2-,$$

$R^{44}$, $R^{45}$, and $R^{54}$ each represent a hydrogen atom, an alkyl group, or an aryl group, L represents a bivalent linking group required to form a 5- to 7-membered ring, $R^{41}$ and $R^{51}$ have the same meanings as that of $R^{21}$ of formula (III'), $R^{43}$ has the same meaning as that of $R^{23}$ of formula (III'), and $-(Time)_t-X$ has the same meaning as that of $-(Time)_t-X$ of formula (III').

More particularly, the aliphatic group represented by $R^{42}$ has 1 to 30 carbon atoms and is a straight-chain, branched-chain, or cyclic alkyl group, alkenyl group, or alkynyl group, the aromatic group represented by $R^{42}$ has 6 to 30 carbon atoms and is a phenyl group or a naphthyl group, and the heterocyclic group represented by $R^{42}$ includes a 3- to 12-membered heterocyclic group containing at least one of nitrogen, oxygen, and sulfur. These groups may further be substituted by the groups described as the substituents of A.

Formula (III") will now be described in detail.

The aryl group represented by $R^{31}$ includes an aryl group having 6 to 20 carbon atoms, such as phenyl and naphthyl. The heterocyclic group includes a 5- to 7-membered heterocyclic group having at least one of nitrogen, oxygen, and sulfur, such as furyl and pyridyl. The alkyl group includes an alkyl group having 1 to 30 carbon atoms, such as methyl, hexyl, and octadecyl. The aralkyl group includes an aralkyl group having 7 to 30 carbon atoms, such as benzyl and trityl. The alkenyl group includes an alkenyl group having 2 to 30 carbon atoms, such as allyl. The alkynyl group includes an alkynyl group having 2 to 30 carbon atoms, such as propargyl. $R^{31}$ preferably represents an aryl group, more preferably a phenyl group.

As examples of the protecting groups represented by $p^{31}$ and $p^{32}$, those described as the protecting groups of the amino group of A in formula (III) can be mentioned. Preferably $p^{31}$ and $p^{32}$ each represent a hydrogen atom.

Preferably G represents —CO—, and preferably X represents those described for formula (III').

$R^{21}$ to $R^{23}$ in formula (III') and $R^{31}$ in formula (III") may be substituted. The substituent may have a group capable of being adsorbed to silver halides or a so-called ballasting group for giving non-diffusibility and preferably has a ballasting group. When $R^{31}$ is a phenyl group, the substituent is preferably an electron donative group, such as a sulfonamido group, an amido group, an alkoxy group, and a ureido group. When $R^{21}$, $R^{22}$, $R^{23}$, or $R^{31}$ has a ballasting group, the case wherein there is a polar group, such as a hydroxyl group, a carboxyl group, and a sulfo group, is present in the molecule is particularly preferable.

Now, to describe the contents of the present invention more specifically, specific examples of the compound represented by formula (III) are shown below, but the compounds that can be used in the present invention are not limited to them.

III-1
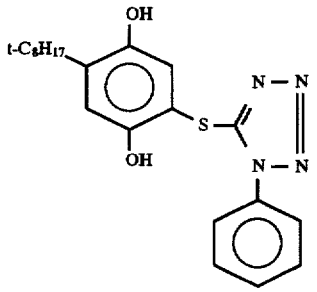
III-2
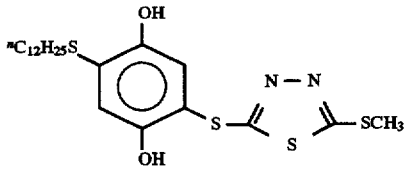
III-3
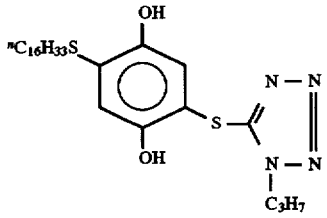
III-4
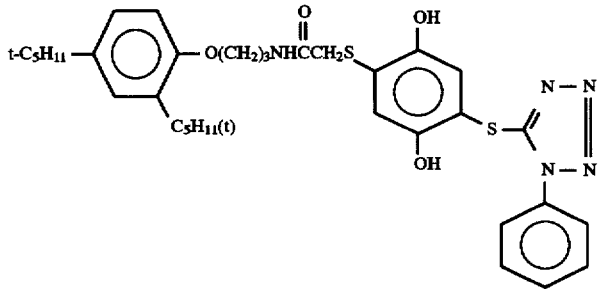
III-5
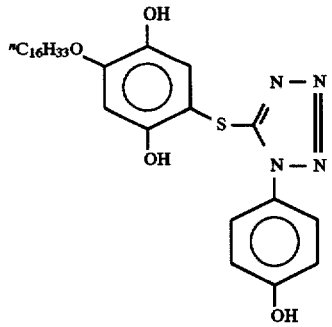
III-6
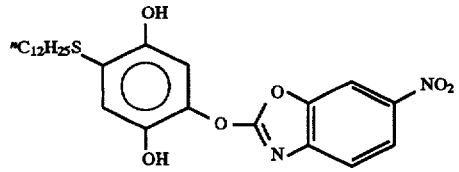

-continued
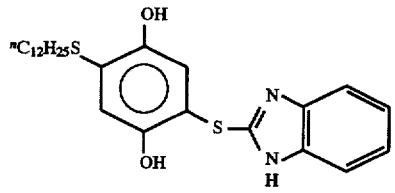
III-7
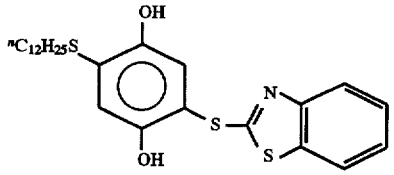
III-8
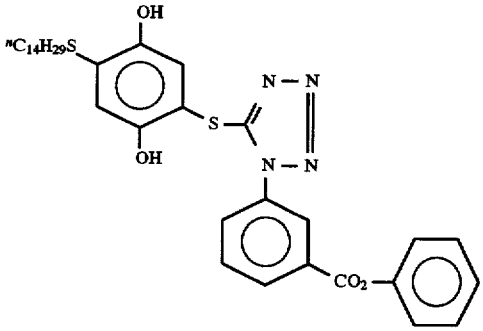
III-9
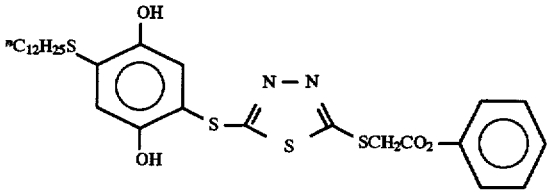
III-10
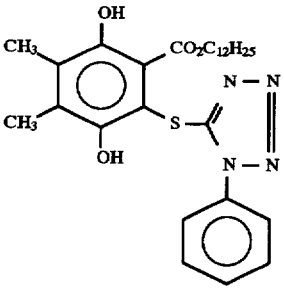
III-11
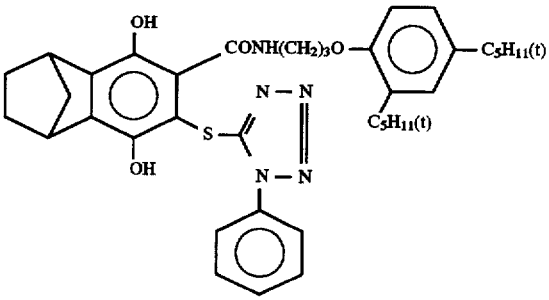
III-12

-continued
III-13
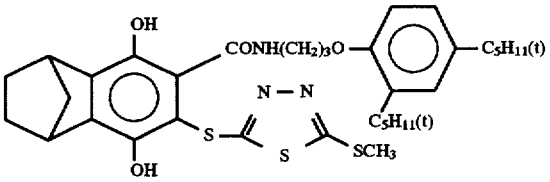
III-14
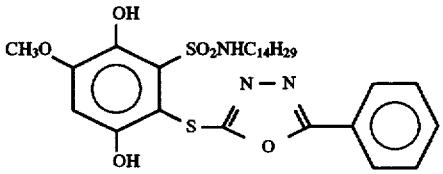
III-15
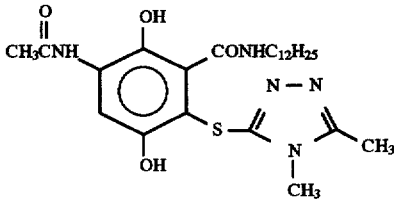
III-16
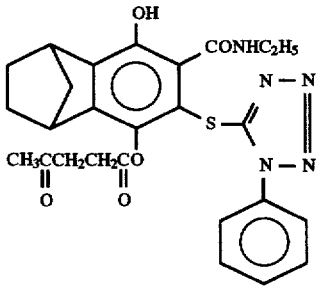
III-17
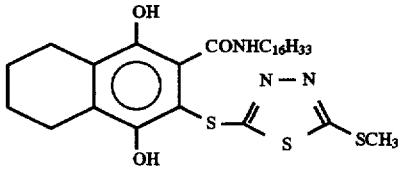
III-18
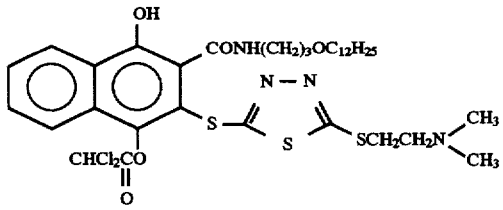
III-19
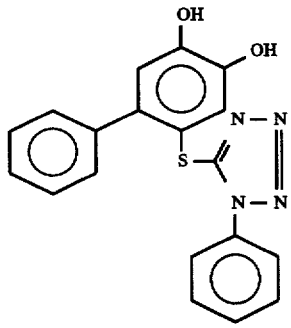

-continued
III-20
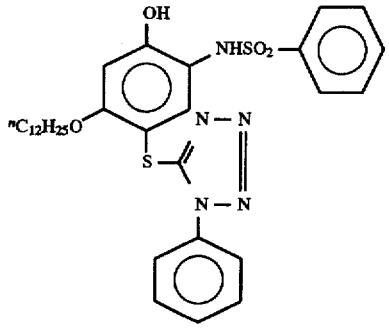
III-21
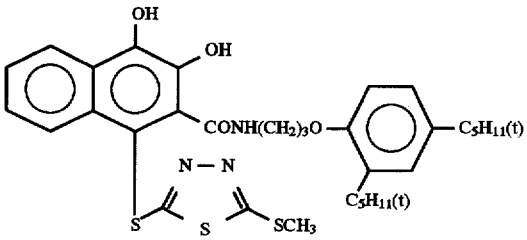
III-22
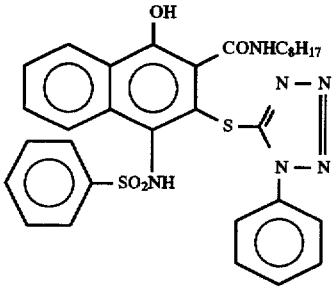
III-23
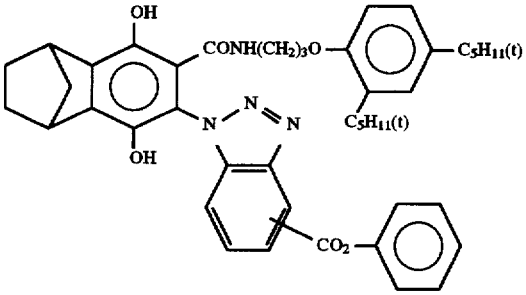
III-24
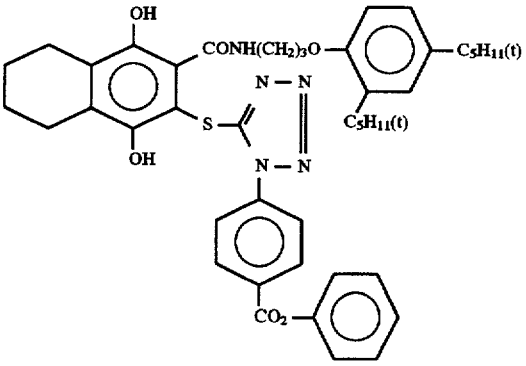

-continued
III-25
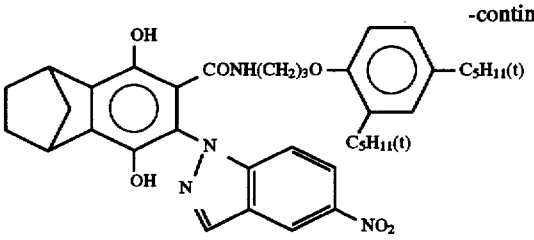
III-26
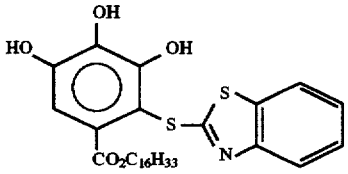
III-27
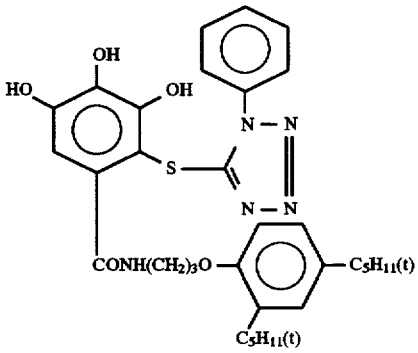
III-28
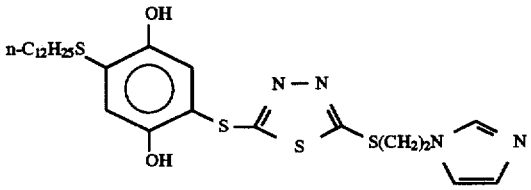
III-29
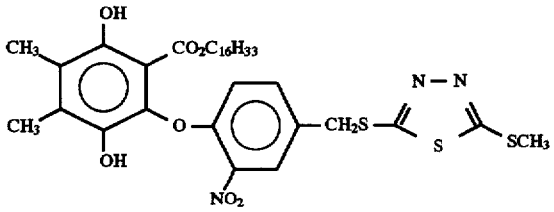
III-30
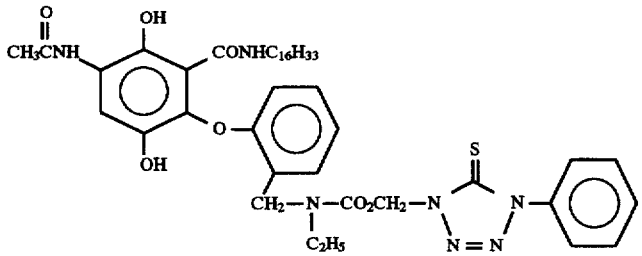
III-31
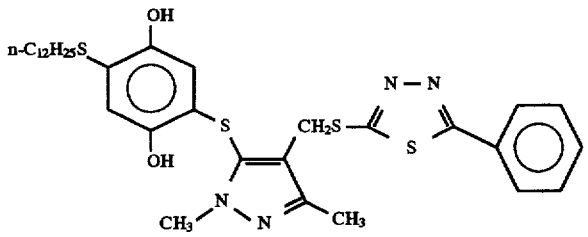

-continued
III-32
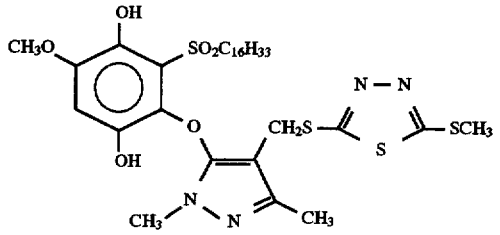
III-33
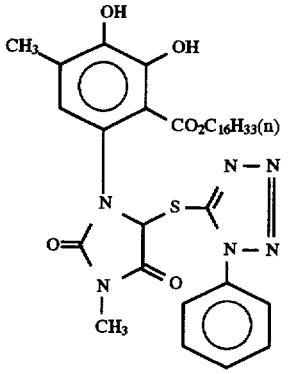
III-34
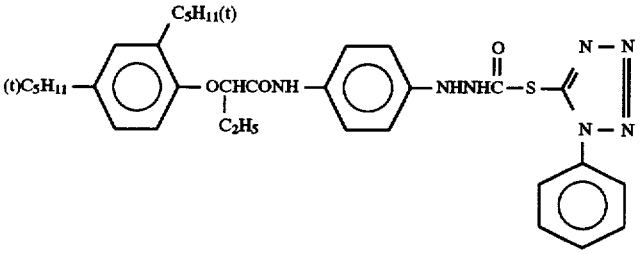
III-35
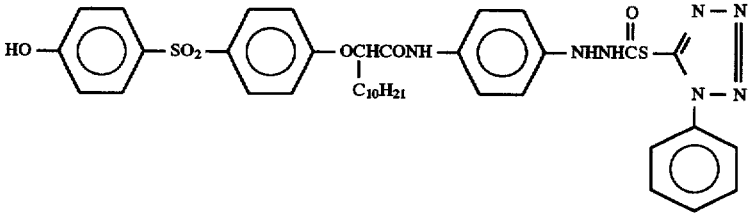
III-36
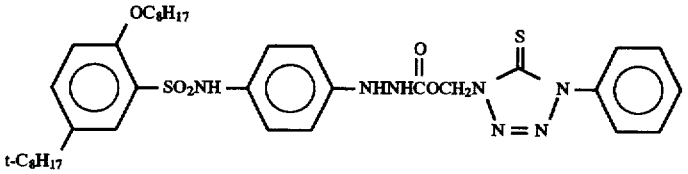
III-37
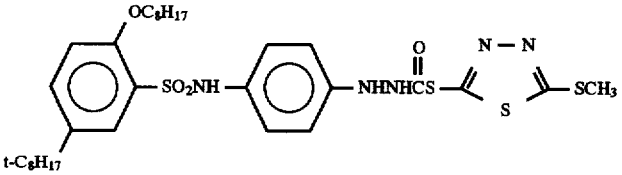

-continued
III-38
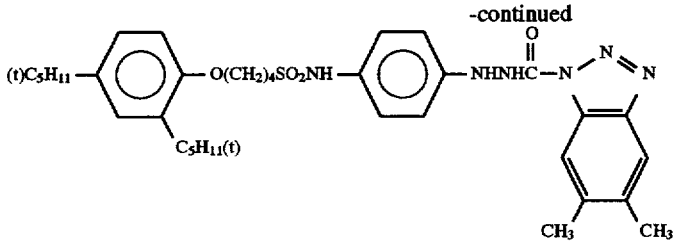
III-39
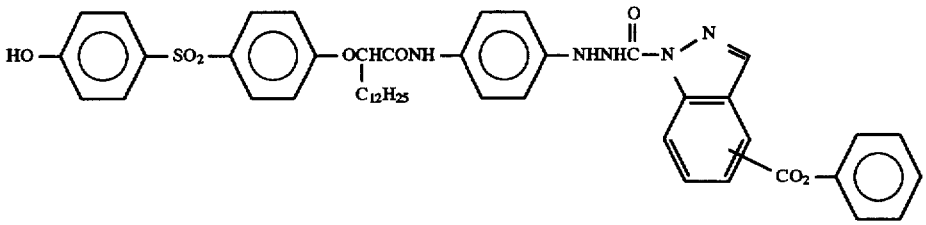
III-40
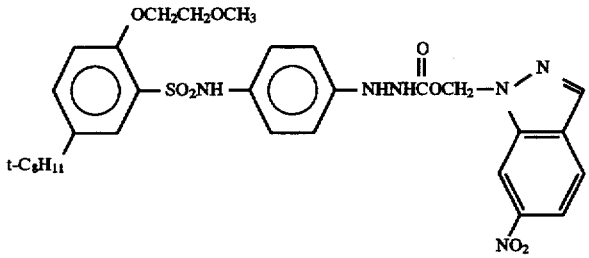
III-41
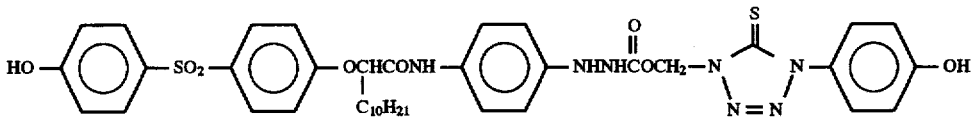
III-42
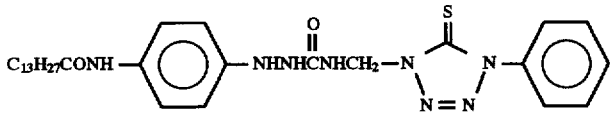
III-43
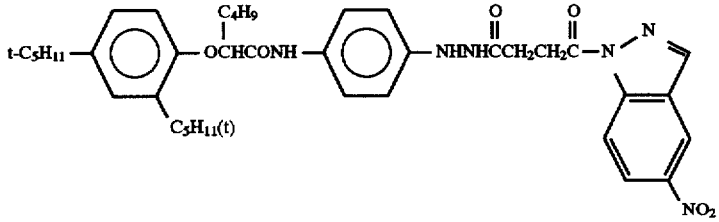
III-44
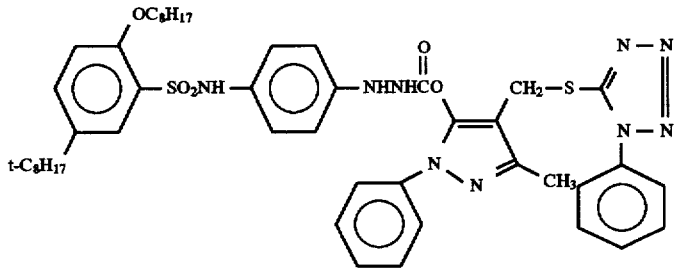
III-45
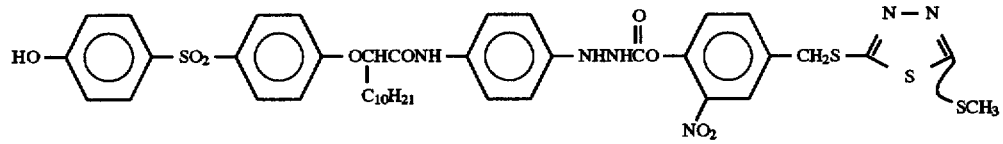

-continued
III-46
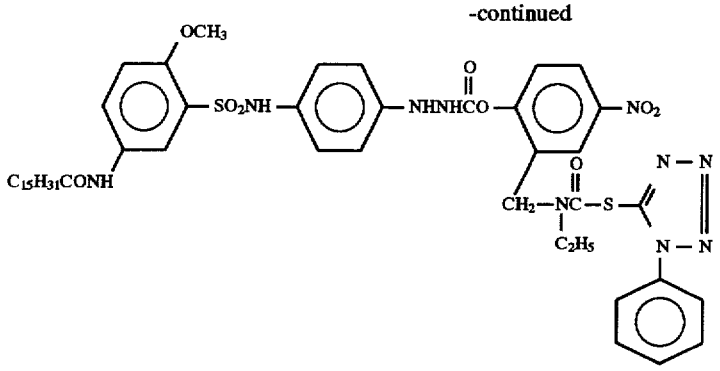
III-47
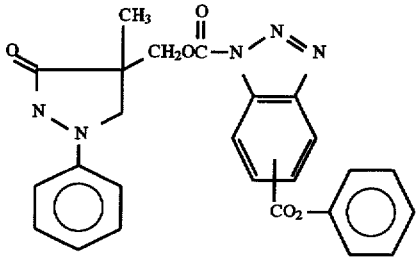
III-48
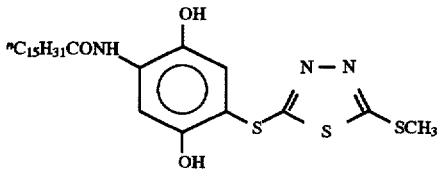
III-49
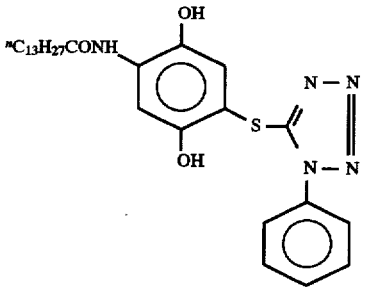
III-50
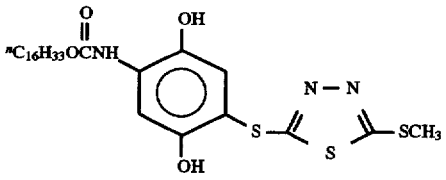
III-51
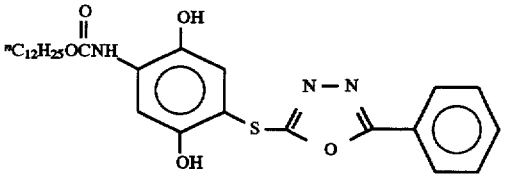
III-52
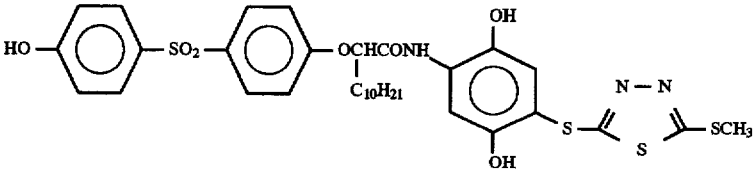

-continued
III-53
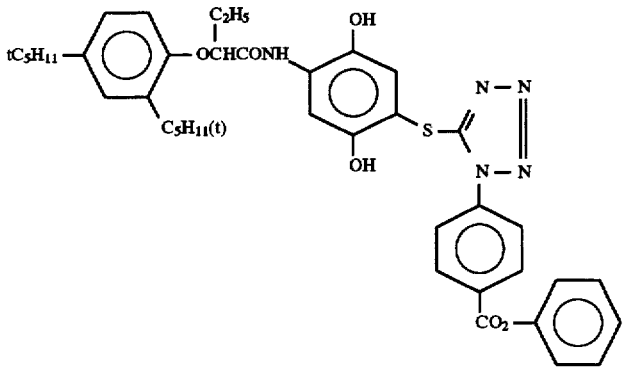
III-54
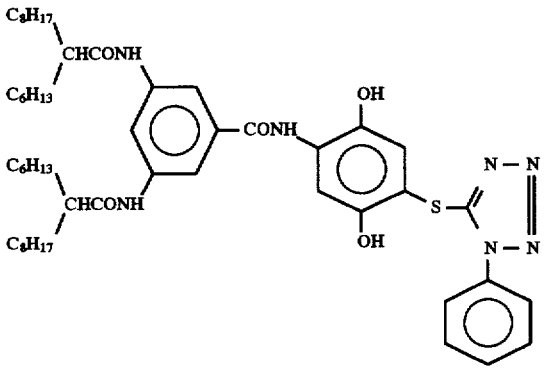
III-55
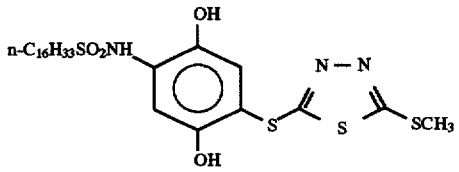
III-56
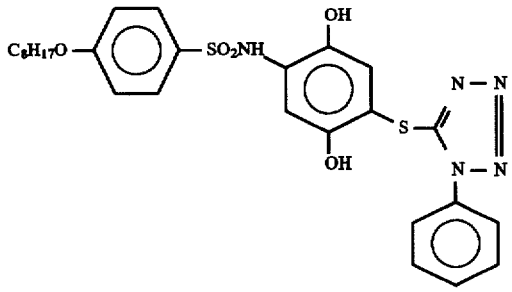
III-57
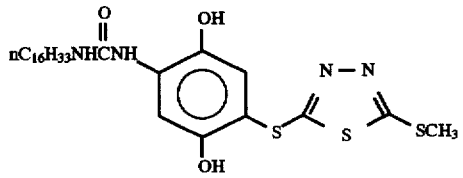
III-58
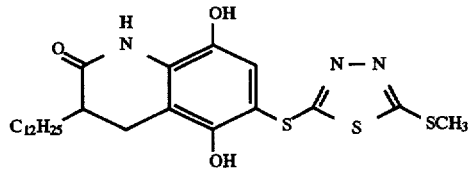

-continued
III-59
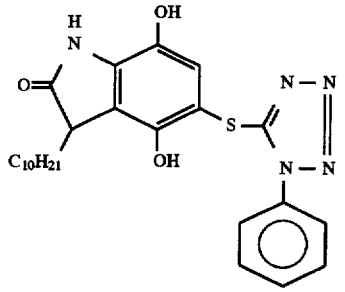
III-60
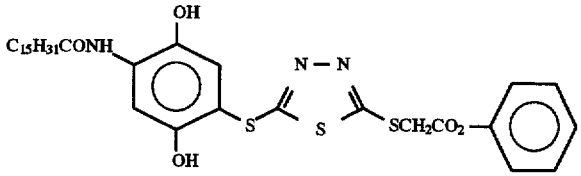
III-61
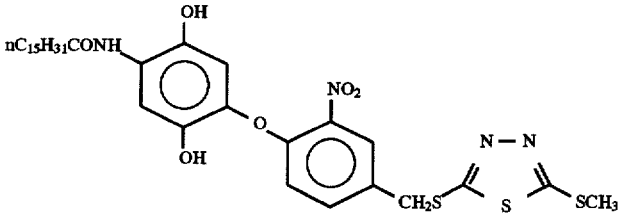
III-62
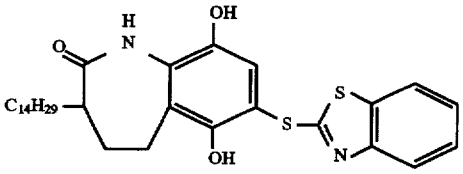
III-63
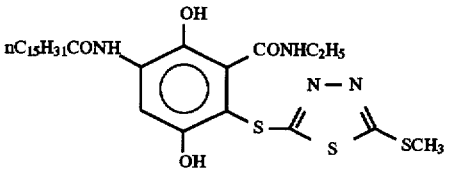
III-64
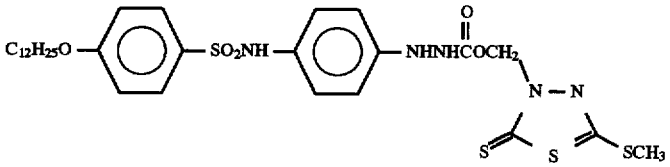
III-65
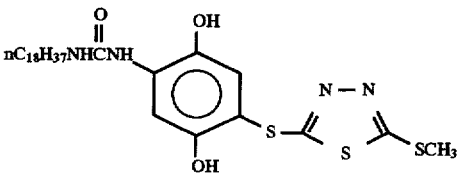
III-66
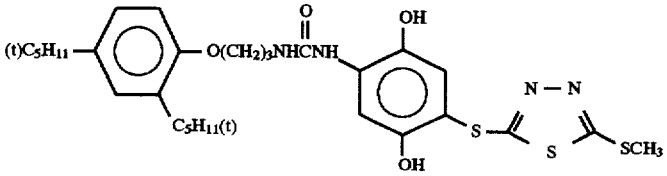

-continued
III-67
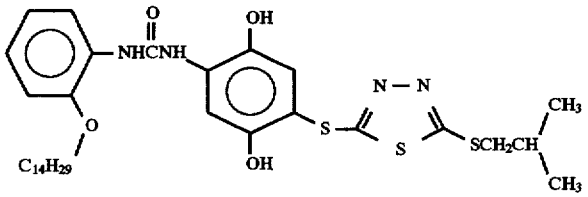
III-68
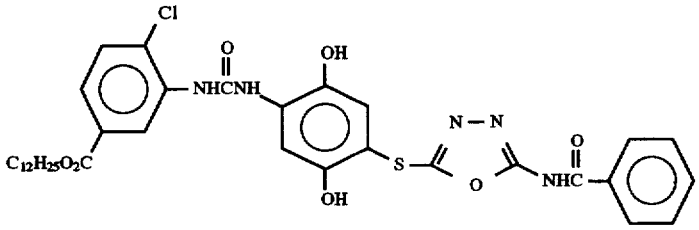
III-69
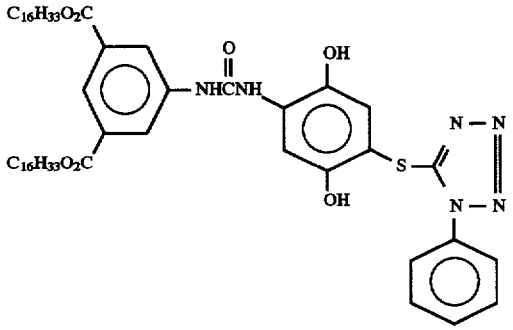
III-70
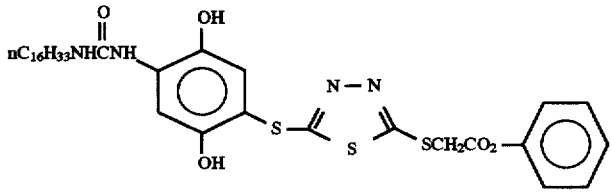
III-71
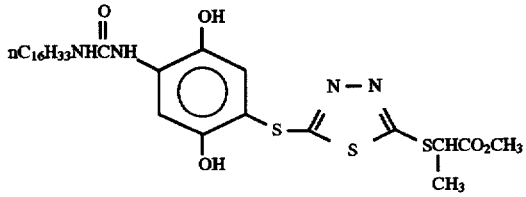
III-72
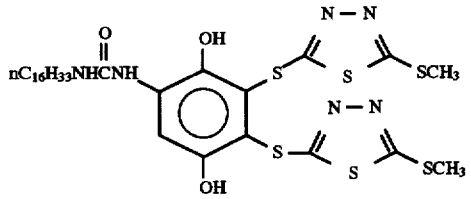
III-73
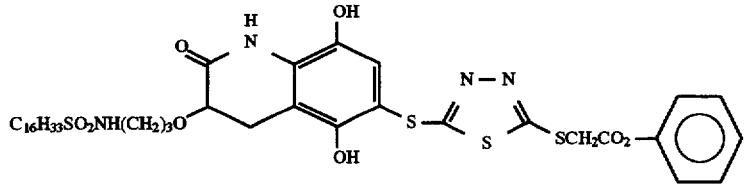

-continued
III-74
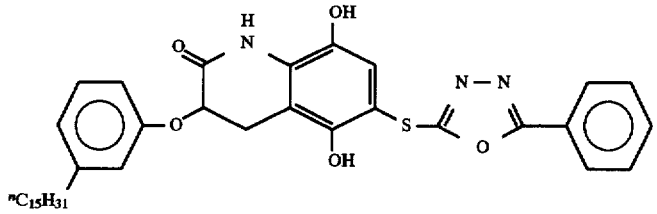
III-75
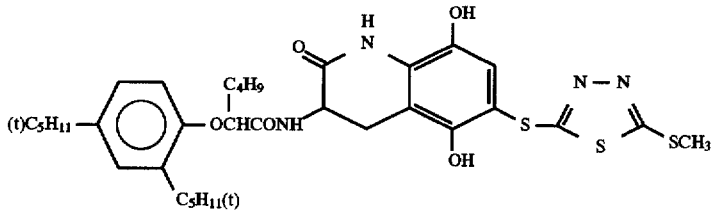
III-76
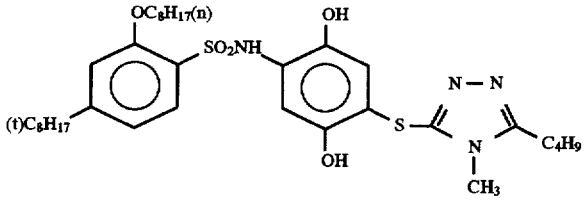
III-77
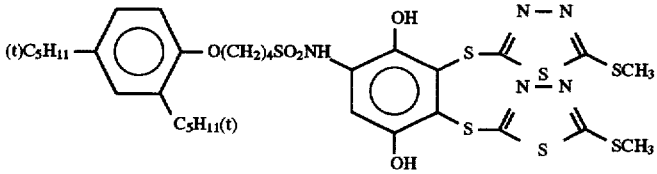
III-78
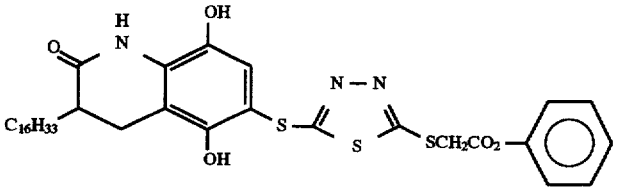
III-79
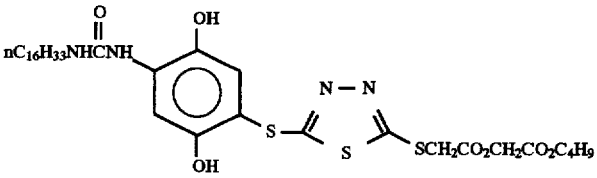
III-80
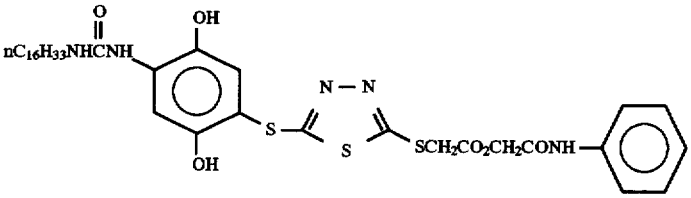

-continued
III-81
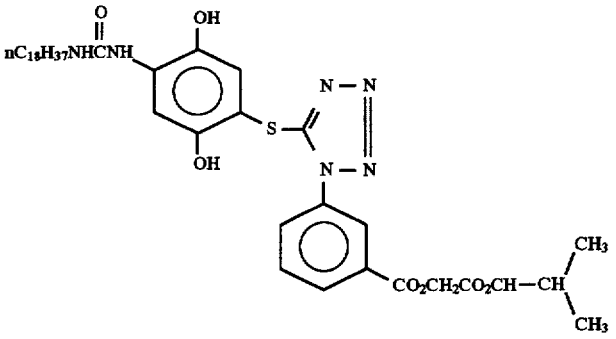
III-82
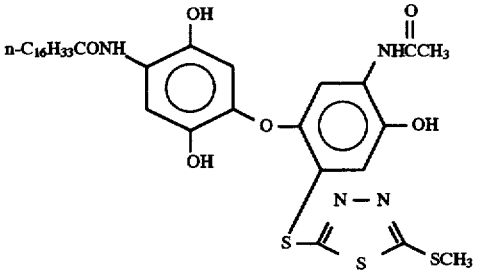
III-83
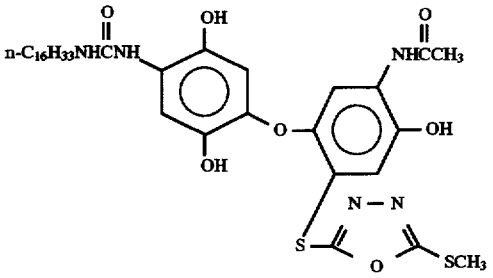
III-84
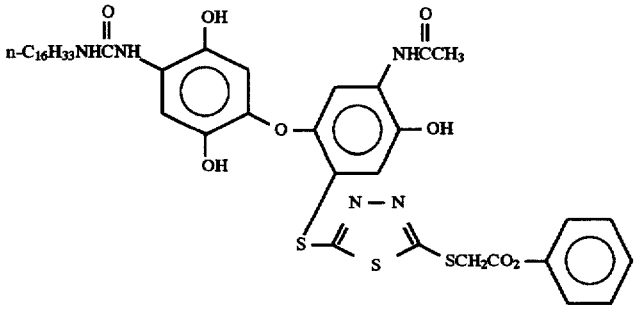
III-85
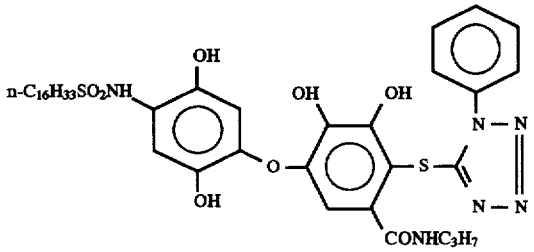

-continued

III-86

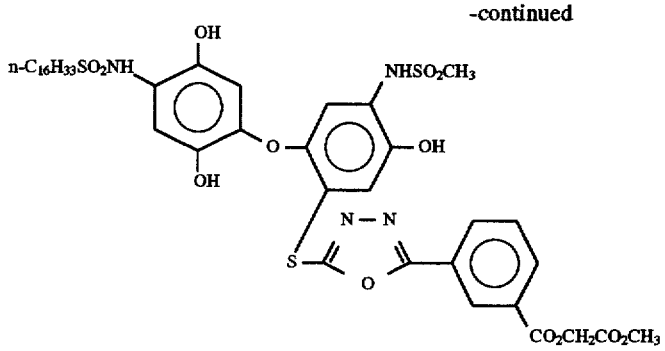

III-87

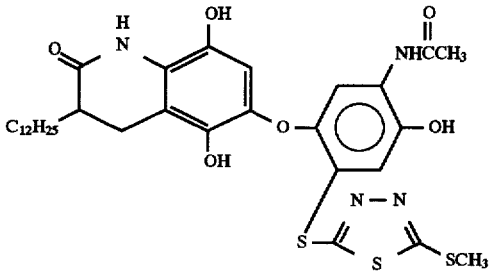

III-88

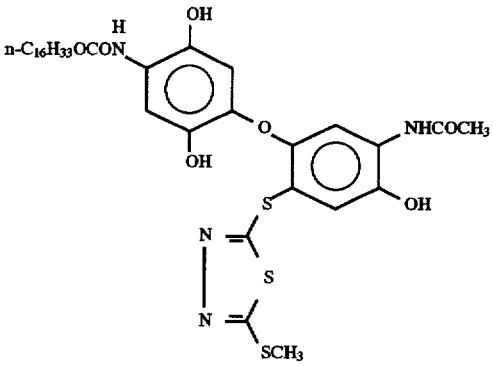

III-89

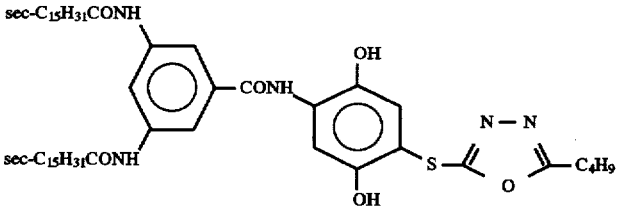

The following is the common description for all embodiments of the present invention.

It is adequate if the photographic material of the present invention has on a support at least one blue-sensitive silver halide emulsion layer, at least one green-sensitive silver halide emulsion layer, and at least one red-sensitive silver halide emulsion layer, and there is no particular restriction on the number of silver halide emulsion layers and non-photosensitive layers and on the order of the layers. A typical example is a silver halide photographic material having, on a support, at least one photosensitive layer that comprises several silver halide emulsion layers that have substantially the same color sensitivity but different in photosensitivity, which photosensitive layer is a unit photosensitive layer having color sensitivity to any one of blue light, green light, and red light, and, in the case of a multilayer silver halide color photographic material, generally the arrangement of unit photosensitive layers is such that a red-sensitive layer, a green-sensitive layer, and a blue-sensitive layer are provided on a support in the stated order, with the red-sensitive layer adjacent to the support. However, depending on the purpose, the order of the arrangement may be reversed or the arrangement may be such that layers having the same photosensitivity have a layer with different color photosensitivity between them.

A non-photosensitive layer, such as various intermediate layers, may be placed between the above-mentioned silver halide photosensitive layers, and such a layer also be placed on the uppermost layer or the lowermost layer.

The said intermediate layer may contain such couplers and DIR compounds as described in JP-A Nos. 43748/1986, 113438/1984, 113440/1984, 20037/1986, and 20038/1986, and it may also contain a usually-used color mixing-inhibitor.

For multiple silver halide emulsion layers that constitute each unit photosensitive layer, preferably a two-layer constitution can be used, which comprises a high-sensitive emulsion layer and a low-sensitive emulsion layer, as described in West German Patent No. 1,121,470 and British Patent No. 923,045. Generally, the arrangement is preferably such that the photosensitivities are decreased successively toward the support, and a non-photosensitive layer may be placed between halogen emulsions layers. Further, as described in JP-A Nos. 112751/1982, 200350/1987, 206541/1987, and 206543/1987, a low-sensitive emulsion layer may be placed away from the base and a high-sensitive emulsion layer may be placed nearer to the support.

A specific example is an arrangement of a low-sensitive blue-sensitive layer (BL)/a high-sensitive blue-sensitive layer (BH)/a high-sensitive green-sensitive layer (GH)/a low-sensitive green-sensitive layer (GL)/a high-sensitive red-sensitive layer (RH)/a low-sensitive red-sensitive layer (RL), which are named from the side away from the support, or an arrangement of BH/BL/GL/GH/RH/RL, or an arrangement of BH/BL/GH/GL/RL/RH.

Also, as described in JP-B No. 34932/1980, the order may be a blue-sensitive layer/GH/RH/GL/RL, which are named from the side away from the support. Also, as described in JP-A Nos. 25738/1981 and 63936/1987, the order may be a blue-sensitive layer/GL/RL/GH/RH, which are named from the side away from the support.

Further, as described in JP-B No. 15495/1974, an arrangement constituted of three layers different in photosensitivity can be mentioned wherein an upper layer is a silver halide emulsion layer highest in sensitivity, an intermediate layer is a silver halide emulsion layer whose sensitivity is lower than that of the upper layer, and a lower layer is a silver halide emulsion layer whose sensitivity is lower than that of the intermediate layer, so that the sensitivities may be decreased successively toward the support. If the arrangement is made up of three layers different in sensitivity in this way, as described in JP-A No. 202464/1984, in the same color sensitive layer, the order may be an intermediate-sensitive emulsion layer, a high-sensitive emulsion layer, and a low-sensitive emulsion layer, which are stated from the side away from the support.

Further, the order may be, for example, a high-sensitive emulsion layer, a low-sensitive emulsion layer, and an intermediate-emulsion layer, or a low-sensitive emulsion layer, an intermediate-sensitive emulsion layer, and a high-sensitive emulsion layer. If there are four or more layers, the arrangement can be varied as described above.

In order to improve color reproduction, it is preferable that donor layers (CL), described in U.S. Pat. Nos. 4,663,271, 4,705,744, and 4,707,436, and JP-A Nos. 160448/1987 and 89850/1988, whose spectral sensitivity distribution is different from that of a main sensitive layer, such as BL, GL, and, RL and which have a double-layer effect are arranged adjacent or near to the main sensitive layer.

As stated above, various layer constitutions and arrangements can be chosen in accordance with the purpose of each photographic material.

A preferable silver halide to be contained in the photographic emulsion layer of the photographic material utilized in the present invention is silver bromoiodide, silver chloroiodide, or silver bromochloroiodide, containing about 30 mol % or less of silver iodide. A particularly preferable silver halide is silver bromoiodide or silver bromochloroiodide, containing about 2 to about 10 mol % of silver iodide.

The silver halide grains in the photographic emulsion may have a regular crystal form, such as a cubic shape, an octahedral shape, and a tetradecahedral shape, or a irregular crystal shape, such as spherical shape or a tabular shape, or they may have a crystal defect, such as twin planes, or they may have a composite crystal form.

The silver halide grains may be fine grains having a diameter of about 0.2 μm or less, or large-size grains with the diameter of the projected area being down to about 10 μm, and as the silver halide emulsion, a polydisperse emulsion or a monodisperse emulsion can be used.

The silver halide photographic emulsions that can be used in the present invention may be prepared suitably by known means, for example, by the methods described in *I. Emulsion Preparation and Types*, in *Research Disclosure* (RD) No. 17643 (December 1978), pp. 22–23, and ibid. No. 18716 (November 1979), p. 648, and ibid. No. 307105 (November, 1989), pp. 863–865; the methods described in P. Glafkides, *Chimie et Phisique Photographique*, Paul Montel (1967), in G. F. Duffin, *Photographic Emulsion Chemistry*, Focal Press (1966), and in V. L. Zelikman et al., *Making and Coating of Photographic Emulsion*, Focal Press (1964).

A monodisperse emulsion, such as described in U.S. Pat. Nos. 3,574,628 and 3,655,394, and in British Patent No. 1,413,748, is also preferable.

Tabular grains having an aspect ratio of 3 or greater can be used in the emulsion of the present invention. Tabular grains can be easily prepared by the methods described in, for example, Gutoff, *Photographic Science and Engineering*, Vol. 14, pp. 248–257 (1970), U.S. Pat. Nos. 4,434,226, 4,414,310, 4,433,048, and 4,439,520, and British Patent No. 2,112,157.

The crystal structure of silver halide grains may be uniform, the outer halogen composition of the crystal structure may be different from the inner halogen composition, or the crystal structure may be layered. Silver halides whose compositions are different may be joined by the epitaxial joint, or a silver halide may be joined, for example, to a compound other than silver halides, such as silver rhodanide, lead oxide, etc.

Silver halide grains which is a mixture of grains of various crystal shapes may be used.

The silver halide emulsion that has been physically ripened, chemically ripened, and spectrally sensitized is generally used. Additives to be used in these steps are described in *Research Disclosure* Nos. 17643, 18716 and 307105, and involved sections are listed in the Table shown below.

In the photographic material of the present invention, two or more kinds of emulsions in which at least one of characteristics, such as grain size of photosensitive silver halide emulsion, distribution of grain size, composition of silver halide, shape of grain, and sensitivity is different each other can be used in a layer in a form of mixture.

Silver halide grains the surface of which has been fogged as described in, for example, U.S. Pat. No. 4,082,553, and silver halide grains the inner part of which has been fogged as described in, for example, U.S. Pat. No. 4,626,498 and JP-A No. 214852/1984 or colloidal silver may be preferably used in a photosensitive silver halide emulsion layer and/or a substantially non-photosensitive hydrophilic colloid layer. "Silver halide grains the surface or inner part of which has been fogged" means a silver halide grains capable of being uniformly (non-image-wisely) developed without regard to unexposed part or exposed part to lightof the photographic material. The method for preparing a silver halide grains the surface or inner part of which has been fogged are described, for example, in U.S. Pat. No. 4,626,498 and JP-A No. 214852/1984.

The silver halide composition forming inner nucleus of core/shell-type silver halide grain the inner part of which has been fogged may be the same or different. As a silver halide grain the surface or inner part of which has been fogged, any of silver chloride, silver chlorobromide, silver bromide, silver chloroiodobromide can be used. Although the grain size of such silver halide grains which has been fogged is not particularly restricted, the average grain size is preferably 0.01 to 0.75 μm, particularly preferably 0.05 to 0.6 μm. Further, the shape of grains is not particularly restricted, a regular grain or an irregular grain can be used.

In the present invention, it is preferable to use a non-photosensitive fine grain silver halide. "Non-photosensitive fine grain silver halide" means a silver halide fine grain that is not sensitized at an imagewise exposure to light to obtain a color image and is not developed substantially at a development processing, and preferably it is not fogged previously.

Fine grain silver halide has a silver bromide content of 0 to 100 mol %, and may contain silver chloride and/or silver iodide, if needed. Preferable ones contain silver iodide of 0.5 to 10 mol %.

The average grain diameter (average diameter of circle corresponding to projected area) of fine grain silver halide is preferably 0.01 to 0.5 μm, more preferably 0.02 to 0.2 μm.

The fine grain silver halide can be prepared in the same manner as an ordinary photosensitive silver halide. In this case, it is not necessary to chemically sensitize the surface of the silver halide grain and also spectrally sensitizing is not needed. However, before adding this to a coating solution, to add previously such a compound as triazoles, azaindenes, benzothiazoliums, and mercapto compounds or a known stabilizing agent, such as zinc compounds, is preferable. Colloidal silver is preferably contained in a layer containing this fine grain silver halide.

The coating amount in terms of silver of photographic material of the present invention is preferably 6.0 g/m$^2$ or below, most preferably 4.5 g/m$^2$ or below.

Known photographic additives that can be used in the present invention are also described in the above-mentioned three Research Disclosures, and involved sections are listed in the same Table below.

| Additive | RD 17643 | RD 18716 | RD 307105 |
|---|---|---|---|
| 1 Chemical sensitizer | p. 23 | p. 648 (right column) | p. 866 |
| 2 Sensitivity-enhancing agent | — | p. 648 (right column) | — |
| 3 Spectral sensitizers and Supersensitizers | pp. 23–24 | pp. 648 (right column)–649 (right column) | pp. 866–868 |
| 4 Brightening agents | p. 24 | p. 647 (right column) | p. 868 |
| 5 Antifogging agents and Stabilizers | pp. 24–25 | p. 649 (right column) | pp. 868–870 |
| 6 Light absorbers, Filter dyes, and UV Absorbers | pp. 25–26 | pp. 649 (right column)–650 (left column) | p. 873 |
| 7 Stain-preventing agent | p. 25 (right column) | p. 650 (left to right column) | p. 872 |
| 8 Image dye stabilizers | p. 25 | p. 650 (left column) | p. 872 |
| 9 Hardeners | p. 26 | p. 651 (left column) | pp. 874–875 |
| 10 Binders | p. 26 | p. 651 (left column) | pp. 873–874 |
| 11 Plasticizers and Lubricants | p. 27 | p. 650 (right column) | p. 876 |
| 12 Coating aids and Surface-active agents | pp. 26–27 | p. 650 (right column) | pp. 875–876 |
| 13 Antistatic agents | p. 27 | p. 650 (right column) | pp. 876–877 |
| 14 Matting agent | — | — | pp. 878–879 |

Further, in order to prevent the lowering of photographic performances due to formaldehyde gas, a compound described in, for example, U.S. Pat. Nos. 4,411,987 and 4,435,503 that is able to react with formaldehyde to immobilize is preferably added to the photographic material.

In the photographic material of the present invention, a mercapto compound described in, for example, U.S. Pat. Nos. 4,740,454 and 4,788,132, and JP-A Nos. 18539/1987 and 283551/1989 is preferably contained.

In the photographic material of the present invention, a compound that releases a fogging agent, a development accelerator, a solvent for silver halide, or the precursor thereof, independent of the amount of silver formed by a development processing, described in, for example, JP-A No. 106052/1989 is preferably contained.

In the photographic material of the present invention, a dye dispersed by a method described in, for example, International Publication No. WO88/04794 and Japanese Published Searched Patent Publication No. 502912/1989, or a dye described in, for example, European Patent No. 317,308A, U.S. Pat. No. 4,420,555, and JP-A No. 259358/1989 is preferably contained.

In the present invention, various color couplers can be used, and concrete examples of them are described in patents cited in the above-mentioned *Research Disclosure* No. 17643, VII-C to G, and ibid. No. 307105, VII-C to G.

As yellow couplers to be used in combination with the yellow coupler of the present invention, those described in, for example, U.S. Pat. Nos. 3,933,501, 4,022,620, 4,326,024, 4,401,752, and 4,248,961, JP-B No. 10739/1983, British Patent Nos. 1,425,020 and 1,476,760, U.S. Pat. Nos. 3,973,968, 4,314,023, and 4,511,649, and European Patent No. 249,473A are preferable.

As magenta couplers, 5-pyrazolone compounds and pyrazoloazole compounds are preferable, and polymer couplers of the present invention and couplers described in, for example, U.S. Pat. Nos. 4,310,619 and 4,351,897, European Patent No. 73,636, U.S. Pat. Nos. 3,061,432 and 3,725,067, *Research Disclosure* No. 24420 (June 1984), JP-A No. 33552/1985, *Research Disclosure* No. 24230 (June 1984), JP-A Nos. 43659/1985, 72238/1986, 35730/1985, 118034/1980, and 185951/1985, U.S. Pat. Nos. 4,500,630, 4,540,654, 4,556,630, and International Publication No. W088/04795 are preferable, in particular.

In the present invention, as cyan couplers to be used in combination with the cyan coupler represented by the above-described formula (I), phenol-type couplers and naphthol-type couplers can be mentioned, and those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, West German Patent Application (OLS) No. 3,329,729, European Patent Nos. 121,365A and 249,453A, U.S. Pat. Nos. 3,446,622, 4,333,999, 4,775,616, 4,451,559, 4,427,767, 4,690,889, 4,254,212, and 4,296,199, and JP-A No. 42658/1986 are preferable. Further, pyrazoloazole series couplers as described, for example, in JP-A Nos. 553/1989, 554/1989, 555/1989, and 556/1989, and imidazole series couplers as described, for example, in U.S. Pat. No. 4,818,672 can be used.

Typical examples of polymerized dye-forming coupler are described in, for example, U.S. Pat. Nos. 3,451,820, 4,080,211, 4,367,282, 4,409,320, and 4,576,910, British Patent No. 2,102,137, and European Patent No. 341,188A.

As a coupler which forms a dye having moderate diffusibility, those described in U.S. Pat. No. 4,366,237, British Patent No. 2,125,570, European Patent No. 96,570, and West German Patent Application (OLS) No. 3,234,533 are preferable.

As a colored coupler to rectify the unnecessary absorption of color-forming dyes, those couplers described in, paragraph VII-G of *Research Disclosure* No. 17643, paragraph VII-G of ibid. No. 307105, U.S. Pat. No. 4,163,670, JP-B No. 39413/1982, U.S. Pat. Nos. 4,004,929 and 4,138,258, and British Patent No. 1,146,368 are preferable. Further, it is preferable to use couplers to rectify the unnecessary absorption of color-forming dyes by a fluorescent dye released upon the coupling reaction as described in U.S. Pat. No. 4,774,181 and couplers having a dye precursor group, as a group capable of being released, that can react with the developing agent to form a dye as described in U.S. Pat. No. 4,777,120.

Comopounds that release a photographically useful residue accompanied with the coupling reaction can be used favorably in this invention. As a DIR coupler that release a development retarder, those described in patents cited in paragraph VII-F of the above-mentioned *Research Disclosure* No. 17643 and in paragraph VII-F of ibid. No. 307105, JP-A Nos. 151944/1982, 154234/1982, 184248/1985, 37346/1988, and 37350/1986, and U.S. Pat. Nos. 4,248,962 and 4,782,012 are preferable.

A coupler that releases a bleaching accelerator, described, for example, in Research Disclosure Nos. 11449 and 24241, and JP-A No. 201247/1986, is effective for shortening the time of processing that has bleaching activity, and the effect is great in the case wherein the coupler is added in a photographic material using the above-mentioned tabular silver halide grains.

As a coupler that releases, imagewisely, a nucleating agent or a development accelerator upon developing, those described in British Patent Nos. 2,097,140 and 2,131,188, and JP-A Nos. 157638/1984 and 170840/1984 are preferable. Further, compounds which release a fogging agent, a developing accelerator, or a solvent for silver halide by a oxidation-reduction reaction with the oxidized product of developing agent as described in JP-A Nos. 107029/1985, 252340/1985, 44940/1989, and 45687/1989 are also preferable.

Other compounds that can be used in the photographic material of the present invention include competitive couplers described in U.S. Pat. No. 4,130,427, multi-equivalent couplers described in U.S. Pat. Nos. 4,283,472, 4,338,393, and 4,310,618, couplers which release a DIR redox compound, couplers which release a DIR coupler, and redox compounds which release a DIR coupler or a DIR redox as described in JP-A Nos. 185950/1985 and 24252/1987, couplers which release a dye to regain a color after releasing as described in European Patent Nos. 173,302A and 313,308A, couplers which release a ligand as described in U.S. Pat. No. 4,555,477, couplers which release a leuco dye as described in JP-A No. 75747/1988, and couplers which release a fluorescent dye as described in U.S. Pat. No. 4,774,181.

Couplers utilized in the present invention can be incorporated into a photographic material by various known methods for dispersion.

Examples of high-boiling solvent for use in oil-in-water dispersion process are described in, for example, U.S. Pat. No. 2,322,027. As specific examples of high-boiling organic solvent having a boiling point of 175° C. or over at atmospheric pressure for use in oil-in-water dispersion process can be mentioned phthalates (e.g., dibutyl phthalate, dicyclohexyl phthalate, di-2-ethylhexyl phthalate, decyl phthalate, bis(2,4-di-t-amylphenyl phthalate, bis(2,4-di-t-amylphenyl)isophthalate, and bis(1,1-diethylpropyl) phthalate), esters of phosphoric acid or phosphonic acid (e.g., triphenyl phosphate, tricrezyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, and di-2-ethylhexylphenyl phosphate), benzoic esters (e.g., 2-ethylhexyl benzoate, dodecyl benzoate, and 2-ethylhexyl-p-hydroxy benzoate), amides (e.g., N,N-diethyldodecanamide, N,N-diethyllaurylamide, and N-tetradecylpyrrolidone), alcohols or phenols (e.g., isostearyl alcohol and 2,4-di-tert-amyl phenol), aliphatic carbonic acid esters (bis(2-ethylhexyl) sebacate, dioctyl azelate, glycerol tributylate, isostearyl lactate, and trioctyl citrate), aniline derivertives (N,N-dibutyl-2-butoxy-5-tert-octylaniline), and hydrocarbons (paraffin, dodecyl benzene, and diisopropyl naphthalene). Further, as a co-solvent an organic solvent having a boiling point of about 30° C. or over, preferably a boiling point in the range from 50° C. to about 160° C. can be used, and as typical example can be mentioned ethyl acetate, butyl acetate, ethyl propionate, methylethylketone, cyclohexanone, 2-rthoxyethyl acetate, and dimethyl formamide.

Specific examples of process and effects of latex dispersion method, and latices for impregnation are described in, for example, U.S. Pat. No. 4,199,363 and West German Patent Application (OLS) Nos 2,541,274 and 2,541,230.

In the photographic material of this invention, various antiseptics and antifungal agents, such as phenetyl alcohol, and 1,2-benzisothiazoline-3-one, n-butyl p-hydroxybenzoate, phenol, 4-chloro-3,5-dimethylphenol, 2-phenoxyethanol, and 2-(4-thiazolyl)bezimidazole as described in JP-A Nos. 257747/1988, 272248/1987, and 80941/1989 are preferably added.

The present invention can be adopted to various color photographic materials. Representable examples include a color negative film for general use or for cinema, a color reversal film for slide or for television, a color paper, a color positive film, and a color reversal paper.

Suitable supports that can be used in this invention are described in, for example, in the above-mentioned *Research Disclosure* No. 17643, page 28, ibid. No. 18716, from page 647, right column to page 648, left column, and ibid. No. 307105, page 897.

In the photographic material of the present invention, preferably the total layer thickness of all the hydrophilic colloid layers on the side having emulsion layers is 28 μm or below, more preferably 23 μm or below, further more preferably 18 μm or below, and particularly preferably 16 μm or below. Preferably the film swelling speed $T_{1/2}$ is 30 sec or below, more preferably 20 sec or below. The term "layer thickness" means layer thickness measured after moisture conditioning at 25° C. and a relative humidity of 55% for two days, and the film swelling speed $T_{1/2}$ can be measured in a manner known in the art. For example, the film swelling speed $T_{1/2}$ can be measured by using a swellometer (swell-measuring meter) of the type described by A. Green et al. in *Photographic Science and Engineering*, Vol. 19, No. 2, pp. 124–129, and $T_{1/2}$ is defined as the time required to reach a film thickness of ½ of the saturated film thickness that is 90% of the maximum swelled film thickness that will be reached when the film is treated with a color developer at 30° C. for 3 min 15 sec.

The film swelling speed $T_{1/2}$ can be adjusted by adding a hardening agent to the gelatin that is a binder or by changing the time conditions after the coating. Preferably the ratio of swelling is 150 to 400%. The ratio of swelling is calculated from the maximum swelled film thickness obtained under the above conditions according to the formula: (Maximum swelled film thickness —film thickness)/Film thickness.

It is preferable that the photographic material of the present invention is provided a hydrophilic layer (designated as a back layer) having a total dried layer thickness of 2 μm to 20 μm at the opposite side of having emulsion layers. In such back layer, it is preferable to be contained the above-mentioned light-absorbent, filter-dye, UV-absorbent, static preventer, film-hardener, binder, plasticizer, lubricant, coating auxiliary, and surface-active agent. The ratio of swelling of back layer is preferably 150 to 500%.

The color photographic material in accordance with the present invention can be subjected to the development processing by an ordinary method as described in the above-mentioned *RD* No. 17463, pp. 28–29, ibid. No. 18716, p. 651, from left column to right column, and ibid. No. 307105, pp. 880–881.

Preferably, the color developer to be used for the development processing of the photographic material of the present invention is an aqueous alkaline solution whose major component is an aromatic primary amine color-developing agent. As the color-developing agent, aminophenol compounds are useful, though p-phenylene diamine compounds are preferably used, and typical examples thereof include 3-methyl-4-amino-N,N-diethyl-aniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, 4-amino-3-methyl-N-methyl-N-(3-hydroxypropyl)aniline, 4-amino-3-methyl-N-ethyl-N-(3-hydroxypropyl)aniline, 4-amino-3-methyl-N-ethyl-N-(2-hydroxypropyl)aniline, 4-amino-3-ethyl-N-ethyl-N-(3-hydroxypropyl)aniline, 4-amino-3-methyl-N-propyl-N-(3-hydroxypropyl)aniline, 4-amino-3-propyl-N-methyl-N-(3-hydroxypropyl)aniline, 4-amino-3-methyl-N-methyl-N-(4-hydroxybutyl)aniline, 4-amino-3-methyl-N-ethyl-N-(4-hydroxybutyl)aniline, 4-amino-3-methyl-N-propyl-N-(4-hydroxybutyl)aniline, 4-amino-3-methyl-N-ethyl-N-(3-hydroxy-2-metylpropyl)aniline, 4-amino-3-methyl-N,N-bis(4-hydroxybutyl)aniline, 4-amino-3-methyl-N,N-bis(5-hydroxypntyl)aniline, 4-amino-3-methyl-N-(5-hydroxypentyl)-N-(4-hydroxybutyl)aniline, 4-amino-3-methoxyl-N-ethyl-N-(4-hydroxybutyl)aniline, 4-amino-3-ethoxyl-N,N-bis(5-hydroxypentyl)aniline, 4-amino-3-propyl-N-(4-hydroxybutyl)aniline, and their sulfates, hydrochlorides, and p-toluenesulfonates. Among them, in particular, 3-methyl-4-amino-N-ethyl-N-β-hydroxyethylaniline, 4-amino-3-methyl-N-ethyl-N-(3-hydroxypropyl)aniline, 4-amino-3-methyl-N-ethyl-N-(4-hydroxybutyl)aniline, and their hydrochloride, p-toluenesulfonate or sulfate are preferable. A combination of two or more of these compounds may be used in accordance with the purpose.

The color developer generally contains, for example, pH-buffers, such as carbonates, borates, or phosphates of alkali metals, and development inhibitors or antifoggants, such as chloride salts, bromide salts, iodide salts, benzimidazoles, benzothiazoles, or mercapto compounds. The color developer may, if necessary, contain various preservatives, such as hydroxylamine, diethylhydroxylamine, sulfites, hydrazines for example N,N-bis-carboxymethylhydrazine, phenylsemicarbazides, triethanolamine, and catecholsulfonic acids, organic solvents such as ethylene glycol and diethylene glycol, development accelerators such as benzyl alcohol, polyethylene glycol, quaternary ammonium salts, and amines, dye forming couplers, competing couplers, auxiliary developers such as 1-phenyl-3-pyrazolidone, tackifiers, and various chelate agents as represented by aminopolycarboxylic acids, aminopolyphosphonic acids, alkylphosphonic acids, and phosphonocarboxylic acids, typical example thereof being ethylenediaminetetraacetic acid, nitrilotriacetic acid, diethylenetriaminepentaacetic acid, cyclohexanediaminetetraacetic acid, hydroxyethyl-iminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, and ethylenediamine-di(o-hydroxyphenylacetic acid), and their salts.

Processing solutions and processes, excluding color developer and developing, for the color reversal photographic material of the present invention will be described below.

Process from a black and white developing to a color developing in the processing of the color reversal photographic material of the present invention includes the following processes.

1) Black and white developing—water washing—reversal processing—color developing,
2) Black and white developing—water washing—light reversal processing—color developing, and
3) Black and white developing—water washing—color developing.

Any water washing process in the above processes 1) to 3) can be altered by rinse process described in, for example U.S. Pat. No. 4,804,616, to intend the simplification of process or decreasing of waste solution.

Process after color developing will be described below.

4) Color developing—conditioning—bleaching—fixing—water washing—stabilizing,
5) Color developing—water washing—bleaching—fixing—water washing—stabilizing,
6) Color developing—conditioning—bleaching—water washing—fixing—water washing—stabilizing,
7) Color developing—water washing—bleaching—water washing—fixing—water washing—stabilizing,
8) Color developing—bleaching—fixing—water washing—stabilizing,
9) Color developing—bleaching—bleach-fixing—water washing—stabilizing,
10) Color developing—bleaching—bleach-fixing—fixing—water washing—stabilizing,
11) Color developing—bleaching—water washing—fixing—water washing—stabilizing,
12) Color developing—conditioning—bleach-fixing—water washing—stabilizing,
13) Color developing—water washing—bleach-fixing—water washing—stabilizing,
14) Color developing—bleach-fixing—water washing—stabilizing, or 15) Color developing—fixing—bleach-fixing—water washing—stabilizing.

In the above processing processes 4) to 15), the water washing immediately before the stabilizing may be omitted, and, on the contrary, the final stabilizing process may not be conducted. A color reversal processing process is formed by connecting any one of above processes of 1) to 3) and any one of above processes of 4) to 15).

Processing solutions for use in the color reversal process for the present invention will be described below.

In the black and white developer of the present invention any one of well known developing agents can be used. As developing agent, dihydroxybenzenes (e.g., hydroquinone), 3-pyrazolidones (e.g., 1-phenyl-3-pyrazolidone), 1-phenyl-3-pyrazolines, ascorbic acid, and a heterocyclic compound, such as condensed 2,3,4-tetrahydroquinone ring with indolene ring as described in U.S. Pat. No. 4,067,872, can be used singly or in combination.

If necessary, the black and white developer may be contained a preservative (e.g., sulfite and bisulfite), a buffer (e.g., carbonate, boric acid, borate, and alkanolamine), an alkali (e.g., hydroxide and carbonate), a dissolving assistant (e.g., polyethylene glycols and their esters), a pH adjusting agent (e.g., organic acid, such as acetic acid), a sensitizer (e.g., quaternary ammonium salt), a development accelerator, a surface-active agent, an antifoamer, a film hardener, and a tackifier.

Although the black and white developer for use in the present invention is required to contain a compound acting as a silver halide solvent, generally a sulfite added as a preservative, as described above, serves as the solvent. As useful silver halide solvents including the sulfite and others, can be mentioned, specifically, KSCN, NaSCN, $K_2SO_3$, $Na_2SO_3$, $K_2S_2O_2$, $Na_2S_2O_5$, $K_2S_2O_3$, and $Na_2S_2O_3$.

The pH of thus-prepared developer is selected so as to give desired density and contrast, but generally the pH is in a range of about 8.5 to 11.5.

When a sensitizing treatment is intended to carry out, it is enough to elongate the processing time to maximum 3 times a standard process. At this time, the elongation time for sensitizing process can be shortened by raising the temperature of processing.

Generally the pH of this color developer and black-and-white developing solution is 9 to 12. The replenishing amount of these developing solutions is generally 3 liter or below per square meter of the color photographic material to be processed, though the replenishing amount changes depending on the type of color photographic material, and if the concentration of bromide ions in the replenishing solution is lowered previously, the replenishing amount can be lowered to 500 ml or below per square meter of the color photographic material. If it is intended to lower the replenishing amount, it is preferable to prevent the evaporation of the solution and oxidation of the solution with air by reducing the area of the solution in processing tank that is in contact with the air.

The contact area of the photographic processing solution with the air in the processing tank is represented by the opened surface ratio which is defined as follows:

$$\text{Opened surface ratio } (\text{cm}^{-1}) = \frac{\text{Contact surface area } (\text{cm}^2) \text{ of the processing solution with the air}}{\text{Whole volume } (\text{cm}^3) \text{ of the processing solution}}$$

wherein "contact surface area of the processing solution with the air" means a surface area of the processing solution that is not covered by anything such as floating lids or rolls.

The opened surface ratio is preferably 0.1 $cm^{-1}$ or less, more preferably 0.001 to 0.05 $cm^{-1}$. Methods for reducing the opened surface ratio that can be mentioned include a utilization of movable lids as described in JP-A No. 82033/1989 and a slit-developing process as described in JP-A No. 216050/1988, besides a method of providing a shutting materials such as floating lids on the surface of the photographic processing solution of the processing tank. It is preferable to adopt the means for reducing the opened surface ratio not only in a color developing and black-and-white developing process but also in all succeeding processes, such as bleaching, bleach-fixing, fixing, washing, and stabilizing process. It is also possible to reduce the replenishing amount by using means of suppressing the accumulation of bromide ions in the developer.

A reversal bath to be used after black and white developing can be contained a well known fogging agent, for example complex salts of stannous ions, such as a complex salt of stannous ions and organic acid (e.g., described in U.S. Pat. No. 3,617,282), a complex salt of stannous ions and organic phosphonocarbonyl acid (e.g., described in JP-B No. 23616/1981), and a complex salt of stannous ions and aminopolycarbonyl acid (e.g., described in U.S. Pat. No. 1,209,050); boron compounds, such as a hydrogenated boron compound (e.g., described in U.S. Pat. No. 2,984,567) and a heterocyclic amine boron compound (e.g., described in British Patent No. 1,011,000). The pH of this fogging bath (reversal bath) ranges broadly from an acid side to an alkaline side, and the pH is generally in a range of 2 to 12, preferably 2.5 to 10, particularly preferably 3 to 9. A light reversal processing by reexposure of light may be carried out instead of a reversal bath, and the reversal process may be omitted by adding the above-described fogging agent into a color developer.

Although the processing time of color developing is settled, in generally, between 2 and 5 minutes, the time can be shortened by, for example, processing at high temperature and at high pH, and using a color developer having high concentration of a color developing agent.

The silver halide color photographic material of the present invention is generally subjected to a bleaching process or a bleach-fixing process, after the color developing. These processes may be carried out immediately after color developing without through the other process. Alternately, the bleaching process or bleach-fixing process may be carried out after processes, such as stopping, conditioning, and water washing following color developing, in order to prevent unrequired post development and aerial fog and to reduce the carried over of color developer to desilvering process, or in order to wash out or make harmless such components as sensitizing dyes, dyes, or the like contained in the photographic material and the developing agent impregnated into the photographic material.

The photographic emulsion layer are generally subjected to a bleaching process after color development. The beaching process can be carried out together with the fixing process (bleach-fixing process), or it can be carried out separately from the fixing process. Further, to quicken the process bleach-fixing may be carried out after the bleaching process. In accordance with the purpose, the process may be arbitrarily carried out using a bleach-fixing bath having two successive tanks, or a fixing process may be carried out before the bleach-fixing process, or a bleaching process may be carried out after the bleach-fixing process. As the bleaching agent, use can be made of, for example, compounds of polyvalent metals, such as iron (III) peroxides, quinones, and nitro compounds. As typical bleaching agent, use can be made of organic complex salts of iron (III), such as complex salts of aminopolycarboxylic acids, for example ethylenediaminetetraacetic acid, diethylenetriaminepentaaacetic acid, cyclohexanediaminetetraacetic acid, methyliminodiacetic acid, 1,3-diaminopropanetetraacetic acid, and glycoletherdiaminetetraacetic acid, citric acid, tartaric acid, and malic acid. Of these, aminopolycarboxylic acid iron (III) complex salts, including ethylenediaminetetraacetic acid iron (III) complex salt and 1,3-diaminopropanetetraacetic acid iron (III) complex salt are preferable in view of rapid-processing and the prevention of pollution problem. Further, aminopolycarboxylic acid iron (III) complex salts are particularly useful in a bleaching solution as well as a bleach-fixing solution. The pH of the bleaching solution or the bleach-fixing solution using these aminopolycarboxylic acid iron (III) complex salts is generally 4.0 to 8.0, by if it is required to quicken the process, the process can be effected at a low pH.

In the bleaching solution, the bleach-fixing solution, and the bath preceding them a bleach-accelerating agent may be used if necessary. Examples of useful bleach-accelerating agents are compounds having a mercapto group or a disulfide linkage, described in U.S. Pat. No. 3,893,858, West German Patent Nos. 1,290,812 and 2,059,988, JP-A Nos. 32736/1978, 57831/1978, 37418/1978, 72623/1978, 95630/1978, 95631/1978, 104232/1978, 124424/1978, 141623/1978, and 28426/1978, and *Research Disclosure* No. 17129 (July, 1978); thiazolidine derivatives, described in JP-A No. 140129/1975; thiourea derivatives, described in JP-B No. 8506/1970, JP-A Nos. 20832/1977 and 32735/1978, and U.S. Pat. No. 3,706,561; iodide salts, described in West German Patent No. 1,127,715 and JP-A No. 16235/1983; polyoxyethylene compounds in West German Patent Nos. 966,410 and 2,748,430; polyamine compounds, described in JP-B No. 8836/1970; other compounds, described in JP-A Nos. 40943/1974, 59644/1974, 94927/1978, 35727/1979, 26506/1980, and 163940/1983; and bromide ions. Of these, compounds having a mercapto group or a disulfide group are preferable in view of higher acceleration effect, and in particular, compounds described in U.S. Pat. No. 3,893,858, West German Patent No. 1,290,812, and JP-A No. 95630/1978 are preferable. Further, compound described in U.S. Pat. No. 4,552,834 are preferable. These bleach-accelerating agents may be added into a photographic material. When the color photographic materials for photographing are to be bleach-fixed, these bleach-accelerating agents are particularly effective.

In addition to the above compounds, an organic acid is preferably contained in the bleach solution or bleach-fix solution in order to prevent bleach stain. A particularly preferable organic acid is a compound having an acid dissociation constant (pKa) of 2 to 5, and specifically, for example, acetic acid, propionic acid hydroxyacetic acid are preferable.

As a fixing agent to be used in the fixing solution and the bleach-fix solution, thiosulfates, thiocyanates, thioether compounds, thioureas, and large amounts of iodides can be mentioned, although thiosulfates are used generally, and particularly ammonium thiosulfate is used most widely. A combination, for example, of a thiosulfate with a thiocyanate, a thioether compound, or thiourea is also used preferably. As preservatives for the fixing solution or the bleach-fix solution, sulfites, bisulfites, carbonyl bisulfite adducts, and sulfinic acid compounds described in European Patent No. 294,769A are preferable. Further, in order to stabilize the fixing solution or the bleach-fix solution, the addition of various aminopolycarboxylic acids or organic phosphonic acids to the solution is preferable.

In the present invention, to the fixing solution or the bleach-fix solution, a compound having a pKa of 6.0 to 9.0, preferably imidazoles, such as imidazole, 1-methylimidazole, 1-ethylimidazole, and 2-methylimidazole, is preferably added in an amount of 0.1 to 10 mol/liter in order to adjust the pH.

The total period of the desilvering step is preferably made shorter within the range wherein silver retention will not occur. A preferable period is 1 to 3 min, more preferably 1 to 2 min. The processing temperature is 25° to 50° C., preferably 35° to 45° C. In a preferable temperature range, the desilvering speed is improved and the occurrence of stain after the processing can effectively be prevented.

In the desilvering step, preferably the stirring is intensified as far as possible. Specific methods for intensifying the stirring are a method described in JP-A No. 183460/1987, wherein a jet stream of a processing solution is applied to the emulsion surface of the photographic material; a method described in JP-A No. 183461/1987, wherein the stirring effect is increased by using a rotating means; a method wherein a photographic material is moved with a wiper blade placed in a solution in contact with the emulsion surface, to cause a turbulent flow to occur over the emulsion surface to improve the stirring effect, and a method wherein the amount of the circulating flow of the whole processing solution is increased. Such stirring improvement means are effective for any of the bleaching solution, the bleach-fix solution, and the fixing solution. The improvement of stirring seems to quicken the supply of the bleaching agent and the fixing agent to the emulsion coating, thereby bringing about an increase of the desilvering speed. The above stirring improvement means is more effective when a bleach accelerator is used and the means can increase the acceleration effect remarkably or can cancel the fixing inhibiting effect of the bleach accelerator.

Preferably, the automatic processor used for the present photographic material is provided with a photographic material conveying means described in JP-A Nos. 191257/1985, 191258/1985, and 191259/1985. As described in JP-A No. 191257/1985 mentioned above, such a conveying means can reduce extraordinarily the carry-in of the processing solution from one bath to the next bath, and therefore it is highly effective in preventing the performance of the processing solution from deteriorating. Such an effect is particularly effective in shortening the processing time in each step and in reducing the replenishing amount of the processing solution.

It is common for the silver halide color photographic material of the present invention to undergo, after a desilvering process such as fixing or bleach-fix, a washing step and/or a stabilizing step. The amount of washing water for a washing step may be set within a wide range depending on the characteristics of the photographic material (e.g., due to the materials used, such as couplers), the application of the photographic material, the washing temperature, the number of washing tanks (the number if steps), the type of replenishing system, including, for example, the counter-current system and the direct flow system and other various conditions. Of these, the relationship between the number of water-washing tanks and the amount of washing water in the multi-stage counter current system can be found according to the method described in *Journal of Society of Motion Picture and Television Engineers*, Vol. 64, pages 248 to 253 (May 1955).

According to the multi-stage-counter-current system described in the literature mentioned above, although the amount of washing water can be considerably reduced, bacteria propagate with an increase of retention time of the washing water in the tanks, leading to a problem with the resulting suspend matter adhering to the photographic material. In processing the color photographic material of the present invention, as a measure to solve this problem the method of reducing calcium ions and magnesium ions described in JP-A No. 288838/1987 can be used quite effectively. Also chlorine-type bactericides such as sodium chlorinated isocyanurate, cyabendazoles, isothiazolone compounds described in JP-A No. 8542/1982, benzotriazoles, and other bactericides described by Hiroshi Horiguchi in *Bokin Bobai-zai no Kagaku*, (1986) published by Sankyo-Shuppan, *Biseibutsu no mekkin, Sakkin, Bobaigijutsu* (1982) edited by Eiseigijutsu-kai, published by Kogyo-Gijutsu-kai, and in *Bokin Bobaizai Jiten* (1986) edited by Nihon Bokin Bobai-gakkai, can be used.

The pH of the washing water used in processing the photographic material of the present invention is 4 to 9, preferably 5 to 8. The washing water temperature and the washing time to be set may very depending, for example, on the characteristics and the application of the photographic material, and they are generally selected in the range of 15° to 45° C. for 20 sec to 10 min, and preferably in the range of 25° to 40° C. for 30 sec to 5 min. Further, the photographic material of the present invention can be processed directly with a stabilizing solution instead of the above washing. In such a stabilizing process, any of known processes, for example, described in JP-A Nos. 8543/1982, 14834/1983, and 220345/1985.

In some cases, the above washing process is further followed by stabilizing process, and as an example thereof can be mentioned a stabilizing bath that is used as a final bath for color photographic materials for photography, which contains a dye-stabilizing agent and a surface-active agent. As an example of dye-stabilizing agent can be mentioned aldehyde (e.g., formalin and gultaraldehyde), N-methylol compound, hexamethylenetetramine and aldehyde-sulfite adduct. In this stabilizing bath, each kind of the chelating agents and bactericides may be added.

The over-flowed solution due to the replenishing of washing solution and/or stabilizing solution may be reused in other steps, such as a desilvering step.

When each of the above-mentioned processing solutions is concentrated due to the evaporation of water in the processing using an automatic processor, preferably water to correct the concentration is added into each solution.

The silver halide color photographic material of the present invention may contain therein a color-developing agent for the purpose of simplifying and quickening the process. To contain such a color-developing agent, it is preferable to use a precursor for color-developing agent. For example, indoaniline-type compounds described in U.S. Pat. No. 3,342,597, Schiff base-type compounds described in U.S. Pat. No. 3,342,599 and *Research Disclosure* Nos. 14850 and 15159, aldol compounds described in *Research Disclosure* No. 13924, metal salt complexes described in U.S. Pat. No. 3,719,492, and urethane-type compounds described in JP-A No. 135628/1978 can be mentioned.

For the purpose of accelerating the color development, the present silver halide color photographic material may contain, if necessary, various 1-phenyl-3-pyrazolicones. Typical compounds are described in JP-A Nos. 64339/1981, 144547/1982, and 115438/1983.

The various processing solutions used for the present invention may be used at 10° to 50° C. Although generally a temperature of 33° to 38° C. may be standard, a higher temperature can be used to accelerate the process to reduce the processing time, or a lower temperature can be used to improve the image quality or the stability of the processing solution.

According to the present invention, a silver halide color photographic material of the present invention excellent in sensitivity/graininess ratio and color reproduction can be obtained.

Further, according to the present invention, a silver halide color photographic material excellent in maximum color density, sharpness and processing ability for stabilizing can be obtained.

Further, according to the present invention, a silver halide color photographic material excellent in color formation, image-dye stability and sensitivity can be obtained.

Further, according to the present invention, a silver halide color photographic material excellent in image-dye stability and improved residual color after development processing can be obtained.

Further, according to the present invention, a silver halide color photographic material improved graininess can be obtained.

Further, according to the present invention, a silver halide color photographic material excellent in saturation and color reproduction of primary colors and intermediate colors can be obtained.

Further, according to the present invention, a silver halide color photographic material excellent in stability at development processing.

The present invention will be described concretely in accordance with examples, but the invention is not limited to them.

Compounds used in Examples shown below are as follows:

C-1

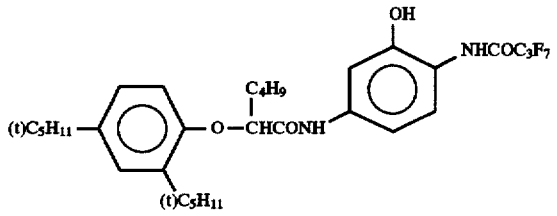

-continued
C-2
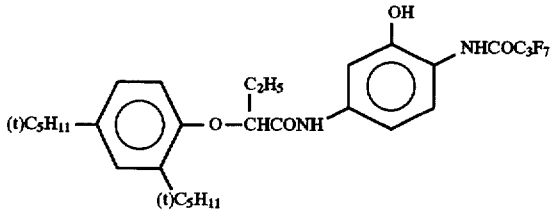
C-3
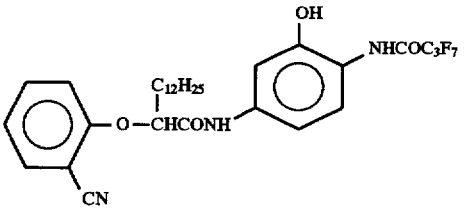
C-4
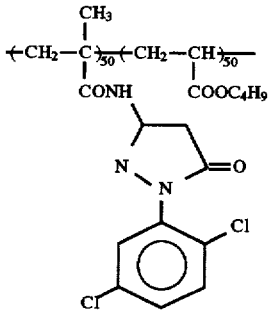
Figures represent wt%
average molecular wt: about 25,000
C-5
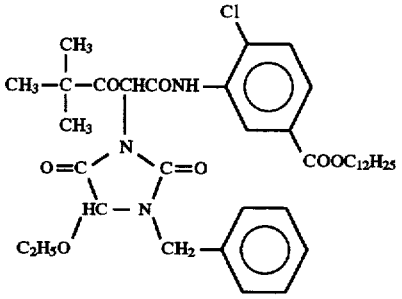
C-6
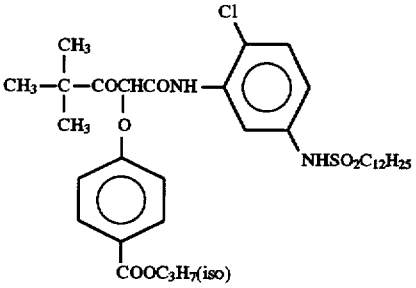

-continued
C-7
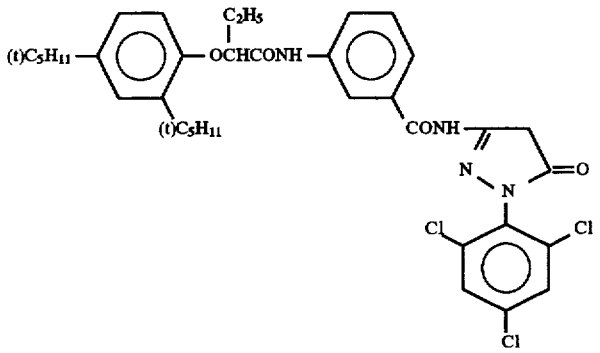
C-8
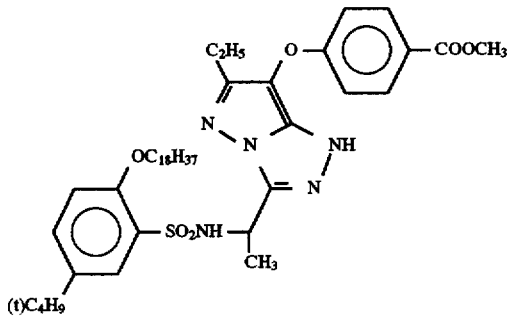
C-9
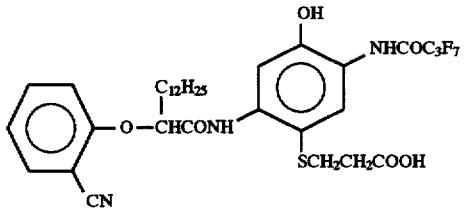
C-10
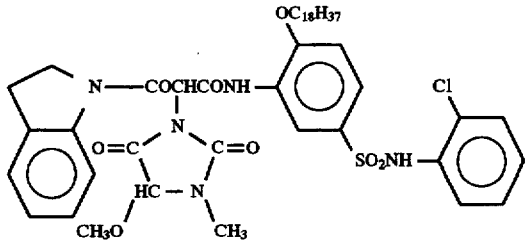
Dibutyl phthalate — Oil-1
Tricresyl phosphate — Oil-2
Oil-3
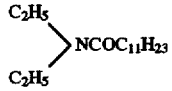
Cpd-A
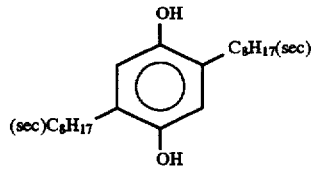

-continued
Cpd-B
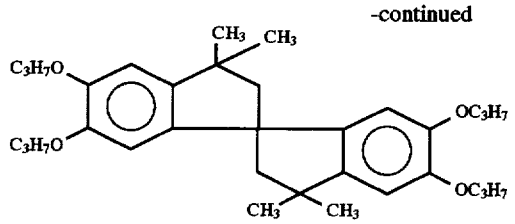
Cpd-C
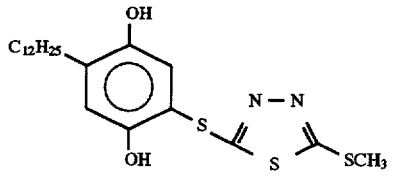
Cpd-D
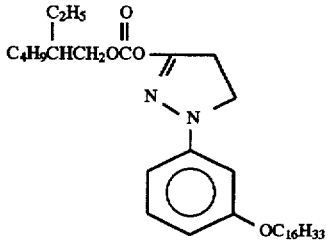
Cpd-E
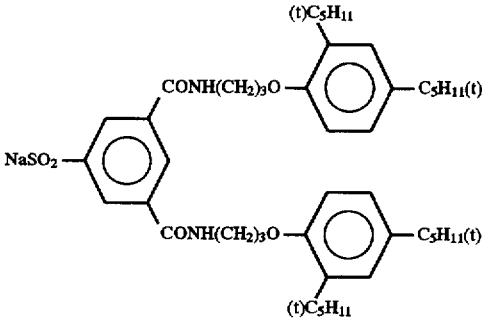
Cpd-F
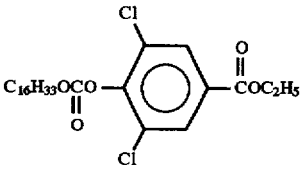
Cpd-G
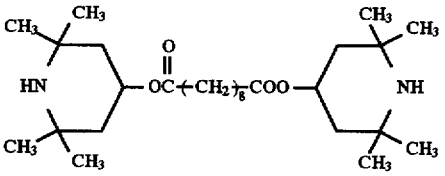
Cpd-H
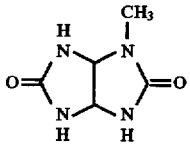
Cpd-I
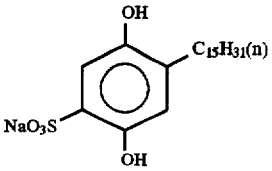

-continued
Cpd-J
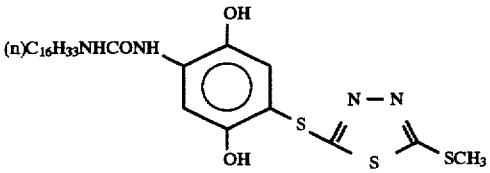
Cpd-K
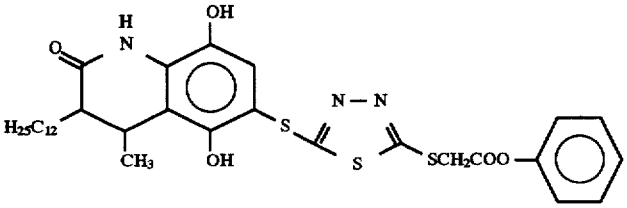
Cpd-L
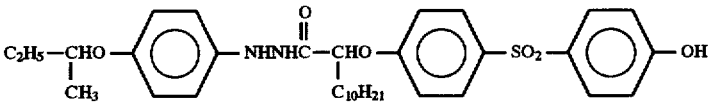
U-1
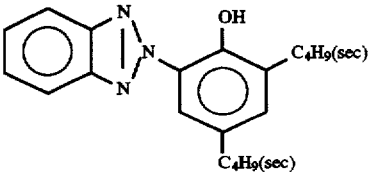
U-2
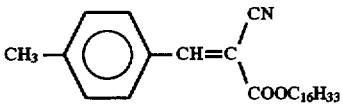
U-3
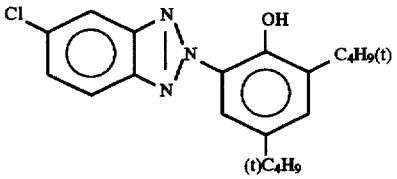
U-4
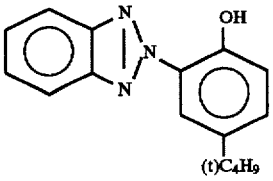
U-5
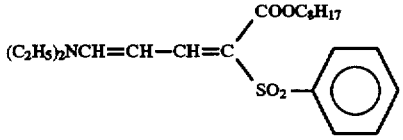
U-6
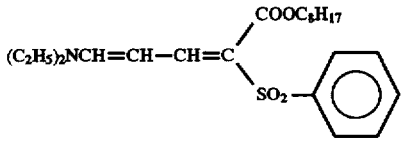
S-1
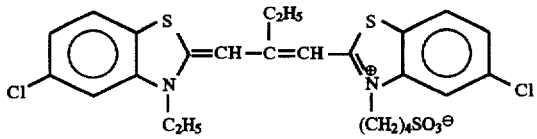

-continued
S-2
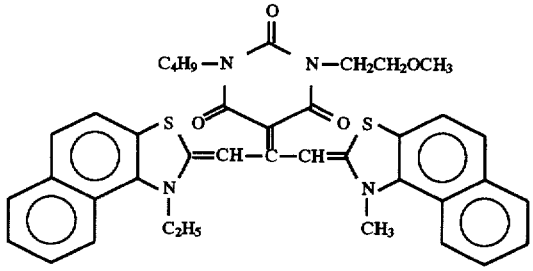
S-3
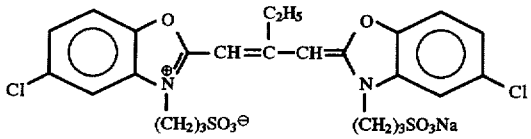
S-4
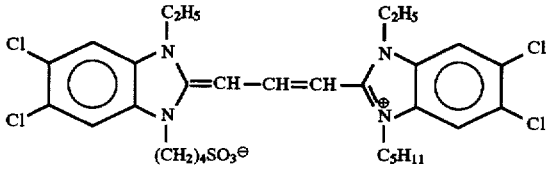
S-5
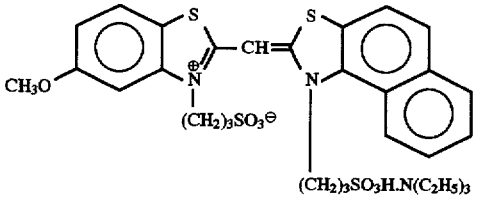
S-6
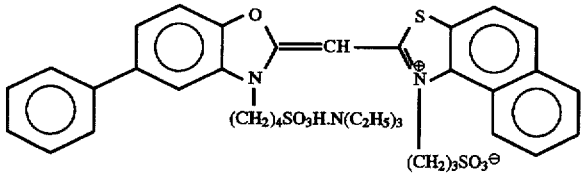
S-7
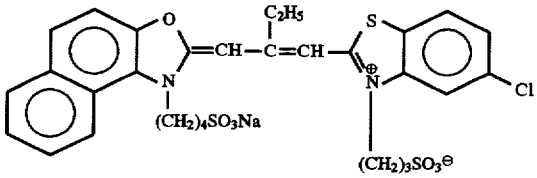
S-8
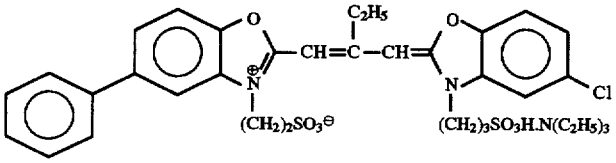
D-1
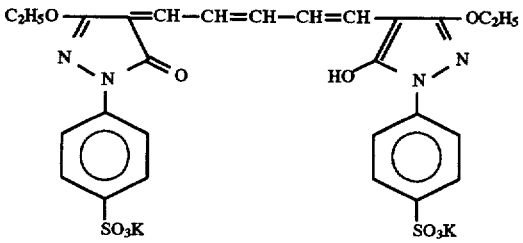

-continued
D-2
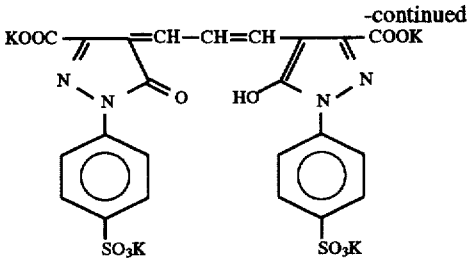
D-3
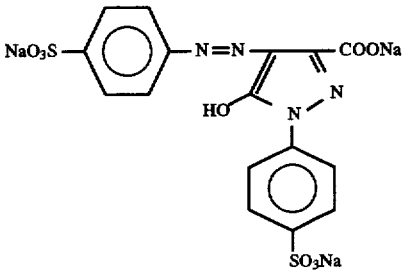
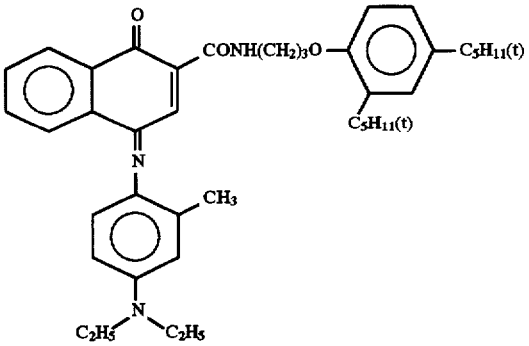
D-5
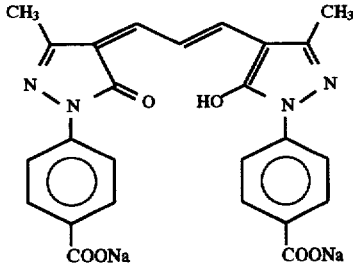
E-1
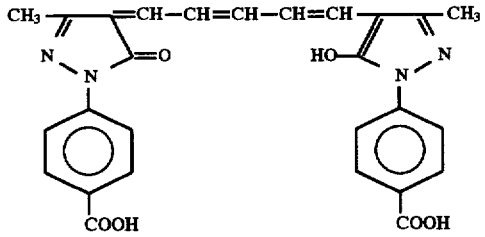
E-2
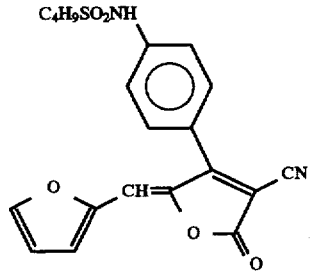

-continued
$CH_2{=}CH{-}SO_2{-}CH_2{-}CONH{-}CH_2$
$CH_2{=}CH{-}SO_2{-}CH_2{-}CONH{-}CH_2$ H-1
$C_8F_17SO_2NHCH_2CH_2CH_2OCH_2CH_2\overset{\oplus}{N}(CH_3)_3$ W-1
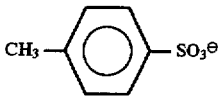
$C_8F_17SO_2N(C_3H_7)CH_2COOK$ W-2
$CH_2COOCH_2CH(C_2H_5)C_4H_9$
$NaO_3S{-}CHCOOCH_2CH(C_2H_5)C_4H_9$ W-3
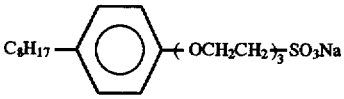
W-4
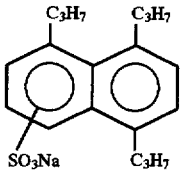
W-5
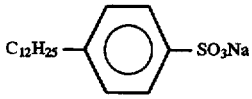
W-6
$(CH_2{-}CH)_n$
$CONHC_4H_9(t)$ P-1
$(CH_2{-}CH)_n$
$COOC_4H_9$ M-1
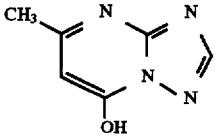
F-1
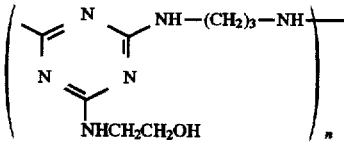
$\cdot HNO_3$ F-2
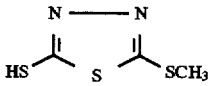
F-3
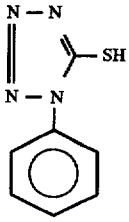
F-4

-continued

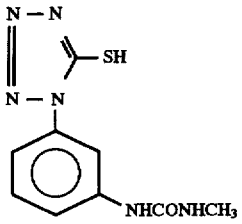

F-5

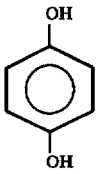

F-6

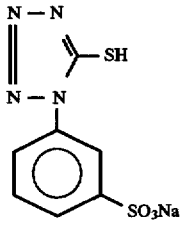

F-7

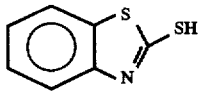

F-8

EXAMPLE 1

A multilayer color photographic material was prepared by multi-coating each layer having composition as shown below on a prime-coated triacetate cellulose film support having a thickness of 127 μm, and it was designated Sample 101. The figures shown indicate the added amounts per $m^2$. The effects of the compound added are not restricted to the shown usage.

| | |
|---|---|
| First layer: Halation-preventing layer | |
| Black colloidal silver | 0.20 g |
| Gelatin | 1.9 g |
| UV-absorbent U-1 | 0.1 g |
| UV-absorbent U-3 | 0.04 g |
| UV-absorbent U-4 | 0.1 g |
| High boiling organic solvent Oil-1 | 0.1 g |
| Fine crystal solid dispersion of dye E-1 | 0.1 g |
| Second layer: Intermediate layer | |
| Gelatin | 0.40 g |
| Compound Cpd-C | 5 mg |
| Compound Cpd-J | 5 mg |
| Compound Cpd-K | 3 mg |
| High-boiling organic solvent Oil-3 | 0.1 g |
| Dye D-4 | 0.4 mg |
| Third layer: Intermediate layer | |
| Silver iodobromide emulsion of fine grains surfaces and inner parts of which were fogged (av. grain diameter 0.06 μm, deviation coefficient: 18%, AgI content: 1 mol %) | silver 0.05 g |
| Gelatin | 0.4 g |
| Fourth layer: Low sensitivity red-sensitive emulsion layer | |
| Emulsion Em-1 | silver 0.5 g |

-continued

| | |
|---|---|
| Gelatin | 0.8 g |
| Coupler C-1 | 0.15 g |
| Coupler C-2 | 0.05 g |
| Coupler C-3 | 0.10 g |
| Compound Cpd-C | 10 mg |
| High-boiling organic solvent Oil-2 | 0.1 g |
| Additive P-1 | 0.1 g |
| Fifth layer: Medium sensitivity red-sensitive emulsion layer | |
| Emulsion Em-2 | silver 0.5 g |
| Gelatin | 0.8 g |
| Coupler C-1 | 0.2 g |
| Coupler C-2 | 0.05 g |
| Coupler C-3 | 0.2 g |
| High boiling organic soivent Oil-2 | 0.1 g |
| Additive P-1 | 0.1 g |
| Sixth layer: High sensitivity red-sensitive emulsion layer | |
| Emulsion Em-3 | silver 0.4 g |
| Gelatin | 1.1 g |
| Coupler C-1 | 0.3 g |
| Coupler C-2 | 0.1 g |
| Coupler C-3 | 0.7 g |
| Additive P-1 | 0.1 g |
| Seventh layer: Intermediate layer | |
| Gelatin | 0.6 g |
| Additive M-1 | 0.3 g |
| Color-mix preventing agent Cpd-1 | 2.6 mg |
| UV-absorbent U-1 | 0.01 g |
| UV-absorbent U-2 | 0.002 g |
| UV-absorbent U-5 | 0.01 g |
| Dye D-1 | 0.02 g |
| Dye D-5 | 0.02 g |
| Compound Cpd-C | 5 mg |
| Compound Cpd-J | 5 mg |
| Compound Cpd-K | 5 mg |
| High-boiling organic solvent Oil-1 | 0.02 g |

-continued

| | |
|---|---|
| Eighth layer: Intermediate layer | |
| Silver iodobromide emulsion of fine grains surfaces and inner parts of which were fogged (av. grain diameter: 0.06 μm, deviation coefficient: 16%, AgI content: 0.3 mol %) | silver 0.02 g |
| Gelatin | 1.0 g |
| Additive P-1 | 0.2 g |
| Color-mix preventing agent Cpd-A | 0.1 g |
| Ninth layer: Low sensitivity green-sensitive emulsion layer | |
| Emulsion E | silver 0.1 g |
| Emulsion F | silver 0.2 g |
| Emulsion G | silver 0.2 g |
| Gelatin | 0.5 g |
| Coupler C-4 | 0.1 g |
| Coupler C-7 | 0.05 g |
| Coupler C-8 | 0.20 g |
| Compound Cpd-B | 0.03 g |
| Compound Cpd-C | 10 mg |
| Compound Cpd-D | 0.02 g |
| Compound Cpd-E | 0.02 g |
| Compound Cpd-F | 0.02 g |
| Compound Cpd-G | 0.02 g |
| Compound Cpd-L | 0.05 g |
| High-boiling organic solvent Oil-1 | 0.1 g |
| High-boiling organic solvent Oil-2 | 0.1 g |
| Tenth layer: Medium sensitivity green-sensitive emulsion layer | |
| Emulsion G | silver 0.3 g |
| Emulsion H | silver 0.1 g |
| Gelatin | 0.6 g |
| Coupler C-4 | 0.1 g |
| Coupler C-7 | 0.2 g |
| Coupler C-8 | 0.1 g |
| Compound Cpd-B | 0.03 g |
| Compound Cpd-D | 0.02 g |
| Compound Cpd-E | 0.02 g |
| Compound Cpd-F | 0.05 g |
| Compound Cpd-G | 0.05 g |
| Compound Cpd-L | 0.05 g |
| High-boiling organic solvent Oil-2 | 0.01 g |
| Eleventh layer: High sensitivity green-sensitive emulsion layer | |
| Emulsion I | silver 0.5 g |
| Gelatin | 1.0 g |
| Coupler C-4 | 0.3 g |
| Coupler C-7 | 0.1 g |
| Coupler C-8 | 0.1 g |
| Compound Cpd-B | 0.08 g |
| Compound Cpd-C | 5 mg |
| Compound Cpd-D | 0.02 g |
| Compound Cpd-E | 0.02 g |
| Compound Cpd-F | 0.02 g |
| Compound Cpd-G | 0.02 g |
| Compound Cpd-J | 5 mg |
| Compound Cpd-K | 5 mg |
| Compound Cpd-L | 0.05 g |
| High-boiling organic solvent Oil-1 | 0.02 g |
| High-boiling organic solvent Oil-2 | 0.02 g |
| Twelfth layer: Intermediate layer | |
| Gelatin | 0.6 g |
| Thirteenth layer: Yellow filter layer | |
| Yellow colloidal silver | silver 0.07 g |
| Gelatin | 1.1 g |
| Color-mix preventing agent Cpd-A | 0.01 g |
| High-boiling organic solvent Oil-1 | 0.01 g |
| Fine crystal solid dispersion of Dye E-2 | 0.05 g |
| Fourteenth layer: Intermediate layer | |
| Gelatin | 0.6 g |

-continued

| | |
|---|---|
| Fifteenth layer: Low sensitivity blue-sensitive emulsion layer | |
| Emulsion J | silver 0.2 g |
| Emulsion K | silver 0.3 g |
| Emulsion L | silver 0.1 g |
| Gelatin | 0.8 g |
| Coupler C-5 | 0.2 g |
| Coupler C-6 | 0.1 g |
| Coupler C-10 | 0.4 g |
| Sixteen layer: Medium sensitivity blue-sensitive emulsion layer | |
| Emulsion L | silver 0.1 g |
| Emulsion M | silver 0.4 g |
| Gelatin | 0.9 g |
| Coupler C-5 | 0.3 g |
| Coupler C-6 | 0.1 g |
| Coupler C-10 | 0.1 g |
| Seventeenth layer: High sensitivity blue-sensitivity emulsion layer | |
| Emulsion N | silver 0.4 g |
| Gelatin | 1.2 g |
| Coupler C-5 | 0.1 g |
| Coupler C-6 | 0.1 g |
| Coupler C-10 | 0.6 g |
| High-boiling organic solvent Oil-2 | 0.1 g |
| Eighteenth layer: First protective layer | |
| Gelatin | 0.7 g |
| UV-absorbent U-1 | 0.2 g |
| UV-absorbent U-2 | 0.05 g |
| UV-absorbent U-5 | 0.3 g |
| Formalin scavenger Cpd-H | 0.4 g |
| Dye D-1 | 0.1 g |
| Dye D-2 | 0.05 g |
| Dye D-3 | 0.1 g |
| Nineteenth layer: Second protective layer | |
| Colloidal silver | silver 0.1 mg |
| Silver iodobromide emulsion of fine grains (av. grain diameter: 0.06 μm, AgI content: 1 mol %) | silver 0.1 g |
| Gelatin | 0.4 g |
| Twentieth layer: Third protective layer | |
| Gelatin | 0.4 g |
| Poly(methylmethacrylate) (av. grain diameter: 1.5 μm) | 0.1 g |
| Copolymer of metylmethacrylate and acrylic acid (4:6) (av. grain diameter: 1.5 μm) | 0.1 g |
| Silicone oil | 0.03 g |
| Surface-active agent W-1 | 3.0 mg |
| Surface-active agent W-2 | 0.03 g |

Further, to all emulsion layers, in addition to the above-described components, additives F-1 to F-8 were added. Further, to each layer, in addition to the above-described components, gelatin hardener H-1 and surface-active agents W-3, W-4, W-5, and W-6 for coating and emulsifying were added.

Further, as antifungal and antibacterial agents, phenol, 1,2-benzisothiazoline-3-one, 2-phenoxyethanol, phenetylalcohol and p-benzoic buthylester were added.

Silver iodobromide emulsions used for Sample 101 are as follows:

| Emulsion | Feauture of grain | Average grain-diameter corresponding to sphere (μm) | Deviation coefficient (%) | AgI content (%) |
|---|---|---|---|---|
| E | Monodisperse cubic grain | 0.20 | 17 | 4.0 |
| F | Monodisperse cubic grain | 0.23 | 16 | 4.0 |
| G | Monodisperse cubic internal latent image-type grain | 0.28 | 11 | 3.5 |
| H | Monodisperse cubic internal latent image-type grain | 0.32 | 9 | 3.5 |
| I | Tabular grain, average aspect ratio: 9.0 | 0.80 | 28 | 1.5 |
| J | Monodisperse tetradecahedral grain | 0.30 | 18 | 4.0 |
| K | Monodisperse tabular grain, average aspect ratio: 7.0 | 0.45 | 17 | 4.0 |
| L | Monodisperse cubic internal latent image-type grain | 0.46 | 14 | 3.5 |
| M | Monodisperse tabular grain, average aspect ratio: 10.0 | 0.55 | 13 | 4.0 |
| N | Tabular grain, average aspect ratio: 12.0 | 1.00 | 33 | 1.3 |

Spectral sensitizing dyes and their amounts added to Emulsions E to N were as follows:

| Emulsion | Sensitizing dye added | Amount added (g) per mol of silver halide |
|---|---|---|
| E | S-3 | 0.5 |
| | S-4 | 0.1 |
| F | S-3 | 0.3 |
| | S-4 | 0.1 |
| G | S-3 | 0.25 |
| | S-4 | 0.08 |
| | S-8 | 0.05 |
| H | S-3 | 0.2 |
| | S-4 | 0.06 |
| | S-8 | 0.05 |
| I | S-3 | 0.3 |
| | S-4 | 0.07 |
| | S-8 | 0.1 |
| J | S-6 | 0.2 |
| | S-5 | 0.05 |
| K | S-6 | 0.2 |
| | S-5 | 0.05 |
| L | S-6 | 0.22 |
| | S-5 | 0.06 |
| M | S-6 | 0.15 |
| | S-5 | 0.04 |
| N | S-6 | 0.22 |
| | S-5 | 0.06 |

Samples 102 to 109 were prepared in the same manner as Sample 101, except that cyan couplers and emulsions in red-sensitive emulsion layers (i.e., the 4th, 5th, and 6th layer) were changed as shown in Table 11.

TABLE 11

| | Cyan coupler | | | Emulsion | | |
|---|---|---|---|---|---|---|
| Sample No. | 4th layer | 5th layer | 6th layer | 4th layer | 5th layer | 6th layer |
| 101 | (Conventional cyan couplers)* | | | Em-1 | Em-2 | Em-3 |
| 102 | | Ib-1 | | " | " | " |
| 103 | | " | | " | " | " |
| 104 | | " | | Em-4 Em-5 | Em-6 | " |
| 105 | | " | | Em-4 Em-5 | Em-6 | Em-7 |
| 106 | The same as Sample 101 | | | " | " | " |
| 107 | | Ib-9 | | " | " | " |
| 108 | | Ic-3 | | " | " | " |

TABLE 11-continued

| | Cyan coupler | | | Emulsion | | |
|---|---|---|---|---|---|---|
| Sample No. | 4th layer | 5th layer | 6th layer | 4th layer | 5th layer | 6th layer |
| 109 | | Ih-12 | | " | " | " |

Note: *Coupler C-1, C-2, and C-3

Emulsions Em (silver halide iodobromide emulsions) used in Example 1 are shown in Table 12.

TABLE 12

| Emulsion No. | Feature of grain | Average grain-diameter corresponding to sphere (μm) | Deviation coefficient (%) | AgI content (%) |
|---|---|---|---|---|
| Em-1 | Polydisperse cubic grain | 0.35 | 37 | 3.7 |
| Em-2 | Polydisperse cubic grain | 0.45 | 25 | 3.5 |
| Em-3 | Polydisperse tabular grain average aspect ratio: 6.5 | 0.70 | 35 | 2.0 |
| Em-4 | Monodisperse tetradecahedral grain | 0.25 | 14 | 3.7 |
| Em-5 | Monodisperse cubic grain | 0.32 | 11 | 3.7 |
| Em-6 | Monodisperse tetradecahedral grain | 0.40 | 17 | 3.5 |
| Em-7 | Monodisperse tabular grain, average aspect ratio: 7.0 | 0.67 | 18 | 2.0 |

Thus-prepared Samples 101 to 109 were tested according to the method shown below. Results are shown in Table 13.

Method of Evaluation of the Samples (1) Color reproduction

The sample was exposed to light from a white light source through a cyan filter and was processed in the processing steps shown below, by an automatic processor, and the yellow density, at the section where the cyan density was 2.0, was measured. The lower the yellow density is, the higher the saturation of the color of the cyan is, indicating it is excellent in color reproduction.

(2) Sensitivity/graininess ratio

The sample was exposed to light from a white light source through a deposited wedge filter for 1/100 sec and was processed in the processing steps shown below. The RMS graininess and the relative sensitivity, at the section wherein the cyan density was 1.0, were measured.

(3) Storage stability

A sample stored in a freezer and a sample that had been stored at a temperature of 50° C. and humidity of 55% for 7 days were taken out, were exposed to light, and were processed, in the same manner as the above (2), and the relative sensitivity thereof was measured when the cyan density was 1.0. Herein "relative sensitivity" means a relative value of reciprocal of the exposure amount that gives cyan density of 1.0. The difference between the sensitivity of the sample that had been stored in a freezer and the sensitivity of the sample that had been stored at 50° C. and 55% is shown. It indicates that the smaller the difference is, the more the storage stability is.

Processing process

| Process | Time | Temperature | Tank volume | Replenisher amount |
|---|---|---|---|---|
| B/W development | 6 min | 38° C. | 12 liter | 2.2 l/m² |
| 1st Water-washing | 2 min | 38° C. | 4 liter | 7.5 l/m² |
| Reversal | 2 min | 38° C. | 4 liter | 1.1 l/m² |
| Color development | 6 min | 38° C. | 12 liter | 2.2 l/m² |
| Conditioning | 2 min | 38° C. | 4 liter | 1.1 l/m² |
| Bleaching | 6 min | 38° C. | 12 liter | 0.22 l/m² |
| Fixing | 4 min | 38° C. | 8 liter | 1.1 l/m² |
| 2nd water-washing | 4 min | 38° C. | 8 liter | 7.5 l/m² |
| Stabilizing | 1 min | 25° C. | 2 liter | 1.1 l/m² |

Compositions of processing solutions used were as follows:

| | Mother solution | Replenisher |
|---|---|---|
| B/W (Black and white) developer | | |
| Pentasodium nitrilo-N,N,N-trimethylenephosphonate | 2.0 g | 2.0 g |
| Sodium sulfite | 30 g | 30 g |
| Hydroquinone potassium monosulfonate | 20 g | 20 g |
| Potassium carbonate | 33 g | 33 g |
| 1-Phenyl-4-methyl-4-hydroxymethyl-3-pyrazolydone | 2.0 g | 2.0 g |
| Potassium bromide | 2.5 g | 1.4 g |
| Potassium thiocyanate | 1.2 g | 1.2 g |
| Potassium iodide | 2.0 mg | — |
| Water to make | 1,000 ml | 1,000 ml |
| pH | 9.60 | 9.60 |
| (pH was adjusted by using hydrochloric acid or potassium hydroxide) | | |
| Reversal solution | | |
| Pentasodium nitrilo-N,N,N-trimethylenephosphonate | 3.0 g | Same as mother solution |
| Stannous chloride (dihydrate) | 1.0 g | |
| P-Aminophenol | 0.1 g | |
| Sodium hydroxide | 8 g | |
| Glacial acetic acid | 15 ml | |
| Water to make | 1,000 ml | |
| pH | 6.00 | |
| (pH was adjusted by using hydrochloric acid or sodium hydroxide) | | |
| Color developer | | |
| Pentasodium nitrilo-N,N,N-trimethylenephosphonate | 2.0 g | 2.0 g |
| Sodium sulfite | 7.0 g | 7.0 g |
| Sodium tertiary phosphate (12-hydrate) | 36 g | 36 g |

-continued

| | Mother solution | Replenisher |
|---|---|---|
| Potassium bromide | 1.0 g | — |
| Potassium iodide | 90 mg | — |
| Sodium hydroxide | 3.0 g | 3.0 g |
| Cytrazinic acid | 1.5 g | 1.5 g |
| N-Ethyl-N-(β-methanesulfonamidoethyl)-3-methyl-4-aminoaniline 3/2 sulfate (mono hydrate) | 11 g | 11 g |
| 3,6-Dithia-1,8-octane-diol | 1.0 g | 1.0 g |
| Water to make | 1,000 ml | 1,000 ml |
| pH | 11.80 | 12.00 |
| (pH was adjusted by using hydrochloric acid or potassium hydroxide) | | |
| Conditioner | | |
| Disodium ethylenediaminetetraacetate (dihydrate) | 8.0 g | Same as mother solution |
| Sodium sulfite | 12 g | |
| 1-Thioglycerin | 0.4 ml | |
| Solbitan.ester* | 0.1 g | |
| Water to make | 1,000 ml | |
| pH | 6.20 | |
| (pH was adjusted by using hydrochloric acid or sodium hydroxide) | | |
| Bleaching solution | | |
| Disodium ethylenediaminetetraacetate (dihydrate) | 2.0 g | 4.0 g |
| Iron (III) ammonium ethylenediaminetetraacetate (dihydrate) | 120 g | 240 g |
| Potassium bromide | 100 g | 200 g |
| Ammonium nitrate | 10 g | 20 g |
| Water to make | 1,000 ml | 1,000 ml |
| pH | 5.70 | 5.50 |
| (pH was adjusted by using hydrochloric acid or sodium hydroxide) | | |
| Fixing solution | | |
| Ammonium thiosulfate | 8.0 g | Same as mother solution |
| Sodium sulfite | 5.0 g | |
| Sodium bisulfite | 5.0 g | |
| Water to make | 1,000 ml | |
| pH | 6.60 | |
| (pH was adjusted by using hydrochloric acid or aqueous ammonia) | | |
| Stabilizing solution | | |
| Formalin (37%) | 5.0 ml | Same as mother solution |
| Polyoxyethylene-p-monononyl phenyl ether (av. polymerization degree: 10) | 0.5 ml | |
| Water to make | 1,000 ml | |
| pH | (not adjusted) | |

Solbitan.ester*

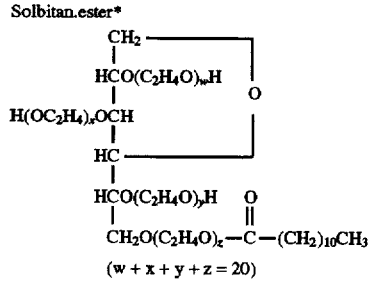

TABLE 13

| Sample No. | Relative yellow density at the part of cyan density 2.0 | Relative sensitivity (cyan density 1.0) | RMS graininess (cyan density 1.0) | Decrement of sensitivity after storage for 7 days at 50° C. and 55% RH (log E) | Remarks |
|---|---|---|---|---|---|
| 101 | 0 (standard) | 100 (standard) | 0.015 | −0.03 | Comparison |
| 102 | −0.05 | 101 | 0.015 | −0.07 | Comparison |
| 103 | −0.05 | 103 | 0.013 | −0.03 | This invention |
| 104 | −0.05 | 102 | 0.012 | −0.02 | This invention |
| 105 | −0.05 | 105 | 0.011 | −0.02 | This invention |
| 106 | 0 | 104 | 0.011 | −0.02 | Comparison |
| 107 | −0.06 | 102 | 0.010 | −0.03 | This invention |
| 108 | −0.04 | 105 | 0.011 | −0.02 | This invention |
| 109 | −0.07 | 107 | 0.012 | −0.02 | This invention |

As is apparent form the results in Table 13, it can be understood that samples according to the present invention are excellent in color reproduction, sensitivity/graininess ratio and storage stability.,

EXAMPLE 2

Samples 201 to 207 were prepared by changing cyan couplers and emulsions in the 2nd, 3rd, and 4th layers of photographic material No. 9 in Example 3, described in JP-A No. 93641/1990, as shown in Table 14.

Emulsions used are shown in Table 15.

Thus-prepared samples were processed by the same method as described in Example 3 of JP-A 93641/1990, and similar results to those of Example 1 were obtained.

TABLE 14

| Sample No. | Cyan couplers of 2nd layer to 4th layer | Emulsion 2nd layer | Emulsion 3rd layer | Emulsion 4th layer |
|---|---|---|---|---|
| 201 | ExC-1, ExC-2, ExC-3 | Emulsion of PM 9* (deviation (coefficient: 37%) | Emulsion of PM 9* (deviation coefficient: 25% and 37%) | Emulsion of PM 9* (deviation (coefficient: 25%) |
| 202 | Ib-1 | Emulsion of PM 9* (deviation (coefficient: 37%) | Emulsion of PM 9* (deviation coefficient: 25% and 37%) | Emulsion of PM 9* (deviation (coefficient: 25%) |
| 203 | The same as Sample 201 | Em-21, Em-22 | Em-23, Em-24 | Em-25 |
| 204 | Ib-1 | " | " | " |
| 205 | Ib-9 | " | " | " |
| 206 | Ic-3 | " | " | " |
| 207 | Ih-3 | " | " | " |

Note: PM 9* Photographic material 9 described in Example 3 of JP-A No. 93641/1990

TABLE 15

| Emulsion No. | Feature of grain | Average AgI content (mol %) | Average grain-diameter corresponding to sphere (μm) | Deviation coefficient (%) |
|---|---|---|---|---|
| Em-21 | Octahedral grain | 4 | 0.32 | 11 |
| Em-22 | Octahedral grain | 4 | 0.45 | 13 |
| Em-23 | Octahedral grain | 4 | 0.50 | 14 |
| Em-24 | Tabular grain | 6 | 0.65 | 17 |
| Em-25 | Tabular grain | 6 | 0.75 | 18 |

EXAMPLE 3

Preparation of Sample 301

A multilayer color photographic material was prepared by multi-coating each layer having composition as shown below on a prime-coated triacetate cellulose film support having a thickness of 127 μm, and it was designated Sample 301. The figures provided indicate the added amounts per $m^2$. The effects of the compound added are not restricted to the shown usage.

| | |
|---|---|
| First layer: Halation-preventing layer | |
| Black colloidal silver | 0.20 g |
| Gelatin | 1.9 g |
| UV-absorbent U-1 | 0.1 g |
| UV-absorbent U-3 | 0.04 g |
| UV-absorbent U-4 | 0.1 g |
| High-boiling organic solvent Oil-1 | 0.1 g |
| Fine crystal solid dispersion of dye E-1 | 0.1 g |
| Second layer: Intermediate layer | |
| Gelatin | 0.40 g |
| Compound Cpd-C | 5 mg |

-continued

| | |
|---|---|
| Compound Cpd-J | 5 mg |
| Compound Cpd-K | 3 mg |
| High-boiling organic soivent Oil-3 | 0.1 g |
| Dye D-4 | 0.4 mg |
| Third layer: Intermediate layer | |
| Gelatin | 0.4 g |
| Fourth layer: Low sensitivity red-sensitive emulsion layer | |
| Emulsion A | silver 0.1 g |
| Emulsion B | silver 0.4 g |
| Gelatin | 0.8 g |
| Coupler C-1 | 0.15 g |
| Coupler C-2 | 0.05 g |
| Coupler C-3 | 0.05 g |
| Coupler C-9 | 0.05 g |
| Compound Cpd-C | 10 mg |
| High-boiling organic solvent Oil-2 | 0.1 g |
| Additive P-1 | 0.1 g |
| Fifth layer: Medium sensitivity red-sensitive emulsion layer | |
| Emulsion B | silver 0.2 g |
| Emulsion C | silver 0.3 g |
| Gelatin | 0.8 g |
| Coupler C-1 | 0.2 g |
| Coupler C-2 | 0.05 g |
| Coupler C-3 | 0.2 g |
| High-boiling organic solvent Oil-2 | 0.1 g |
| Additive P-1 | 0.1 g |
| Sixth layer: High sensitivity red-sensitive emulsion layer | |
| Emulsion D | silver 0.4 g |
| Gelatin | 1.1 g |
| Coupler C-1 | 0.3 g |
| Coupler C-2 | 0.1 g |
| Coupler C-3 | 0.7 g |
| Additive P-1 | 0.1 g |
| Seventh layer: Intermediate layer | |
| Gelatin | 0.6 g |
| Additive M-1 | 0.3 g |
| Color-mix preventing agent Cpd-1 | 2.6 mg |
| UV-absorbent U-1 | 0.01 g |
| UV-absorbent U-2 | 0.002 g |
| UV-absorbent U-5 | 0.01 g |
| Dye D-1 | 0.02 g |
| Compound Cpd-C | 5 mg |
| Compound Cpd-J | 5 mg |
| Compound Cpd-K | 5 mg |
| High-boiling organic solvent Oil-1 | 0.02 g |
| Eighth layer: Intermediate layer | |
| Gelatin | 1.0 g |
| Additive P-1 | 0.2 g |
| Color-mix preventing agent Cpd-A | 0.1 g |
| Ninth layer: Low sensitivity green-sensitive emulsion layer | |
| Emulsion E | silver 0.1 g |
| Emulsion F | silver 0.2 g |
| Emulsion G | silver 0.2 g |
| Gelatin | 0.5 g |
| Coupler C-4 | 0.1 g |
| Coupler C-7 | 0.05 g |
| Coupler C-8 | 0.20 g |
| Compound Cpd-B | 0.03 g |
| Compound Cpd-C | 10 mg |
| Compound Cpd-D | 0.02 g |
| Compound Cpd-E | 0.02 g |
| Compound Cpd-F | 0.02 g |
| Compound Cpd-G | 0.02 g |
| High-boiling organic solvent Oil-1 | 0.1 g |
| High-boiling organic solvent Oil-2 | 0.1 g |
| Tenth layer: Medium sensitivity green-sensitive emulsion layer | |
| Emulsion G | silver 0.3 g |

-continued

| | |
|---|---|
| Emulsion H | silver 0.1 g |
| Gelatin | 0.6 g |
| Coupler C-4 | 0.1 g |
| Coupler C-7 | 0.2 g |
| Coupler C-8 | 0.1 g |
| Compound Cpd-B | 0.03 g |
| Compound Cpd-D | 0.02 g |
| Compound Cpd-E | 0.02 g |
| Compound Cpd-F | 0.05 g |
| Compound Cpd-G | 0.05 g |
| High-boiling organic solvent Oil-2 | 0.02 g |
| Eleventh layer: High sensitivity green-sensitive emulsion layer | |
| Emulsion I | silver 0.5 g |
| Gelatin | 1.0 g |
| Coupler C-4 | 0.3 g |
| Coupler C-7 | 0.1 g |
| Coupler C-8 | 0.1 g |
| Compound Cpd-B | 0.08 g |
| Compound Cpd-C | 5 mg |
| Compound Cpd-D | 0.02 g |
| Compound Cpd-E | 0.02 g |
| Compound Cpd-F | 0.02 g |
| Compound Cpd-G | 0.02 g |
| Compound Cpd-J | 5 mg |
| Compound Cpd-K | 5 mg |
| High-boiling organic solvent Oil-1 | 0.02 g |
| High-boiling organic soivent Oil-2 | 0.02 g |
| Twelfth layer: Intermediate layer | |
| Gelatin | 0.6 g |
| Thirteenth layer: Yellow filter layer | |
| Yellow colloidal silver | silver 0.07 g |
| Gelatin | 1.1 g |
| Color-mix preventing agent Cpd-A | 0.01 g |
| High-boiling organic solvent Oil-1 | 0.01 g |
| Fine crystal solid dispersion of Dye E-2 | 0.05 g |
| Fourteenth layer: Intermediate layer | |
| Gelatin | 0.6 g |
| Fifteenth layer: Low sensitivity blue-sensitive emulsion layer | |
| Emulsion J | silver 0.2 g |
| Emulsion K | silver 0.3 g |
| Emulsion L | silver 0.1 g |
| Gelatin | 0.8 g |
| Coupler C-5 | 0.2 g |
| Coupler C-6 | 0.1 g |
| Coupler C-10 | 0.4 g |
| Sixteen layer: Medium sensitivity blue-sensitive emulsion layer | |
| Emulsion L | silver 0.1 g |
| Emulsion M | silver 0.4 g |
| Gelatin | 0.9 g |
| Coupler C-5 | 0.3 g |
| Coupler C-6 | 0.1 g |
| Coupler C-10 | 0.1 g |
| Seventeenth layer: High sensitivity blue-sensitivity emulsion layer | |
| Emulsion N | silver 0.4 g |
| Gelatin | 1.2 g |
| Coupler C-5 | 0.3 g |
| Coupler C-6 | 0.6 g |
| Coupler C-10 | 0.1 g |
| Eighteenth layer: First protective layer | |
| Gelatin | 0.7 g |
| UV-absorbent U-1 | 0.2 g |
| UV-absorbent U-2 | 0.05 g |
| UV-absorbent U-5 | 0.3 g |
| Formalin scavenger Cpd-H | 0.4 g |
| Dye D-1 | 0.1 g |
| Dye D-2 | 0.05 g |
| Dye D-3 | 0.1 g |

-continued

| Nineteenth layer: Second protective layer | |
|---|---|
| Colloidal silver | silver 0.1 mg |
| Silver iodobromide emulsion of fine grains (av. grain diameter: 0.06 μm, AgI content: 1 mol %) | silver 0.1 g |
| Gelatin | 0.4 g |
| **Twentieth layer: Third protective layer** | |
| Gelatin | 0.4 g |
| Poly(methylmethacrylate) (av. grain diameter: 1.5. μm) | 0.1 g |
| Copolymer of methylmethacrylate and acrylic acid (4:6), av. grain diameter: 1.5 μm) | 0.1 g |
| Silicone oil | 0.03 g |
| Surface-active agent W-1 | 3.0 mg |
| Surface-active agent W-2 | 0.03 g |

Further, to all emulsion layers, in addition to the above-described components, additives F-1 to F-8 were added. Further, to each layer, in addition to the above-described components, gelatin hardener H-1 and surface-active agents W-3, W-4, W-5, and W-6 for coating and emulsifying were added.

Further, as antifungal and antibacterial agents, phenol, 1,2-benzisothiazoline-3-one, 2-phenoxyethanol, phenetylalcohol, and p-benzoic acid butyl ester were added.

Silver iodobromide emulsions used for Sample are as follows:

| Emulsion | Feature of grain | Average grain diameter (μm) | Deviation coefficient (%) | AgI content (%) |
|---|---|---|---|---|
| A | Monodisperse tetradecahedral grain | 0.25 | 16 | 3.7 |
| B | Monodisperse cubic internal latent image-type grain | 0.30 | 10 | 3.3 |
| C | Monodisperse tetradecahedral grain | 0.30 | 18 | 5.0 |
| D | Polydisperse twins grain | 0.60 | 25 | 2.0 |
| E | Monodisperse cubic grain | 0.17 | 17 | 4.0 |
| F | Monodisperse cubic grain | 0.20 | 16 | 4.0 |
| G | Monodisperse cubic internal latent image-type grain | 0.25 | 11 | 3.5 |
| H | Monodisperse cubic internal latent image-type grain | 0.30 | 9 | 3.5 |
| I | Polydisperese tabular grain, average aspect ratio: 4.0 | 0.80 | 28 | 1.5 |
| J | Monodisperse tetradecahedral grain | 0.30 | 18 | 4.0 |
| K | Monodisperse tetradecahedral grain | 0.37 | 17 | 4.0 |
| L | Monodisperse cubic internal latent image-type grain | 0.46 | 14 | 3.5 |
| M | Monodisperese cubic grain | 0.55 | 13 | 4.0 |
| N | Polydisperese tabular grain, average aspect ratio: 7.0 | 1.00 | 33 | 1.3 |

Spectral sensitizing dyes and their amounts added to Emulsions A to N were as follows:

| Emulsion | Sensitizing dye added | Amount added (g) per mol of silver halide |
|---|---|---|
| A | S-1 | 0.025 |
| | S-2 | 0.25 |
| B | S-1 | 0.01 |
| | S-2 | 0.25 |
| C | S-1 | 0.02 |
| | S-2 | 0.25 |
| D | S-1 | 0.01 |
| | S-2 | 0.10 |
| | S-7 | 0.01 |
| E | S-3 | 0.5 |
| | S-4 | 0.1 |
| F | S-3 | 0.3 |
| | S-4 | 0.1 |
| G | S-3 | 0.25 |
| | S-4 | 0.08 |
| H | S-3 | 0.2 |
| | S-4 | 0.06 |
| I | S-3 | 0.3 |
| | S-4 | 0.07 |
| | S-8 | 0.1 |
| J | S-6 | 0.2 |
| | S-5 | 0.05 |
| K | S-6 | 0.2 |
| | S-5 | 0.05 |
| L | S-6 | 0.22 |
| | S-5 | 0.06 |
| M | S-6 | 0.15 |
| | S-5 | 0.04 |
| N | S-6 | 0.22 |
| | S-5 | 0.06 |

Samples 302 to 322 were prepared in the same manner as Sample 301, except that a silver iodobromide emulsion (average grain diameter: 0.07 μm, deviation coefficient: 18%, AgI content: 1 mol %) whose surface had been fogged was added as shown in Table 31 and couplers in the fourth to sixth layers were changed as shown Table 31, each in an equimolar amount.

The thus prepared Samples were subjected to an exposure to red light through a continuous wedge and to a developing processing, shown below, using an automatic processor.

Processing process

| Process | Time | Temperature | Tank volume | Replenisher amount |
|---|---|---|---|---|
| 1st development | 6 min | 38° C. | 12 liter | 2,200 ml/m$^2$ |
| 1st water-washing | 2 min | 38° C. | 4 liter | 7,500 ml/m$^2$ |
| Reversal | 2 min | 38° C. | 4 liter | 1,100 ml/m$^2$ |
| Color development | 6 min | 38° C. | 12 liter | 2,200 ml/m$^2$ |
| Conditioning | 2 min | 38° C. | 4 liter | 1,100 ml/m$^2$ |

-continued

Processing process

| Process | Time | Temperature | Tank volume | Replenisher amount |
|---|---|---|---|---|
| Bleaching | 6 min | 38° C. | 12 liter | 220 ml/m² |
| Fixing | 4 min | 38° C. | 8 liter | 1,100 ml/m² |
| 2nd water-washing | 4 min | 38° C. | 8 liter | 7,500 ml/m² |
| Stabilizing | 1 min | 25° C. | 2 liter | 1,100 ml/m² |

Compositions of processing solutions used were as follows:

| | Tank solution | Replenisher |
|---|---|---|
| First developer | | |
| Pentasodium nitrilo-N,N,N-trimethylenephosphonate | 1.5 g | 1.5 g |
| Pentasodium diethylenetriamine-pentaacetate | 2.0 g | 2.0 g |
| Sodium sulfite | 30 g | 30 g |
| Hydroquinone potassium monosulfonate | 20 g | 20 g |
| Potassium carbonate | 15 g | 20 g |
| Sodium carbonate | 12 g | 15 g |
| 1-Phenyl-4-methyl-4-hydroxymethyl-3-pyrazolydone | 1.5 g | 2.0 g |
| Potassium bromide | 2.5 g | 1.4 g |
| Potassium thiocyanate | 1.2 g | 1.2 g |
| Potassium iodide | 2.0 mg | — |
| Diethylene glycol | 13 g | 15 g |
| Water to make | 1,000 ml | 1,000 ml |
| pH | 9.60 | 9.60 |
| (pH was adjusted by using hydrochloric acid or potassium hydroxide) | | |
| Reversal solution (Both mother solution and replenisher) | | |
| Pentasodium nitrilo-N,N,N-trimethylenephosphonate | 3.0 g | |
| Stannous chloride (dihydrate) | 1.0 g | |
| p-Amylphenol | 0.1 g | |
| Sodium hydoxide | 8 g | |
| Glacial acetic acid | 15 ml | |
| Water to make | 1,000 ml | |
| pH | 6.00 | |
| (pH was adjusted by using hydrochloric acid or sodium hydroxide) | | |
| Color developer | | |
| Pentasodium nitrilo-N,N,N-trimethylenephosphonate | 2.0 g | 2.0 g |
| Sodium sulfite | 7.0 g | 7.0 g |
| Sodium tertiary phosphate (12-hydrate) | 36 g | 36 g |
| Potassium bromide | 1.0 g | — |
| Potassium iodide | 90 mg | — |
| Sodium hydroxide | 3.0 g | 3.0 g |
| Cytrazinic acid | 1.5 g | 1.5 g |
| N-Ethyl-N-(β-methanesulfonamidoethyl)-3-methyl-4-aminoaniline 3/2 sulfate mono hydrate | 11 g | 11 g |
| 3,6-Dithiaoctane-1,8-diol | 1.0 g | 1.0 g |
| Water to make | 1,000 ml | 1,000 ml |
| pH | 11.80 | 12.00 |
| (pH was adjusted by using hydrochloric acid or potassium hydroxide) | | |
| Conditioner | | |
| Disodium ethylenediaminetetraacetate (dihydrate) | 8.0 g | 8.0 g |
| Sodium sulfite | 12 g | 12 g |
| 1-Thioglycerin | 0.4 g | 0.4 g |
| Formaldehyde.sodium bisulfite adduct | 30 g | 35 g |
| Water to make | 1,000 ml | 1,000 ml |

-continued

| | Tank solution | Replenisher |
|---|---|---|
| pH | 6.30 | 6.10 |
| (pH was adjusted by using hydrochloric acid or sodium hydroxide) | | |
| Bleaching solution | | |
| Disodium ethylenediaminetetraacetate (dihydrate) | 2.0 g | 4.0 g |
| Iron (III) ammonium ethylenediamine-tetraacetate (dihydrate) | 120 g | 240 g |
| Potassium bromide | 100 g | 200 g |
| Ammonium nitrate | 10 g | 20 g |
| Water to make | 1,000 ml | 1,000 ml |
| pH | 5.70 | 5.50 |
| (pH was adjusted by using hydrochloric acid or sodium hydroxide) | | |
| Fixing solution | | |
| Ammonium thiosulfate | | 8.0 g |
| Sodium sulfite | | 5.0 g |
| Sodium bisulfite | | 5.0 g |
| Water to make | | 1,000 ml |
| pH | | 6.60 |
| (pH was adjusted by using hydrochloric acid or aqueous ammonia) | | |
| Stabilizing solution | | |
| Benzoisothiazolin-3-one | 0.02 g | 0.03 g |
| Polyoxyethylene-p-monononyl phenyl ether (av. polymerization degree: 10) | 0.3 g | 0.3 g |
| Water to make | 1,000 ml | 1,000 ml |
| pH | 7.0 | 7.0 |

Next, each sample of photographic materials was exposed to light through a continuous wedge by controlling each of three color (red, green, and blue) lights such that the color of a sample exposed to a white light and developed in the same way as above became gray. Then the development process was conducted. At this time, the amount of red light in red-light exposure was the same amount as the red light contained in the white light.

With respect to each of thus processed samples, by measuring color densities, the difference of exposure amounts, ΔlogE(R), between the red-light exposure and the white light exposure that gave cyan density being 0.6 was determined as an interimage effect to the red-sensitive silver halide layer. In the same manner, ΔlogE(G) and ΔlogE(B), that are interimage effects to other silver halide emulsion layers were obtained.

Next, each sample was exposed to light through a pattern for determining a sharpness, developed processed in the same manner as above, and MTF value was determined, to obtain the MTF value at a frequency of 25 lines per mm. Results are shown in Table 32.

TABLE 31

| Sample No. | Layer added an emulsion whose surface had been fogged and coated amount (coated silver amount) (g/m$^2$) | Cyan couplers in 4th to 6th layers | Remarks |
|---|---|---|---|
| 301 | — | 4th layer: C-1, -2, -3 and -9<br>5th and 6th layers: C-1, -2 and -3 | Comparison |
| 302 | 3rd layer: 0.05 | 4th layer: C-1, -2, -3 and -9<br>5th and 6th layers: C-1, -2 and -3 | " |
| 303 | 4th layer: 0.05 | 4th layer: C-1, -2, -3 and -9<br>5th and 6th layers: C-1, -2 and -3 | " |
| 304 | 5th layer: 0.05 | 4th layer: C-1, -2, -3 and -9<br>5th and 6th layers: C-1, -2 and -3 | " |
| 305 | — | 4th to 6th layers: Ib-12 | " |
| 306 | — | 4th to 6th layers: Ic-17 | " |
| 307 | — | 4th to 6th layers: Ih-17 | " |
| 308 | 3rd layer: 0.05 | 4th to 6th layers: Ih-17 | This invention |
| 309 | 4th layer: 0.05 | 4th to 6th layers: Ih-17 | " |
| 310 | 5th layer: 0.05 | 4th to 6th layers: Ih-17 | " |
| 311 | 4th layer: 0.05 | 4th to 6th layers: Ib-1 | " |
| 312 | " | 4th to 6th layers: Ib-12 | " |
| 313 | " | 4th to 6th layers: Ic-1 | " |
| 314 | " | 4th to 6th layers: Ic-14 | " |
| 315 | " | 4th to 6th layers: Ic-17 | " |
| 316 | " | 4th to 6th layers: Id-1 | " |
| 317 | " | 4th to 6th layers: If-1 | " |
| 318 | " | 4th to 6th layers: Ih-10 | " |
| 319 | " | 4th layer: C-1, -2, -3 and -9<br>5th and 6th layers: Ih-10 | " |
| 320 | 4th layer: 0.05<br>8th layer: 0.05 | 4th to 6th layers: Ib-12 | " |
| 321 | 4th layer: 0.05<br>8th layer: 0.05 | 4th to 6th layers: Ic-17 | " |
| 322 | 4th layer: 0.05<br>8th layer: 0.05 | 4th to 6th layers: Ih-17 | " |

TABLE 32

| Sample | Interimage effect | | | MTF value* | | | | |
|---|---|---|---|---|---|---|---|---|
| No. | Δ log E (R) | Δ log E (G) | Δ log E (B) | R | G | B | Dmax** | Remarks |
| 301 | 0.12 | 0.14 | 0.08 | 0.58 | 0.64 | 0.69 | 2.90 | Comparison |
| 302 | 0.20 | 0.23 | 0.12 | 0.67 | 0.67 | 0.70 | 2.73 | " |
| 303 | 0.23 | 0.24 | 0.13 | 0.70 | 0.69 | 0.70 | 2.65 | " |
| 304 | 0.21 | 0.23 | 0.12 | 0.72 | 0.70 | 0.71 | 2.50 | " |
| 305 | 0.15 | 0.17 | 0.10 | 0.60 | 0.65 | 0.69 | 3.13 | " |
| 306 | 0.16 | 0.17 | 0.10 | 0.59 | 0.64 | 0.69 | 3.27 | " |
| 307 | 0.17 | 0.18 | 0.11 | 0.61 | 0.66 | 0.70 | 3.30 | " |
| 308 | 0.30 | 0.32 | 0.20 | 0.69 | 0.68 | 0.71 | 3.22 | This invention |
| 309 | 0.32 | 0.35 | 0.22 | 0.71 | 0.70 | 0.71 | 3.10 | " |
| 310 | 0.31 | 0.33 | 0.20 | 0.73 | 0.71 | 0.71 | 3.05 | " |
| 311 | 0.30 | 0.32 | 0.19 | 0.71 | 0.70 | 0.70 | 3.08 | " |
| 312 | 0.32 | 0.33 | 0.21 | 0.70 | 0.71 | 0.71 | 3.20 | " |
| 313 | 0.30 | 0.30 | 0.20 | 0.72 | 0.70 | 0.70 | 3.04 | " |
| 314 | 0.31 | 0.32 | 0.21 | 0.70 | 0.70 | 0.70 | 3.18 | " |
| 315 | 0.31 | 0.32 | 0.21 | 0.73 | 0.69 | 0.72 | 3.21 | " |
| 316 | 0.30 | 0.30 | 0.20 | 0.70 | 0.70 | 0.70 | 3.09 | " |
| 317 | 0.31 | 0.32 | 0.21 | 0.71 | 0.71 | 0.71 | 3.08 | " |
| 318 | 0.33 | 0.33 | 0.22 | 0.72 | 0.73 | 0.72 | 3.05 | " |
| 319 | 0.31 | 0.30 | 0.20 | 0.69 | 0.68 | 0.69 | 3.05 | " |
| 320 | 0.34 | 0.35 | 0.23 | 0.72 | 0.73 | 0.73 | 3.20 | " |
| 321 | 0.33 | 0.34 | 0.22 | 0.75 | 0.72 | 0.75 | 3.20 | " |
| 322 | 0.34 | 0.34 | 0.23 | 0.75 | 0.71 | 0.74 | 3.21 | " |

Note:
*MTF value frequency of 25 lines per mm
**Maximum color density of cyan image-dye As is apparent from the results in Table 32, in samples according to the present invention, which utilized the cyan coupler and the surface-fogged emulsion in emulsion layers or an immediate layer adjacent to an emulsion layer, interimage effect and MTF value increase, without lowering the maximum color density of cyan image-dye, thus the color reproduction and sharpness are improved.

EXAMPLE 4

Samples 401 to 418 were prepared in the same manner as Sample 301 in Example 3, except that core/shell-type silver bromide emulsion (average grain diameter: 0.20 μm, deviation coefficient: 18%, shell thickness: 250 Å) that had been fogged inside of grain was added to layers as shown in Table 41, and couplers in the 4th to 6th layers were changed, in an equalmolar amount, as shown in Table 41.

With respect to Samples 301, 305 to 307 in Example 3 and Samples 401 to 418, the same experiment as in Example 3 was conducted. Results are shown in Table 42.

TABLE 41

| Sample No. | Layer added a colloidal silver and coated amount (coated silver amount) (g/m²) | Cyan couplers in 4th to 6th layers | Remarks |
|---|---|---|---|
| 301 | — | 4th layer: C-1, C-2, C-3 and C-9<br>5th and 6th layers: C-1, C-2 and C-3 | Comparison |
| 401 | 3rd layer: 0.1 | 4th layer: C-1, C-2, C-3 and C-9<br>5th and 6th layers: C-1, C-2 and C-3 | " |
| 402 | 4th layer: 0.1 | 4th layer: C-1, C-2, C-3 and C-9<br>5th and 6th layers: C-1, C-2 and C-3 | " |
| 403 | 5th layer: 0.1 | 4th layer: C-1, C-2, C-3 and C-9<br>5th and 6th layers: C-1, C-2 and C-3 | " |
| 305 | — | 4th to 6th layers: Ib-12 | " |
| 306 | — | 4th to 6th layers: Ic-17 | " |
| 307 | — | 4th to 6th layers: Ih-17 | " |
| 404 | 3th layer: 0.1 | 4th to 6th layers: Ih-17 | This invention |
| 405 | 4th layer: 0.1 | 4th to 6th layers: Ih-17 | " |
| 406 | 5th layer: 0.1 | 4th to 6th layers: Ih-17 | " |
| 407 | 4th layer: 0.1 | 4th to 6th layers: Ib-1 | " |
| 408 | " | 4th to 6th layers: Ib-12 | " |
| 409 | " | 4th to 6th layers: Ic-1 | " |
| 410 | " | 4th to 6th layers: Ic-14 | " |
| 411 | " | 4th to 6th layers: Ic-17 | " |
| 412 | " | 4th to 6th layers: Id-1 | " |
| 413 | " | 4th to 6th layers: Ib-1 | " |
| 414 | " | 4th to 6th layers: Ih-10 | " |
| 415 | " | 4th layer: C-1, C-2, C-3 and C-9<br>5th and 6th layers: Ig-17 | " |
| 416 | 4th layer: 0.1<br>9th layer: 0.1<br>15th layer: 0.1 | 4th to 6th layers: Ig-12 | " |
| 417 | 4th layer: 0.1<br>9th layer: 0.1<br>15th layer: 0.1 | 4th to 6th layers: Ic-17 | " |
| 418 | 4th layer: 0.1<br>9th layer: 0.1<br>15th layer: 0.1 | 4th to 6th layers: Ih-17 | " |

TABLE 42

| Sample | Interimage effect | | | MTF value* | | | | |
|---|---|---|---|---|---|---|---|---|
| No. | Δ log E (R) | Δ log E (G) | Δ log E (B) | R | G | B | Dmax** | Remarks |
| 301 | 0.12 | 0.14 | 0.08 | 0.58 | 0.64 | 0.69 | 2.90 | Comparison |
| 401 | 0.18 | 0.21 | 0.10 | 0.66 | 0.65 | 0.69 | 2.88 | " |
| 402 | 0.20 | 0.22 | 0.11 | 0.69 | 0.67 | 0.69 | 2.76 | " |
| 403 | 0.19 | 0.22 | 0.10 | 0.70 | 0.69 | 0.70 | 2.70 | " |
| 305 | 0.15 | 0.17 | 0.10 | 0.60 | 0.65 | 0.69 | 3.13 | " |
| 306 | 0.16 | 0.17 | 0.10 | 0.59 | 0.64 | 0.69 | 3.27 | " |
| 307 | 0.17 | 0.18 | 0.11 | 0.61 | 0.66 | 0.70 | 3.30 | " |
| 404 | 0.29 | 0.30 | 0.18 | 0.67 | 0.66 | 0.69 | 3.35 | This invention |
| 405 | 0.30 | 0.33 | 0.20 | 0.69 | 0.68 | 0.69 | 3.20 | " |
| 406 | 0.30 | 0.30 | 0.19 | 0.71 | 0.70 | 0.69 | 3.18 | " |

TABLE 42-continued

| Sample | Interimage effect | | | MTF value* | | | | |
|---|---|---|---|---|---|---|---|---|
| No. | Δ log E (R) | Δ log E (G) | Δ log E (B) | R | G | B | Dmax** | Remarks |
| 407 | 0.28 | 0.30 | 0.18 | 0.68 | 0.69 | 0.69 | 3.20 | " |
| 408 | 0.30 | 0.31 | 0.20 | 0.68 | 0.70 | 0.70 | 3.13 | " |
| 409 | 0.29 | 0.29 | 0.19 | 0.70 | 0.69 | 0.69 | 3.18 | " |
| 410 | 0.29 | 0.30 | 0.20 | 0.68 | 0.69 | 0.69 | 3.30 | " |
| 411 | 0.29 | 0.30 | 0.20 | 0.71 | 0.68 | 0.71 | 3.32 | " |
| 412 | 0.28 | 0.28 | 0.19 | 0.68 | 0.69 | 0.70 | 3.20 | " |
| 413 | 0.29 | 0.30 | 0.20 | 0.69 | 0.70 | 0.69 | 3.19 | " |
| 414 | 0.30 | 0.31 | 0.21 | 0.70 | 0.72 | 0.70 | 3.18 | " |
| 415 | 0.28 | 0.31 | 0.19 | 0.67 | 0.65 | 0.67 | 3.05 | " |
| 416 | 0.32 | 0.33 | 0.21 | 0.70 | 0.71 | 0.72 | 3.12 | " |
| 417 | 0.31 | 0.32 | 0.22 | 0.72 | 0.70 | 0.73 | 3.30 | " |
| 418 | 0.32 | 0.35 | 0.23 | 0.73 | 0.71 | 0.72 | 3.19 | " |

Note:
*MTF value frequency of 25 lines per mm
**Maximum color density of cyan image-dye As is apparent from the results in Table 42, in samples according to the present invention, which utilized the cyan coupler and the surface-fogged emulsion in emulsion layers or an immediate layer adjacent to an emulsion layer, interimage effect and MTF value increase, without lowering the maximum color density of cyan image-dye, thus the color reproduction and sharpness are improved.

EXAMPLE 5

Samples 501 to 514 were prepared in the same manner as Sample 301 in Example 3, except that yellow colloidal silver was added as shown in Table 51 and couplers in the 4th to 6th layers were changed, in an equal molar amount, as shown in Table 51.

Thus-prepared Samples were subjected to the same experiment as in Example 3. Results are shown in Table 52.

TABLE 51

| Sample No. | Layer added an emulsion whose inside of grain had been fogged and coated amount (coated silver amount) (g/m$^2$) | Cyan couplers in 4th to 6th layers | Remarks |
|---|---|---|---|
| 301 | — | 4th layer: C-1, C-2, C-3 and C-9<br>5th and 6th layers: C-1, C-2 and C-3 | Comparison |
| 501 | 3rd layer: 0.02 | 4th layer: C-1, C-2, C-3 and C-9<br>5th and 6th layers: C-1, C-2 and C-3 | " |
| 502 | 4th layer: 0.02<br>8th layer: 0.02 | 4th layer: C-1, C-2, C-3 and C-9<br>5th and 6th layers: C-1, C-2 and C-3 | " |
| 503 | 3rd layer: 0.02 | 4th to 6th layers: Ib-1 | This invention |
| 504 | " | 4th to 6th layers: Ib-12 | " |
| 505 | " | 4th to 6th layers: Ic-1 | " |
| 506 | " | 4th to 6th layers: Ic-14 | " |
| 507 | " | 4th to 6th layers: Ic-17 | " |
| 508 | " | 4th to 6th layers: Ih-1 | " |
| 509 | " | 4th to 6th layers: Ih-10 | " |
| 510 | " | 4th to 6th layers: Ih-17 | " |
| 511 | 3rd layer: 0.02<br>8th layer: 0.02 | 4th to 6th layers: Ib-12 | " |
| 512 | 3rd layer: 0.02<br>8th layer: 0.02 | 4th to 6th layers: Ic-12 | " |
| 513 | 3rd layer: 0.02<br>8th layer: 0.02 | 4th to 6th layers: Ih-17 | " |
| 515 | 3rd layer: 0.02<br>8th layer: 0.02 | 4th layer: C-1, C-2, C-3 and C-9<br>5th and 6th layers: Ih-17 | " |

TABLE 52

| Sample | Interimage effect | | | MTF value* | | | | |
|---|---|---|---|---|---|---|---|---|
| No. | Δ log E (R) | Δ log E (G) | Δ log E (B) | R | G | B | Dmax** | Remarks |
| 301 | 0.12 | 0.14 | 0.08 | 0.58 | 0.64 | 0.69 | 2.90 | Comparison |
| 501 | 0.23 | 0.20 | 0.14 | 0.70 | 0.69 | 0.70 | 2.40 | " |
| 502 | 0.25 | 0.28 | 0.21 | 0.71 | 0.72 | 0.74 | 2.35 | " |
| 503 | 0.33 | 0.30 | 0.16 | 0.72 | 0.73 | 0.70 | 2.98 | This invention |
| 504 | 0.34 | 0.31 | 0.17 | 0.75 | 0.76 | 0.71 | 3.05 | " |
| 505 | 0.32 | 0.30 | 0.16 | 0.73 | 0.75 | 0.71 | 3.04 | " |
| 506 | 0.33 | 0.31 | 0.18 | 0.74 | 0.76 | 0.71 | 3.07 | " |
| 507 | 0.34 | 0.32 | 0.18 | 0.76 | 0.76 | 0.72 | 3.10 | " |
| 508 | 0.30 | 0.30 | 0.17 | 0.71 | 0.72 | 0.70 | 3.02 | " |
| 509 | 0.32 | 0.30 | 0.16 | 0.72 | 0.73 | 0.71 | 3.09 | " |
| 510 | 0.34 | 0.33 | 0.19 | 0.75 | 0.76 | 0.72 | 3.12 | " |
| 511 | 0.34 | 0.37 | 0.25 | 0.75 | 0.80 | 0.78 | 3.00 | " |
| 512 | 0.35 | 0.37 | 0.26 | 0.76 | 0.81 | 0.80 | 3.02 | " |
| 513 | 0.35 | 0.38 | 0.25 | 0.75 | 0.82 | 0.81 | 3.08 | " |
| 514 | 0.32 | 0.35 | 0.23 | 0.73 | 0.80 | 0.79 | 2.98 | " |

Note:
*MTF value frequency of 25 lines per mm
**Maximum color density of cyan image-dye As is apparent from the results in Table 52, in samples according to the present invention, which utilized the cyan coupler and the colloidal silver in an emulsion layers or intermediate layers adjacent to an emulsion layer, interimage effect and MTF value increase, without lowering the maximum color density of cyan image-dye, thus the color reproduction and sharpness are improved.

EXAMPLE 6

Samples prepared in Examples 2 to 5 were exposed to white light (temperature of light source; 4800K, intensity of illumination of exposure: 1000 lux) through a wedge for sensitometry, and subjected to the same development processing as in Example 3.

Next, sensitizing processing was conducted in the same processing as described in Example 3, except that the time of first development was extended from 6 min (standard) to 10 min.

Thus-processed samples were measured for optical densities, to determine the sensitivity and maximum color density of cyan image-dye.

Sensitivity was obtained as a reciprocal of the exposure amount to give a density of 1.0, and the ratio of sensitivities obtained by the sensitizing processing and those obtained by the standard processing is shown in Table 53 as S sensitizing processing/S standard processing.

Further, the difference in maximum color densities between the standard processing and the sensitizing processing is shown in Table 53 as ΔDmax (the standard processing-sensitizing processing).

TABLE 53

| Sample No. | Ratio of sensitivities S sensitizing processing/ S standard processing | Difference of maximum color densities Δmax (standard processing – sensitizing processing | Remarks |
|---|---|---|---|
| 301 | 2.1 | 0.28 | Comparison |
| 303 | 3.5 | 0.58 | " |
| 307 | 2.2 | 0.61 | " |
| 315 | 3.6 | 0.29 | This invention |

TABLE 53-continued

| Sample No. | Ratio of sensitivities S sensitizing processing/ S standard processing | Difference of maximum color densities Δmax (standard processing – sensitizing processing | Remarks |
|---|---|---|---|
| 404 | 3.7 | 0.31 | " |
| 405 | 3.8 | 0.32 | " |
| 408 | 3.7 | 0.30 | " |
| 411 | 3.8 | 0.30 | " |
| 418 | 3.7 | 0.29 | " |
| 504 | 3.9 | 0.32 | " |
| 507 | 4.0 | 0.33 | " |
| 510 | 4.0 | 0.32 | " |
| 513 | 4.1 | 0.33 | " |

As is apparent from the results in Table 53, Samples according to the present invention are excellent in aptitude for sensitizing processing at color reversal development processing, since the sensitivity ratio obtained by the sensitizing processing and those obtained by the standard processing is large and the difference of maximum color densities between standard processing and sensitizing processing.

EXAMPLE 7

(1) Preparation of Emulsion a. Emulsion A

Into 1560 ml of an aqueous 3.4% gelatin solution maintained at 75° C. 800 ml of an aqueous 15% $AgNO_3$ solution, an aqueous solution containing 0.85 mol/l of KBr, and an aqueous solution containing 0.031 mol/l of KI were added over 60 min by double-jet method, by maintaining the pH at 6.8 and the silver electric potential (SCE) at +60 mV, to prepare monodisperse cubic core grains having an edge length of 0.35 μm. Next, chemical sensitizing of these core grains was carried out for 60 min at pH 6.8 and a silver electric potential of 80 mV, by adding 1.8 mg of compound A-5, 1.1 mg of sodium chloroaurate, as a gold sensitizer, and 4.0 mg and 0.3 mg of compounds A-2 and A-3, respectively. After 0.14 g of compound A-1 and 0.3 g of compound A-4 were added, the temperature was lowered to 50° C., and 200 ml of the aqueous 15% $AgNO_3$ solution, the aqueous solution containing 0.85 mol/l of KBr, and an aqueous solution containing 0.031 mol/l of KI were added over 5 min at pH 6.8 and silver electric potential of +10 mV, thereby precipitating shell, to obtain monodisperse cubic grains having 0.38 μm of average edge length of final grains and 3.5 mol % of average silver iodide content. After removing soluble silver salt from this dispersion by a conventional flocculation sedimentation process, an internal latent image-type emulsion (Emulsion A) having 6.2 of a final pH and a pAg of 8.4. The deviation coefficient (a value of standard deviation of distribution divided by average grain size, that is, edge-length, and multiplying by 100) of grain size was 8%, and the deviation coefficient of the distribution of silver iodide content was 5%. The crystal habit of thus-obtained grains was 92% at face (100) and 8% at face (111).

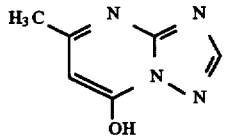
A-1

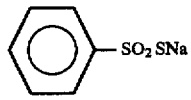
A-2

$K_2IRCl_5$ A-3

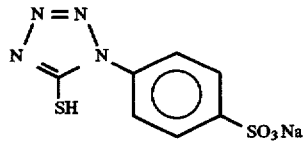
A-4

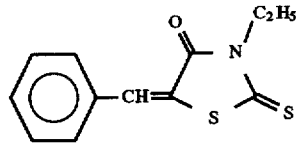
A-5 b. Emulsions B to E

Internal latent image-type emulsions (Emulsions B to E) were prepared in the same manner as Emulsion A, except that the ratio of aqueous $AgNO_3$ solutions for core formation and shell formation were changed as shown in Table 54, so as to be different in the depth from the grain surface to the chemical sensitized position.

c. Emulsion F

An internal latent image-type emulsion (Emulsion F), wherein the ratio of the latent image formed at surface is larger than that of Emulsion A was prepared in the same manner, except that the condition for shell formation was changed to a temperature of 75° C. and a silver electric potential of 60 mV.

d. Emulsion G

An internal latent image-type emulsion (Emulsion G), wherein the ratio of the latent image formed at the surface is less than that of Emulsion A was prepared in the same manner, except that the condition for forming shell was changed to a temperature of 40° C. and silver electric potential of −30 mV, and the speed of adding aqueous $AgNO_3$ solution was increased by 5 times.

e. Emulsion H

A surface latent image-type emulsion (Emulsion H) was prepared in the same manner as Emulsion A, except that the surfer-sensitizer, gold sensitizer, and compounds A-1 to A-4, which were added after the formation of core grain at the preparation of Emulsion A, were not added before the shell formation, but were added after the shell formation and removal of soluble silver salt, and the shell surface was chemically sensitized. At that time, sensitizers were added in an amount 1.2 times that of Emulsion A, thereby obtaining an optimum sensitivity.

The depth of chemical sensitized position and the ratio of latent image formed on the surface of grains of each emulsion are shown in the following Table.

TABLE 54

| Emulsion | Depth of chemical sensitized position from grain surface (μm) | Ratio of latent image formed on surface |
|---|---|---|
| A | 0.0135 | 0.40 |
| B | 0.0190 | 0.30 |
| C | 0.0270 | 0.10 |
| D | 0.0096 | 0.45 |
| E | 0.0068 | 0.55 |
| F | 0.0135 | 0.80 |
| G | 0.0135 | 0.10 |
| H | 0 | 1.00 |

(2) Preparation of coated sample

A multilayer color photographic material was prepared by multi-coating each layer having composition as shown below on a prime-coated triacetate cellulose film support having a thickness of 127 μm, and it was designated Sample as 601. The figures provided indicate the added amounts per $m^2$. The effects of the compound added are not restricted to the shown usage.

| | |
|---|---|
| First layer: Halation-preventing layer | |
| Black colloidal silver | 0.20 g |
| Gelatin | 1.9 g |
| UV-absorbent U-1 | 0.1 g |
| UV-absorbent U-3 | 0.04 g |
| UV-absorbent U-4 | 0.1 g |
| High boiling organic solvent Oil-1 | 0.1 g |
| Fine crystal solid dispersion of dye E-1 | 0.1 g |
| Second layer: Intermediate layer | |
| Gelatin | 0.40 g |
| Compound Cpd-C | 5 mg |
| Compound Cpd-J | 5 mg |
| Compound Cpd-K | 3 mg |
| High-boiling organic solvent Oil-3 | 0.1 g |
| Dye D-4 | 0.4 mg |
| Third layer: Intermediate layer | |
| Silver iodobromide emulsion of fine grains surface and inner part of which were fogged (av. grain diameter 0.06 μm, deviation coefficient: 18%, AgI content: 1 mol %) | silver 0.05 g |
| Gelatin | 0.4 g |
| Fourth layer: Low sensitivity red-sensitive emulsion layer | |
| Emulsion 1 | silver 0.1 g |
| Emulsion B | silver 0.4 g |
| Gelatin | 0.8 g |
| Coupler C-1 | 0.15 g |
| Coupler C-2 | 0.05 g |
| Coupler C-3 | 0.05 g |
| Coupler C-9 | 0.05 g |
| Compound Cpd-C | 10 mg |
| High-boiling organic solvent Oil-2 | 0.1 g |
| Additive P-1 | 0.1 g |
| Fifth layer: Medium sensitivity red-sensitive emulsion layer | |
| Emulsion B | silver 0.2 g |

-continued

| | |
|---|---|
| Emulsion 2 | silver 0.3 g |
| Gelatin | 0.8 g |
| Coupler C-1 | 0.2 g |
| Coupler C-2 | 0.05 g |
| Coupler C-3 | 0.2 g |
| High boiling organic solvent Oil-2 | 0.1 g |
| Additive P-1 | 0.1 g |
| Sixth layer: High sensitivity red-sensitive emulsion layer | |
| Emulsion 3 | silver 0.4 g |
| Gelatin | 1.1 g |
| Coupler C-1 | 0.3 g |
| Coupler C-2 | 0.1 g |
| Coupler C-3 | 0.7 g |
| Additive P-1 | 0.1 g |
| Seventh layer: Intermediate layer | |
| Gelatin | 0.6 g |
| Additive M-1 | 0.3 g |
| Color-mix preventing agent Cpd-I | 2.6 mg |
| UV-absorbent U-1 | 0.01 g |
| UV-absorbent U-2 | 0.002 g |
| UV-absorbent U-5 | 0.01 g |
| Dye D-1 | 0.02 g |
| Compound Cpd-C | 5 mg |
| Compound Cpd-J | 5 mg |
| Compound Cpd-K | 5 mg |
| High-boiling organic solvent Oil-1 | 0.02 g |
| Eighth layer: Intermediate layer | |
| Silver iodobromide emulsion of fine grains surface and inner part of which were fogged (av. grain diameter: 0.06 μm, deviation coefficient: 16%, AgI content: 0.3 mol %) | silver 0.02 g |
| Gelatin | 1.0 g |
| Additive P-1 | 0.2 g |
| Color-mix preventing agent Cpd-A | 0.1 g |
| Ninth layer: Low sensitivity green-sensitive emulsion layer | |
| Emulsion 4 | silver 0.1 g |
| Emulsion 5 | silver 0.2 g |
| Emulsion 6 | silver 0.2 g |
| Gelatin | 0.5 g |
| Coupler C-4 | 0.1 g |
| Coupler C-7 | 0.05 g |
| Coupler C-8 | 0.20 g |
| Compound Cpd-B | 0.03 g |
| Compound Cpd-C | 10 mg |
| Compound Cpd-D | 0.02 g |
| Compound Cpd-E | 0.02 g |
| Compound Cpd-F | 0.02 g |
| Compound Cpd-G | 0.02 g |
| High-boiling organic solvent Oil-1 | 0.1 g |
| High-boiling organic solvent Oil-2 | 0.1 g |
| Tenth layer: Medium sensitivity green-sensitive emulsion layer | |
| Emulsion 6 | silver 0.3 g |
| Emulsion 7 | silver 0.1 g |
| Gelatin | 0.6 g |
| Coupler C-4 | 0.1 g |
| Coupler C-7 | 0.2 g |
| Coupler C-8 | 0.1 g |
| Compound Cpd-B | 0.03 g |
| Compound Cpd-D | 0.02 g |
| Compound Cpd-E | 0.02 g |
| Compound Cpd-F | 0.05 g |
| Compound Cpd-G | 0.05 g |
| High-boiling organic solvent Oil-2 | 0.01 g |
| Eleventh layer: High sensitivity green-sensitive emulsion layer | |
| Emulsion 8 | silver 0.5 g |
| Gelatin | 1.0 g |
| Coupler C-4 | 0.3 g |
| Coupler C-7 | 0.1 g |
| Coupler C-8 | 0.1 g |

-continued

| | |
|---|---|
| Compound Cpd-B | 0.08 g |
| Compound Cpd-C | 5 mg |
| Compound Cpd-D | 0.02 g |
| Compound Cpd-E | 0.02 g |
| Compound Cpd-F | 0.02 g |
| Compound Cpd-G | 0.02 g |
| Compound Cpd-J | 5 mg |
| Compound Cpd-K | 5 mg |
| High-boiling organic solvent Oil-1 | 0.02 g |
| High-boiling organic solvent Oil-2 | 0.02 g |
| Twelfth layer: Intermediate layer | |
| Gelatin | 0.6 g |
| Thirteenth layer: Yellow filter layer | |
| Yellow colloidal silver | silver 0.07 g |
| Gelatin | 1.1 g |
| Color-mix preventing agent Cpd-A | 0.01 g |
| High-boiling organic solvent Oil-1 | 0.01 g |
| Fine crystal solid dispersion of Dye E-2 | 0.05 g |
| Fourteenth layer: Intermediate layer | |
| Gelatin | 0.6 g |
| Fifteenth layer: Low sensitivity blue-sensitive emulsion layer | |
| Emulsion 9 | silver 0.2 g |
| Emulsion 10 | silver 0.3 g |
| Emulsion 11 | silver 0.1 g |
| Gelatin | 0.8 g |
| Coupler C-5 | 0.2 g |
| Coupler C-6 | 0.1 g |
| Coupler C-10 | 0.4 g |
| Sixteen layer: Medium sensitivity blue-sensitive emulsion layer | |
| Emulsion 11 | silver 0.1 g |
| Emulsion 12 | silver 0.4 g |
| Gelatin | 0.9 g |
| Coupler C-5 | 0.3 g |
| Coupler C-6 | 0.1 g |
| Coupler C-10 | 0.1 g |
| Seventeenth layer: High sensitivity blue-sensitivity emulsion layer | |
| Emulsion 13 | silver 0.4 g |
| Gelatin | 1.2 g |
| Coupler C-5 | 0.3 g |
| Coupler C-6 | 0.6 g |
| Coupler C-10 | 0.1 g |
| Eighteenth layer: First protective layer | |
| Gelatin | 0.7 g |
| UV-absorbent U-1 | 0.2 g |
| UV-absorbent U-2 | 0.05 g |
| UV-absorbent U-5 | 0.3 g |
| Formalin scavenger Cpd-H | 0.4 g |
| Dye D-1 | 0.1 g |
| Dye D-2 | 0.05 g |
| Dye D-3 | 0.1 g |
| Nineteenth layer: Second protective layer | |
| Colloidal silver | silver 0.1 mg |
| Silver iodobromide emulsion of fine grains (av. grain diameter: 0.06 μm, AgI content: 1 mol %) | silver 0.1 g |
| Gelatin | 0.4 g |
| Twentieth layer: Third protective layer | |
| Gelatin | 0.4 g |
| Poly(methylmethacrylate) (av. grain diameter: 1.5 μm) | 0.1 g |
| Copolymer of methylmethacrylate and acrylic acid (4:6), av. grain diameter: 1.5 μm) | 0.1 g |
| Silicone oil | 0.03 g |
| Surface-active agent W-1 | 3.0 mg |
| Surface-active agent W-2 | 0.03 g |

Further, to all emulsion layers, in addition to the above-described components, additives F-1 to F-8 were added. Further, to each layer, in addition to the above-described components, gelatin hardener H-1 and surface-active agents W-3, W-4, W-5, and W-6 for coating and emulsifying were added.

Further, as antifungal and antibacterial agents, phenol, 1,2-benzisothiazoline-3-one, 2-phenoxyethanol, phenetylalcohol, and p-benzoic butylester were added.

Silver iodobromide emulsions A and 1 to 13 are as follows:

| Emulsion | Feature of grain | Average grain-diameter corresponding to sphere (μm) | Deviation coefficient (%) | AgI content (%) |
|---|---|---|---|---|
| 1 | Monodisperse tetradecahedral grain | 0.28 | 16 | 3.7 |
| A | Monodisperse cubic internal latent image-type grain | 0.38 | 8 | 3.5 |
| 2 | Monodisperse tabular grain, average aspect ratio: 4.0 | 0.38 | 18 | 5.0 |
| 3 | Tabular grain, av. aspect ratio: 8.0 | 0.68 | 25 | 2.0 |
| 4 | Monodisperse cubic grain | 0.20 | 17 | 4.0 |
| 5 | Monodisperse cubic grain | 0.23 | 16 | 4.0 |
| 6 | Monodisperse cubic internal latent image-type grain | 0.28 | 11 | 3.5 |
| 7 | Monodisperse cubic internal latent image-type grain | 0.32 | 9 | 3.5 |
| 8 | Tabular grain, av. aspect ratio: 9.0 | 0.80 | 28 | 1.5 |
| 9 | Monodisperse tetradecahedral grain | 0.30 | 18 | 4.0 |
| 10 | Monodisperse tabular grain, av. aspect ratio: 7.0 | 0.45 | 17 | 4.0 |
| 11 | Monodisperse cubic internal latent image-type grain | 0.46 | 14 | 3.5 |
| 12 | Monodisperse tabular grain, average aspect ratio: 10.0 | 0.55 | 13 | 4.0 |
| 13 | Tabular grain, av. aspect ratio: 12.0 | 1.00 | 33 | 1.3 |

Spectral sensitizing of Emulsions 1 to 13 and A

| Emulsion | Sensitizing dye added | Amount added (g) per mol of silver halide |
|---|---|---|
| 1 | S-1 | 0.025 |
| | S-2 | 0.25 |
| | S-7 | 0.01 |
| A | S-1 | 0.01 |
| | S-2 | 0.25 |
| | S-7 | 0.01 |
| 2 | S-1 | 0.02 |
| | S-2 | 0.25 |
| | S-7 | 0.01 |
| 3 | S-1 | 0.01 |
| | S-2 | 0.10 |
| | S-7 | 0.01 |
| 4 | S-3 | 0.5 |
| | S-4 | 0.1 |
| 5 | S-3 | 0.3 |
| | S-4 | 0.1 |
| 6 | S-3 | 0.25 |
| | S-4 | 0.08 |

-continued

| Emulsion | Sensitizing dye added | Amount added (g) per mol of silver halide |
|---|---|---|
| | S-8 | 0.05 |
| 7 | S-3 | 0.2 |
| | S-4 | 0.06 |
| | S-8 | 0.05 |
| 8 | S-3 | 0.3 |
| | S-4 | 0.07 |
| | S-8 | 0.1 |
| 9 | S-6 | 0.2 |
| | S-5 | 0.05 |
| 10 | S-6 | 0.2 |
| | S-5 | 0.05 |
| 11 | S-6 | 0.22 |
| | S-5 | 0.06 |
| 12 | S-6 | 0.15 |
| | S-5 | 0.04 |
| 13 | S-6 | 0.22 |
| | S-5 | 0.06 |

Samples 602 to 616 were prepared in the same manner as Sample 601, except that Emulsion B and the cyan coupler of Sample 601 were changed as shown in Table 61. Thus-prepared samples were exposed to light through a wedge in a condition of 1,000 lux and 1/50 sec. Then they were subjected to a negative-type development processing in a first step and then a positive image-dye formation processing which, carried out color formation development by using residual silver halide, according to the processing process shown below.

With respect to thus-obtained images, relative sensitivity that was determined from exposure amount required to obtain 1.0 higher cyan color density than minimum density. Results are shown in Table 61.

Further, respective processed samples were measured for transfer density; thereby characteristic curves were obtained and evaluation of characteristics was conducted. Results are shown in Table 61.

(1) Color formation

A logarithm value of the exposure amount that gives a higher density by 1.0 than the minimum density (Dmin) was determined from each characteristic curve, and was designated as sensitivity point (S value). Difference of each S value (ΔS) from the S value of Sample 602 (standard) was calculated. Further, a density at the point that gives the higher exposure amount by 0.3 in logarithm value than the sensitivity point was read, and a density ratio (D%) of each sample was calculated by comparing the density point with that of Sample 602 as a standard. Results are shown in Table 61. With respect to ΔS, it is indicated that the higher the positive value is, the higher sensitivity is, and with respect to D, a value larger than 100 indicates that a high color density is obtained.

(2) Image-dye fastness

For evaluating heat and humidity fastness, each Sample having images was stored for 10 days at a temperature of 80° C. and relative humidity of 75%. For evaluating a light fastness, each sample was exposed to light for 10 days using a xenon fading tester (intensity of illumination; 80,000 lux). After the test was completed, an image-dye residual ratio (%) was calculated by again measuring the density at the point of exposure amount where density of 2.0 was obtained before the test. Results are shown in Table 61. The nearer to 100 the value is, the better the image dye fastness is.

Processing process

| Process | Time | Temperature | Tank volume | Replenisher amount |
|---|---|---|---|---|
| 1st Development | 6 min | 38° C. | 12 liter | 2,200 ml/m² |
| 1st Water-washing | 2 min | 38° C. | 4 liter | 7,500 ml/m² |
| Reversal | 2 min | 38° C. | 4 liter | 1,100 ml/m² |
| Color development | 6 min | 38° C. | 12 liter | 2,200 ml/m² |
| Conditioning | 2 min | 38° C. | 4 liter | 1,100 ml/m² |
| Bleaching | 6 min | 38° C. | 12 liter | 220 ml/m² |
| Fixing | 4 min | 38° C. | 8 liter | 1,100 ml/m² |
| 2nd Water-washing | 4 min | 38° C. | 8 liter | 7,500 ml/m² |
| Stabilizing | 1 min | 25° C. | 2 liter | 1,100 ml/m² |

Compositions of processing solutions used were as follows:

| | Tank solution | Replenisher |
|---|---|---|
| First developing solution | | |
| Pentasodium nitrilo-N,N,N-trimethylenephosphonate | 1.5 g | 1.5 g |
| Pentasodium diethylenetriamine-pentaacetate | 2.0 g | 2.0 g |
| Sodium sulfite | 30 g | 30 g |
| Hydroquinone potassium monosulfonate | 20 g | 20 g |
| Potassium carbonate | 15 g | 20 g |
| Sodium bicarbonate | 12 g | 15 g |
| 1-Phenyl-4-methyl-4-hydroxymethyl-3-pyrazolydone | 1.5 g | 2.0 g |
| Potassium bromide | 2.5 g | 1.4 g |
| Potassium thiocyanate | 1.2 g | 1.2 g |
| Potassium iodide | 2.0 mg | — |
| Diethylene glycol | 13 g | 15 g |
| Water to make | 1,000 ml | 1,000 ml |
| pH | 9.60 | 9.60 |
| (pH was adjusted by using hydrochloric acid or potassium hydroxide) | | |
| Reversal solution | | |
| Pentasodium nitrilo-N,N,N-trimethylenephosphonate | 3.0 g | Same as tank solution |
| Stannous chloride (dihydrate) | 1.0 g | |
| p-Aminophenol | 0.1 g | |
| Sodium hydroxide | 8 g | |
| Glacial acetic acid | 15 ml | |
| Water to make | 1,000 ml | |
| pH | 6.00 | |
| (pH was adjusted by using hydrochloric acid or sodium hydroxide) | | |
| Color developer | | |
| Pentasodium nitrilo-N,N,N-trimethylenephosphonate | 2.0 g | 2.0 g |
| Sodium sulfite | 7.0 g | 7.0 g |
| Sodium tertiary phosphate (12-hydrate) | 36 g | 36 g |
| Potassium bromide | 1.0 g | — |
| Potassium iodide | 90 mg | — |
| Sodium hydroxide | 3.0 g | 3.0 g |
| Cytrazinic acid | 1.5 g | 1.5 g |
| N-Ethyl-N-(β-methanesulfonamidoethyl)-3-methyl-4-aminoaniline 3/2 sulfate (monohydrate) | 11 g | 11 g |
| 3,6-Dithiaoctane-1,8-diol | 1.0 g | 1.0 g |
| Water to make | 1,000 ml | 1,000 ml |
| pH | 11.80 | 12.00 |
| (pH was adjusted by using hydrochloric acid or potassium hydroxide) | | |
| Conditioner | | |
| Disodium ethylenediaminetetraacetate (dihydrate) | 8.0 g | 8.0 g |
| Sodium sulfite | 12 g | 12 g |
| 1-Thioglycerol | 0.4 g | 0.4 g |
| Formaldehyde-sodium bisulfite adduct | 30 g | 35 g |
| Water to make | 1,000 ml | 1,000 ml |
| pH | 6.30 | 6.10 |
| (pH was adjusted by using hydrochloric acid or sodium hydroxide) | | |
| Bleaching solution | | |
| Disodium ethylenediaminetetraacetate (dihydrate) | 2.0 g | 4.0 g |
| Fe (III) ammonium ethylenediamine-tetraacetate (dihydrate) | 120 g | 240 g |
| Potassium bromide | 100 g | 200 g |
| Ammonium nitrate | 10 g | 20 g |
| Water to make | 1,000 ml | 1,000 ml |
| pH | 5.70 | 5.50 |
| (pH was adjusted by using hydrochloric acid or sodium hydroxide) | | |
| Fixing solution | | |
| Ammonium thiosulfate | 80 g | Same as tank solution |
| Sodium sulfite | 5.0 g | |
| Sodium bisulfite | 5.0 g | |
| Water to make | 1,000 ml | |
| pH | 6.60 | |
| (pH was adjusted by using hydrochloric acid or aqueous ammonia) | | |
| Stabilizing solution | | |
| Benzoisothiazoline-3-one | 0.02 g | 0.03 g |
| Polyoxyethylene-p-monononyl phenyl ether (av. polymerization degree: 10) | 0.3 g | 0.3 g |
| Water to make | 1,000 ml | 1,000 ml |
| pH | 7.0 | 7.0 |

TABLE 61

| Sample No. | Emulsion | Cyan coupler | Color formation | Image-dye fastness Wet & Heat | Image-dye fastness Light | Sensitivity (relative value) log E | Remarks |
|---|---|---|---|---|---|---|---|
| 601 | B | C-1 | 100 | 80 | 87 | +0.07 | Comparison |
| 602 | H | C-1 | 100 | 80 | 87 | ±0.00 (standard) | Comparison |
| 603 | A | Ib-12 | 115 | 96 | 95 | +0.15 | This invention |
| 604 | B | Ib-12 | 115 | 96 | 95 | +0.12 | This invention |
| 605 | C | Ib-12 | 115 | 96 | 94 | −0.01 | Comparison |
| 606 | D | Ib-12 | 115 | 96 | 95 | +0.14 | This invention |
| 607 | E | Ib-12 | 116 | 96 | 95 | +0.13 | This invention |
| 608 | F | Ib-12 | 115 | 96 | 95 | +0.11 | This invention |
| 609 | G | Ib-12 | 115 | 96 | 95 | +0.10 | This invention |
| 610 | H | Ib-12 | 114 | 94 | 95 | −0.03 | Comparison |
| 611 | A | Ic-17 | 114 | 97 | 96 | +0.16 | This invention |
| 612 | A | Id-1 | 117 | 96 | 98 | +0.17 | This invention |
| 615 | A | Ie-1 | 118 | 97 | 97 | +0.15 | This invention |
| 616 | A | Io-1 | 119 | 98 | 96 | +0.16 | This invention |

As is apparent from the results in Table 61, comparing with Sample 602, sensitivity of Sample 610, which utilized only the cyan coupler according to the present invention becomes lower, although the color formation and image-dye fastness of the sample are improved. Further, Sample 601, which utilized only the emulsion according to the present invention, is not improved in color formation and image-dye fastness, although the sensitivity is higher (0.07) than Sample 602. On the contrary, Samples that utilized the emulsion according to the present invention, for example Sample 604, are improved in sensitivity more than 0.07 and further, all of sensitivity, color formation, and image-dye fastness comparing with Sample 610 that utilized the coupler according to the present invention.

EXAMPLE 8

Preparation of Sample 701

A multilayer color photographic material was prepared by multi-coating each layer having composition as shown below on a prime-coated triacetate cellulose film support having a thickness of 127 μm, and it was designated as Sample 701. The figures provided indicate the added amounts per $m^2$. The effects of the compound added are not restricted to the shown usage.

| | |
|---|---|
| **First layer: Halation-preventing layer** | |
| Black colloidal siiver | 0.20 g |
| Gelatin | 1.9 g |
| UV-absorbent U-1 | 0.1 g |
| UV-absorbent U-3 | 0.04 g |
| UV-absorbent U-4 | 0.1 g |
| High boiling organic solvent Oil-1 | 0.1 g |
| Fine crystal solid dispersion of dye E-1 | 0.1 |
| **Second layer: Intermediate layer** | |
| Gelatin | 0.40 g |
| Compound Cpd-C | 5 mg |
| Compound Cpd-J | 5 mg |
| Compound Cpd-K | 3 mg |
| High-boiling organic solvent Oil-3 | 0.1 g |
| Dye D-4 | 0.4 mg |
| **Third layer: Intermediate layer** | |
| Silver iodobromide emulsion of fine grains surface and inner part of which were fogged (av. grain diameter 0.06 μm, deviation coefficient: 18%, AgI content: 1 mol %) | silver 0.05 g |
| Gelatin | 0.4 g |
| **Fourth layer: Low sensitivity red-sensitive emulsion layer** | |
| Emulsion A | silver 0.5 g |
| Silver iodobromide emulsion of fine grains surface and inner part of which were fogged (av. grain diameter 0.06 μm, deviation coefficient: 18%, AgI content: 1.0 mol %) | silver 0.05 g |
| Gelatin | 0.8 g |
| Coupler C-1 | 0.15 g |
| Coupler C-2 | 0.15 g |
| Compound Cpd-C | 10 mg |
| High-boiling organic solvent Oil-2 | 0.1 g |
| Additive P-1 | 0.1 g |
| **Fifth layer: Medium sensitivity red-sensitive emulsion layer** | |
| Emulsion B | silver 0.5 g |
| Silver iodobromide emulsion of fine grains surface and inner part of which were fogged (av. grain diameter 0.06 μm, deviation coefficient: 18%, AgI content: 1.0 mol %) | silver 0.05 g |
| Gelatin | 0.8 g |
| Coupler C-1 | 0.25 g |
| Coupler C-2 | 0.25 g |
| High boiling organic solvent Oil-2 | 0.1 g |
| Additive P-1 | 0.1 g |
| **Sixth layer: High sensitivity red-sensitive emulsion layer** | |
| Emulsion C | silver 0.4 g |
| Gelatin | 1.1 g |
| Coupler C-3 | 1.0 g |
| Additive P-1 | 0.1 g |
| **Seventh layer: Intermediate layer** | |
| Gelatin | 0.6 g |
| Additive M-1 | 0.3 g |
| Color-mix preventing agent Cpd-1 | 2.6 mg |
| UV-absorbent U-1 | 0.01 g |
| UV-absorbent U-2 | 0.002 g |
| UV-absorbent U-5 | 0.01 g |
| Dye D-1 | 0.02 g |
| Compound Cpd-C | 5 mg |
| Compound Cpd-J | 5 mg |
| Compound Cpd-K | 5 mg |
| High-boiling organic solvent Oil-1 | 0.02 g |

-continued

| | |
|---|---|
| **Eighth layer: Intermediate layer** | |
| Silver iodobromide emulsion of fine grains surface and inner part of which were fogged (av. grain diameter: 0.06 μm, deviation coefficient: 16%, AgI content: 0.3 mol %) | silver 0.02 g |
| Gelatin | 1.0 g |
| Additive P-1 | 0.2 g |
| Color-mix preventing agent Cpd-A | 0.1 g |
| **Ninth layer: Low sensitivity green-sensitive emulsion layer** | |
| Emulsion D | silver 0.1 g |
| Emulsion E | silver 0.2 g |
| Emulsion F | silver 0.2 g |
| Silver iodobromide emulsion of fine grains surface and inner part of which were fogged (av. grain diameter: 0.06 μm, deviation coefficient: 18%, AgI content: 1 mol %) | silver 0.05 g |
| Gelatin | 0.5 g |
| Coupler C-4 | 0.1 g |
| Coupler C-7 | 0.05 g |
| Coupler C-8 | 0.20 g |
| Compound Cpd-B | 0.03 g |
| Compound Cpd-C | 10 mg |
| Compound Cpd-D | 0.02 g |
| Compound Cpd-E | 0.02 g |
| Compound Cpd-F | 0.02 g |
| Compound Cpd-G | 0.02 g |
| High-boiling organic solvent Oil-1 | 0.1 g |
| High-boiling organic solvent Oil-2 | 0.1 g |
| **Tenth layer: Medium sensitivity green-sensitive emulsion layer** | |
| Emulsion F | silver 0.3 g |
| Emulsion G | silver 0.1 g |
| Silver iodobromide emulsion of fine grains surface and inner part of which were fogged (av. grain diameter: 0.06 μm, deviation coefficient: 18%, AgI content: 1 mol %) | silver 0.05 g |
| Gelatin | 0.6 g |
| Coupler C-4 | 0.1 g |
| Coupler C-7 | 0.2 g |
| Coupler C-8 | 0.1 g |
| Compound Cpd-B | 0.03 g |
| Compound Cpd-D | 0.02 g |
| Compound Cpd-E | 0.02 g |
| Compound Cpd-F | 0.05 g |
| Compound Cpd-G | 0.05 g |
| High-boiling organic solvent Oil-2 | 0.01 g |
| **Eleventh layer: High sensitivity green-sensitive emulsion layer** | |
| Emulsion H | silver 0.5 g |
| Gelatin | 1.0 g |
| Coupler C-4 | 0.3 g |
| Coupler C-7 | 0.1 g |
| Coupler C-8 | 0.1 g |
| Compound Cpd-B | 0.08 g |
| Compound Cpd-C | 5 mg |
| Compound Cpd-D | 0.02 g |
| Compound Cpd-E | 0.02 g |
| Compound Cpd-F | 0.02 g |
| Compound Cpd-G | 0.02 g |
| Compound Cpd-J | 5 mg |
| Compound Cpd-K | 5 mg |
| High-boiling organic solvent Oil-1 | 0.02 g |
| High-boiling organic solvent Oil-2 | 0.02 g |
| **Twelfth layer: Intermediate layer** | |
| Gelatin | 0.6 g |
| **Thirteenth layer: Yellow filter layer** | |
| Yellow colloidal silver | silver 0.07 g |
| Gelatin | 1.1 g |
| Color-mix preventing agent Cpd-A | 0.01 g |
| High-boiling organic solvent Oil-1 | 0.01 g |
| Fine crystal solid dispersion of Dye E-2 | 0.05 g |

-continued

| | |
|---|---|
| **Fourteenth layer: Intermediate layer** | |
| Gelatin | 0.6 g |
| **Fifteenth layer: Low sensitivity blue-sensitive emulsion layer** | |
| Emulsion I | silver 0.2 g |
| Emulsion J | silver 0.3 g |
| Emulsion K | silver 0.1 g |
| Gelatin | 0.8 g |
| Coupler C-5 | 0.2 g |
| Coupler C-6 | 0.1 g |
| Coupler C-9 | 0.4 g |
| **Sixteen layer: Medium sensitivity blue-sensitive emulsion layer** | |
| Emulsion K | silver 0.1 g |
| Emulsion L | silver 0.4 g |
| Gelatin | 0.9 g |
| Coupler C-5 | 0.3 g |
| Coupler C-6 | 0.1 g |
| Coupler C-9 | 0.1 g |
| **Seventeenth layer: High sensitivity blue-sensitivity emulsion layer** | |
| Emulsion M | silver 0.4 g |
| Gelatin | 1.2 g |
| Coupler C-5 | 0.3 g |
| Coupler C-6 | 0.6 g |
| Coupler C-9 | 0.1 g |
| **Eighteenth layer: First protective layer** | |
| Gelatin | 0.7 g |
| UV-absorbent U-1 | 0.2 g |
| UV-absorbent U-2 | 0.05 g |
| UV-absorbent U-5 | 0.3 g |
| Formalin scavenger Cpd-H | 0.4 g |
| Dye D-1 | 0.1 g |
| Dye D-2 | 0.05 g |
| Dye D-3 | 0.1 g |
| **Nineteenth layer: Second protective layer** | |
| Colloidal silver | silver 0.1 mg |
| Silver iodobromide emulsion of fine grains (av. grain diameter: 0.06 μm, AgI content: 1 mol %) | silver 0.1 g |
| Gelatin | 0.4 g |
| **Twentieth layer: Third protective layer** | |
| Gelatin | 0.4 g |
| Poly(methylmethacrylate) (av. grain diameter: 1.5 μm) | 0.1 g |
| Copolymer of methylmethacrylate and acrylic acid (4:6), av. grain diameter: 1.5 μm) | 0.1 g |
| Silicone oil | 0.03 g |
| Surface-active agent W-1 | 3.0 mg |

Further, to all emulsion layers, in addition to the above-described components, additives F-1 to F-8 were added. Further, to each layer, in addition to the above-described components, gelatin hardener H-1 and surface-active agents W-2, W-3, and W-4 for coating and emulsifying were added.

Further, as antifungal and antibacterial agents, phenol, 1,2-benzisothiazoline-3-one, 2-phenoxyethanol and phenetylalcohol were added.

Silver iodobromide emulsions used in Sample 701 are as follows:

| Emulsion | Feature of grain | Average grain diameter (μm) | Deviation coefficient (%) | AgI content (%) |
|---|---|---|---|---|
| A | Monodisperse tetradecahedral grain | 0.25 | 15 | 3.7 |

-continued

| Emulsion | Feature of grain | Average grain diameter (μm) | Deviation coefficient (%) | AgI content (%) |
|---|---|---|---|---|
| B | Monodisperse tetradecahedral grain | 0.30 | 14 | 3.2 |
| C | Polydisperse twins grain | 0.60 | 25 | 2.0 |
| D | Monodisperse cubic grain | 0.17 | 13 | 4.0 |
| E | Monodisperse cubic grain | 0.20 | 15 | 4.0 |
| F | Monodisperse cubic internal latent image-type grain | 0.25 | 11 | 3.5 |
| G | Monodisperse cubic internal latent image-type grain | 0.30 | 9 | 3.5 |
| H | Polydisperse tabular grain, average aspect ratio: 4.0 | 0.80 | 28 | 1.5 |
| I | Polydisperse tetradecahedral grain | 0.31 | 25 | 4.0 |
| J | Polydisperse tetradecahedral grain | 0.36 | 23 | 4.0 |
| K | Monodisperse cubic internal latent image-type grain | 0.46 | 22 | 3.5 |
| L | Polydisperse cubic grain | 0.53 | 25 | 4.0 |
| M | Polydisperse tabular grain, average aspect ratio: 7.0 | 1.00 | 28 | 1.3 |

Spectral sensitizing dyes and their amounts added to Emulsions A to M were as follows:

| Emulsion | Sensitizing dye added | Amount added (g) per mol of silver halide |
|---|---|---|
| A | S-1 | 0.025 |
| | S-2 | 0.25 |
| B | S-1 | 0.02 |
| | S-2 | 0.25 |
| C | S-1 | 0.01 |
| | S-2 | 0.11 |
| D | S-3 | 0.5 |
| | S-4 | 0.1 |
| E | S-3 | 0.3 |
| | S-4 | 0.1 |
| F | S-3 | 0.25 |
| | S-4 | 0.08 |
| G | S-3 | 0.2 |
| | S-4 | 0.06 |
| H | S-3 | 0.3 |
| | S-4 | 0.07 |
| | S-7 | 0.1 |
| I | S-6 | 0.2 |
| | S-5 | 0.05 |
| J | S-6 | 0.2 |
| | S-5 | 0.05 |
| K | S-6 | 0.22 |
| | S-5 | 0.06 |
| L | S-6 | 0.15 |
| | S-5 | 0.04 |
| M | S-6 | 0.22 |
| | S-5 | 0.06 |

Emulsions a to o were prepared in the same manners as Emulsions A to C, except that the sensitizing dyes were changed as shown in Table 71.

Samples 702 to 710 were prepared in the same manner as sample 701, except that the emulsions and the couplers in the 4th to 6th layers were changed as shown in Table 72.

TABLE 71

| Emulsion | Original emulsion corresponded | Sensitizing dye added |
|---|---|---|
| a | A | (II)-1/S-2 |
| b | " | (II)-2/S-2 |
| c | " | (II)-4/S-2 |
| d | " | (II)-9/(II)-15 |
| e | " | Not added |
| f | B | (II)-1/S-2 |
| g | " | (II)-7/S-2 |
| h | " | (II)-31/S-2 |
| i | " | (II)-13/(II)-28 |
| j | " | Not added |
| k | C | (II)-1/S-2 |
| l | " | (II)-7/(II)-13 |
| m | " | (II)-9/S-2 |
| n | " | (II)-15/S-2 |
| o | " | Not added |

TABLE 72

| | Emulsion | | | Cyan coupler | | |
|---|---|---|---|---|---|---|
| Sample No. | 4th layer | 5th layer | 6th layer | 4th & 5th layer | 6th layer | Remarks |
| 701 | A | B | C | C-1/C-2 | C-3 | Comparison |
| 702 | " | " | " | (Ih)-1 | (Ic)-9 | " |
| 703 | d | h | k | (Ic)-3 | (Iq)-3 | This invention |
| 704 | b | g | k | (Ih)-11 | (Ic)-13 | " |
| 705 | c | f | n | (Ib)-12 | " | " |
| 706 | d | i | l | (Ib)-2 | (Ih)-9 | " |
| 707 | a | i | m | (Ih)-2 | (Ic)-3 | " |
| 708 | a | i | m | (Io)-1 | (Ib)-2 | " |
| 709 | c | g | l | (Ib)-12 | (Ih)-3 | " |
| 710 | e | j | o | C-1/C-2 | C-3 | Standard |

Thus prepared Samples 701 to 710 were subjected to an exposure to a white light through a white/black wedge at an exposure amount of 20 CMS in an exposure time of 1/100 sec, and then they were processed by the processing process shown below, using an automatic processor, followed by density measurement.

The evaluation of residual color was conducted by comparison of respective densities of minimum magenta image with that of standard sample (Sample 710).

The spectral absorption of cyan color image was measured, to evaluate color reproduction.

Further, the evaluation of cyan color image fastness was conducted by storage of processed samples for 14 days at 80° C.

Results obtained are shown in Table 73.

| Processing step | Time | Temperature |
|---|---|---|
| First development | 6 min | 38° C. |
| Water washing | 2 min | 38° C. |
| Reversal | 2 min | 38° C. |
| Color development | 6 min | 38° C. |
| Conditioning | 2 min | 38° C. |
| Bleaching | 6 min | 38° C. |
| Fixing | 4 min | 38° C. |
| Water washing | 4 min | 38° C. |
| Stabilizing | 1 min | 25° C. |

Composition of each processing solution is an follows:

| First developing solution | |
|---|---|
| Pentasodium nitrilo-N,N,N-trimethylenephosphonate | 2.0 g |
| Sodium sulfite | 30 g |
| Hydroquinone potassium monosulfonate | 20 g |
| Potassium carbonate | 33 g |
| 1-Phenyl-4-methyl-4-hydroxymethyl-3-pyrazolydone | 2.0 g |
| Potassium bromide | 2.5 g |
| Potassium thiocyanate | 1.2 g |
| Potassium iodide | 2.0 mg |
| Water to make | 1,000 ml |
| pH | 9.60 |
| (pH was adjusted by using hydrochloric acid or potassium hydroxide) | |
| **Reversal solution** | |
| Pentasodium nitrilo-N,N,N-trimethylenephosphonate | 3.0 g |
| Stannous chloride (dihydrate) | 1.0 g |
| p-Aminophenol | 0.1 g |
| Sodium hydroxide | 8 g |
| Glacial acetic acid | 15 ml |
| Water to make | 1,000 ml |
| pH | 6.00 |
| (pH was adjusted by using hydrochloric acid or potassium hydroxide) | |
| **Color developer** | |
| Pentasodium nitrilo-N,N,N-trimethylenephosphonate | 2.0 g |
| Sodium sulfite | 7.0 g |
| Sodium tertiary phosphate $12H_2O$ | 36 g |
| Potassium bromide | 1.0 g |
| Potassium iodide | 90 mg |
| Sodium hydroxide | 3.0 g |
| Cytrazinic acid | 1.5 g |
| N-Ethyl-N-(β-methanesulfonamidoethyl)-3-methyl-4-aminoaniline sulfate | 11 g |
| 3,6-Dithiaoctane-1,8-diol | 1.0 g |
| Water to make | 1,000 ml |
| pH | 11.80 |
| (pH was adjusted by using hydrochloric acid or potassium hydroxide) | |
| **Conditioner** | |
| Disodium ethylenediaminetetraacetate (dihydrate) | 8.0 g |
| Sodium sulfite | 12 g |
| 1-Thioglycerin | 0.4 ml |
| Water to make | 1,000 ml |
| pH | 6.20 |
| (pH was adjusted by using hydrochloric acid or sodium hydroxide) | |
| **Bleaching solution** | |
| Disodium ethylenediaminetetraacetate (dihydrate) | 2.0 g |
| Fe (III) ammonium ethylenediamine-tetraacetate (dihydrate) | 120 g |
| Potassium bromide | 100 g |
| Ammonium nitrate | 10 g |
| Water to make | 1,000 ml |
| pH | 5.70 |
| (pH was adjusted by using hydrochloric acid or sodium hydroxide) | |
| **Fixing solution** | |
| Ammonium thiosulfate | 80 g |
| Sodium sulfite | 5.0 g |
| Sodium bisulfite | 5.0 g |
| Water to make | 1,000 ml |
| pH | 6.60 |
| (pH was adjusted by using hydrochloric acid or aqueous ammonia) | |

-continued

| Stabilizing solution | |
|---|---|
| Formalin (37%) | 5.0 ml |
| Polyoxyethylene-p-monononyl phenyl ether (av. polymerization degree: 10) | 0.5 ml |
| Water to make | 1,000 ml |

TABLE 73

| Sample No. | Residual color *1 | Spectral absorption characte-ristics *2 | Imag-dye fastness *3 | Remarks |
|---|---|---|---|---|
| 701 | 0.024 | 0.21 | 11 | Comparisiton |
| 702 | 0.042 | 0.06 | 3 | Comparisiton |
| 703 | 0.007 | 0.08 | 3 | This invention |
| 704 | 0.007 | 0.06 | 2 | This invention |
| 705 | 0.007 | 0.07 | 4 | This invention |
| 706 | 0.008 | 0.07 | 4 | This invention |
| 707 | 0.009 | 0.07 | 3 | This invention |
| 708 | 0.009 | 0.08 | 3 | This invention |
| 709 | 0.009 | 0.06 | 2 | This invention |
| 710 | — | — | — | Standard |

Note:
*1 Difference of minimum magenta image densities between each sample and standard sample (Sample 710)
*2 Ratio of densities of cyan images at (λmax-230 nm) to λmax (Dλmax-230 nm/Dmax)
*3 Decreased ratio of maximum density of cyan image after storage for 14 days at 80° C.

As is apparent from the results in Table 73, Samples of this invention (Samples 703 to 710) are excellent in fastness and spectral absorption characteristics of cyan image-dye and less in residual dye after processing.

EXAMPLE 9

With respect to Samples 701 to 711 prepared in Example 8, the same procedure as Example 8, except that the processing process was changed as shown below, was conducted, and the similar results to Example 8 were obtained.

Processing process

| Process | Time | Tempera-ture | Tank volume | Replenisher amount |
|---|---|---|---|---|
| 1st development | 6 min | 38° C. | 12 liter | 2,200 ml/m² |
| 1st water-washing | 45 sec | 38° C. | 2 liter | 2,200 ml/m² |
| Reversal | 45 sec | 38° C. | 2 liter | 1,100 ml/m² |
| Color development | 6 min | 38° C. | 12 liter | 2,200 ml/m² |
| Bleaching | 2 min | 38° C. | 4 liter | 860 ml/m² |
| Bleach-fixing | 4 min | 38° C. | 8 liter | 1,100 ml/m² |
| 2nd water-washing (1) | 1 min | 38° C. | 2 liter | — |
| 2nd water-washing (2) | 1 min | 38° C. | 2 liter | 1,100 ml/m² |
| Stabilizing | 1 min | 25° C. | 2 liter | 1,100 ml/m² |
| Drying | 1 min | 65° C. | — | — |

Processing was carried out using an automatic processor until the accumulated replenishing amount had reached to three times the tank volume.

The replenishing of second water-washing was carried out in a countercurrent replenishing mode wherein the replenisher was led to the second water-washing (2), and overflow from the second water-washing (2) was led to the second water-washing (1).

Compositions of processing solutions used were as follows:

| | Tank solution | Replenisher |
|---|---|---|
| First developing solution | | |
| Pentasodium nitrilo-N,N,N-trimethylenephosphonate | 2.0 g | 2.0 g |
| Sodium sulfite | 30 g | 30 g |
| Hydroquinone potassium monosulfonate | 20 g | 20 g |
| Sodium carbonate | 33 g | 33 g |
| 1-Phenyl-4-methyl-4-hydroxymethyl-3-pyrazolydone | 2.0 g | 2.0 g |
| Potassium bromide | 2.5 g | 1.4 g |
| Potassium thiocyanate | 1.2 g | 1.2 g |
| Potassium iodide | 2.0 mg | — |
| Water to make | 1,000 ml | 1,000 ml |
| pH | 9.60 | 9.60 |
| (pH was adjusted by using hydrochloric acid or potassium hydroxide) | | |
| First water washing solution | | |
| Ethylenediamine tetramethylene-phosphonic acid | 2.0 g | Same as tank solution |
| Disodium phosphate | 5.0 g | |
| Water to make | 1,000 ml | |
| pH | 7.00 | |
| (pH was adjusted by using hydrochloric acid or sodium hydroxide) | | |
| Reversal solution | | |
| Pentasodium nitrilo-N,N,N-trimethylenephosphonate | 3.0 g | Same as tank solution |
| Stannous chloride (dihydrate) | 1.0 g | |
| p-Aminolphenol | 0.1 g | |
| Sodium hydroxide | 8 g | |
| Glacial acetic acid | 15 ml | |
| Water to make | 1,000 ml | |
| pH | 6.00 | |
| (pH was adjusted by using hydrochloric acid or sodium hydroxide) | | |
| Color developer | | |
| Pentasodium nitrilo-N,N,N-trimethylenephosphonate | 2.0 g | 2.0 g |
| Sodium sulfite | 7.0 g | 7.0 g |
| Sodium tertiary phosphate (12-hydrate) | 36 g | 36 g |
| Potassium bromide | 1.0 g | — |
| Potassium iodide | 90 mg | — |
| Sodium hydroxide | 3.0 g | 3.0 g |
| Cytrazinic acid | 1.5 g | 1.5 g |
| N-Ethyl-N-(β-methanesulfonamidoethyl)-3-methyl-4-aminoaniline 3/2 sulfate monohydrate | 11 g | 11 g |
| 3,6-Dithiaoctane-1,8-diol | 1.0 g | 1.0 g |
| Water to make | 1,000 ml | 1,000 ml |
| pH | 11.80 | 12.00 |
| (pH was adjusted by using hydrochloric acid or potassium hydroxide) | | |
| Bleaching solution | | |
| Disodium ethylenediaminetetraacetate (dihydrate) | 10.0 g | Same as tank solution |
| Fe (III) ammonium ethylenediamine-tetraacetate (dihydrate) | 120 g | |
| Potassium bromide | 100 g | |
| Ammonium nitrate | 10 g | |
| Bleaching accelerator $(CH_3)_2N—CH_2—CH_2—S—S—CH_2—CH_2—N(CH_3)_2.2HCl$ | 0.005 mol | |
| Water to make | 1,000 ml | |
| pH | 6.30 | |
| (pH was adjusted by using hydrochloric acid or aqueous ammonia) | | |
| Bleach-fixing solution | | |
| Disodium ethylenediaminetetraacetate (dihydrate) | 5.0 g | Same as tank solution |
| Fe (III) ammonium ethylenediamine-tetraacetate (dihydrate) | 50 g | |

-continued

| | Tank solution | Replenisher |
|---|---|---|
| Ammonium thiosulfate | 80 g | |
| Sodium sulfite | 12.0 g | |
| Water to make | 1,000 ml | |
| pH | 6.60 | |
| (pH was adjusted by using hydrochloric acid or aqueous ammonia) | | |
| Second water-washing solution (Both tank solution and replenisher) | | |

Tap water was treated by passing through a mixed bed ion-exchange column filled with H-type strong acidic cation exchange resin (Amberlite IR-120B, tradename manufactured by Rohm & Haas) and OH-type strong basic anion exchange resin (Amberlite IR-400, the same as the above) so that the concentrations of calcium ions and magnesium ions decrease both to 3 mg/liter or below. To the thus-obtained ion-exchanged water 20 mg/liter of sodium dichlorinated isocyanurate and 1.5 mg/liter of sodium sulfate were added. The pH of this solution was in a range of 6.5 to 7.5.)

| Stabilizing solution | Tank solution | Replenisher |
|---|---|---|
| Formalin (37%) | 0.5 ml | Same as tank solution |
| Polyoxyethylene-p-monononyl phenyl ether (av. polymerization degree: 10) | 0.3 g | |
| Triazole | 1.7 g | |
| Piperazine 6-hydrate | 0.6 g | |
| Water to make | 1,000 ml | |
| pH | (not adjusted) | |

EXAMPLE 10

Preparation of Sample 1101

A multilayer color photographic material was prepared by multi-coating each layer having composition as shown below on a prime-coated triacetate cellulose film support having a thickness of 127 μm, and it was designated Sample 1101. The figures provided indicate the added amounts per $m^2$. The effects of the compound added are not restricted to the shown usage.

| | |
|---|---|
| First layer: Halation-preventing layer | |
| Black colloidal silver | 0.20 g |
| Gelatin | 1.9 g |
| UV-absorbent U-1 | 0.1 g |
| UV-absorbent U-3 | 0.04 g |
| UV-absorbent U-4 | 0.1 g |
| High boiling organic solvent Oil-1 | 0.1 g |
| Fine crystal solid dispersion of dye E-1 | 0.1 g |
| Second layer: Intermediate layer | |
| Gelatin | 0.40 g |
| Compound Cpd-C | 5 mg |
| Compound Cpd-J | 5 mg |
| Compound Cpd-K | 3 mg |
| High-boiling organic solvent Oil-3 | 0.1 g |
| Dye D-4 | 0.4 mg |
| Third layer: Intermediate layer | |
| Silver iodobromide emulsion of fine grains surface and inner part of which were fogged (av. grain diameter 0.06 μm, deviation coefficient: 18%, AgI | silver 0.05 g |

| | |
|---|---|
| content: 1 mol %) | |
| Gelatin | 0.4 g |
| Fourth layer: Low sensitivity red-sensitive emulsion layer | |
| Emulsion A | silver 0.5 g |
| Gelatin | 0.8 g |
| Coupler C-1 | 0.15 g |
| Coupler C-2 | 0.05 g |
| Coupler C-3 | 0.05 g |
| Compound Cpd-C | 10 mg |
| High-boiling organic solvent Oil-2 | 0.1 g |
| Additive P-1 | 0.1 g |
| Fifth layer: Medium sensitivity red-sensitive emulsion layer | |
| Emulsion B | silver 0.5 g |
| Gelatin | 0.8 g |
| Coupler C-1 | 0.2 g |
| Coupler C-2 | 0.05 g |
| Coupler C-3 | 0.2 g |
| High boiling organic solvent Oil-2 | 0.1 g |
| Additive P-1 | 0.1 g |
| Sixth layer: High sensitivity red-sensitive emulsion layer | |
| Emulsion C | silver 0.4 g |
| Gelatin | 1.1 g |
| Coupler C-1 | 0.3 g |
| Coupler C-2 | 0.1 g |
| Coupler C-3 | 0.7 g |
| Additive P-1 | 0.1 g |
| Seventh layer: Intermediate layer | |
| Gelatin | 0.6 g |
| Additive M-1 | 0.3 g |
| Color-mix preventing agent Cpd-I | 2.6 mg |
| UV-absorbent U-1 | 0.01 g |
| UV-absorbent U-2 | 0.002 g |
| UV-absorbent U-5 | 0.01 g |
| Dye D-1 | 0.02 g |
| Dye D-5 | 0.02 g |
| Compound Cpd-C | 5 mg |
| Compound Cpd-J | 5 mg |
| Compound Cpd-K | 5 mg |
| High-boiling organic solvent Oil-1 | 0.02 g |
| Eighth layer: Intermediate layer | |
| Silver iodobromide emulsion of fine grains surface and inner part of which were fogged (av. grain diameter: 0.06 μm, deviation coefficient: 16%, AgI content: 0.3 mol %) | silver 0.02 g |
| Gelatin | 1.0 g |
| Additive P-1 | 0.2 g |
| Color-mix preventing agent Cpd-A | 0.1 g |
| Ninth layer: Low sensitivity green-sensitive emulsion layer | |
| Emulsion D | silver 0.5 g |
| Gelatin | 0.5 g |
| Coupler C-4 | 0.1 g |
| Coupler C-7 | 0.05 g |
| Coupler C-8 | 0.20 g |
| Compound Cpd-B | 0.03 g |
| Compound Cpd-C | 10 mg |
| Compound Cpd-D | 0.02 g |
| Compound Cpd-E | 0.02 g |
| Compound Cpd-F | 0.02 g |
| Compound Cpd-G | 0.02 g |
| Compound Cpd-L | 0.05 g |
| High-boiling organic solvent Oil-1 | 0.1 g |
| High-boiling organic solvent Oil-2 | 0.1 g |
| Tenth layer: Medium sensitivity green-sensitive emulsion layer | |
| Emulsion E | siiver 0.4 g |
| Gelatin | 0.6 g |
| Coupler C-4 | 0.1 g |
| Coupler C-7 | 0.2 g |

| | |
|---|---|
| Coupler C-8 | 0.1 g |
| Compound Cpd-B | 0.03 g |
| Compound Cpd-D | 0.02 g |
| Compound Cpd-E | 0.02 g |
| Compound Cpd-F | 0.05 g |
| Compound Cpd-G | 0.05 g |
| Compound Cpd-L | 0.05 g |
| High-boiling organic solvent Oil-2 | 0.01 g |
| Eleventh layer: High sensitivity green-sensitive emulsion layer | |
| Emulsion F | silver 0.5 g |
| Gelatin | 1.0 g |
| Coupler C-4 | 0.3 g |
| Coupler C-7 | 0.1 g |
| Coupler C-8 | 0.1 g |
| Compound Cpd-B | 0.08 g |
| Compound Cpd-C | 5 mg |
| Compound Cpd-D | 0.02 g |
| Compound Cpd-E | 0.02 g |
| Compound Cpd-F | 0.02 g |
| Compound Cpd-G | 0.02 g |
| Compound Cpd-J | 5 mg |
| Compound Cpd-K | 5 mg |
| Compound Cpd-L | 0.05 g |
| High-boiling organic solvent Oil-1 | 0.02 g |
| High-boiling organic solvent Oil-2 | 0.02 g |
| Twelfth layer: Intermediate layer | |
| Gelatin | 0.6 g |
| Thirteenth layer: Yellow filter layer | |
| Yellow colloidal silver | silver 0.07 g |
| Gelatin | 1.1 g |
| Color-mix preventing agent Cpd-A | 0.01 g |
| High-boiling organic solvent Oil-1 | 0.01 g |
| Fine crystal solid dispersion of Dye E-2 | 0.05 g |
| Fourteenth layer: Intermediate layer | |
| Gelatin | 0.6 g |
| Fifteenth layer: Low sensitivity blue-sensitive emulsion layer | |
| Emulsion G | silver 0.5 g |
| Gelatin | 0.8 g |
| Coupler C-5 | 0.2 g |
| Coupler C-6 | 0.1 g |
| Coupler C-10 | 0.4 g |
| Sixteen layer: Medium sensitivity blue-sensitive emulsion layer | |
| Emulsion H | silver 0.5 g |
| Gelatin | 0.9 g |
| Coupler C-5 | 0.1 g |
| Coupler C-6 | 0.1 g |
| Coupler C-10 | 0.6 g |
| Seventeenth layer: High sensitivity blue-sensitivity emulsion layer | |
| Emulsion I | silver 0.4 g |
| Gelatin | 1.2 g |
| Coupler C-5 | 0.1 g |
| Coupler C-6 | 0.1 g |
| Coupler C-10 | 0.6 g |
| High-boiling organic solvent Oil-2 | 0.1 g |
| Eighteenth layer: First protective layer | |
| Gelatin | 0.7 g |
| UV-absorbent U-1 | 0.2 g |
| UV-absorbent U-2 | 0.05 g |
| UV-absorbent U-5 | 0.3 g |
| Formalin scavenger Cpd-H | 0.4 g |
| Dye D-1 | 0.1 g |
| Dye D-2 | 0.05 g |
| Dye D-3 | 0.1 g |
| Nineteenth layer: Second protective layer | |
| Colloidal silver | silver 0.1 mg |
| Silver iodobromide emulsion of fine grains (av. grain diameter: 0.06 μm, | silver 0.1 g |

-continued

| | |
|---|---|
| AgI content: 1 mol %) | |
| Gelatin | 0.4 g |
| Twentieth layer: Third protective layer | |
| Gelatin | 0.4 g |
| poly(methylmethacrylate) (av. grain diameter: 1.5 μm) | 0.1 g |
| Copolymer of methylmethacrylate and acrylic acid (4:6) (av. grain diameter: 1.5 μm) | 0.1 g |
| Silicone oil | 0.03 g |
| Surface-active agent W-1 | 3.0 mg |
| Surface-active agent W-2 | 0.03 g |

Further, to all emulsion layers, in addition to the above-described components, additives F-1 to F-8 were added. Further, to each layer, in addition to the above-described components, gelatin hardener H-1 and surface-active agents W-3, W-4, W-5, and W-6 for coating and emulsifying were added.

Further, as antifungal and antibacterial agents, phenol, 1,2-benzisothiazoline-3-one, 2-phenoxyethanol, phenetylalcohol, and p-benzoic butylester were added.

Emulsions A to I used in Sample 101' are as follows:

| Emulsion | Feature of grain | Average grain diameter (μm) | Deviation coefficient (%) | AgI content (%) |
|---|---|---|---|---|
| A | Monodisperse tetradecahedral grain | 0.28 | 16 | 3.0 |
| B | Monodisperse cubic internal latent image-type grain | 0.38 | 10 | 4.0 |
| C | Tabular grain average aspect ratio: 6.0 | 0.62 | 18 | 2.0 |
| D | Monodisperse cubic grain | 0.20 | 17 | 4.0 |
| E | Monoodisperse cubic internal latent image-type grain | 0.28 | 11 | 3.5 |
| F | Tabular grain, average aspect ratio: 7.0 | 0.80 | 18 | 1.5 |
| G | Monodisperse tetradecahedral grain | 0.30 | 18 | 4.0 |
| H | Monodisperse tarbular grain, average aspect ratio: 7.0 | 0.60 | 17 | 4.0 |
| I | Monodisperse terbular grain, average aspect ratio: 7.0 | 1.20 | 33 | 1.3 |

Spectral sensitizing dyes and their amounts added to Emulsions A to N were as follows:

| Emulsion | Sensitizing dye added | Amount added (g) per mol of silver halide |
|---|---|---|
| A | S-2 | 0.025 |
| | S-3 | 0.25 |
| | S-8 | 0.01 |
| B | S-1 | 0.01 |
| | S-2 | 0.01 |
| | S-3 | 0.25 |
| | S-8 | 0.01 |
| C | S-2 | 0.01 |
| | S-3 | 0.10 |
| | S-8 | 0.01 |
| D | S-4 | 0.5 |

-continued

| Emulsion | Sensitizing dye added | Amount added (g) per mol of silver halide |
|---|---|---|
| | S-5 | 0.1 |
| E | S-4 | 0.25 |
| | S-5 | 0.08 |
| | S-9 | 0.05 |
| F | S-4 | 0.3 |
| | S-5 | 0.07 |
| | S-9 | 0.1 |
| G | S-6 | 0.05 |
| | S-7 | 0.2 |
| | S-6 | 0.05 |
| | S-7 | 0.2 |
| I | S-6 | 0.06 |
| | S-7 | 0.22 |

Sample 1102 was prepared in the same manner as Sample 1101, except that the 4th layer and 5th layer of Sample 1101 were combined to be one layer, and the 15th layer and 16th of Sample 1101 were combined to be one layer. Sample 1103 was prepared in the same manner as Sample 1101, except that the 4th layer and 5th layer of Sample 1101 were combined to be one layer, the 9th layer and 10th layer of Sample 1101 were combined to be one layer, and the 15th layer and 16th of Sample 1101 were combined to be one layer.

Sample 1201 was prepared in the same manner as Sample 1101, except that each coupler C-1 in the 4th, 5th, and 6th layer of Sample 1101 was replaced with 0.6 times molar of compound I-1. Sample 1202 was prepared in the same manner as Sample 1102, except that each coupler C-1 in the 4th, 5th, and 6th layer of Sample 1102 was replaced with 0.6 times molar of compound C-1. Sample 1203 was prepared in the same manner as Sample 1103, except that each coupler C-1 in the 4th, 5th, and 6th layer of Sample 1103 was replaced with 0.6 times molar of compound C-1.

Samples 1111, 1121, and 1131 were prepared in the same manner as Sample 1101, except that the AgI content of emulsion in each layer of Sample 1101 was changed as shown in the following Table 81. Samples 1211, 1221, and 1231 were prepared in the same manner as Sample 1201, except that the AgI content of emulsion in each layer of Sample 1201 was changed as shown in the following Table 81.

TABLE 81

| | AgI content (%) of each layer | | | | | | | |
|---|---|---|---|---|---|---|---|---|
| | 1101 | 1111 | 1121 | 1131 | 1201 | 1211 | 1221 | 1231 |
| 4th layer | 3.0 | 3.5 | 3.0 | 2.0 | 3.0 | 3.5 | 3.0 | 2.0 |
| 5th layer | 4.0 | 3.0 | 3.0 | 3.0 | 4.0 | 3.0 | 3.0 | 3.0 |
| 6th layer | 2.0 | 2.5 | 3.0 | 4.0 | 2.0 | 2.5 | 3.0 | 4.0 |
| 9th layer | 4.0 | 4.0 | 3.0 | 3.0 | 4.0 | 4.0 | 3.0 | 3.0 |
| 10th layer | 3.5 | 3.5 | 3.0 | 3.0 | 3.5 | 3.5 | 3.0 | 3.0 |
| 11th layer | 1.5 | 1.5 | 3.0 | 3.0 | 1.5 | 1.5 | 3.0 | 3.0 |
| 15th layer | 4.0 | 3.5 | 3.0 | 2.0 | 4.0 | 3.5 | 3.0 | 2.0 |
| 16th layer | 3.0 | 3.0 | 3.0 | 3.0 | 3.0 | 3.0 | 3.0 | 3.0 |
| 17th layer | 1.3 | 2.5 | 3.0 | 4.0 | 1.3 | 2.5 | 3.0 | 4.0 |

After each of Samples 1101, 1102, 1103, 1201, 1202, 1203, 1111, 1121, 1131, 1211, 1221 and 1231 was stored for 10 days at temperature 30° C. and relative humidity of 60%, each sample was cut into 35 mm width, perforated, and was used for photographing by using a commercially available camera. Conditions for photographing were as follows: the place, outdoors in the precinct of Ashigara factory of Fuji Photo Film Co. Ltd., of Minami-ashigara-shi, Kanagawaken, Japan; the date and hour, noontime under a clear sky in early March; object is Macbeth chart, Macbeth gray plate, human figure, landscape, tree, and foliage plant, such as potos. The color balance of each sample having a little deviation was corrected so as to be photographed the gray plate being gray by inserting a suitable color filter.

In next day of photographing, development processing as shown below was conducted.

| Process | Time | Temperature | Tank volume | Replenisher amount |
|---|---|---|---|---|
| 1st development | 6 min | 38° C. | 12 liter | 2,200 ml/m² |
| 1st water-washing | 2 min | 38° C. | 4 liter | 7,500 ml/m² |
| Reversal | 2 min | 38° C. | 4 liter | 1,100 ml/m² |
| Color development | 6 min | 38° C. | 12 liter | 2,200 ml/m² |
| Conditioning | 2 min | 38° C. | 4 liter | 1,100 ml/m² |
| Bleaching | 6 min | 38° C. | 12 liter | 220 ml/m² |
| Fixing | 4 min | 38° C. | 8 liter | 1,100 ml/m² |
| 2nd water-washing | 4 min | 38° C. | 8 liter | 7,500 ml/m² |
| Stabilizing | 1 min | 25° C. | 2 liter | 1,100 ml/m² |

Compositions of processing solutions used were as follows:

| | Tank solution | Replenisher |
|---|---|---|
| First Development solution | | |
| Pentasodium nitrilo-N,N,N-trimethylenephosphonate | 1.5 g | 1.5 g |
| Pentasodium diethylenetriamine-pentaacetate | 2.0 g | 2.0 g |
| Sodium sulfite | 30 g | 30 g |
| Hydroquinone potassium monosulfonate | 20 g | 20 g |
| Sodium carbonate | 15 g | 20 g |
| Sodium bicarbonate | 12 g | 15 g |
| 1-Phenyl-4-methyl-4-hydroxymethyl-3-pyrazolydone | 1.5 g | 2.0 g |
| Potassium bromide | 2.5 g | 1.4 g |
| Potassium thiocyanate | 1.2 g | 1.2 g |
| Potassium iodide | 2.0 mg | — |
| Diethylene glycol | 13 g | 15 g |
| Water to make | 1,000 ml | 1,000 ml |
| pH | 9.60 | 9.60 |
| (pH was adjusted by using hydrochloric acid or potassium hydroxide) | | |
| Reversal solution | | |
| Pentasodium nitrilo-N,N,N-trimethylenephosphonate | 3.0 g | Same as tank solution |
| Stannous chloride (dihydrate) | 1.0 g | |
| p-Amylphenol | 0.1 g | |
| Sodium hydroxide | 8 g | |
| Glacial acetic acid | 15 ml | |
| Water to make | 1,000 ml | |
| pH | 6.00 | |
| (pH was adjusted by using hydrochloric acid or sodium hydroxide) | | |
| Color developer | | |
| Pentasodium nitrilo-N,N,N-trimethylenephosphonate | 2.0 g | 2.0 g |
| Sodium sulfite | 7.0 g | 7.0 g |
| Sodium tertiary phosphate (12-hydrate) | 36 g | 36 g |
| Potassium bromide | 1.0 g | — |
| Potassium iodide | 90 mg | — |
| Sodium hydroxide | 3.0 g | 3.0 g |
| Cytrazinic acid | 1.5 g | 1.5 g |
| N-Ethyl-N-(β-methanesulfonamidoethyl)-3-methyl-4-aminoaniline sulfate | 11 g | 11 g |
| 3,6-Dithiaoctane-1,8-diol | 1.0 g | 1.0 g |
| Water to make | 1,000 ml | 1,000 ml |

-continued

| | Tank solution | Replenisher |
|---|---|---|
| pH | 11.80 | 12.00 |
| (pH was adjusted by using hydrochloric acid or potassium hydroxide) | | |
| Conditioner | | |
| Disodium ethylenediaminetetraacetate (dihydrate) | 8.0 g | 8.0 g |
| Sodium sulfite | 12 g | 12 g |
| 1-Thioglycerin | 0.4 g | 0.4 g |
| Formaldehyde-sodium bisulfite adduct | 30 g | 30 g |
| Water to make | 1,000 ml | 1,000 ml |
| pH | 6.20 | 6.10 |
| (pH was adjusted by using hydrochloric acid or sodium hydroxide) | | |
| Bleaching solution | | |
| Disodium ethylenediaminetetraacetate (dihydrate) | 2.0 g | 4.0 g |
| Iron (III) ammonium ethylenediamine-tetraacetate (dihydrate) | 120 g | 120 g |
| Potassium bromide | 100 g | 200 g |
| Ammonium nitrate | 10 g | 20 g |
| Water to make | 1,000 ml | 1,000 ml |
| pH | 5.70 | 5.50 |
| (pH was adjusted by using hydrochloric acid or sodium hydroxide) | | |
| Fixing solution | | |
| Ammonium thiosulfate | 8.0 g | Same as tank solution |
| Sodium sulfite | 5.0 g | |
| Sodim bisulfite | 5.0 g | |
| Water to make | 1,000 ml | |
| pH | 6.60 | |
| (pH was adjusted by using hydrochloric acid or aqueous ammonia) | | |
| Stabilizing solution | | |
| Benzoisothiazoline-3-one | 0.02 g | 0.03 g |
| Polyoxyethylene-p-monononyl phenyl ether (av. polymerization degree: 10) | 0.3 g | 0.3 g |
| Water to make | 1,000 ml | 1,000 ml |
| pH | 7.0 | 7.0 |

Evaluation of color reproduction was carried out for each sample after development processing being on a table as it is. Evaluation of graininess was conducted by using 16 fold-enlarged image of each sample on a commercially available reversal color paper, manufactured by Fuji Photo Film Co., Ltd.

Evaluation was conducted by 5 panelists working at Ashigara Laboratories of Fuji Photo Film Co., Ltd., whose work is to evaluate the image quality of photograph and the 5-step assessment shown below was carried out.

| Point | Assessment |
|---|---|
| 5 | Excellent |
| 4 | Good |
| 3 | Normal, lowest permissible |
| 2 | Inferior |
| 1 | Remarkably inferior |

Results of assessment with respect to color reproduction and graininess are shown in Table 82 as average points of 5 members.

TABLE 82

| Sample No. | Cyan coupler | Constitution of sample: Number of separated layer | Constitution of sample: AgI content | Result of Evaluation: Graininess | Result of Evaluation: Color reproduction | Remarks |
|---|---|---|---|---|---|---|
| 1101 | C-1 | 3 | Low content in high sensitivity layer | 4.2 | 2.6 | Comparison |
| 1102 | C-1 | 2 3 | Low content in high sensitivity layer | 3.6 | 2.8 | " |
| 1103 | C-1 | 2 | Low content in high sensitivity layer | 2.6 | 3.2 | " |
| 1201 | Ib-1 | 3 | Low content in high sensitivity layer | 4.4 | 4.2 | This invention |
| 1202 | Ib-1 | 2 3 | Low content in high sensitivity layer | 3.6 | 4.4 | " |
| 1203 | Ib-1 | 2 | Low content in high sensitivity layer | 3.0 | 4.8 | " |
| 1111 | C-1 | 3 | Low content in high sensitivity layer | 4.0 | 2.4 | Comparison |
| 1121 | C-1 | 3 | Equal amount content in each layer | 3.8 | 2.2 | " |
| 1131 | C-1 | 3 | Low content in high sensitivity layer | 4.4 | 2.0 | " |
| 1211 | Ib-1 | 3 | Low content in high sensitivity layer | 3.8 | 4.0 | This invention |
| 1221 | Ib-1 | 3 | Equal amount content in each layer | 4.0 | 3.4 | " |
| 1231 | Ib-1 | 3 | Equal amount content in each layer | 4.4 | 3.0 | " |

As is apparent from the results in Table 82, all samples of the present invention satisfy both graininess and color reproduction. In particular, samples that utilized a cyan coupler according to this invention are excellent in reproduction of green color. Graininess as the purpose of the invention, can be obtained with a three layer constitution for the first time. Further, samples of the present invention having a low AgI content in the high-sensitivity layer are excellent in color reproduction; in particular, green of leaves, wherein sunshine is reproduced in brilliant bright green, and green in the shade is reproduced in a deep and serious green. On the other hand, in samples having a high AgI content in the high-sensitivity layer, the green obtained is expressionless, and bright green is not reproduced as bright green.

With respect to sharpness, all samples are of a satisfactory level.

EXAMPLE 11

Preparation of Sample 801

A multilayer color photographic material was prepared by multi-coating each layer having composition as shown below on a prime-coated triacetate cellulose film support having a thickness of 127 μm, and it was designated Sample 801. The figures provided indicate the added amounts per $m^2$. The effects of the compound added are not restricted to the shown usage.

| | |
|---|---|
| First layer: Halation-preventing layer | |
| Black colloidal silver | 0.20 g |
| Gelatin | 1.9 g |
| UV-absorbent U-1 | 0.04 g |
| UV-absorbent U-2 | 0.1 g |
| UV-absorbent U-3 | 0.1 g |

-continued

| | |
|---|---|
| UV-absorbent U-4 | 0.1 g |
| UV-absorbent U-6 | 0.1 g |
| High boiling organic solvent Oil-1 | 0.1 g |
| Fine crystal solid dispersion of dye E-1 | 0.1 g |
| Second layer: Intermediate layer | |
| Gelatin | 0.40 g |
| High-boiling organic solvent Oil-3 | 0.1 g |
| Dye D-4 | 0.4 mg |
| Third layer: Intermediate layer | |
| Silver iodobromide emulsion of fine grains surface and inner part of which were fogged (av. grain diameter 0.06 μm, deviation coefficient: 18%, AgI content: 1 mol %) | silver 0.05 g |
| Gelatin | 0.4 g |
| Fourth layer: Low sensitivity red-sensitive emulsion layer | |
| Emulsion A | silver 0.1 g |
| Emulsion B | silver 0.4 g |
| Gelatin | 0.8 g |
| Coupler C-1 | 0.15 g |
| Coupler C-2 | 0.05 g |
| Coupler C-9 | 0.05 g |
| High-boiling organic solvent Oil-2 | 0.1 g |
| Fifth layer: Medium sensitivity red-sensitive emulsion layer | |
| Emulsion B | silver 0.2 g |
| Emulsion C | silver 0.3 g |
| Gelatin | 0.8 g |
| Coupler C-1 | 0.2 g |
| Coupler C-2 | 0.05 g |
| Coupler C-3 | 0.2 g |
| High boiling organic solvent Oil-2 | 0.1 g |

-continued

| | |
|---|---|
| Sixth layer: High sensitivity red-sensitive emulsion layer | |
| Emulsion D | silver 0.4 g |
| Gelatin | 1.1 g |
| Coupler C-1 | 0.3 g |
| Coupler C-3 | 0.7 g |
| Additive P-1 | 0.1 g |
| Seventh layer: Intermediate layer | |
| Gelatin | 0.6 g |
| Additive M-1 | 0.3 g |
| Color-mix preventing agent Cpd-K | 2.6 mg |
| UV-absorbent U-1 | 0.1 g |
| UV-absorbent U-6 | 0.1 g |
| Dye D-1 | 0.02 g |
| Eighth layer: Intermediate layer | |
| Silver iodobromide emulsion of fine grains surface and inner part of which were fogged (av. grain diameter: 0.06 μm, deviation coefficient: 16%, AgI content: 0.3 mol %) | silver 0.02 g |
| Gelatin | 1.0 g |
| Additive P-1 | 0.2 g |
| Color-mix preventing agent Cpd-N | 0.1 g |
| Color-mix preventing agent Cpd-A | 0.1 g |
| Ninth layer: Low sensitivity green-sensitive emulsion layer | |
| Emulsion E | silver 0.1 g |
| Emulsion F | silver 0.2 g |
| Emulsion G | silver 0.2 g |
| Gelatin | 0.5 g |
| Coupler C-7 | 0.05 g |
| Coupler C-8 | 0.20 g |
| Compound Cpd-B | 0.03 g |
| Compound Cpd-E | 0.02 g |
| Compound Cpd-F | 0.02 g |
| Compound Cpd-G | 0.02 g |
| Compound Cpd-H | 0.02 g |
| High-boiling organic solvent Oil-1 | 0.1 g |
| High-boiling organic solvent Oil-2 | 0.1 g |
| Tenth layer: Medium sensitivity green-sensitive emulsion layer | |
| Emulsion G | silver 0.3 g |
| Emulsion H | silver 0.1 g |
| Gelatin | 0.6 g |
| Coupler C-7 | 0.2 g |
| Coupler C-8 | 0.1 g |
| Compound Cpd-B | 0.03 g |
| Compound Cpd-E | 0.02 g |
| Compound Cpd-F | 0.02 g |
| Compound Cpd-G | 0.05 g |
| Compound Cpd-H | 0.05 g |
| High-boiling organic solvent Oil-2 | 0.01 g |
| Eleventh layer: High sensitivity green-sensitive emulsion layer | |
| Emulsion I | silver 0.5 g |
| Gelatin | 1.0 g |
| Coupler C-4 | 0.3 g |
| Coupler C-8 | 0.1 g |
| Compound Cpd-B | 0.08 g |
| Compound Cpd-E | 0.02 g |
| Compound Cpd-F | 0.02 g |
| Compound Cpd-G | 0.02 g |
| Compound Cpd-H | 0.02 g |
| High-boiling organic solvent Oil-1 | 0.02 g |
| High-boiling organic solvent Oil-2 | 0.02 g |
| Twelfth layer: Intermediate layer | |
| Gelatin | 0.6 g |
| Dye D-2 | 0.05 g |
| Thirteenth layer: Yellow filter layer | |
| Yellow colloidal silver | silver 0.07 g |
| Gelatin | 1.1 g |
| Color-mix preventing agent Cpd-A | 0.01 g |

-continued

| | |
|---|---|
| High-boiling organic solvent Oil-1 | 0.01 g |
| Fine crystal solid dispersion of Dye E-2 | 0.05 g |
| Fourteenth layer: Intermediate layer | |
| Gelatin | 0.6 g |
| Fifteenth layer: Low sensitivity blue-sensitive emulsion layer | |
| Emulsion J | silver 0.2 g |
| Emulsion K | silver 0.3 g |
| Emulsion L | silver 0.1 g |
| Gelatin | 0.8 g |
| Coupler C-5 | 0.2 g |
| Coupler C-10 | 0.4 g |
| Sixteen layer: Medium sensitivity blue-sensitive emulsion layer | |
| Emulsion L | silver 0.1 g |
| Emulsion M | silver 0.4 g |
| Gelatin | 0.9 g |
| Coupler C-5 | 0.3 g |
| Coupler C-6 | 0.1 g |
| Coupler C-10 | 0.1 g |
| Seventeenth layer: High sensitivity blue-sensitivity emulsion layer | |
| Emulsion N | silver 0.4 g |
| Gelatin | 1.2 g |
| Coupler C-6 | 0.6 g |
| Coupler C-10 | 0.1 g |
| Eighteenth layer: First protective layer | |
| Gelatin | 0.7 g |
| UV-absorbent U-1 | 0.04 g |
| UV-absorbent U-2 | 0.01 g |
| UV-absorbent U-3 | 0.03 g |
| UV-absorbent U-4 | 0.03 |
| UV-absorbent U-5 | 0.05 g |
| UV-absorbent U-6 | 0.05 g |
| High-boiling organic solvent Oil-1 | 0.02 g |
| Formalin scavenger Cpd-H | |
| Cpd-C | 0.2 g |
| Cpd-I | 0.4 g |
| Dye D-3 | 0.05 g |
| Compound Cpd-N | 0.02 g |
| Nineteenth layer: Second protective layer | |
| Colloidal silver | silver 0.1 mg |
| Silver iodobromide emulsion of fine grains (av. grain diameter: 0.06 μm, AgI content: 1 mol %) | silver 0.1 g |
| Gelatin | 0.4 g |
| Twentieth layer: Third protective layer | |
| Gelatin | 0.4 g |
| Poly(methylmethacrylate) (av. grain diameter: 1.5 μm) | 0.1 g |
| Copolymer of methylmethacrylate and acrylic acid (4:6), av. grain diameter: 1.5 μm | 0.1 g |
| Silicone oil | 0.03 g |
| Surface-active agent W-1 | 3.0 mg |
| Surface-active agent W-2 | 0.03 g |

Further, to all emulsion layers, in addition to the above-described components, additives F-1 to F-8 were added. Further, to each layer, in addition to the above-described components, gelatin hardener H-1 and surface-active agents W-3, W-4, W-5, W-6, and W-7 for coating and emulsifying were added.

Further, as antifungal and antibacterial agents, phenol, 1,2-benzisothiazoline-3-one, 2-phenoxyethanol and phenetylalcohol were added.

Silver iodobromide emulsions A to N which were used in Sample 801 are shown in the following table. Further, spectral sensitization of emulsions A to N are conducted as shown in the following table.

| Emulsion | Feature of grain | Average grain diameter (μm) | Deviation coefficient (%) | AgI content (%) |
|---|---|---|---|---|
| A | Monodisperse tetradecahedral grain | 0.20 | 16 | 3.7 |
| B | Monodisperse cubic internal latent image-type grain | 0.35 | 10 | 3.3 |
| C | Monodisperse cubic grain | 0.38 | 18 | 5.0 |
| D | Monodisperse cubic grain | 0.68 | 25 | 2.0 |
| E | Monodisperse cubic grain | 0.20 | 17 | 4.0 |
| F | Monodisperse cubic grain | 0.23 | 16 | 4.0 |
| G | Monodisperse cubic internal latent image-type grain | 0.33 | 11 | 3.5 |
| H | Monodisperse cubic internal latent image-type grain | 0.37 | 9 | 3.5 |
| I | Monodisperse tabular grain, av. aspect ratio: 7.0 | 0.80 | 28 | 1.5 |
| J | Mondisperse tetradecahedral grain | 0.30 | 18 | 4.0 |
| K | Monodisperse tabular grain, av. aspect ratio: 7.0 | 0.45 | 17 | 4.0 |
| L | Monodisperese cubic internal latent image-type grain | 0.46 | 14 | 3.5 |
| M | Monodisperse tabular grain, average aspect ratio: 7.0 | 0.55 | 13 | 4.0 |
| N | Monodisperse tabular grain, average aspect ratio: 7.0 | 1.00 | 33 | 1.3 |

Spectral sensitizing dyes and their amounts added to Emulsions A to N were as follows:

| Emulsion | Spectral Sensitizing dye added | Amount added (g) per mol of silver halide | Time when spectral-sensitizing dye added |
|---|---|---|---|
| A | S-1 | 0.025 | Immediately after chemical sensitization |
| | S-2 | 0.25 | Immediately after chemical sensitization |
| B | S-1 | 0.01 | Immediately after grain formation ended |
| | S-2 | 0.25 | Immediately after grain formation ended |
| C | S-1 | 0.02 | Immediately before chemical sensitization |
| | S-2 | 0.25 | Immediately before chemical sensitization |
| D | S-1 | 0.01 | Immediately after chemical sensitization |
| | S-2 | 0.11 | Immediately after chemical sensitization |
| E | S-3 | 0.5 | Immediately after chemical sensitization |
| | S-4 | 0.1 | Immediately after chemical sensitization |
| F | S-3 | 0.3 | Immediately after chemical sensitization |
| | S-4 | 0.1 | Immediately after chemical sensitization |
| G | S-3 | 0.25 | Immediately after grain formation ended |
| | S-4 | 0.08 | Immediately after grain formation ended |
| H | S-3 | 0.2 | During grain formation |
| | S-4 | 0.06 | During grain formation |
| I | S-3 | 0.3 | Immediately before chemical sensitization |
| | S-4 | 0.07 | Immediately before chemical sensitization |
| | S-8 | 0.1 | Immediately before chemical sensitization |
| J | S-6 | 0.2 | During grain formation |
| | S-5 | 0.05 | During grain formation |
| K | S-6 | 0.2 | Immediately before chemical sensitization |
| | S-5 | 0.05 | Immediately before chemical sensitization |
| L | S-6 | 0.22 | Immediately after grain formation ended |
| | S-5 | 0.06 | Immediately after grain formation ended |
| M | S-6 | 0.15 | Immediately before chemical sensitization |
| | S-5 | 0.04 | Immediately before chemical sensitization |
| N | S-6 | 0.22 | Immediately after grain formation ended |
| N | S-5 | 0.06 | Immediately after grain formation ended |

Preparation of Samples 802 to 820

Samples 802 to 820 were prepared in the same manner as Sample 801, except that changes shown in Table 83 were conducted.

The spectral sensitivity distribution of blue-sensitive silver halide emulsions were controlled by suitably changing each amount of sensitizing dyes S-5 and S-6 and dye D-3.

The spectral sensitivity distributions of green-sensitive silver halide emulsions were controlled by suitably changing each amount of sensitizing dyes S-3, S-4, S-8, and S-5 and dye D-2.

The spectral sensitivity distributions of red-sensitive silver halide emulsions were controlled by suitably changing each amount of sensitizing dyes S-1, S-2, and S-7 and dye D-1.

Further, the DIR compound was added in the 2nd layer or 7th layer in such a manner that each coating amount of Cpd-D, —L, and —M is 20 mg, 20 mg, and 10 mg, per $m^2$, as shown in Table 83. When DIR compound was contained, Emulsion A was replaced with Emulsion P, whose monodisperse tetradecahedral grains had an average diameter of 0.28 μm.

Compound represented by formula (I) of the present invention was used instead of C-1, C-2, C-3, and C-9 in the 4th, 5th, and 6th layers, as shown in Table 83, in an amount same as the total coating amount of C-1, C-2, C-3, and C-9.

Evaluation of coated samples

Processing of samples was conducted in the following processing process.

| Process | Time | Temperature | Tank volume | Replenisher amount |
|---|---|---|---|---|
| B/W development | 6 min | 38° C. | 12 l | 2.2 l/m² |
| 1st Water-washing | 2 min | 38° C. | 4 l | 7.5 l/m² |
| Reversal | 2 min | 38° C. | 4 l | 1.1 l/m² |
| Color development | 6 min | 38° C. | 12 l | 2.2 l/m² |
| Conditioning | 2 min | 38° C. | 4 l | 1.1 l/m² |
| Bleaching | 6 min | 38° C. | 12 l | 0.22 l/m² |
| Fixing | 4 min | 38° C. | 8 l | 1.1 l/m² |
| 2nd water-washing | 4 min | 38° C. | 8 l | 7.5 l/m² |
| Stabilizing | 1 min | 25° C. | 2 l | 1.1 l/m² |

Compositions of processing solutions used were as follows:

| | Mother solution | Replenisher |
|---|---|---|
| B/W (Black and white) developer | | |
| Pentasodium nitrilo-N,N,N-trimethylenephosphonate | 2.0 g | 2.0 g |
| Sodium sulfite | 30 g | 30 g |
| Hydroquinone potassium monosulfonate | 20 g | 20 g |
| Potassium carbonate | 33 g | 33 g |
| 1-Phenyl-4-methyl-4-hydroxymethyl-3-pyrazolydone | 2.0 g | 2.0 g |
| Potassium bromide | 2.5 g | 1.4 g |
| Potassium thiocyanate | 1.2 g | 1.2 g |
| Potassium iodide | 2.0 mg | — |
| Water to make | 1,000 ml | 1,000 ml |
| pH | 9.60 | 9.60 |
| (pH was adjusted by using hydrochloric acid or potassium hydroxide) | | |
| Reversal solution | | |
| Pentasodium nitrilo-N,N,N-trimethylenephosphonate | 3.0 g | Same as mother solution |
| Stannous chloride (dihydrate) | 1.0 g | |
| p-Aminophenol | 0.1 g | |
| Sodium hydroxide | 8 g | |
| Glacial acetic acid | 15 ml | |
| Water to make | 1,000 ml | |
| pH | 6.00 | |
| (pH was adjusted by using hydrochloric acid or sodium hydroxide) | | |
| Color developer | | |
| Pentasodium nitrilo-N,N,N-trimethylenephosphonate | 2.0 g | 2.0 g |
| Sodium sulfite | 7.0 g | 7.0 g |
| Sodium tertiary phosphate (12-hydrate) | 36 g | 36 g |
| Potassium bromide | 1.0 g | — |
| Potassium iodide | 90 mg | — |
| Sodium hydroxide | 3.0 g | 3.0 g |
| Cytrazinic acid | 1.5 g | 1.5 g |
| N-Ethyl-N-(β-methanesulfonamidoethyl)-3-methyl-4-aminoaniline sulfate | 11 g | 11 g |
| 3,6-Dithiaoctan-1,8-diol | 1.0 g | 1.0 g |
| Water to make | 1,000 ml | 1,000 ml |
| pH | 11.80 | 12.00 |
| (pH was adjusted by using hydrochloric acid or potassium hydroxide) | | |
| Conditioner | | |
| Disodium ethylenediaminetetraacetate | 8.0 g | Same as |

-continued

| | Mother solution | Replenisher |
|---|---|---|
| (dihydrate) | | mother solution |
| Sodium sulfite | 12 g | |
| 1-Thioglycerin | 0.4 ml | |
| Solbitan.ester* | 0.1 g | |
| Water to make | 1,000 ml | |
| pH | 6.20 | |
| (pH was adjusted by using hydrochloric acid or sodium hydroxide) | | |
| Bleaching solution | | |
| Disodium ethylenediaminetetraacetate (dihydrate) | 2.0 g | 4.0 g |
| Iron (III) ammonium ethylenediamine-tetraacetate (dihydrate) | 120 g | 240 g |
| Potassium bromide | 100 g | 200 g |
| Ammonium nitrate | 10 g | 20 g |
| Water to make | 1,000 ml | 1,000 ml |
| pH | 5.70 | 5.50 |
| (pH was adjusted by using hydrochloric acid or sodium hydroxide) | | |
| Fixing solution | | |
| Ammonium thiosulfate | 8.0 g | Same as mother solution |
| Sodium sulfite | 5.0 g | |
| Sodium bisulfite | 5.0 g | |
| Water to make | 1,000 ml | |
| pH | 6.60 | |
| (pH was adjusted by using hydrochloric acid or aqueous ammonia) | | |
| Stabilizing solution | | |
| Formalin (37%) | 5.0 ml | Same as mother solution |
| Polyoxyethylene-p-monononyl phenyl ether (av. polymerization degree: 10) | 0.5 ml | |
| Water to make | 1,000 ml | |
| pH | (not adjusted) | |

Each test piece of Samples 801 to 820 was subjected to a sensitometory by an exposure to a white light of color temperature 5850 K. of 0.01 sec, and processing in the processing process above described to determine a filter correction value for the divergence of color balance thereby a condition to obtain gray balance being determined.

The dependence to color temperature was determined by visual evaluation of color on strips obtained by an exposure to light under a filter condition balanced in gray at 5850 K. by changing the color temperature to 7200 K., and by the same processing described above. Rating of evaluation is as follows:

○: the change of color is small

Δ: a little bluish x: remarkably bluish

Next, a visual evaluation was conducted with respect to each strip exposed to light under a filter condition balanced in gray at 5850 K. using a normal-type fluorescent lamp (F6) as defined by the Japanese Industrial Standard, and processed using the same procedure described above. Rating of evaluation is as follows:

○: the change of color is small

Δ: a little greenish x: remarkably greenish

Further, the color reproduction of bluish green and the saturations of green and red were evaluated by photographing a color rendition chart, manufactured by Macbeth Co., at a color temperature of 5850 K.. Ratings of evaluation are as follows:

○: near original color

Δ: a little bluish x: remarkably bluish

Saturation:

○: satisfactory saturation

Δ: slightly insufficient saturation x: remarkably low saturation

Results obtained are shown in Table 83.

TABLE 83

| Sample No. | Spectral sensitivity distribution λmax (nm) | λmax (nm) | SG (λGmax) − SG (470) | λmax (nm) | SR (Rmax) − SR (570) | Compound of formula (III) | Coupler of formula (1) in the 4th, 5th, and 6th layer | Color reproduction: Dependance color temperature | Reproduction of bluish green | Color under fluorescent light | Saturating of green | Saturating of red | Remarks |
|---|---|---|---|---|---|---|---|---|---|---|---|---|---|
| 801 | 410 | 552 | 2.00 | 650 | 1.60 | Not added | — | Δ | × | Δ | × | × | Comparison |
| 802 | 415 | 550 | 1.85 | 640 | 1.40 | " | — | ○ | Δ | ○ | × | × | " |
| 803 | 410 | 552 | 2.00 | 650 | 1.60 | Added in the 2nd layer | — | × | × | × | × | ○ | " |
| 804 | " | " | " | " | " | Not added | Ih-17 | × | × | × | ○ | × | " |
| 805 | 415 | 550 | 1.85 | 640 | 1.40 | Added in the 2nd layer | — | ○ | ○ | ○ | × | Δ | " |
| 806 | 415 | 550 | 1.85 | 640 | 1.40 | Not added | Ih-17 | ○ | ○ | ○ | Δ | × | " |
| 807 | 410 | 552 | 2.00 | 650 | 1.60 | Added in the 2nd layer | " | × | Δ | Δ | ○ | ○ | " |
| 808 | 415 | 550 | 1.85 | 640 | 1.40 | Added in the 2nd layer | " | ○ | ○ | ○ | ○ | ○ | This invention |
| 809 | 455 | " | " | " | " | Added in the 2nd layer | " | ○ | ○ | ○ | ○ | ○ | " |
| 810 | 415 | 530 | " | " | " | Added in the 2nd layer | " | ○ | ○ | ○ | ○ | ○ | " |
| 811 | " | 550 | 1.50 | " | " | Added in the 2nd layer | " | ○ | ○ | ○ | Δ | ○ | " |
| 812 | " | " | 1.40 | " | " | Added in the 2nd layer | " | ○ | Δ | ○ | × | ○ | Comparison |
| 813 | " | " | 1.85 | 630 | " | Added in the 2nd layer | " | ○ | ○ | ○ | ○ | ○ | This invention |
| 814 | " | " | " | 620 | " | Added in the 2nd layer | " | ○ | ○ | ○ | ○ | Δ | " |
| 815 | " | " | " | 640 | 1.10 | Added in the 2nd layer | " | ○ | ○ | ○ | Δ | ○ | " |
| 816 | " | " | " | " | 0.90 | Added in the 2nd layer | " | ○ | ○ | ○ | × | Δ | Comparison |
| 817 | " | " | " | " | 1.40 | Added in the 2nd and 7th layer | " | ○ | ○ | ○ | ○ | ○ | This invention |
| 818 | " | " | " | " | " | Added in the 2nd layer | Ib-12 | ○ | ○ | ○ | ○ | ○ | " |
| 819 | " | " | " | " | " | Added in the 2nd layer | Ic-14 | ○ | ○ | ○ | ○ | ○ | " |
| 820 | " | " | " | " | " | Added in the 2nd layer | Id-1 | ○ | ○ | ○ | ○ | ○ | " |

As is apparent from the results in Table 83, good results concerning dependence for all of color temperature, color reproduction of bluish green, color under a fluorescent light, saturations of green and red, can be obtained only when a photographic material comprises an emulsion layer having a spectral sensitivity distribution of the present invention, and containing a compound represented by formula (III) and a cyan coupler represented by formula (I) of the present invention.

EXAMPLE 12

Preparation of Sample 901

A multilayer color photographic material was prepared by multi-coating each layer having composition as shown below on a prime-coated triacetate cellulose film support having a thickness of 127 μm, and it was designated Sample 901. The figures provided indicate the added amounts per $m^2$. The effects of the compound added are not restricted to the shown ones.

| | |
|---|---|
| **First layer: Halation-preventing layer** | |
| Black colloidal silver | 0.20 g |
| Gelatin | 1.9 g |
| UV-absorbent U-1 | 0.1 g |
| UV-absorbent U-3 | 0.04 g |
| UV-absorbent U-4 | 0.1 g |
| High boiling organic solvent Oil-1 | 0.1 g |
| Fine crystal solid dispersion of dye E-1 | 0.1 g |
| **Second layer: Intermediate layer** | |
| Gelatin | 0.40 g |
| High-boiling organic solvent Oil-3 | 0.1 g |
| Dye D-4 | 0.4 mg |

Third layer: Intermediate layer

| | |
|---|---|
| Silver iodobromide emulsion of fine grains surface surface and inner part of which were fogged (av. grain diameter 0.06 μm, deviation coefficient: 18%, AgI content: 1 mol %) | silver 0.05 g |
| Gelatin | 0.4 g |

Fourth layer: Low sensitivity red-sensitive emulsion layer

| | |
|---|---|
| Emulsion A | silver 0.1 g |
| Emulsion B | silver 0.4 g |
| Gelatin | 0.8 g |
| Coupler C-1 | 0.15 g |
| Coupler C-2 | 0.05 g |
| Coupler C-3 | 0.05 |
| Coupler C-9 | 0.05 g |
| High-boiling organic solvent Oil-2 | 0.1 g |
| Additive P-1 | 0.1 g |

Fifth layer: Medium sensitivity red-sensitive emulsion layer

| | |
|---|---|
| Emulsion B | silver 0.2 g |
| Emulsion C | silver 0.3 g |
| Gelatin | 0.8 g |
| Coupler C-1 | 0.2 g |
| Coupler C-2 | 0.05 g |
| Coupler C-3 | 0.2 g |
| High boiling organic solvent Oil-2 | 0.1 g |
| Additive P-1 | 0.1 g |

Sixth layer: High sensitivity red-sensitive emulsion layer

| | |
|---|---|
| Emulsion D | silver 0.4 g |
| Gelatin | 1.1 g |
| Coupler C-1 | 0.3 g |
| Coupler C-2 | 0.1 g |
| Coupler C-3 | 0.7 g |
| Additive P-1 | 0.1 g |

Seventh layer: Intermediate layer

| | |
|---|---|
| Gelatin | 0.6 g |
| Additive M-1 | 0.3 g |
| Color-mix preventing agent Cpd-I | 2.6 mg |
| UV-absorbent U-1 | 0.01 g |
| UV-absorbent U-2 | 0.002 g |
| UV-absorbent U-5 | 0.01 g |
| Dye D-1 | 0.02 g |
| Dye D-5 | 0.02 g |
| High-boiling organic solvent Oil-1 | 0.02 g |

Eighth layer: Intermediate layer

| | |
|---|---|
| Silver iodobromide emulsion of fine grains surface and inner part of which were fogged (av. grain diameter: 0.06 μm, deviation coefficient: 16% AgI content: 0.3 mol %) | silver 0.02 g |
| Gelatin | 1.0 g |
| Additive P-1 | 0.2 g |
| Color-mix preventing agent Cpd-A | 0.1 g |

Ninth layer: Low sensitivity green-sensitive emulsion layer

| | |
|---|---|
| Emulsion E | silver 0.1 g |
| Emulsion F | siiver 0.2 g |
| Emulsion G | silver 0.2 g |
| Gelatin | 0.5 g |
| Coupler C-4 | 0.1 g |
| Coupler C-7 | 0.05 g |
| Coupler C-8 | 0.20 g |
| Compound Cpd-B | 0.03 g |
| Compound Cpd-D | 0.02 g |
| Compound Cpd-E | 0.02 g |
| Compound Cpd-F | 0.02 g |
| Compound Cpd-G | 0.02 g |
| Compound Cpd-L | 0.02 g |
| High-boiling organic soivent Oil-1 | 0.1 g |
| High-boiling organic soivent Oil-2 | 0.1 g |

Tenth layer: Medium sensitivity green-sensitive emulsion layer

| | |
|---|---|
| Emulsion G | silver 0.3 g |
| Emulsion H | silver 0.1 g |
| Gelatin | 0.6 g |
| Coupler C-4 | 0.1 g |
| Coupler C-7 | 0.2 g |
| Coupler C-8 | 0.1 g |
| Compound Cpd-B | 0.02 g |
| Compound Cpd-D | 0.02 g |
| Compound Cpd-E | 0.02 g |
| Compound Cpd-F | 0.05 g |
| Compound Cpd-G | 0.05 g |
| Compound Cpd-L | 0.05 g |
| High-boiling organic solvent Oil-2 | 0.01 g |

Eleventh layer: High sensitivity green-sensitive emulsion layer

| | |
|---|---|
| Emulsion I | silver 0.5 g |
| Gelatin | 1.0 g |
| Coupler C-4 | 0.3 g |
| Coupler C-7 | 0.1 g |
| Coupler C-8 | 0.1 g |
| Compound Cpd-B | 0.08 g |
| Compound Cpd-D | 0.02 g |
| Compound Cpd-E | 0.02 g |
| Compound Cpd-F | 0.02 g |
| Compound Cpd-G | 0.02 g |
| Compound Cpd-L | 0.05 g |
| High-boiling organic solvent Oil-1 | 0.02 g |
| High-boiling organic solvent Oil-2 | 0.02 g |

Twelfth layer: Intermediate layer

| | |
|---|---|
| Gelatin | 0.6 g |

Thirteenth layer: Yellow filter layer

| | |
|---|---|
| Yellow colloidal silver | silver 0.07 g |
| Gelatin | 1.1 g |
| Color-mix preventing agent Cpd-A | 0.01 g |
| High-boiling organic solvent Oil-1 | 0.01 g |
| Fine crystal solid dispersion of Dye E-2 | 0.05 g |

Fourteenth layer: Intermediate layer

| | |
|---|---|
| Gelatin | 0.6 g |

Fifteenth layer: Low sensitivity blue-sensitive emulsion layer

| | |
|---|---|
| Emulsion J | silver 0.2 g |
| Emulsion K | silver 0.3 g |
| Emulsion L | silver 0.1 g |
| Gelatin | 0.8 g |
| Coupler C-5 | 0.2 g |
| Coupler C-6 | 0.1 g |
| Coupler C-10 | 0.4 g |

Sixteen layer: Medium sensitivity blue-sensitive emulsion layer

| | |
|---|---|
| Emulsion L | silver 0.1 g |
| Emulsion M | silver 0.4 g |
| Gelatin | 0.9 g |
| Coupler C-5 | 0.1 g |
| Coupler C-6 | 0.1 g |
| Coupler C-10 | 0.6 g |

Seventeenth layer: High sensitivity blue-sensitivity emulsion layer

| | |
|---|---|
| Emulsion N | silver 0.4 g |
| Gelatin | 1.2 g |
| Coupler C-5 | 0.1 g |
| Coupler C-6 | 0.1 g |
| Coupler C-10 | 0.6 g |
| High-boiling organic solvent Oil-2 | 0.1 g |

Eighteenth layer: First protective layer

| | |
|---|---|
| Gelatin | 0.7 g |
| UV-absorbent U-1 | 0.2 g |
| UV-absorbent U-2 | 0.05 g |
| UV-absorbent U-5 | 0.3 g |
| Formalin scavenger Cpd-H | 0.4 g |

-continued

| | |
|---|---|
| Dye D-1 | 0.1 g |
| Dye D-2 | 0.05 g |
| Dye D-3 | 0.1 g |
| Nineteenth layer: Second protective layer | |
| Colloidal silver | silver 0.1 mg |
| Silver iodobromide emulsion of fine grains (av. grain diameter: 0.06 μm, AgI content: 1 mol %) | silver 0.1 g |
| Gelatin | 0.4 g |
| Twentieth layer: Third protective layer | |
| Gelatin | 0.4 g |
| Poly(methylmethacrylate) (av. grain diameter: 1.5 μm) | 0.1 g |
| Copolymer of methylmethacrylate and acrylic acid (4:6), av. grain diameter: 1.5 μm) | 0.1 g |
| Silicone oil | 0.03 g |
| Surface-active agent W-1 | 3.0 mg |
| Surface-active agent W-2 | 0.03 g |

Further, to all emulsion layers, in addition to the above-described components, additives F-1 to F-8 were added. Further, to each layer, in addition to the above-described components, gelatin hardener H-1 and surface-active agents W-3, W-4, W-5, W-6, and W-7 for coating and emulsifying were added.

Further, as antifungal and antibacterial agents, phenol, 1,2-benzisothiazoline-3-one, 2-phenoxyethanol, phenetylalcohol and p-benzoic butylester were added.

Silver iodobromide emulsions used in Sample 901 are as follows:

| Emulsion | Feature of grain | Average grain diameter (μm) | Deviation coefficient (%) | AgI content (%) |
|---|---|---|---|---|
| A | Monodisperse tetradecahedral grain | 0.28 | 16 | 3.7 |
| B | Monodisperse cubic internal latent image-type grain | 0.30 | 10 | 3.3 |
| C | Mondisperse tabular grain, av. aspect ratio: 4.0 | 0.38 | 18 | 5.0 |
| D | Tabular grain, av. aspect ratio: 8.0 | 0.68 | 25 | 2.0 |
| E | Monodisperse cubic grain | 0.20 | 17 | 4.0 |
| F | Monodisperse cubic grain | 0.23 | 16 | 4.0 |
| G | Monodisperse cubic internal latent image-type grain | 0.28 | 11 | 3.5 |
| H | Monodisperse cubic internal latent image-type grain | 0.32 | 9 | 3.5 |
| I | Tarbular grain, av. aspect ratio: 9.0 | 0.80 | 28 | 1.5 |
| J | Monodisperse tetradecahedral grain | 0.30 | 18 | 4.0 |
| K | Monodisperse cubic grain av. aspect ratio: 7.0 | 0.45 | 17 | 4.0 |
| L | Monodisperese cubic internal latent image-type grain | 0.46 | 14 | 3.5 |
| M | Monodisperse tabular grain, average aspect ratio: 10.0 | 0.55 | 13 | 4.0 |
| N | Tabular grain, av. aspect ratio: 12.0 | 1.00 | 33 | 1.3 |

Spectral sensitizing dyes and their amounts added to Emulsions A to N were as follows:

| Emulsion | Sensitizing dye added | Amount added (g) per mol of silver halide |
|---|---|---|
| A | S-2 | 0.025 |
| | S-3 | 0.25 |
| | S-8 | 0.01 |
| B | S-1 | 0.01 |
| | S-3 | 0.25 |
| | S-8 | 0.01 |

-continued

| Emulsion | Sensitizing dye added | Amount added (g) per mol of silver halide |
|---|---|---|
| C | S-1 | 0.01 |
| | S-2 | 0.01 |
| | S-3 | 0.25 |
| | S-8 | 0.01 |
| D | S-2 | 0.01 |
| | S-3 | 0.10 |
| | S-8 | 0.01 |
| E | S-4 | 0.5 |
| | S-5 | 0.1 |
| F | S-4 | 0.3 |
| | S-5 | 0.1 |
| G | S-4 | 0.25 |
| | S-5 | 0.08 |
| | S-9 | 0.05 |
| H | S-4 | 0.2 |
| | S-5 | 0.06 |
| | S-9 | 0.05 |
| I | S-4 | 0.3 |
| | S-5 | 0.07 |
| | S-9 | 0.1 |
| J | S-6 | 0.05 |
| | S-7 | 0.2 |
| K | S-6 | 0.05 |
| | S-7 | 0.2 |
| L | S-6 | 0.06 |
| | S-7 | 0.22 |
| M | S-6 | 0.04 |
| | S-7 | 0.15 |
| N | S-6 | 0.06 |
| | S-7 | 0.02 |

(Preparation of Samples 902 to 916)

Samples 902 to 916 were prepared in the same manner as Sample 901, except that couplers added in the 4th, 5th and 6th layers of Sample 901 were changed to an equimolar amount of couplers of the present invention, as shown in Table 84, in the 2nd, 4th, 7th, 9th and 11th layers a development inhibitor utilized in the present invention was added in an amount of 5 mg per $m^2$ of photographic material, respectively, as shown in Table 84.

TABLE 84

| Sample No. | Cyan coupler 4th layer | 5th layer | 6th layer | Developemnt inhibitor added in the 2nd, 4th, 7th, 9th, and 11th layers |
|---|---|---|---|---|
| 901 | C-1,C-2,C-3 | C-1,C-2,C-3 | C-1,C-2,C-3 | None |
| 902 | C-1,C-2,C-3 | C-1,C-2,C-3 | C-1,C-2,C-3 | M-57 |
| 903 | C-1,C-2,C-3 | C-1,C-2,C-3 | C-1,C-2,C-3 | M-89 |
| 904 | C-1,C-2,C-3 | C-1,C-2,C-3 | C-1,C-2,C-3 | M-58 |
| 905 | Ic-3,C-3 | C-1,Ic-3 | C-1,Ic-3 | None |
| 906 | Ib-6,C-3 | C-1,Ib-6 | C-1,Ib-6 | None |
| 907 | Id-3,C-3 | C-1,Id-3 | C-1,Id-3 | M-57 |
| 908 | Ib-6,C-3 | C-1,Ib-6 | C-1,Ib-6 | M-57 |
| 909 | Ib-6,C-3 | C-1,Ib-6 | C-1,Ib-6 | M-88 |
| 910 | Ib-6,C-3 | C-1,Ib-6 | C-1,Ib-6 | M-89 |
| 911 | Ib-6,C-3 | C-1,Ib-6 | C-1,Ib-6 | M-83 |
| 912 | Ib-6,C-3 | C-1,Ib-6 | C-1,Ib-6 | M-58 |
| 913 | Ib-6,Ih-10 | Ib-6,Ih-10 | Ib-6,Ih-10 | M-88 |
| 914 | Ib-1,C-1 | Ic-10,Ib-1 | Ic-10,Ib-1 | M-57 |

The thus-prepared Samples 901 to 914 each were converted into a magazine-form of 35 mm, and were subjected to a practical photographing. A color-checker, manufactured by Macbeth Co., was used as a subject, and the development processing shown below was conducted with respect to thus-obtained practical samples; the assessment of color reproduction in a 5-step evaluation was carried out by multiple panelists. The average values of assessment values are shown in Table 85 as a value that represents a color reproduction.

Further, as the evaluation for the dependence on processing factors of these samples, the dependence on the amount of sodium sulfite in the color developer in the following processing process was studied. That is, color developers in which sodium sulfite contents were changed to 5.4 g/l and 7.7 g/l, respectively, were prepared, and then each strip of samples exposed to a white light through a wedge was development-processed by the same processing process as shown below, except that the color developers described above were used, respectively. The sensitivity was calculated as a logarithm of a reciprocal of an exposure amount that gives a prescribed density. Then, the change of sensitivities that give higher density than fogging by 1.5 on a characteristic curve of the red-sensitive layer was determined. Results are shown in Table 86.

| Process | Time | Temperature | Tank volume | Replenisher amount |
|---|---|---|---|---|
| 1st Development | 6 min | 38° C. | 12 liter | 2,200 ml/m$^2$ |
| 1st water-washing | 2 min | 38° C. | 4 liter | 7,500 ml/m$^2$ |
| Reversal | 2 min | 38° C. | 4 liter | 1,100 ml/m$^2$ |
| Color development | 6 min | 38° C. | 12 liter | 2,200 ml/m$^2$ |
| Conditioning | 2 min | 38° C. | 4 liter | 1,100 ml/m$^2$ |
| Bleaching | 6 min | 38° C. | 12 liter | 220 ml/m$^2$ |
| Fixing | 4 min | 38° C. | 8 liter | 1,100 ml/m$^2$ |
| 2nd water-washing | 4 min | 38° C. | 8 liter | 7,500 ml/m$^2$ |
| Stabilizing | 1 min | 25° C. | 2 liter | 1,100 ml/m$^2$ |

Compositions of processing solutions used were as follows:

| | Tank solution | Replenisher |
|---|---|---|
| **First Development solution** | | |
| Pentasodium nitrilo-N,N,N-trimethylenephosphonate | 1.5 g | 1.5 g |
| Pentasodium diethylenetriamine-pentaacetate | 2.0 g | 2.0 g |
| Sodium sulfite | 30 g | 30 g |
| Hydroquinone potassium monosulfonate | 20 g | 20 g |
| Potassium carbonate | 15 g | 20 g |
| Sodium bicarbonate | 12 g | 15 g |
| 1-Phenyl-4-methyl-4-hydroxymethyl-3-pyrazolydone | 1.5 g | 2.0 g |
| Potassium bromide | 2.5 g | 1.4 g |
| Potassium thiocyanate | 1.2 g | 1.2 g |
| Potassium iodide | 2.0 mg | — |
| Diethylene glycol | 13 g | 15 g |
| Water to make | 1,000 ml | 1,000 ml |
| pH (pH was adjusted by using hydrochloric acid or potassium hydroxide) | 9.60 | 9.60 |
| **Reversal solution** | | |
| Pentasodium nitrilo-N,N,N-trimethylenephosphonate | 3.0 g | Same as tank solution |
| Stannous chloride (dihydrate) | 1.0 g | |
| p-Aminophenol | 0.1 g | |
| Sodium hydroxide | 8 g | |
| Glacial acetic acid | 15 ml | |
| Water to make | 1,000 ml | |
| pH (pH was adjusted by using hydrochloric acid or sodium hydroxide) | 6.00 | |
| **Color developer** | | |
| Pentasodium nitrilo-N,N,N-trimethylenephosphonate | 2.0 g | 2.0 g |
| Sodium sulfite | 7.0 g | 7.0 g |
| Sodium tertiary phosphate (12-hydrate) | 36 g | 36 g |
| Potassium bromide | 1.0 g | — |
| Potassium iodide | 90 mg | — |
| Sodium hydroxide | 3.0 g | 3.0 g |
| Cytrazinic acid | 1.5 g | 1.5 g |
| N-Ethyl-N-(β-methanesulfonamidoethyl)-3-methyl-4-aminoaniline 3/2 sulfate monohydrate | 11 g | 11 g |
| 3,6-Dithiaoctane-1,8-diol | 1.0 g | 1.0 g |
| Water to make | 1,000 ml | 1,000 ml |
| pH (pH was adjusted by using hydrochloric acid or potassium hydroxide) | 11.80 | 12.00 |
| **Conditioner** | | |
| Disodium ethylenediaminetetraacetate (dihydrate) | 8.0 g | 8.0 g |
| Sodium sulfite | 12 g | 12 g |
| 1-Thioglycerin | 0.4 g | 0.4 g |
| Formaldehyde-sodium bisulfite adduct | 30 g | 35 g |
| Water to make | 1,000 ml | 1,000 ml |
| pH (pH was adjusted by using hydrochloric acid or sodium hydroxide) | 6.20 | 6.10 |
| **Bleaching solution** | | |
| Disodium ethylenediaminetetraacetate (dihydrate) | 2.0 g | 4.0 g |
| Iron (III) ammonium ethylenediamine-tetraacetate (dihydrate) | 120 g | 240 g |
| Potassium bromide | 100 g | 200 g |
| Ammonium nitrate | 10 g | 20 g |
| Water to make | 1,000 ml | 1,000 ml |
| pH (pH was adjusted by using hydrochloric acid or sodium hydroxide) | 5.70 | 5.50 |

-continued

| | Tank solution | Replenisher |
|---|---|---|
| Fixing solution | | |
| Ammonium thiosulfate | 8.0 g | Same as tank solution |
| Sodium sulfite | 5.0 g | |
| Sodium bisulfite | 5.0 g | |
| Water to make | 1,000 ml | |
| pH | 6.60 | |
| (pH was adjusted by using hydrochloric acid or aqueous ammonia) | | |
| Stabilizing solution | | |
| Benzoisothiazoline-3-one | 0.02 g | 0.03 g |
| Polyoxyethylene-p-monononyl phenyl ether (av. polimerization degree: 10) | 0.3 g | 0.3 g |
| Water to make | 1,000 ml | 1,000 ml |
| pH | 7.0 | 9.0 |

TABLE 85

| Sample No. | Change of sensitivity by change of $Na_2SO_3$ amount | Remarks |
|---|---|---|
| 901 | 0.05 | Comparison |
| 902 | 0.07 | Comparison |
| 903 | 0.09 | Comparison |
| 904 | 0.06 | Comparison |
| 905 | 0.09 | Comparison |
| 906 | 0.07 | Comparison |
| 907 | 0.04 | Comparison |
| 908 | 0.03 | Comparison |
| 909 | 0.04 | This invention |
| 910 | 0.04 | This invention |
| 911 | 0.03 | This inventon |
| 912 | 0.04 | This invention |
| 913 | 0.03 | This invention |
| 914 | 0.04 | This invention |

TABLE 86

| Sample | Color reproduction | | | | | | |
|---|---|---|---|---|---|---|---|
| No. | Cyan | Magenta | Yellow | Red | Green | Blue | Remarks |
| 901 | 3 | 3 | 3 | 3 | 3 | 3 | Comparison |
| 902 | 3 | 3 | 3 | 3 | 3 | 3 | Comparison |
| 903 | 3 | 3 | 3 | 3 | 4 | 3 | Comparison |
| 904 | 3 | 3 | 3 | 3 | 4 | 3 | Comparison |
| 905 | 4 | 3 | 3 | 3 | 4 | 4 | Comparison |
| 906 | 4 | 3 | 3 | 3 | 4 | 4 | Comparison |
| 907 | 5 | 5 | 4 | 5 | 5 | 5 | This invention |
| 908 | 5 | 5 | 4 | 5 | 5 | 5 | This invention |
| 909 | 5 | 5 | 4 | 5 | 5 | 5 | This invention |
| 910 | 5 | 5 | 4 | 5 | 5 | 5 | This invention |
| 911 | 5 | 4 | 5 | 4 | 5 | 5 | This invention |
| 912 | 5 | 4 | 5 | 4 | 4 | 5 | This invention |
| 913 | 5 | 5 | 5 | 5 | 5 | 5 | This invention |
| 914 | 5 | 5 | 5 | 5 | 5 | 5 | This invention |

Note:
1. inferior,
2. a little inferior,
3. similar,

TABLE 86-continued

| Sample | Color reproduction | | | | | | |
|---|---|---|---|---|---|---|---|
| No. | Cyan | Magenta | Yellow | Red | Green | Blue | Remarks |

4. superior,
5. remarkably superior, to Sample 901

As is apparent from the results in Table 85 and Table 86, when a conventionally known cyan coupler and a development inhibitor according to the present invention are used in combination, the dependence on the amount of sodium sulfite becomes large, although the color reproduction is improved. On the contrary, when the cyan coupler according to the present invention is used instead of the conventional coupler, the color reproduction is more improved, and the dependence on the amount of sodium sulfite becomes small smaller than the samples that employ conventionally known coupler. These effects are obtained for the first time by the combined use of a coupler and a development inhibitor according to the present invention.

Having described our invention as related to the present embodiments, it is our intention that the invention not be limited by any of the details of the description, unless otherwise specified, but rather be construed broadly within its spirit and scope as set out in the accompanying claims.

What is claimed is:

1. A silver halide color photographic material having at least one red-sensitive silver halide emulsion layer, at least one green-sensitive silver halide emulsion layer, and at least one blue-sensitive silver halide emulsion layer on a support, which comprises at least one cyan dye-forming coupler represented by the following formula (I) in at least one of said silver halide emulsion layers:

formula (I)

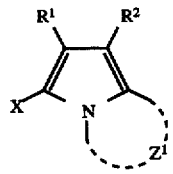

wherein $R^1$ represents a hydrogen atom or a substituent, $R^2$ represents a substituent, X represents a hydrogen atom or a group capable of being released upon a coupling reaction of the coupler represented by formula (I) with an oxidized product of a color-developing agent, and $Z^1$ represents a group of nonmetallic atoms required for forming a nitrogen-containing 6-membered heterocyclic ring, which contains at least one group capable of being dissociated; wherein the emulsion layer containing said cyan dye-forming coupler and/or an intermediate layer adjacent to said emulsion layer contains colloidal silver.

2. The silver halide color photographic material as claimed in claim 1, wherein the amount of colloidal silver to be added is 0.0001 to 0.4 $cm/m^2$.

3. The silver halide color photographic material as claimed in claim 1, wherein said cyan dye-forming coupler is contained in at least one red-sensitive silver halide emulsion layer.

4. The silver halide color photographic material as claimed in claim 1, wherein at least one of $R^1$ and $R^2$ in said formula (I) represents an electron-attracting group whose $\sigma_p$ value of the Hammett substituent constant is 0.35 or more.

5. The silver halide color photographic material as claimed in claim 1, wherein said cyan dye-forming coupler is a member selected from the group consisting of couplers represented by one of the following formulae (Ib) to (Is):
formula (Ib)
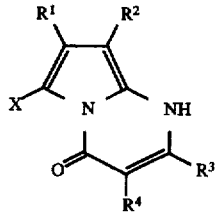
formula (Ic)
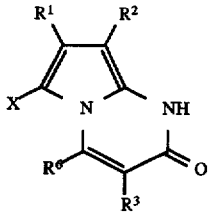
formula (Id)
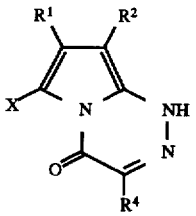
formula (Ie)
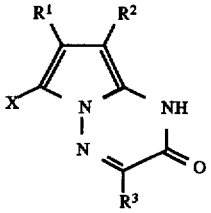
formula (If)
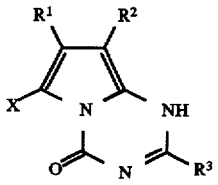
formula (Ig)
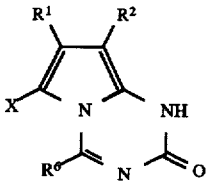
formula (Ih)
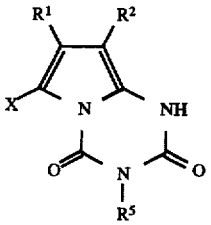
-continued
formula (Ii)
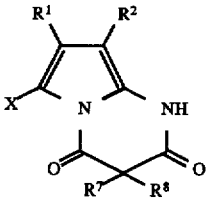
formula (Ij)
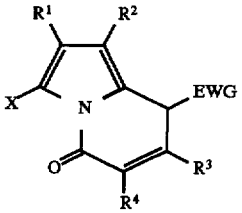
formula (Ik)
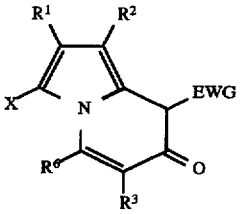
formula (Il)
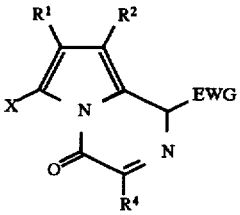
formula (Im)
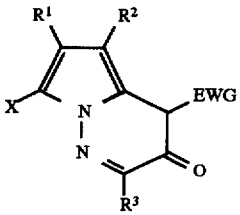
formula (In)
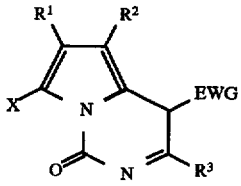
formula (Io)
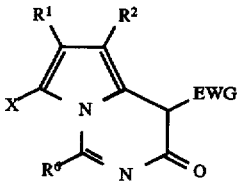

-continued formula (Ip)

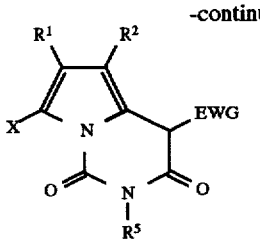

formula (Iq)

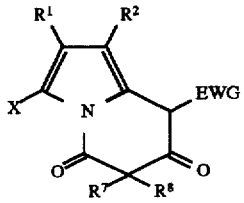

formula (Ir)

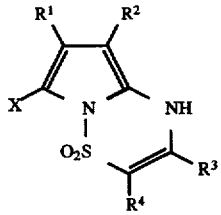

formula (Is)

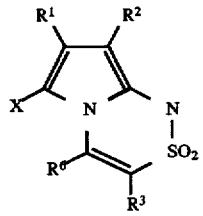

wherein $R^1$ represents a hydrogen atom or a substituent, $R^2$ represents a substituent, X represents a hydrogen atom or a group capable of being released upon a coupling reaction of the coupler represented by one of these formulae (Ib) to (Is) with an oxidized product of a color-developing agent, $R^3$, $R^5$, $R^6$, $R^7$, and $R^8$ each represent a hydrogen atom or a substituent, $R^4$ represents a substituent, and EWG represents an electron-attracting group whose Hammett substituent constant $\sigma_p$ value is 0.35 or more.

6. The silver halide color photographic material as claimed in claim 1, wherein the intermediate layer adjacent to the emulsion layer containing said cyan dye-forming coupler contains colloidal silver.

7. The silver halide color photographic material as claimed in claim 1, wherein said colloidal silver is yellow colloidal silver, brown colloidal silver, blue colloidal silver, or black colloidal silver.

8. The silver halide color photographic material as claimed in claim 5, wherein said cyan dye-forming coupler is represented by formula (Ib).

9. The silver halide color photographic material as claimed in claim 5, wherein said cyan dye-forming coupler is represented by formula (Ic).

10. The silver halide color photographic material as claimed in claim 5, wherein said cyan dye-forming coupler is represented by formula (Id).

11. The silver halide color photographic material as claimed in claim 5, wherein said cyan dye-forming coupler is represented by formula (Ie).

12. The silver halide color photographic material as claimed in claim 5, wherein said cyan dye-forming coupler is represented by formula (If).

13. The silver halide color photographic material as claimed in claim 5, wherein said cyan dye-forming coupler is represented by formula (Ig).

14. The silver halide color photographic material as claimed in claim 5, wherein said cyan dye-forming coupler is represented by formula (Ih).

15. The silver halide color photographic material as claimed in claim 5, wherein said cyan dye-forming coupler is represented by formula (Ii).

16. The silver halide color photographic material as claimed in claim 5, wherein said cyan dye-forming coupler is represented by formula (Ij).

17. The silver halide color photographic material as claimed in claim 5, wherein said cyan dye-forming coupler is represented by formula (Ik).

18. The silver halide color photographic material as claimed in claim 5, wherein said cyan dye-forming coupler is represented by formula (Il).

19. The silver halide color photographic material as claimed claim 5, wherein said cyan dye-forming coupler is represented by formula (Im).

20. The silver halide color photographic material as claimed in claim 5, wherein said cyan dye-forming coupler is represented by formula (In).

21. The silver halide color photographic material as claimed in claim 5, wherein said cyan dye-forming coupler is represented by formula (Io).

22. The silver halide color photographic material as claimed in claim 5, wherein said cyan dye-forming coupler is represented by formula (Ip).

23. The silver halide color photographic material as claimed in claim 5, wherein said cyan dye-forming coupler is represented by formula (Iq).

24. The silver halide color photographic material as claimed in claim 5, wherein said cyan dye-forming coupler is represented by formula (Ir).

25. The silver halide color photographic material as claimed in claim 5, wherein said cyan dye-forming coupler is represented by formula (Is).

* * * * *